US012503921B2

(12) United States Patent
Steele

(10) Patent No.: US 12,503,921 B2
(45) Date of Patent: Dec. 23, 2025

(54) MULTIPLE USE WET MATE HAVING A FLUID RESERVOIR CONFIGURED TO RECEIVE A VOLUME OF COUPLING FLUID THEREIN

(71) Applicant: Halliburton Energy Services, Inc., Houston, TX (US)

(72) Inventor: David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/604,677

(22) Filed: Mar. 14, 2024

(65) Prior Publication Data

US 2024/0318510 A1 Sep. 26, 2024

Related U.S. Application Data

(60) Provisional application No. 63/490,294, filed on Mar. 15, 2023, provisional application No. 63/490,281, filed on Mar. 15, 2023.

(51) Int. Cl.
*E21B 17/02* (2006.01)

(52) U.S. Cl.
CPC ..... *E21B 17/028* (2013.01)

(58) Field of Classification Search
CPC ..... E21B 17/028
See application file for complete search history.

(56) References Cited

U.S. PATENT DOCUMENTS

| | | | | |
|---|---|---|---|---|
| 5,058,683 | A * | 10/1991 | Godfrey | E21B 23/006 166/381 |
| 5,096,001 | A | 3/1992 | Buytaert et al. | |
| 5,107,927 | A | 4/1992 | Whiteley et al. | |
| 7,165,892 | B2 | 1/2007 | Grigsby et al. | |
| 7,222,676 | B2 | 5/2007 | Patel et al. | |
| 7,252,437 | B2 | 8/2007 | Ringgenberg | |
| 7,900,698 | B2 | 3/2011 | Stoesz | |
| 8,056,619 | B2 | 11/2011 | Patel et al. | |
| 8,280,709 | B2 | 10/2012 | Koutsabeloulis et al. | |
| 8,436,743 | B2 | 5/2013 | Auzerais et al. | |
| 8,584,519 | B2 | 11/2013 | Maida et al. | |
| 8,794,337 | B2 | 8/2014 | Thomas et al. | |
| 8,839,850 | B2 | 9/2014 | Algeroy et al. | |
| 8,919,439 | B2 | 12/2014 | Grigsby et al. | |

(Continued)

FOREIGN PATENT DOCUMENTS

| | | |
|---|---|---|
| WO | 2012109397 A2 | 8/2012 |
| WO | 2015044208 A2 | 4/2015 |

(Continued)

*Primary Examiner* — Brad Harcourt
(74) *Attorney, Agent, or Firm* — Scott Richardson; Parker Justiss, P.C.

(57) ABSTRACT

Provided is a wet mate, a well system, and a method. The wet mate, in one aspect, includes a wet mate housing, the wet mate housing having a male wet mate connector portion or a female wet mate connector portion. The wet mate, according to this aspect, further includes a fluid reservoir located within the wet mate housing, and a volume of optical coupling fluid located within the fluid reservoir, the volume of optical coupling fluid sufficient to allow the wet mate housing to undergo at least three decoupling/coupling sequences before running out while the wet mate housing is in a substantially horizontal location.

28 Claims, 103 Drawing Sheets

(56) References Cited

U.S. PATENT DOCUMENTS

| | | | |
|---|---|---|---|
| 8,985,215 | B2 | 3/2015 | Tips et al. |
| 9,038,739 | B2 | 5/2015 | Manwill et al. |
| 9,435,166 | B2 | 9/2016 | Macdonald et al. |
| 9,500,071 | B2 | 11/2016 | Morgan-Smith et al. |
| 9,624,763 | B2 | 4/2017 | Samuelson et al. |
| 9,683,412 | B2 | 6/2017 | Richards |
| 9,726,004 | B2 | 8/2017 | Echols et al. |
| 9,759,016 | B2 | 9/2017 | Perez et al. |
| 9,915,104 | B2 | 3/2018 | Richards |
| 9,988,894 | B1 | 6/2018 | Malone et al. |
| 10,060,196 | B2 | 8/2018 | Richards |
| 10,145,224 | B1 | 12/2018 | Shenoy et al. |
| 10,533,381 | B2 | 1/2020 | Head et al. |
| 10,612,369 | B2 | 4/2020 | Dufour et al. |
| 10,621,500 | B2 | 4/2020 | Dusterhoft et al. |
| 10,934,785 | B2 | 3/2021 | Fripp et al. |
| 10,989,033 | B2 | 4/2021 | Martysevich et al. |
| 11,187,071 | B2 | 11/2021 | Luo et al. |
| 11,295,048 | B2 | 4/2022 | Borrel et al. |
| 11,560,771 | B2 | 1/2023 | Hern |
| 11,753,875 | B2 | 9/2023 | Hanson et al. |
| 12,129,714 | B2 | 10/2024 | Cassidy et al. |
| 12,134,959 | B2 | 11/2024 | Poizat |
| 2003/0141075 | A1 | 7/2003 | Bixenman et al. |
| 2007/0257812 | A1 | 11/2007 | Lasater et al. |
| 2008/0128130 | A1 | 6/2008 | Whitsitt et al. |
| 2009/0045146 | A1 | 2/2009 | Stoesz |
| 2009/0063069 | A1 | 3/2009 | Wu |
| 2009/0078421 | A1 | 3/2009 | Guignard et al. |
| 2009/0078429 | A1 | 3/2009 | Du et al. |
| 2011/0192596 | A1 | 8/2011 | Patel |
| 2011/0214883 | A1 | 9/2011 | Patel |
| 2012/0043079 | A1 | 2/2012 | Wassouf et al. |
| 2012/0045917 | A1* | 2/2012 | Head ..... H01R 13/523 439/190 |
| 2016/0090833 | A1 | 3/2016 | Samuelson et al. |
| 2016/0138373 | A1 | 5/2016 | Wood et al. |
| 2016/0251931 | A1 | 9/2016 | Buchan et al. |
| 2016/0356095 | A1 | 12/2016 | Perez et al. |
| 2017/0005448 | A1 | 1/2017 | Williams et al. |
| 2017/0081926 | A1 | 3/2017 | Pike |
| 2018/0030810 | A1 | 2/2018 | Saldanha |
| 2019/0153854 | A1 | 5/2019 | Manin |
| 2019/0292902 | A1 | 9/2019 | Jarvis et al. |
| 2020/0018149 | A1 | 1/2020 | Luo et al. |
| 2020/0309982 | A1 | 10/2020 | Jin et al. |
| 2020/0386073 | A1 | 12/2020 | Joubran et al. |
| 2020/0386096 | A1 | 12/2020 | Sugiura et al. |
| 2021/0131254 | A1 | 5/2021 | Potty et al. |
| 2021/0140276 | A1 | 5/2021 | Steele, Jr. |
| 2021/0222520 | A1 | 7/2021 | Steele et al. |
| 2021/0222548 | A1 | 7/2021 | Steele et al. |
| 2021/0372276 | A1 | 12/2021 | Steele et al. |
| 2022/0025753 | A1 | 1/2022 | Heidari et al. |
| 2022/0290559 | A1 | 9/2022 | Lim Chen Ning et al. |
| 2022/0292338 | A1 | 9/2022 | Nair et al. |
| 2022/0341293 | A1 | 10/2022 | Steele |
| 2023/0071743 | A1 | 3/2023 | Li et al. |
| 2024/0125183 | A1* | 4/2024 | Mahendran ..... E21B 17/06 |
| 2024/0151111 | A1 | 5/2024 | Cassidy et al. |
| 2024/0309731 | A1 | 9/2024 | Steele et al. |
| 2024/0318510 | A1 | 9/2024 | Steele |
| 2024/0318511 | A1 | 9/2024 | Steele |
| 2024/0318529 | A1 | 9/2024 | Alkadem et al. |
| 2024/0318539 | A1 | 9/2024 | Steele |

FOREIGN PATENT DOCUMENTS

| | | | |
|---|---|---|---|
| WO | 2018175508 | A1 | 9/2018 |
| WO | 2022109157 | A1 | 5/2022 |
| WO | 2022192669 | A1 | 9/2022 |

* cited by examiner

| Material (condition) | Angle of Repose (degrees) |
|---|---|
| Chalk | 45° |
| Clay(dry lump) | 25 - 40° |
| Clay(wet excavated) | 15° |
| Earth | 30 - 45° |
| Granite | 35 - 40° |
| Gravel(crushed stone) | 45° |
| Gravel(natural w/ sand) | 25 - 30° |
| Sand(dry) | 34° |
| Sand(water filled) | 15 - 30° |
| Sand(wet) | 45° |

FIG. 1B

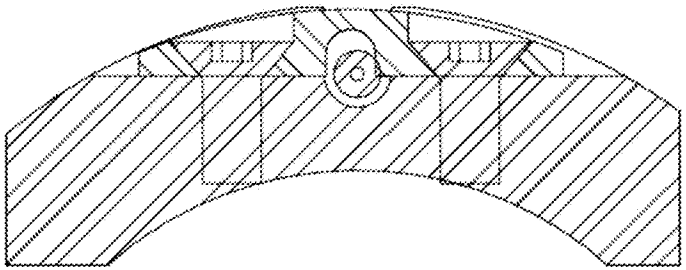
FIG. 17
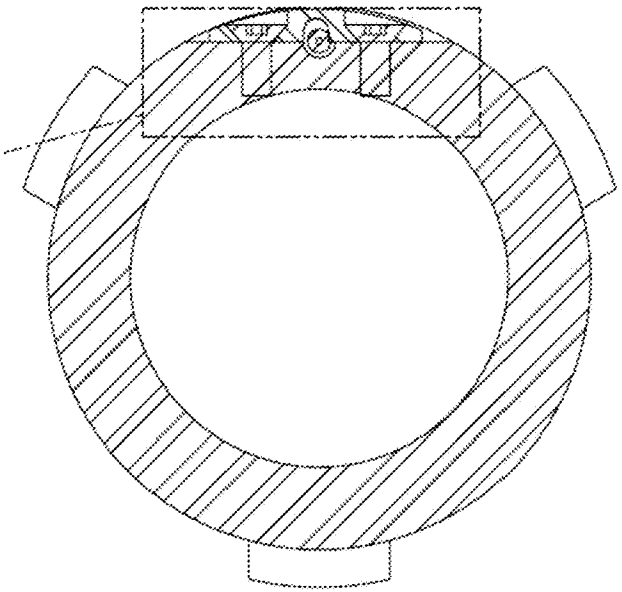
FIG. 16
FIG. 17

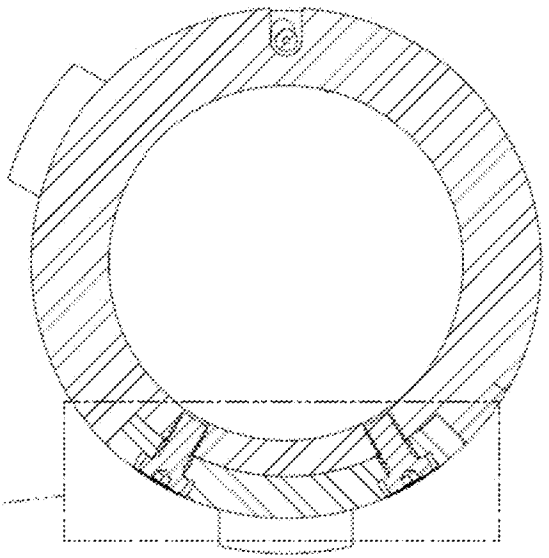
FIG. 19
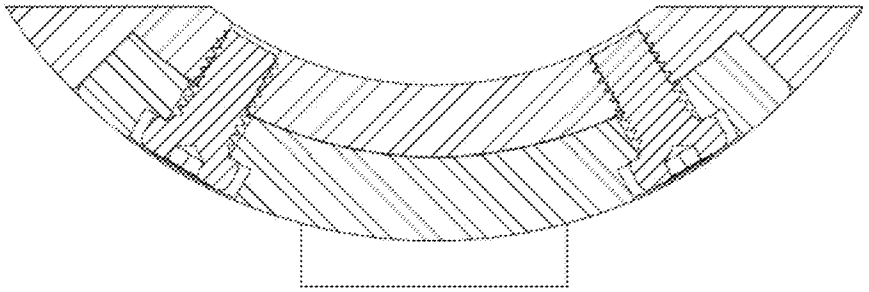
FIG. 19
FIG. 18

The "thing" may comprise of mechanical mechanism, electrical, electronic, sensor, power transformer, hydraulic, combination thereof, a combination of one or more and another not listed "thing"

FIG. 48

The Machine Learning Model

Training the Machine Learning Model - The process of forming the Machine Learning Model - defining the decision boundaries and the data set The Transformer - model architecture.

A flowchart of a spervised machine learning model

6800

MULTIPLE USE WET MATE HAVING A FLUID RESERVOIR CONFIGURED TO RECEIVE A VOLUME OF COUPLING FLUID THEREIN

CROSS-REFERENCE TO RELATED APPLICATION

This application claims the benefit of U.S. Provisional Application Ser. No. 63/490,281, filed on Mar. 15, 2023, entitled "COMPLETION-AND-PRODUCTION MONITORING AND CONTROL VIA A SINGLEDOWNHOLE WET-MATE (E.G., FIBER OPTIC WET-MATE), METHODS, SYSTEMS, AND DEVICES FOR RECORDING DOWNHOLE COMPLETION-ACTIVITY (E.G., FRAC-PACKING) WITH THE ABILITY TO SWITCH TO LONG-TERMPRODUCTION DATA GATHERING AND TRANSMISSION TO SURFACE," and U.S. Provisional Application Ser. No. 63/490,294, filed on Mar. 15, 2023, entitled "ORIENTING WET MATE CONNECTIONS HIGH SIDE IN A WELL," which are commonly assigned with this application and incorporated herein by reference in their entirety.

BACKGROUND

Completing a well is one the highest expenses in a well's total cost. By gathering data about the completion (e.g., gravel pack placement, frac pack efficiency, etc.), the efficiency of the completion (e.g., stimulation) can be increased while decreasing the cost per produced barrel.

BRIEF DESCRIPTION

Reference is now made to the following descriptions taken in conjunction with the accompanying drawings, in which:

FIGS. 1A through 23 illustrate various different embodiments of the disclosure, many of which are related to the positioning of a wet mate high side;

FIGS. 26A through 26I illustrate various different views of a slotted orientation apparatus designed, manufactured, and operated according to one or more embodiments of the disclosure;

Figure 35:
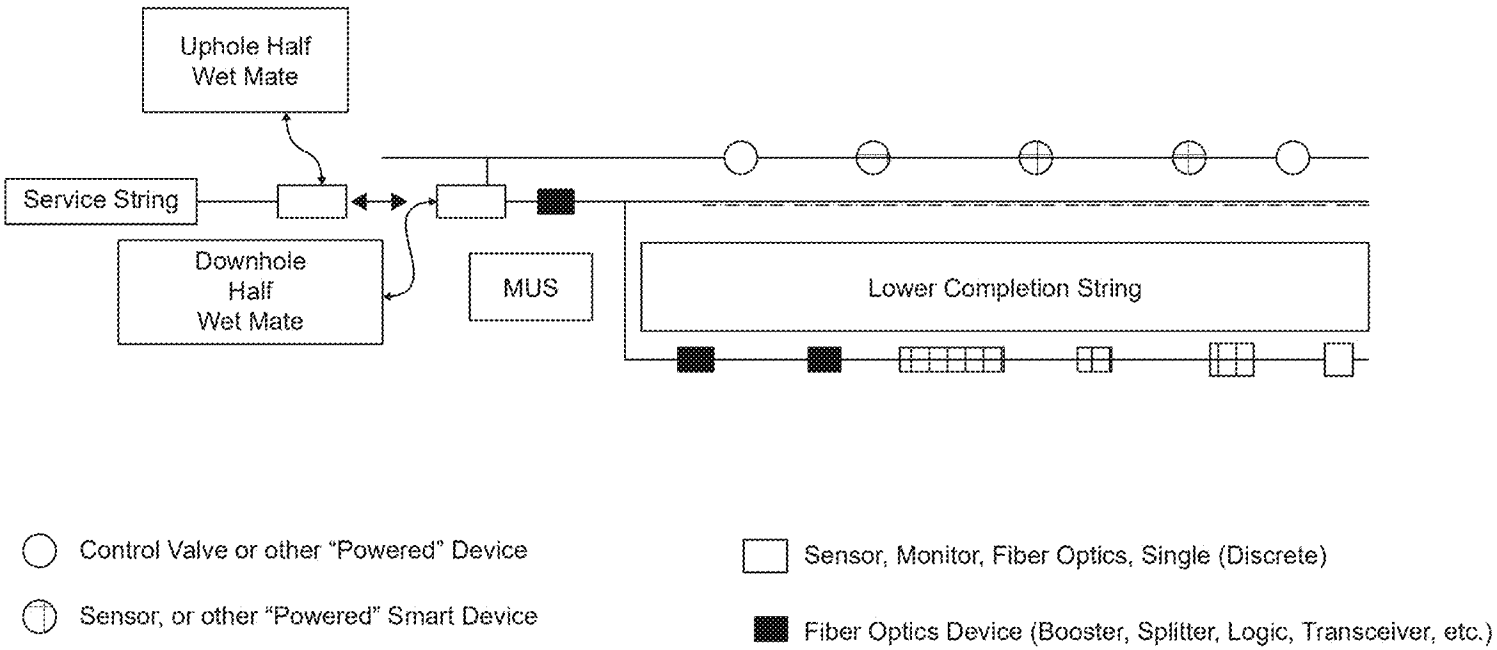
Figure 36:
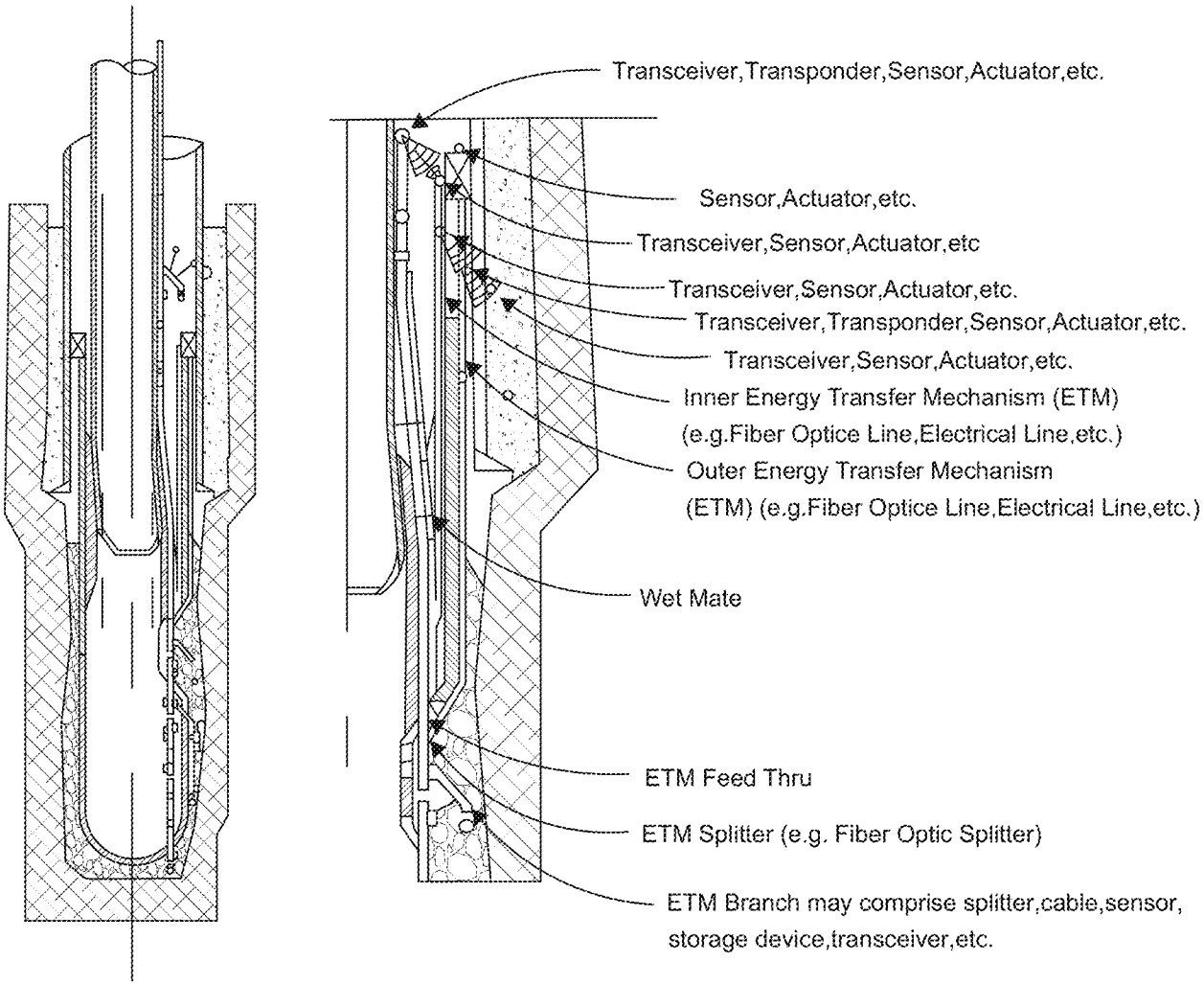
Figure 37:
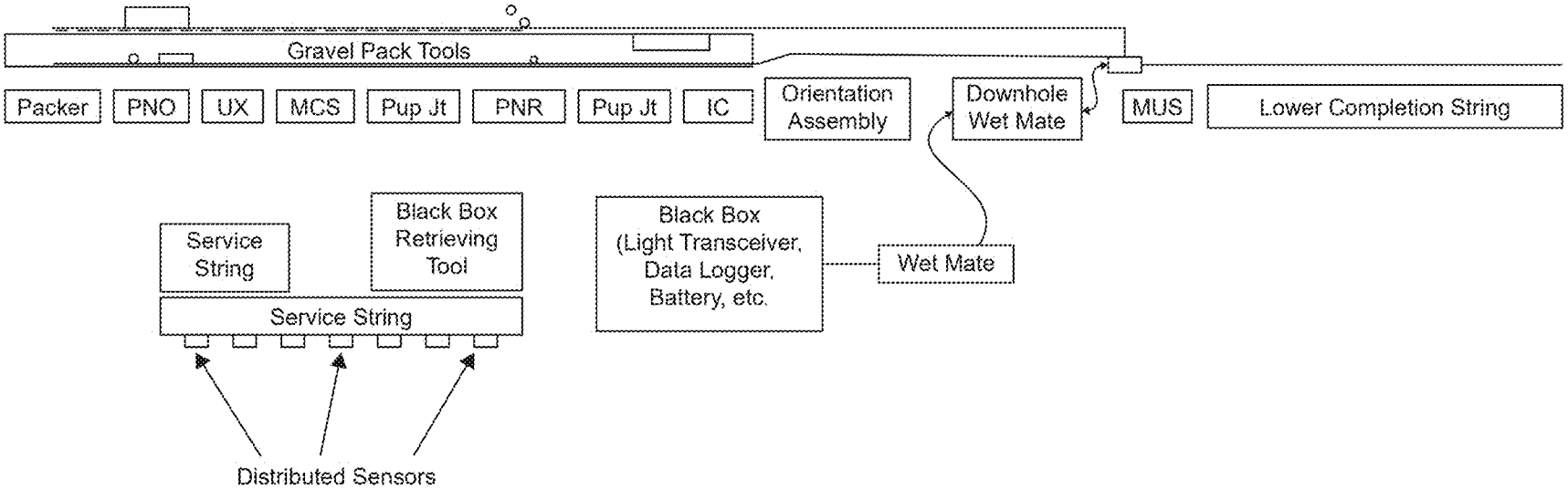
Figure 38:
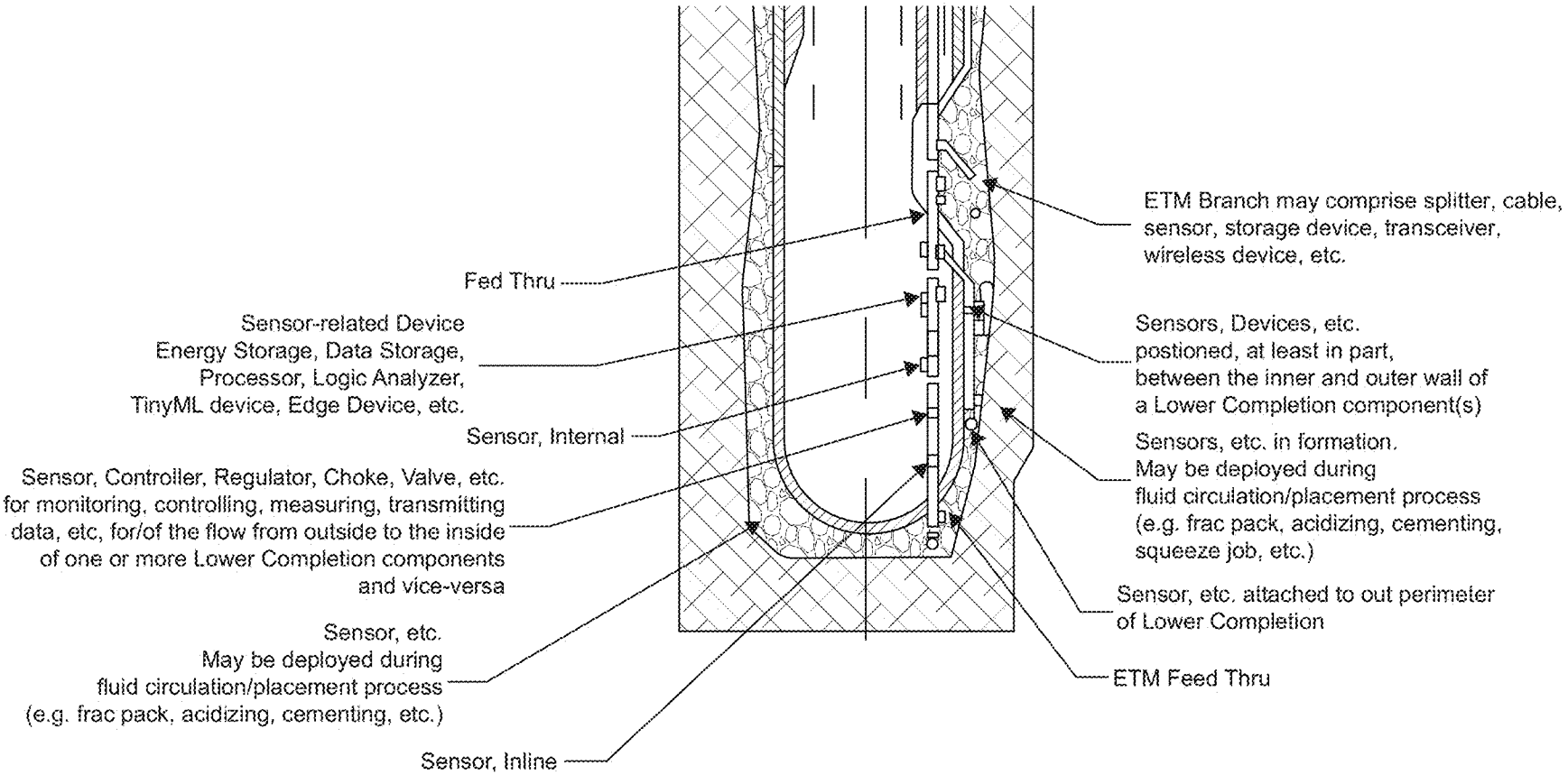
Figure 39:
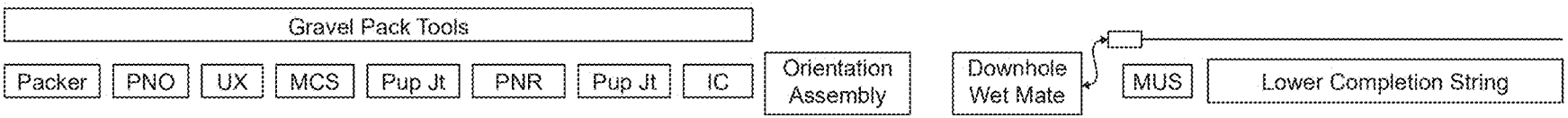
Figure 40:
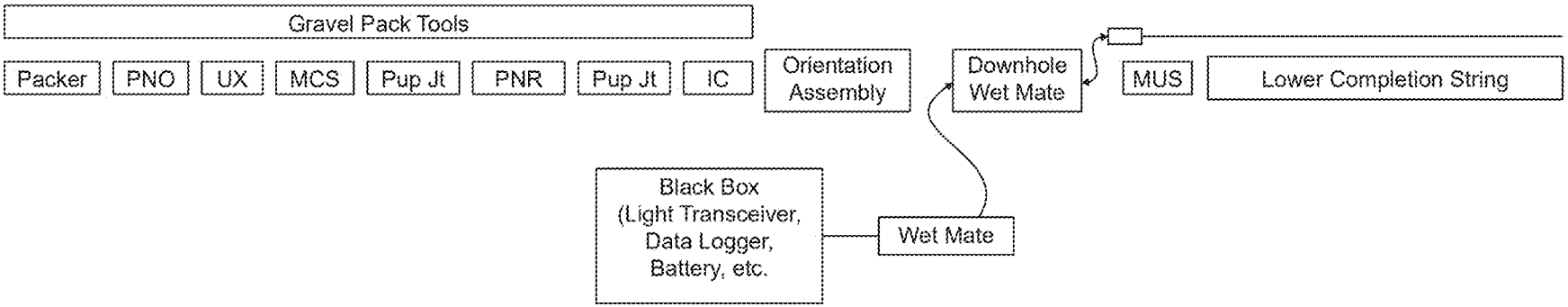
Figure 41:
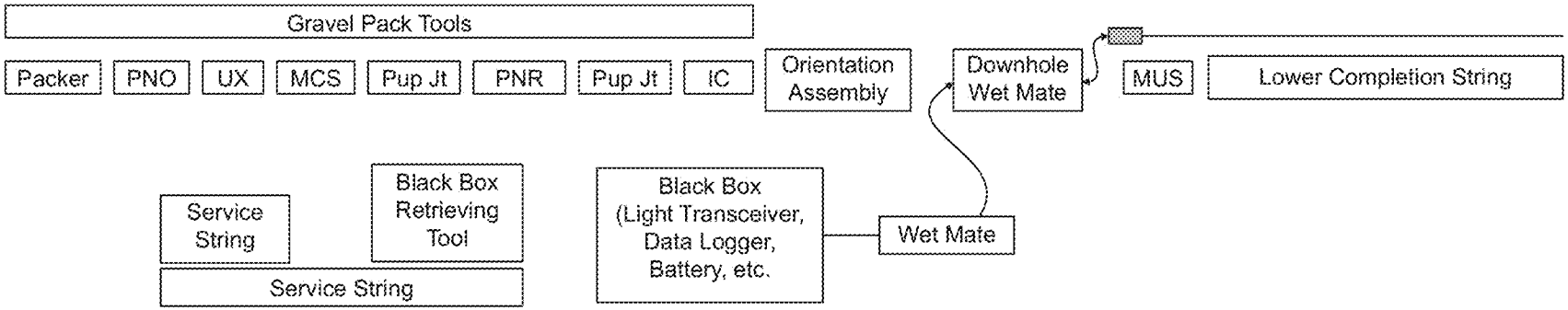
Figure 42:
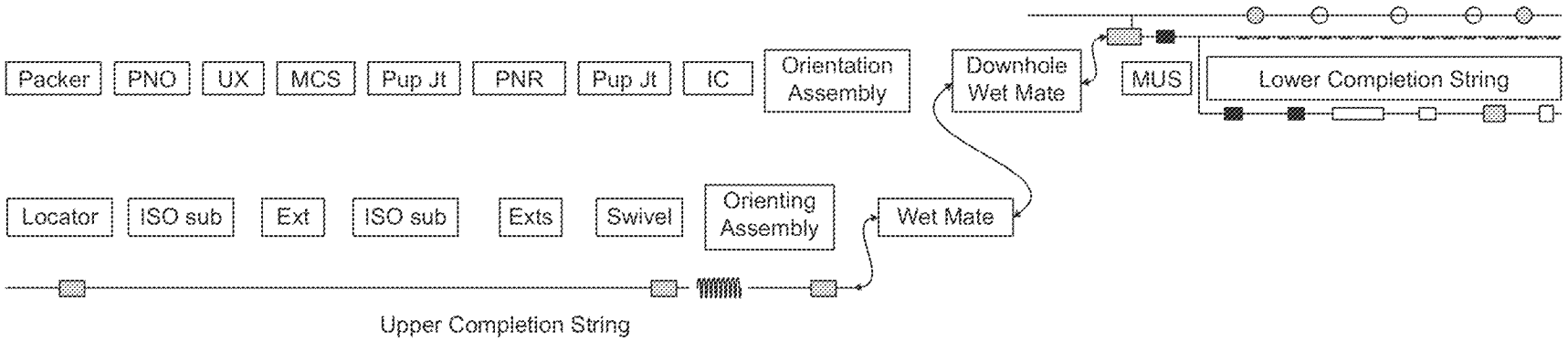
Figure 43:
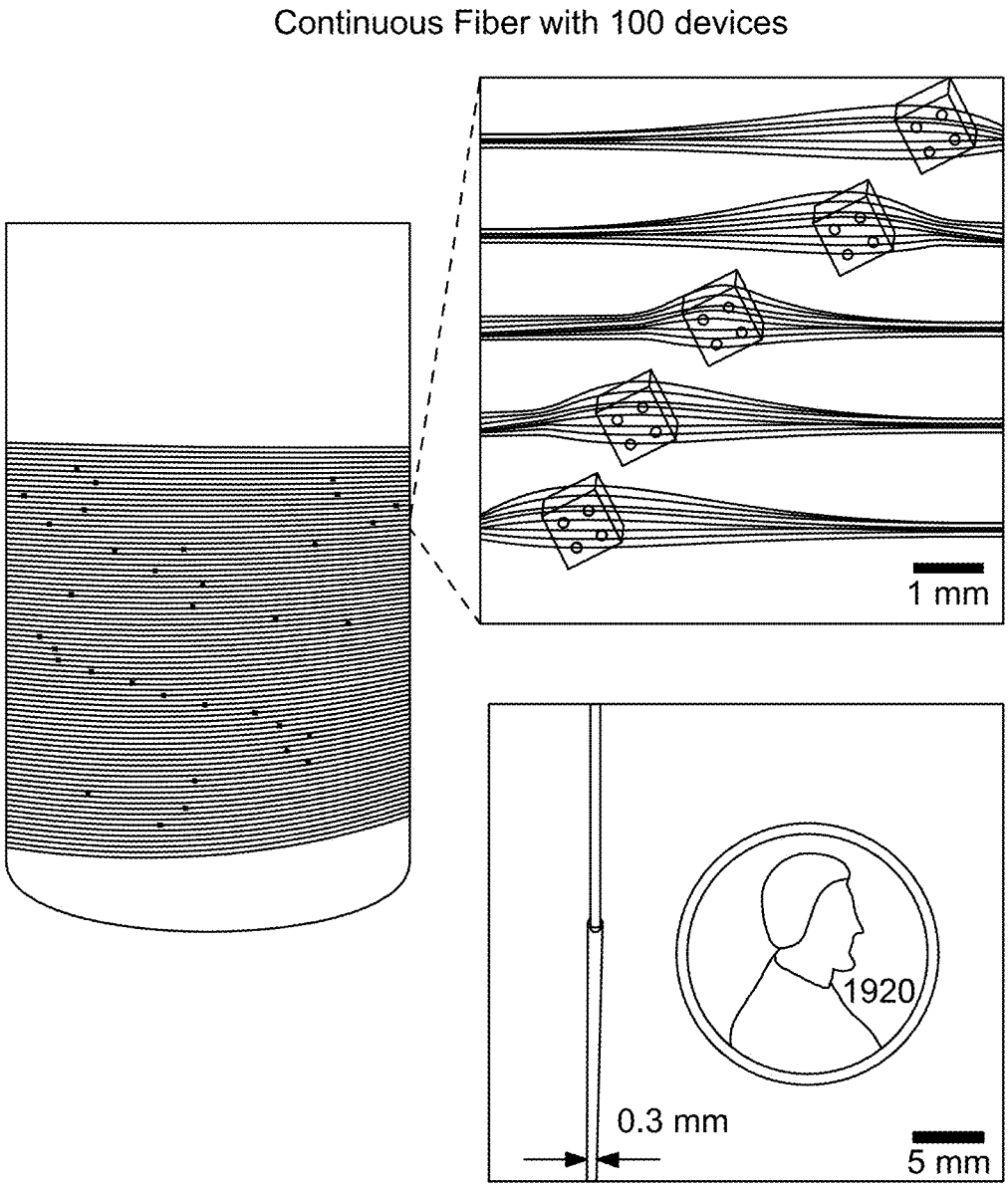
Figure 44:
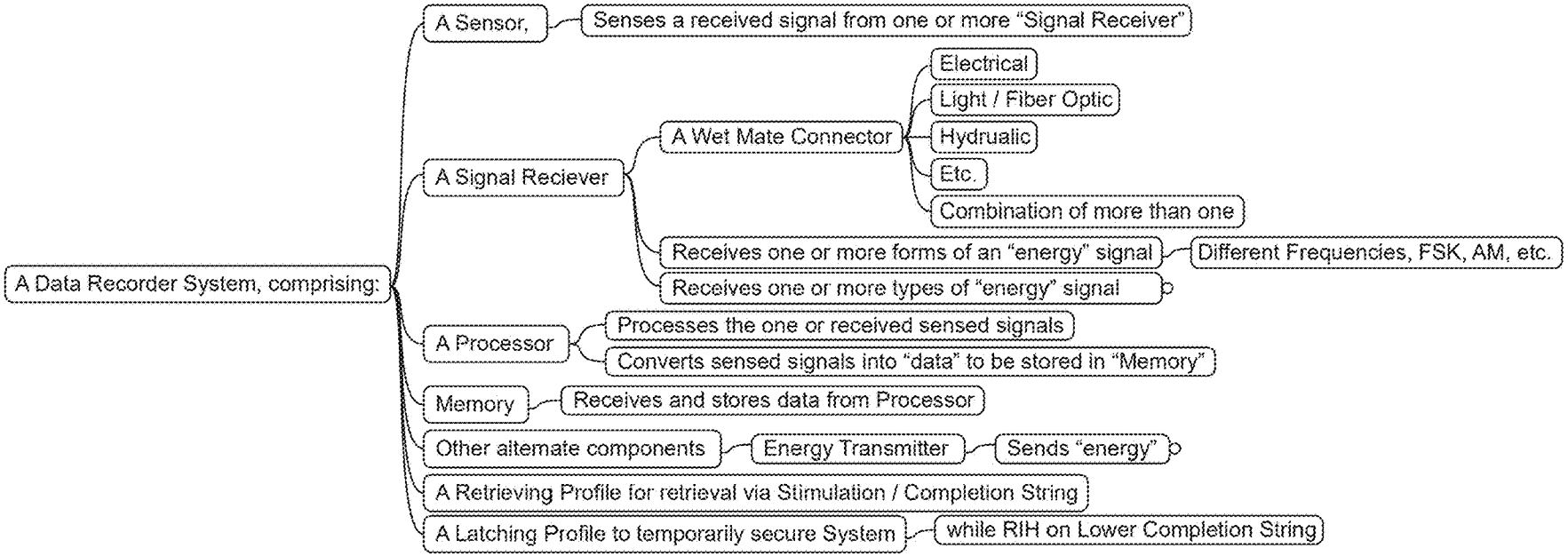
Figure 45:
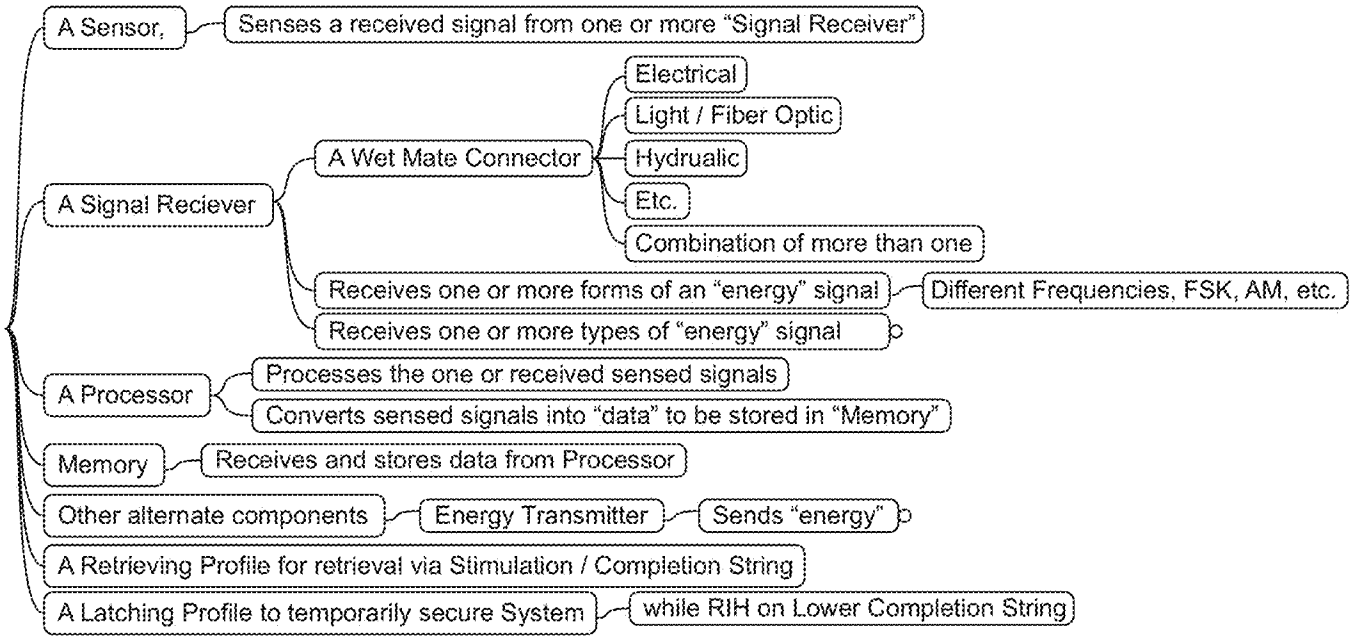
Figure 46:
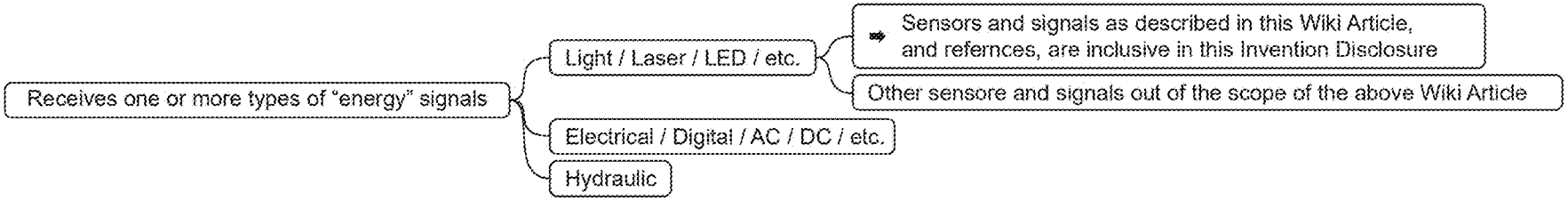
Figure 47:
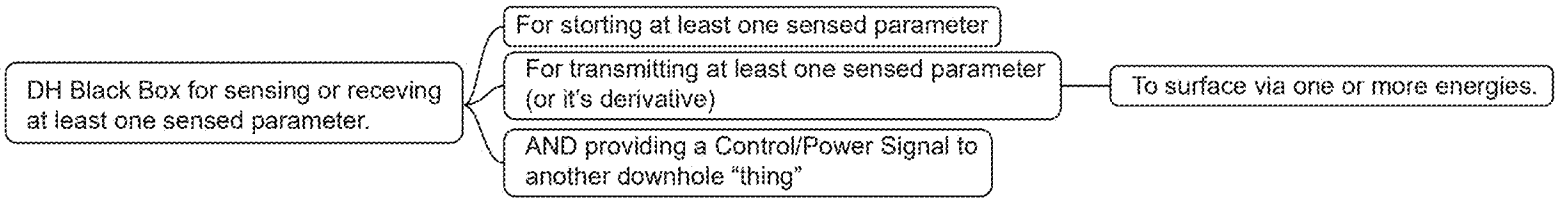
Figure 49:
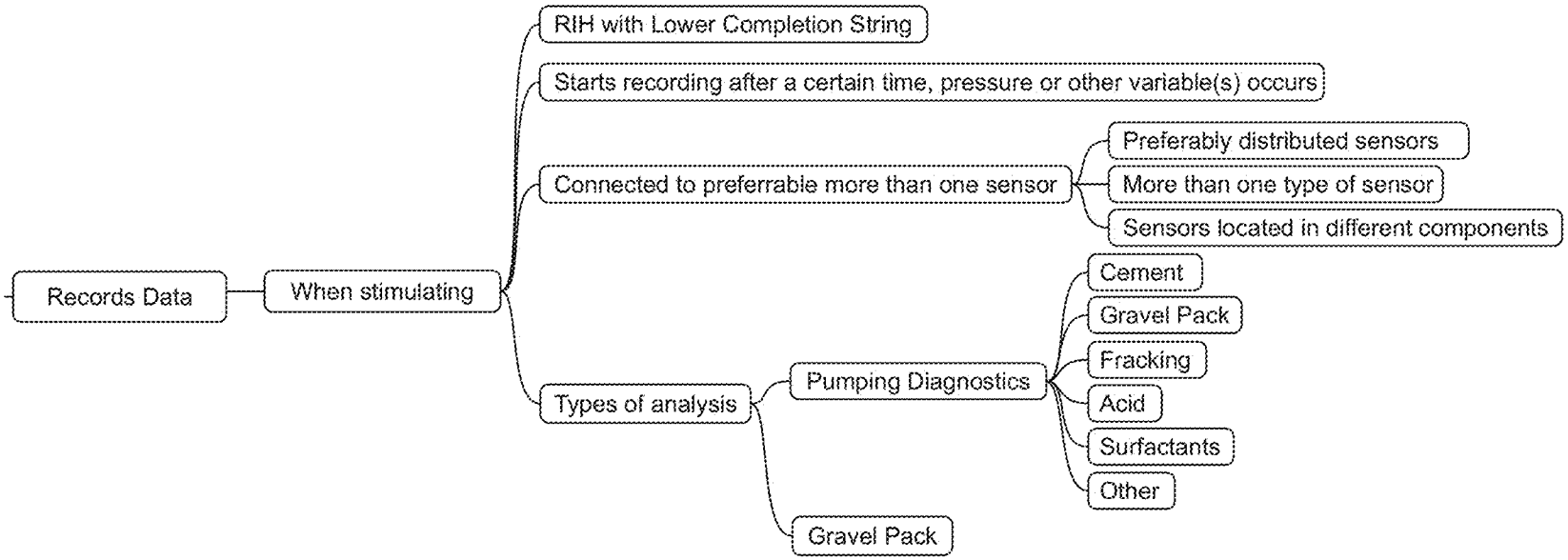
Figure 50A:
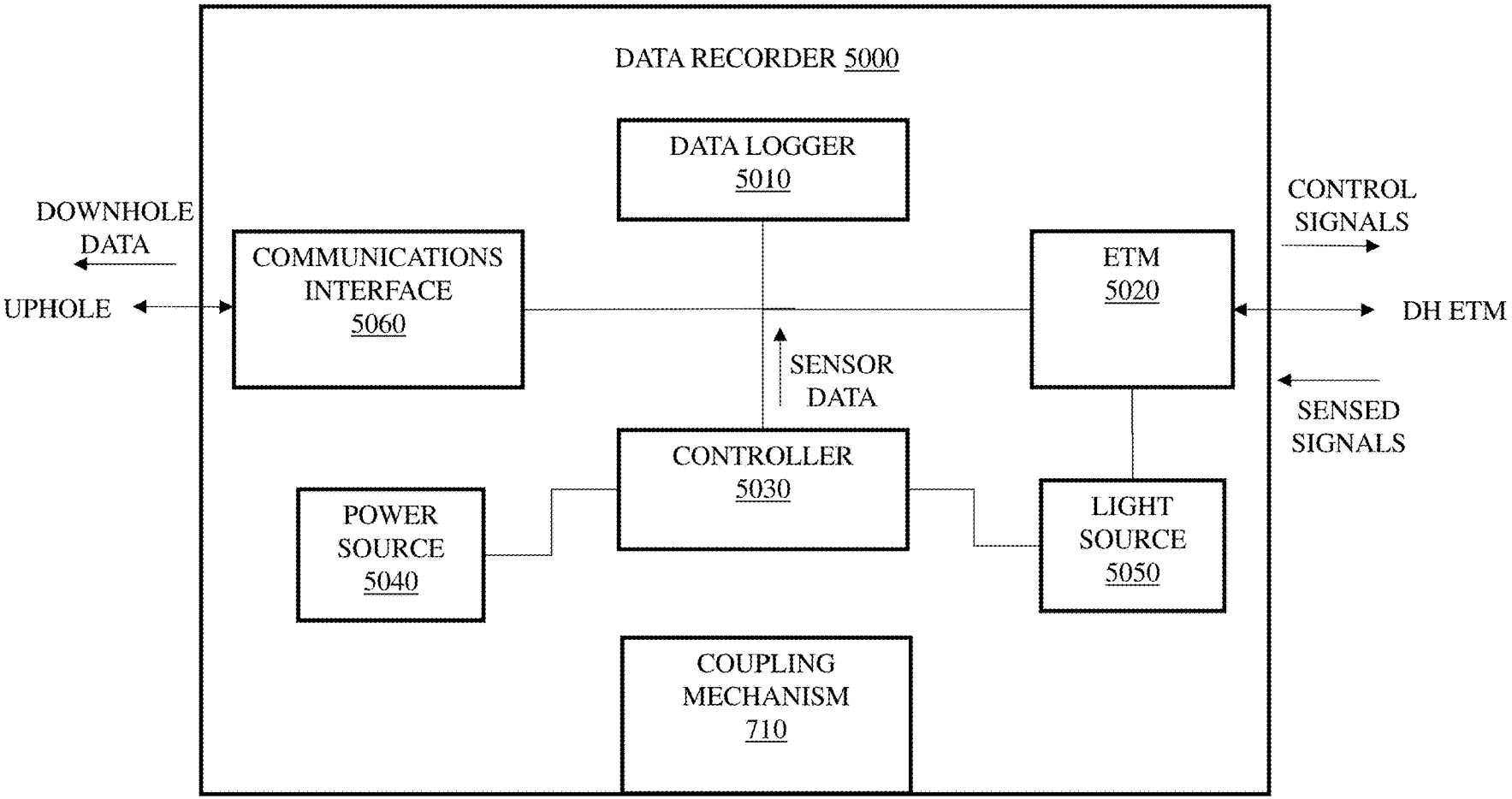
Figure 50B:
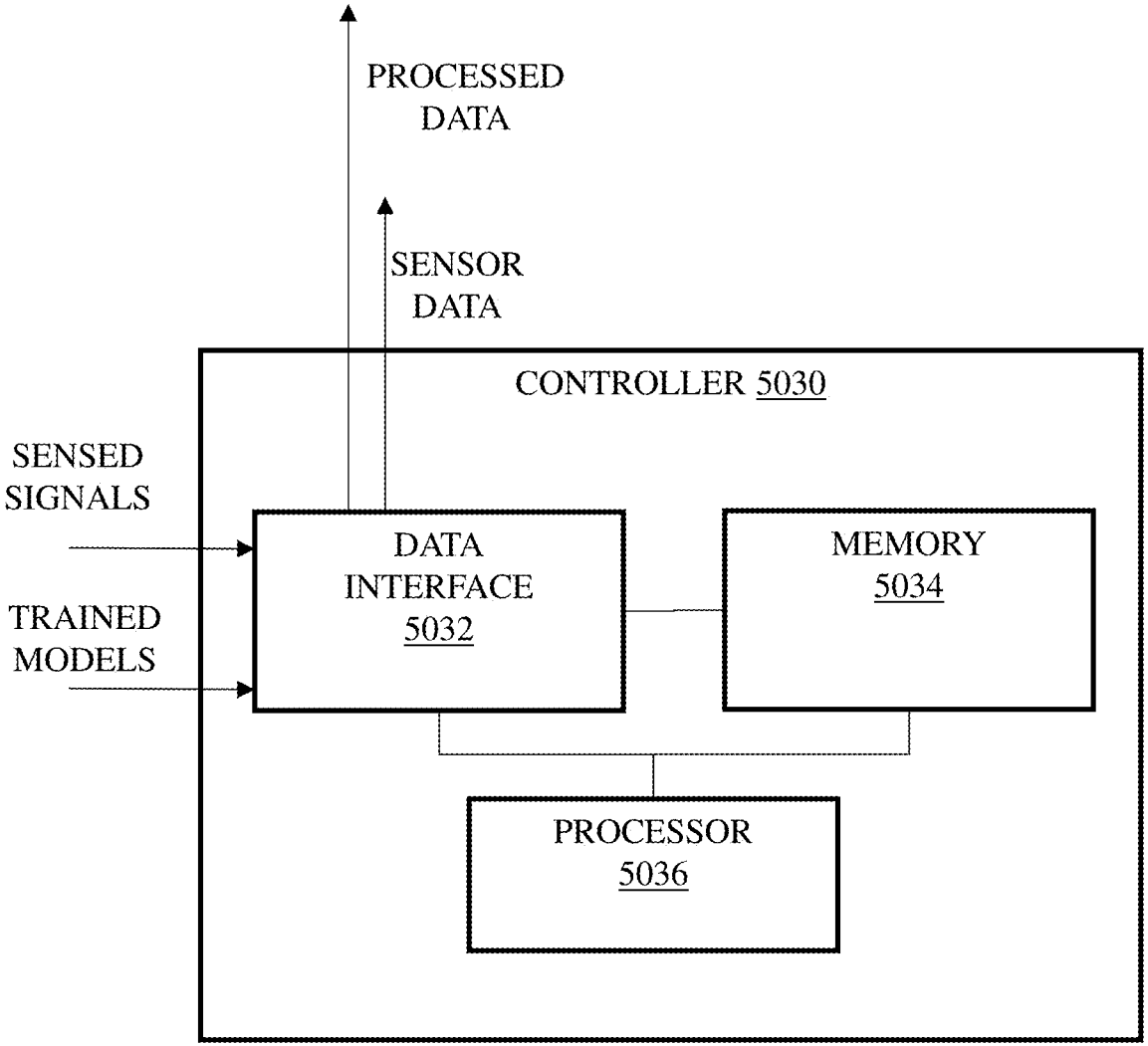
Figure 50C:
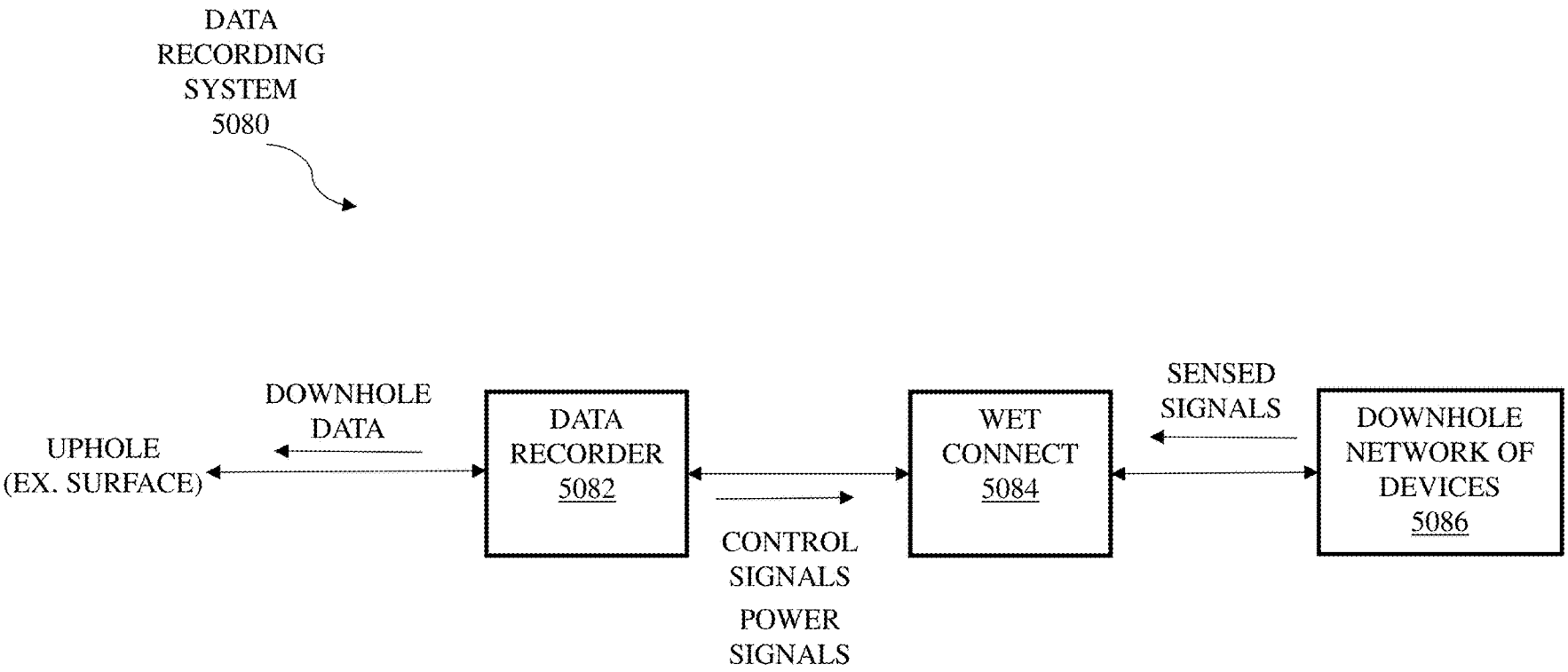
Figure 50D:
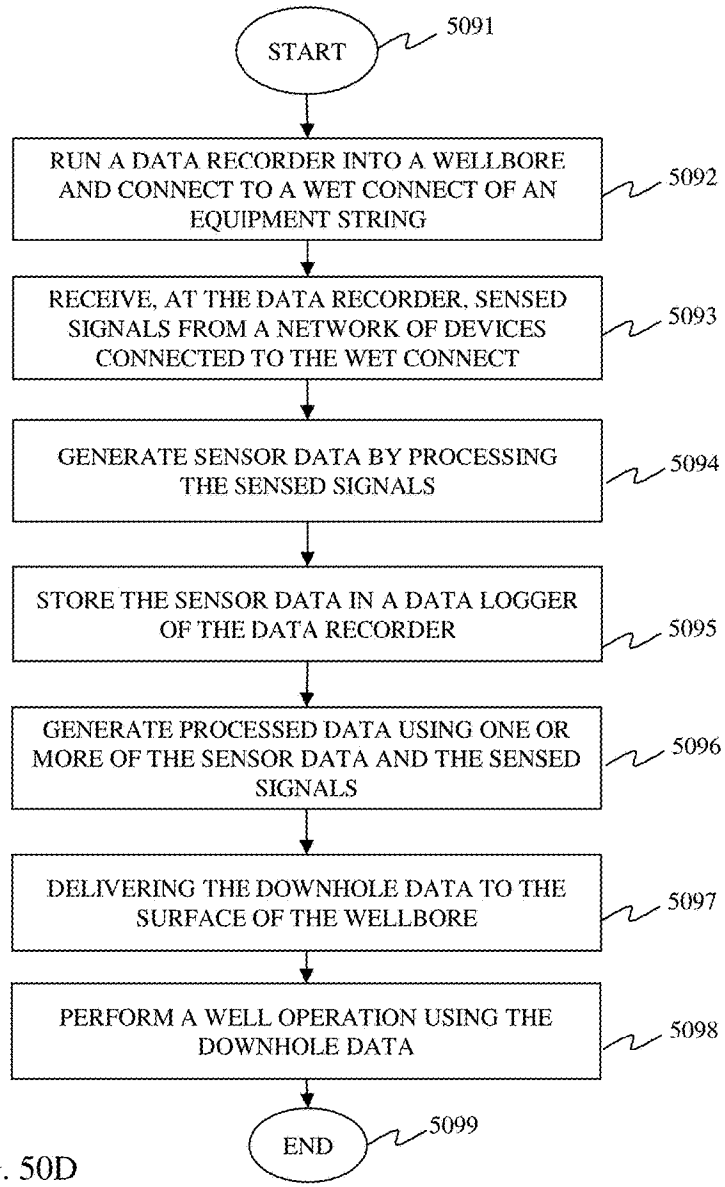
Figure 51A:
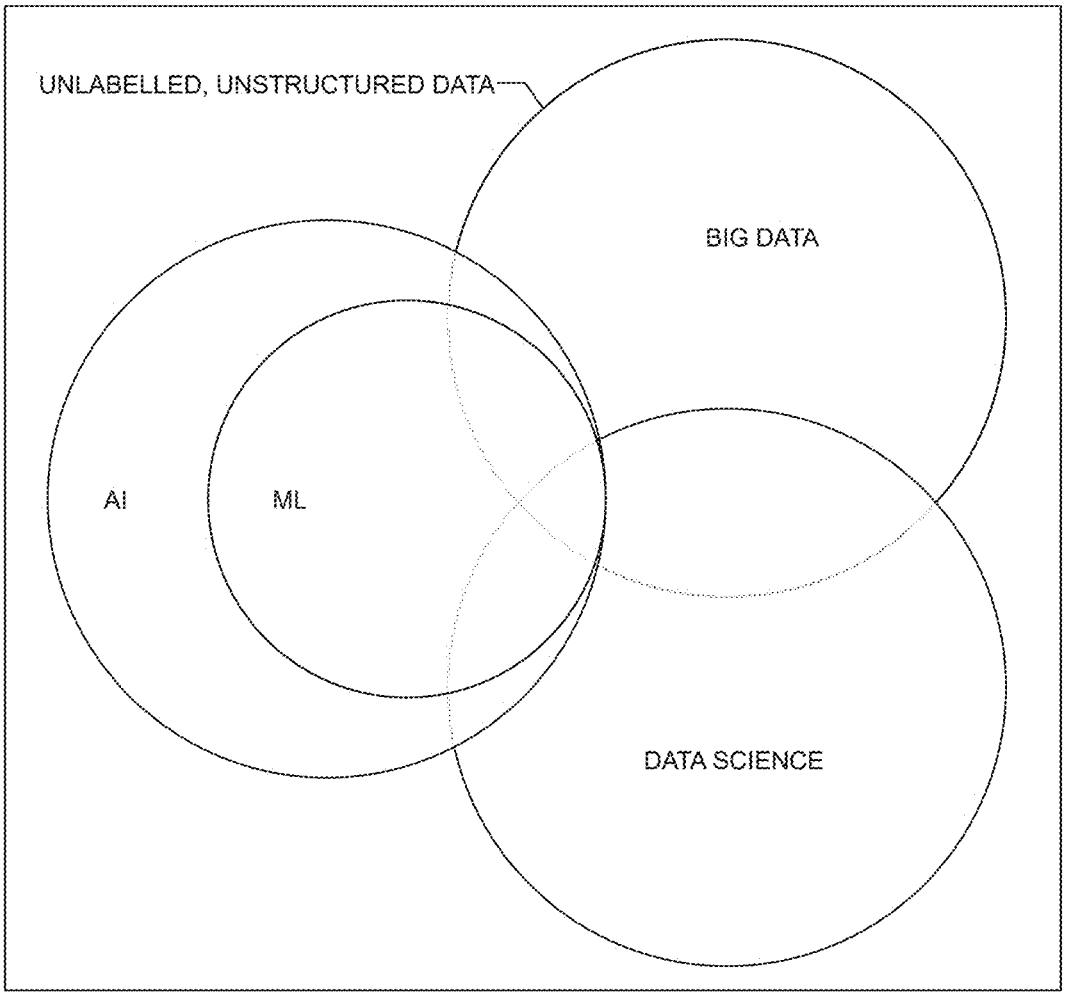
Figure 51B:
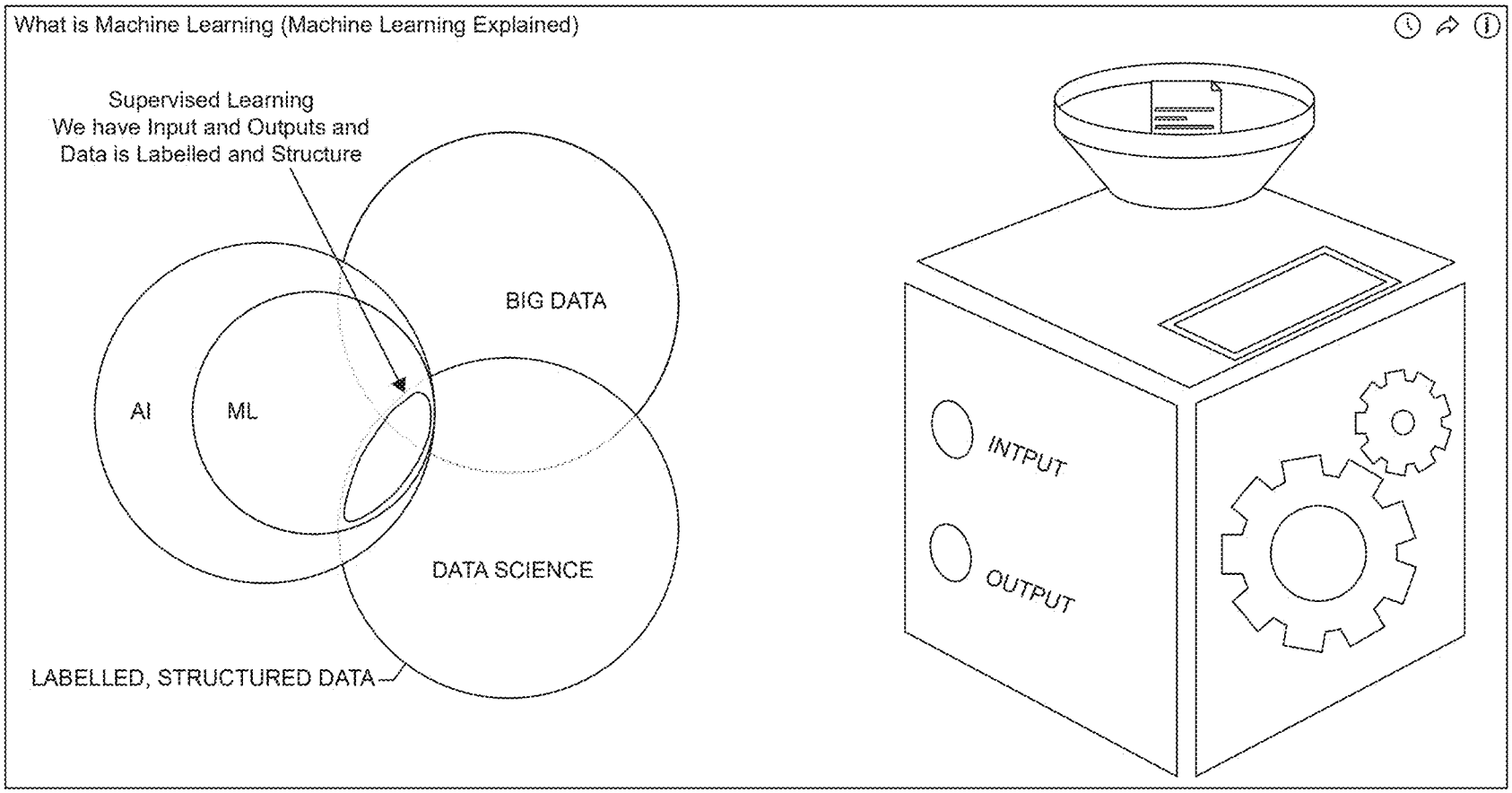
Figure 52:
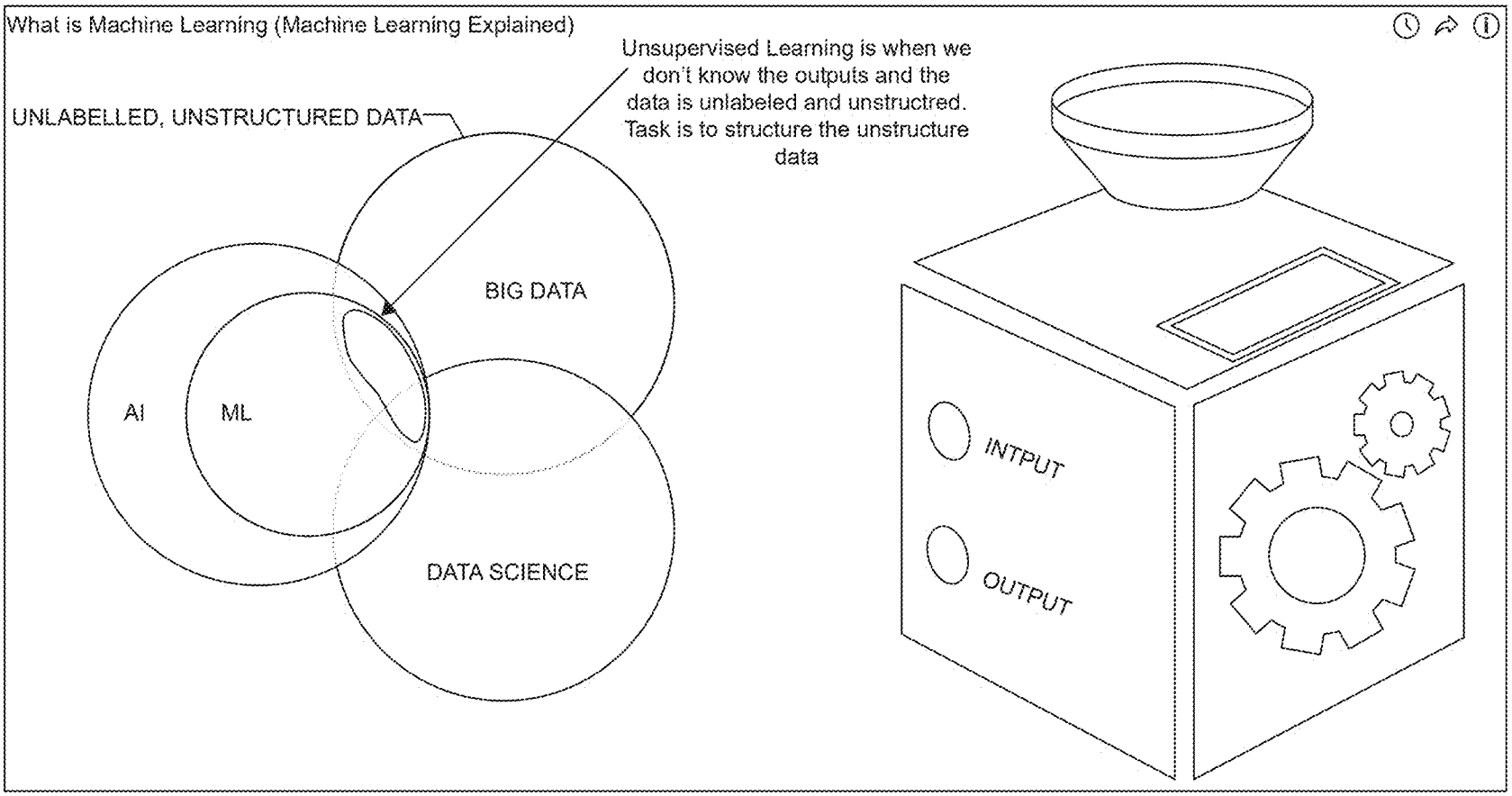
Figure 53:
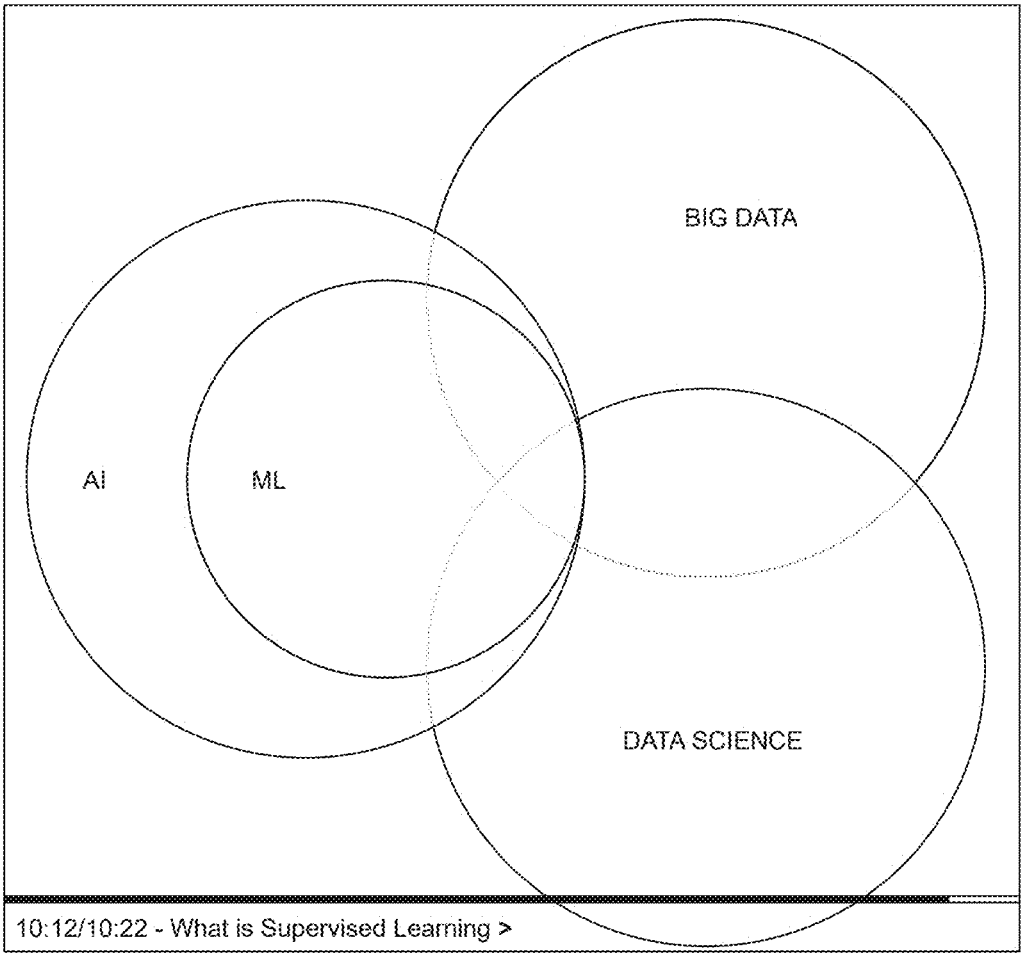
Figure 54:
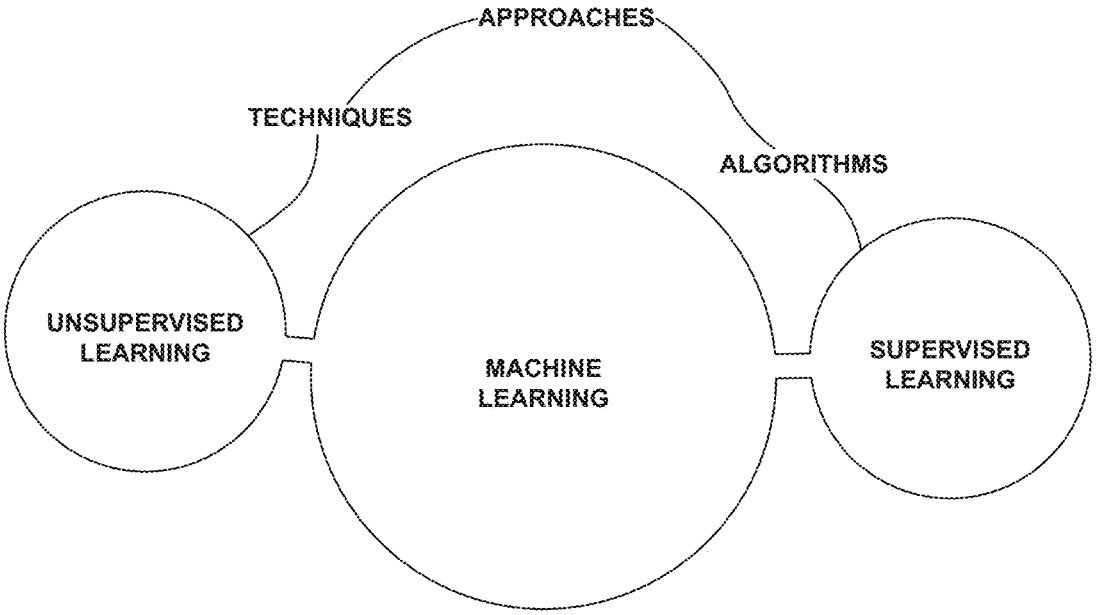
Figure 67:
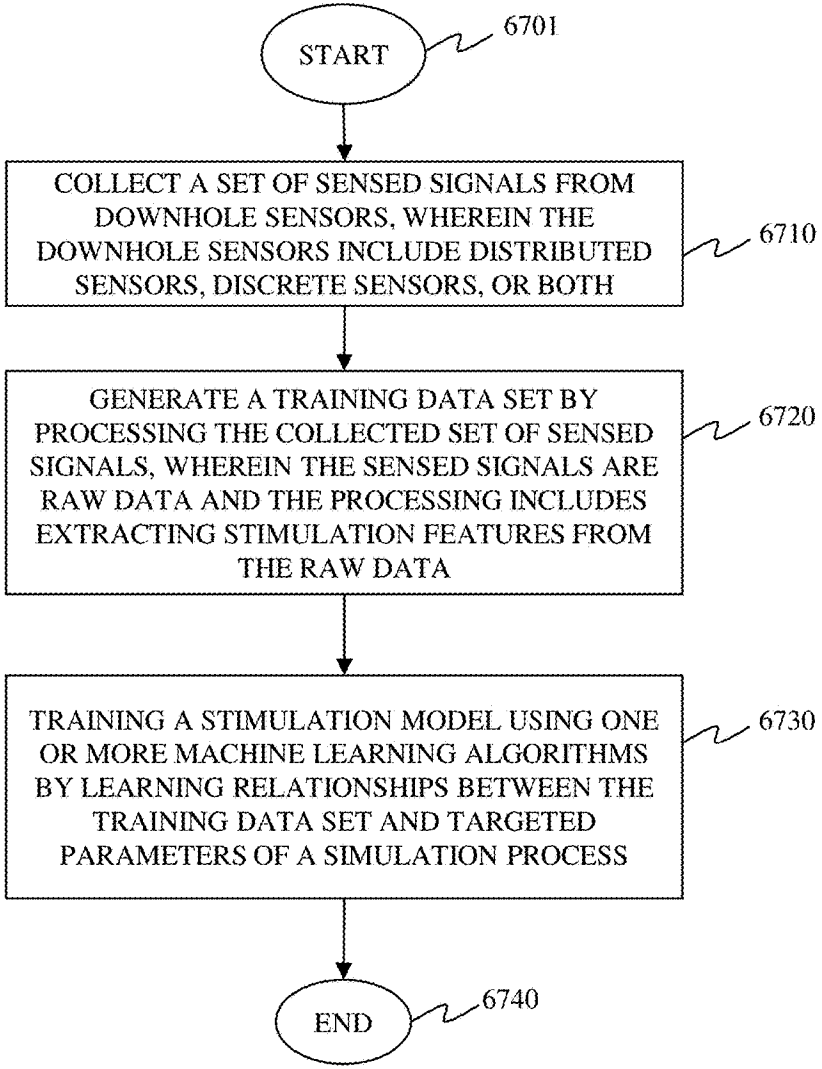
Figure 68:
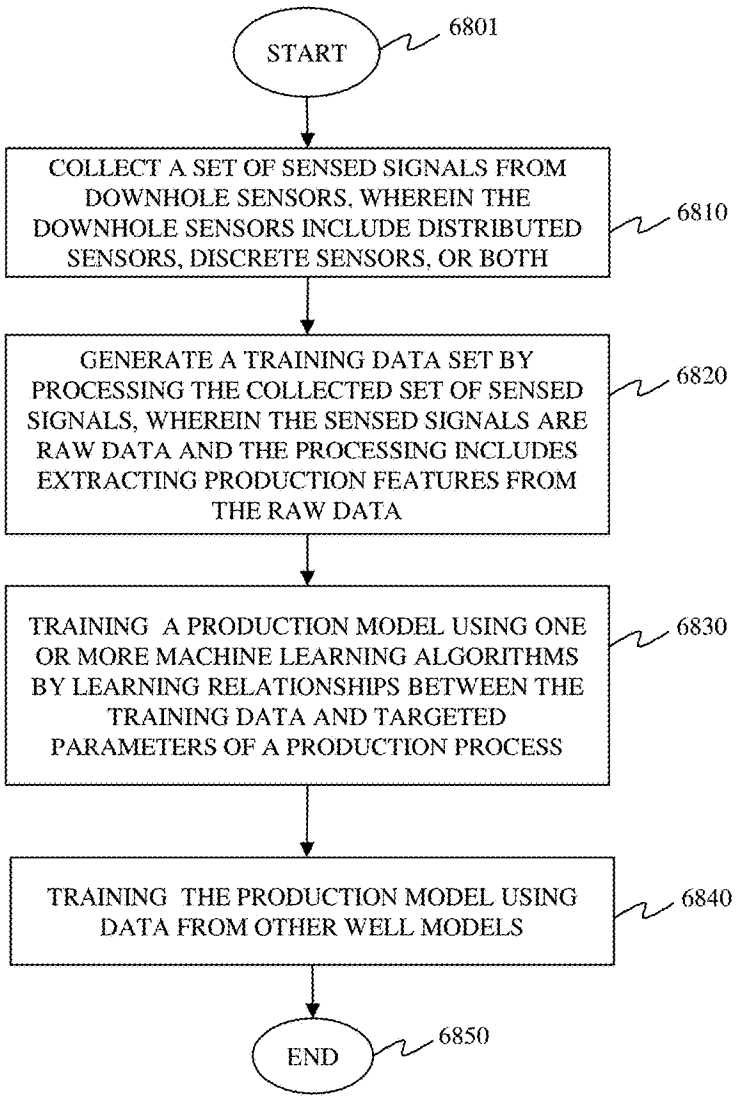
Figure 69:
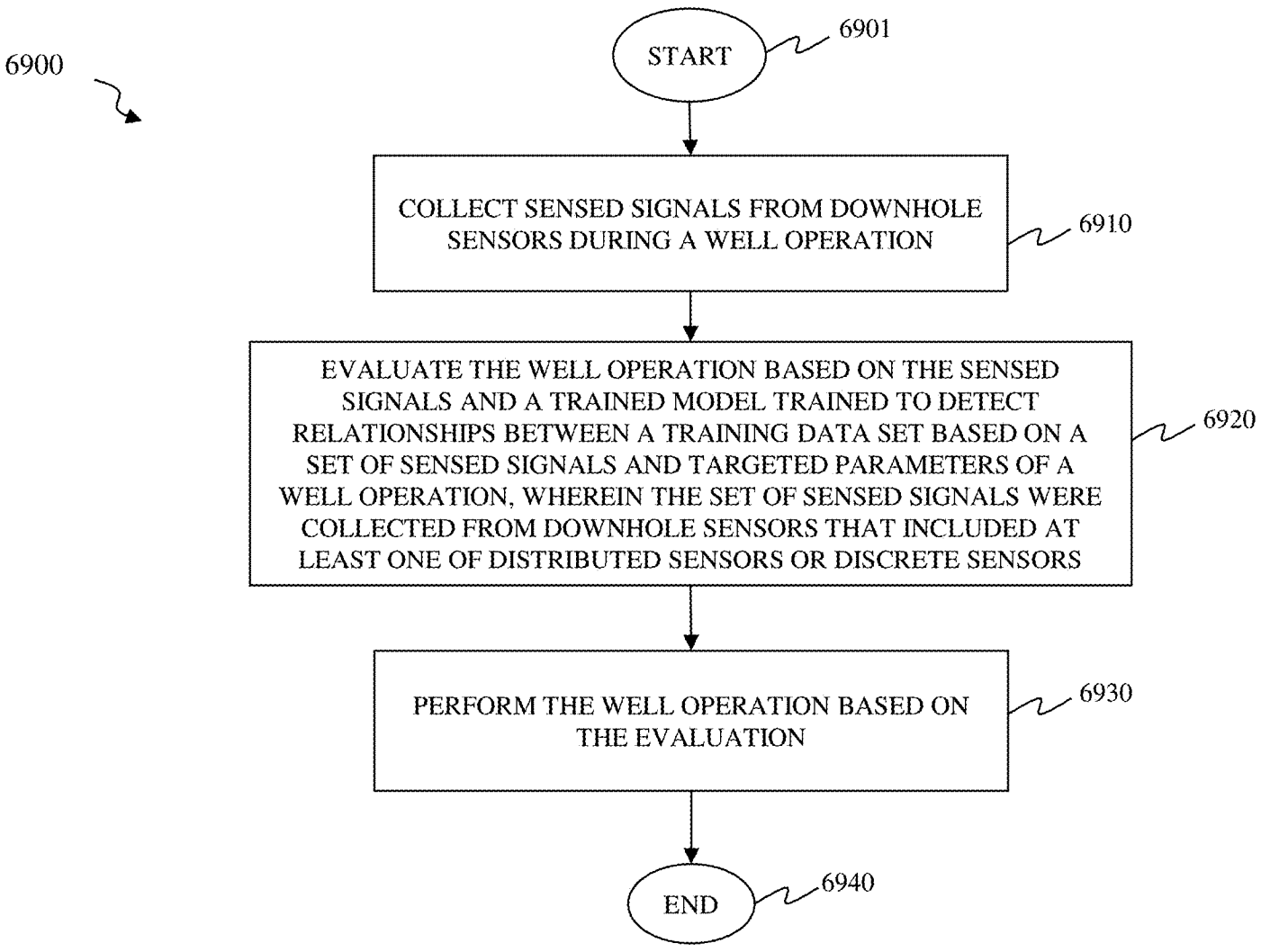
Figure 70:
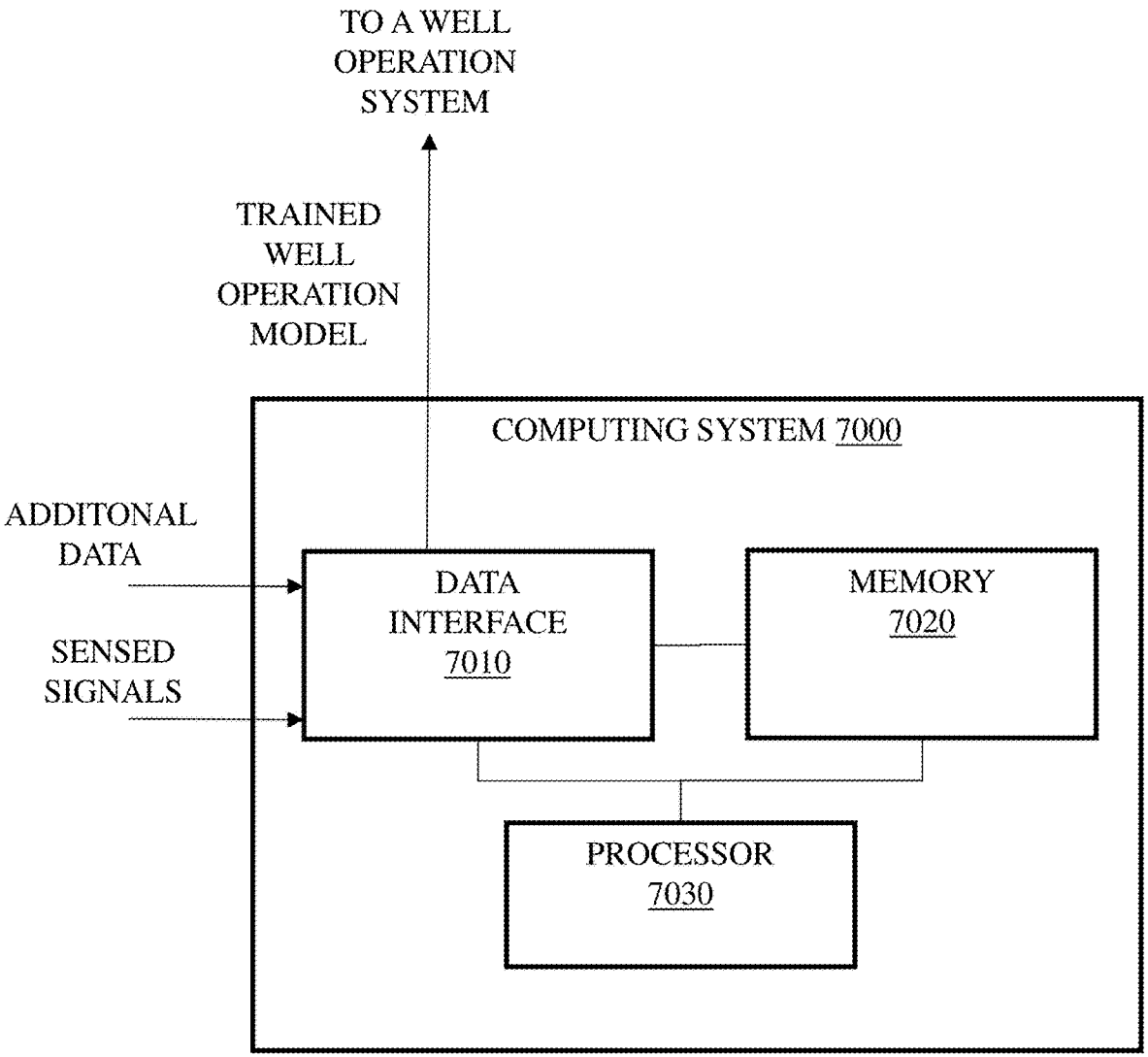

Turning to FIGS. 34A through 34L, illustrated are various different views of various different embodiments of a wet mate designed, manufactured and/or operated according to one or more embodiments of the disclosure;

FIG. 35 illustrates that in one embodiment the first equipment section (e.g., lower completion string) may include sand screens, frac pack screens, expandable screens, oriented screens, base pipe, ICVs, ICDs, AICDs, electric inflow control devices (eICDs), casing, liners, perforated pipe);

FIGS. 36 and 37 illustrate that the use of the wireless devices (e.g., sensors, transceivers, etc.) may be used in certain embodiments of the disclosure;

FIG. 38 illustrates various different configurations for a lower completion string according to the disclosure, including the use of one or more sensors;

FIG. 39 illustrates one embodiment of the gravel pack tools installed;

FIG. 40 illustrates one embodiment of the installation of the black box and its wet mate;

FIG. 41 illustrates the installation of a service string according to one or more embodiments of the disclosure;

FIG. 42 illustrates that once the second equipment section (e.g., service string) is out of the hole, the third equipment section (e.g., the upper completion string, for example with the second retrievable half wet mate connector (e.g., FIG. 33B) and related equipment) may be run-in-hole;

FIG. 43 illustrates a spool of continuous digital fiber with embedded devices, as might be used in accordance with one or more embodiments of the disclosure;

FIG. 44 illustrates a tree that shows the basic black box and how it could be used with fiber optic, electric, a combination of such, etc., according to one or more embodiments of the disclosure;

FIGS. 45 and 46 illustrate how one of the labeled cells receives one or more types of energy signals;

FIG. 47 illustrates how the black box may also transmit signals (data) to the surface for real time operation;

FIG. 48 illustrates how the black box may also provide control signals and/or power to one or more other downhole "things";

FIG. 49 illustrates the different stimulation-type treatments that might be used in accordance with one or more embodiments of the disclosure and the data that the black box can obtain from the stimulation-type treatments;

FIG. 50A illustrates a block diagram of an example of a black box referred to herein as a data recorder that might be used in accordance with the features of FIGS. 44 to 49;

FIG. 50B illustrates a block diagram of the controller of the data recorder of FIG. 50A;

FIG. 50C illustrates a block diagram of a data recording system including a data recorder for monitoring and recording data from a network including downhole sensors;

FIG. 50D illustrates a flow diagram of an example method of obtaining downhole data from a wellbore carried out according to the principles of the disclosure;

FIGS. 51A through 66 provide information on big data, artificial intelligence, machine learning, data science, etc., as might be used in one or more embodiments of the disclosure;

FIG. 67 illustrates a flow diagram of an example of a method of training a stimulation model carried out according to the principles of the disclosure;

FIG. 68 illustrates a flow diagram of an example of a method of training a production model carried out according to the principles of the disclosure;

FIG. 69 illustrates a flow diagram of an example of a method of performing a well operation for a wellbore using a trained model according to the principles of the disclosure; and FIG. 70 illustrates a block diagram of an example of a computing system configured to train well operation models using one or more machine learning algorithms according to the principles of the disclosure.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include an indirect interaction between the elements described.

Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

To broaden the scope of this disclosure, the following phrases will be used:

Energy Transfer Mechanism (ETM)—a device for transferring energy. In some embodiments, the device may comprise a Coupling, a Wet Mate Coupling, an Inductive Coupling, a Capacitance Coupling, a Fluidic Coupling, an Electrical Coupling, a Mechanical Coupling, a wireless coupling, a combination of more than one type of coupling—of those listed above and/or others not listed, other couplings, other devices, etc. In some embodiments, an ETM may comprise a transformer where one type of energy is converted to another type of energy (e.g., an electrical solenoid where electricity is converted into a mechanical energy).

First Equipment Section—in one or more embodiments, the first equipment section comprises a Lower Completion String (which may include a Sand Control String, a Liner, Screens, a Flow Control Device, a Packer, an Anchor, Shoe, a Sensor, a control line (electrical, hydraulic, fiber optic, a combination of one or more, including a tubing encapsulated conductor (TEC) or metal tubing (e.g., bare stainless steel), etc.), one or more ETMs to engage/connect/communicate with another mating one or more ETMs associated with the second equipment section and/or third equipment section and/or other tools or devices, an orientation device to orient a third equipment section (or parts thereof), or other tools or devices, one or more Dry Mates, one or more Wet Mates, a Tool Face or other feature to signify the high side (12 o'clock position) of the first equipment section or of the one or more components of the first equipment section, one or more communication devices to transmit, receive, or both (e.g. transceiver) one or more signals from/to below and/or to/from above the communication device, etc.

Figure 3:
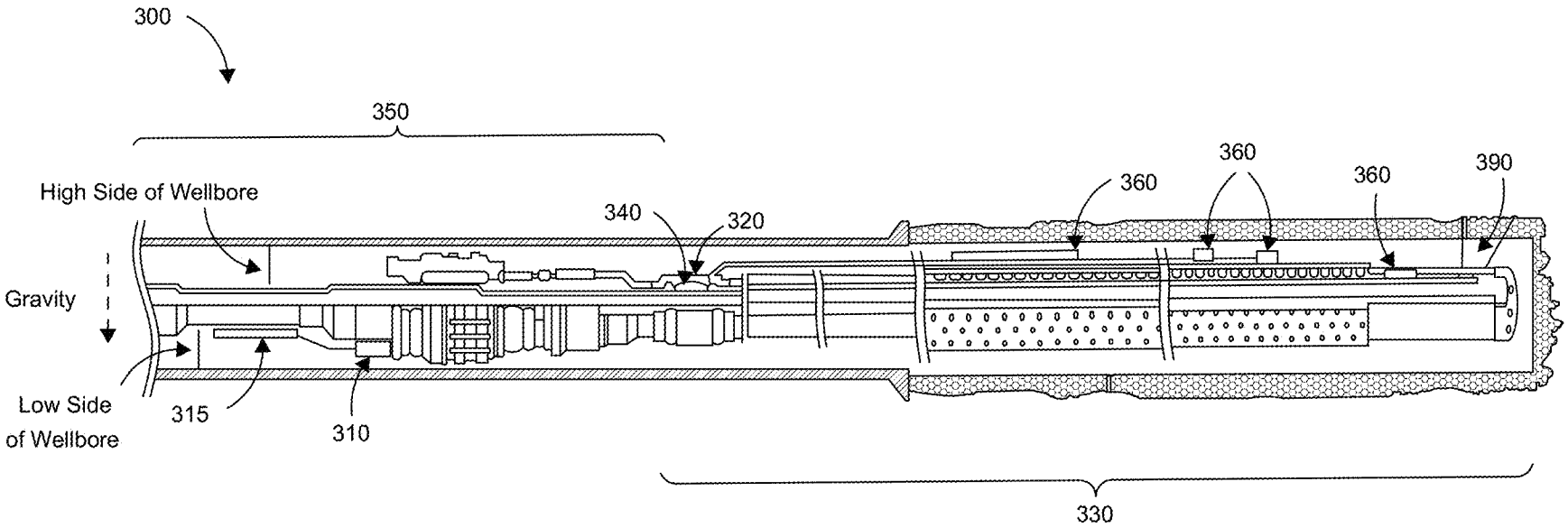
Figure 5:
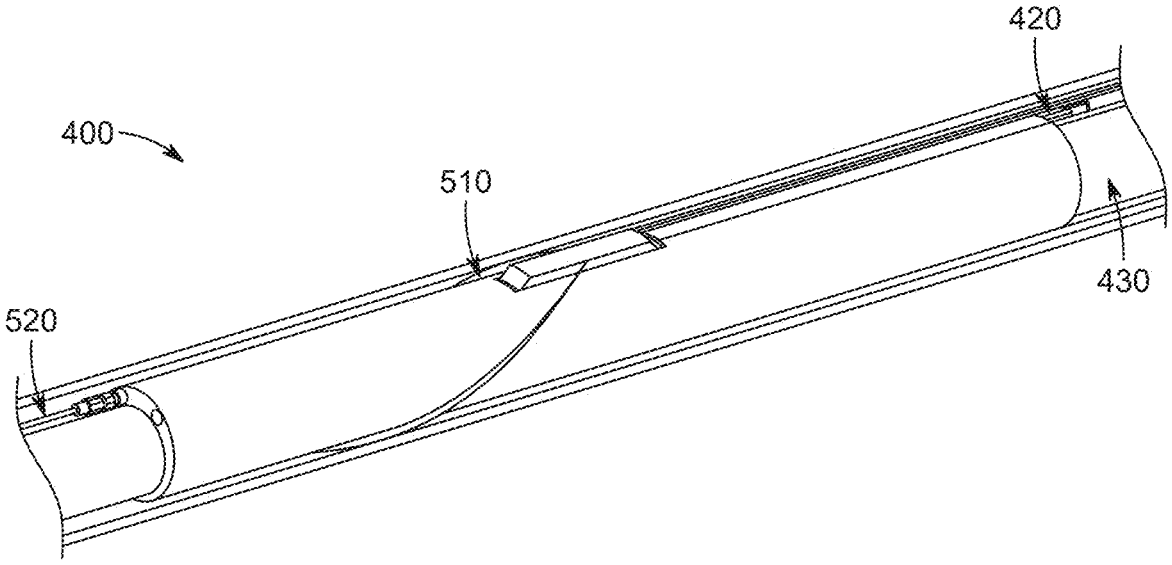

Second Equipment Section—in some embodiments, the second equipment section comprises a Work String (aka Service String, Frac String, Setting String, Stimulation String, etc.). In some embodiments, the second equipment section is used to convey the first equipment section into a wellbore. The second equipment section may have other uses such as, for example, pumping fluid(s) down to the first equipment section for stimulation purposes (and/or other purposes). In this Disclosure, the second equipment section may also comprise an orientation device and/or a communication device:

Orientation Device—the orientation device, shown in FIG. 3 and FIG. 5, will determine the orientation of the device with respect to gravity. The orientation device may comprise a "tool face"—a face, mark, reference point which the angle may be calculated/measured relative to the orientation of the wet mate connection of the first equipment section. By knowing the orientation (angle) of the "tool face" with respect to gravity, the second equipment section (e.g., Work String) can be rotated so a known feature (e.g., wet mate connection of the first equipment section) can be positioned high side (e.g., less than ±45 degrees, less than ±30 degrees, less than ±20 degrees, less than ±10 degrees, less than ±5 degrees, less than ±1 degree) in the wellbore. In at least one embodiment, it is desired that the wet mate connection of the first equipment section be oriented high side. Furthermore, at the surface, before running the tools, it is desired to know the orientation of the second equipment section Orientation Device's tool face relative to the orientation of the first equipment section's wet mate connection. Accordingly, when on bottom, the Work String may be rotated to orient the wet mate connection of the first equipment section to be high side.

Communication Device—the communication device, also shown in FIG. 3 and FIG. 5, will transfer the data to/from the First and/or second equipment section (e.g., Lower Completion String and/or Work String) to the surface. In some embodiments (e.g., when used with the Work String), orientation data (orientation of the "tool face" and/or the first ETM (aka First (Lower) Fiber Optic Coupler/Wet Mate) is used to ensure the first ETM is aligned to the high side of the wellbore to ensure debris will move away from the first ETM via gravity.

Wet Mate—a connection that is capable, but not necessary, of being made up in a wet environment and still maintain a good reliable and sealed connection. A wet mate connection can also be made in a dry environment (e.g., uphole).

Dry Mate—a connection that should be made up in a dry environment (e.g., whether uphole or downhole) and still maintain a good reliable and sealed connection.

Third Equipment Section—in some embodiments, a third equipment section comprises a Completion String (aka Production String, Upper Completion String, Middle Completion String, etc.). In some embodiments, the third equipment section is used to provide a conduit for fluids from the first equipment section to a locale uphole or above the first equipment section (e.g., surface, subsea tree, etc.). The third equipment section may have other uses such as, for example, conveying tools down to the first equipment section, or other sections, for various reasons such as production evaluation, clean out operations, and/or other purposes. In this Disclosure, the third equipment section may also comprise an orientation device and/or a communication device such as those described within or other types of orientation devices and/or communication devices. As one example, the third equipment section may comprise an orientation sensor and/or device to monitor the orientation of the third equipment section (or one or more of its components) while it is being deployed into a well. The third equipment section may comprise one or more ETMs to engage/connect/communicate with another mating one or more ETMs associated with the second equipment section and/or third equipment section and/or other tools or devices, an orientation device to orient a third equipment section (or parts thereof), or other tools or devices, one or more Dry Mates, one or more Wet Mates, a Tool Face or other feature to signify the high side (12 o'clock position) of the third equipment section (or of the one or more components of the First or third equipment sections), one or more communication devices to transmit, receive, or both (e.g. transceiver) one or more signals from/to below and/or to/from above the communication device.

The present disclosure acknowledges that there are certain instances, particularly during production, completion, stimulation and/or fracturing operations, where it may be desirable to employ an energy transfer mechanism (e.g., wet mate connection) in a downhole (e.g., wet environment). The present disclosure, based upon this acknowledgment, has recognized that debris, such as frac sand in one embodiment, may substantially prevent the energy transfer mechanism (e.g., wet mate connection) from achieving a good reliable and sealed connection. With this in mind, the present disclosure has in one embodiment designed an apparatus with the placement of the ETM (e.g., wet mate connection) on a high side of the tubular (e.g., such that ETM is located above 3 o'clock or above 9 o'clock relative to gravity (e.g., gravity being located at 6 o'clock), above 2 o'clock or above 10 o'clock relative to gravity (e.g., gravity being located at 6 o'clock), above 1 o'clock or above 11 o'clock relative to gravity (e.g., gravity being located at 6 o'clock), etc.), which greatly reduces this problem. In one embodiment, the ETM has a first coupling surface configured to couple with an opposing second coupling surface of a second ETM, and further wherein the first coupling surface is located above 3 o'clock or above 9 o'clock relative to gravity (e.g., gravity being located at 6 o'clock), above 2 o'clock or above 10 o'clock relative to gravity (e.g., gravity being located at 6 o'clock), above 1 o'clock or above 11 o'clock relative to gravity (e.g., gravity being located at 6 o'clock), etc. In at least one other embodiment, all portions of the ETM are located above 3 o'clock or above 9 o'clock relative to gravity (e.g., gravity being located at 6 o'clock), above 2 o'clock or above 10 o'clock relative to gravity (e.g., gravity being located at 6 o'clock), above 1 o'clock or above 11 o'clock relative to gravity (e.g., gravity being located at 6 o'clock), etc. The inverse may also hold true, wherein no portion of the ETM is located below 3 o'clock or below 9 o'clock relative to gravity (e.g., gravity being located at 6 o'clock), below 2 o'clock or below 10 o'clock relative to gravity (e.g., gravity being located at 6 o'clock), below 1 o'clock or below 11 o'clock relative to gravity (e.g., gravity being located at 6 o'clock), etc.

In accordance with at least one embodiment, an orientation tool as discussed in detail below could be coupled to a slotted orientation apparatus, the orientation tool configured to orient the energy transfer mechanism (e.g., wet mate connection) and the slot of the slotted orientation apparatus within the wellbore (e.g., on the high side of the tubular). In yet another embodiment the orientation tool is a measurement while drilling (MWD) tool that uses pressure pulses to orient the energy transfer mechanism (e.g., wet mate connection) and slot of the slotted orientation apparatus within the wellbore.

One or more projects intend to implement an energy transfer mechanism (e.g., a downhole fiber optic wet mate connection) to monitor downhole sensors. The coupling of energy transfer mechanisms (e.g., wet mate connections) in a downhole environment is a risky process. The process can be made worse if the energy transfer mechanisms (e.g., wet mate connections) are oriented on the low side of the wellbore, where debris, sediments, proppant, etc. may settle and impede the coupling of the wet mate connection. The solution is to orient the energy transfer mechanisms (e.g., wet mate connections) to the high side of the wellbore (e.g., depending on the design such that no portion of the energy transfer mechanism (e.g., wet mate connection) is located below 3 o'clock or below 9 o'clock relative to gravity, below 2 o'clock or below 10 o'clock relative to gravity, below 1 o'clock or below 11 o'clock relative to gravity, etc.) so that debris, sediments, proppant, etc. will settle on the low side of the wellbore away from the Couplers. This will prevent debris from interfering with the coupling and de-coupling of the energy transfer mechanism (e.g., wet mate connection).

One tool that determines the orientation of the tool and communicates the orientation information to the surface is Halliburton's Workstring Orientation Tool (WOT). The WOT incorporates Mud Pulse Telemetry technology to relay the "tool face" information to the surface. This information allows the drillers to rotate the Work String until the proper "tool face" orientation is achieved. In most embodiments, the "tool face" of the WOT (or similar orientation device) is measured relative to the orientation of the first ETM (aka First (Lower) Fiber Optic Coupler/Wet Mate) that is affixed to the first equipment section (Lower Completion String). This allows the Driller (and others) on the rig floor to know the orientation of the first ETM so it can be oriented high side. High side is typically defined as 180-degrees from low side—the direction of the earth's gravitational vector. High side can be defined by an orientation range such as +/−90-degrees from high side, +/−60-degrees from high side, +/−45-degrees from high side, +/−30-degrees from high side, +/−20-degrees from high side, +/−15-degrees from high side, +/−10-degrees from high side, whether symmetrical or non-symmetrical, etc.

Figure 1A:
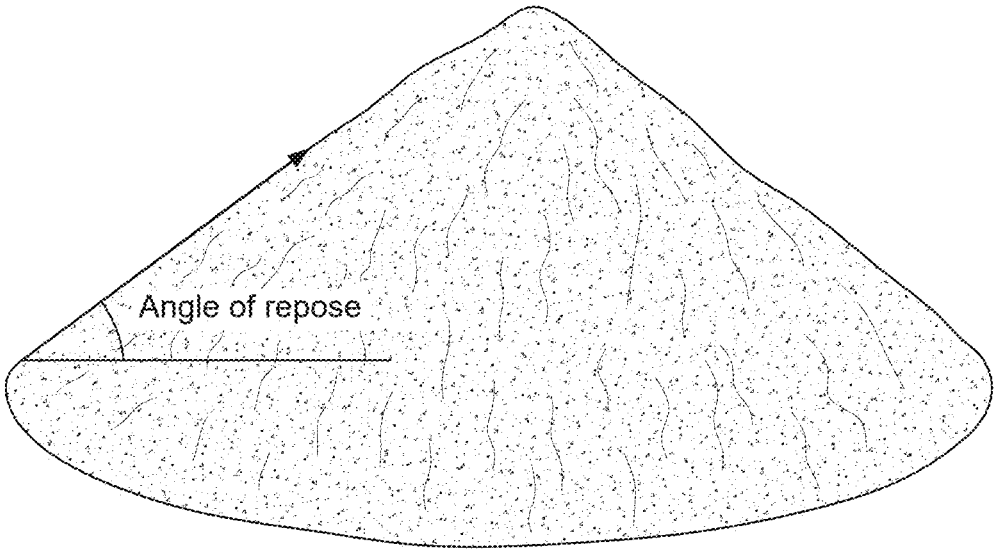

In some embodiments, the high side (or high side range) can be related to the angle of repose as shown in FIG. 1A. The angle of repose angle is the angle where a material on the slope face is on the verge of sliding. By keeping the orientation of the first ETM greater than the angle of repose of the debris in the well, one can be confident the debris will slide off the sides (features) of the ETM coupling, or even slide out of features of other devices associated with the well (e.g., components previously installed and/or to be installed later) and/or associated with well operations (e.g., stimulation tools, clean out tools, etc.) in certain embodiments, thus not interfering with the coupling/de-coupling/engagement/alignment of the ETM(s).

Turning to FIG. 1B, illustrated are the angle of repose of some materials that may be classified as debris in a well.

Figure 2:
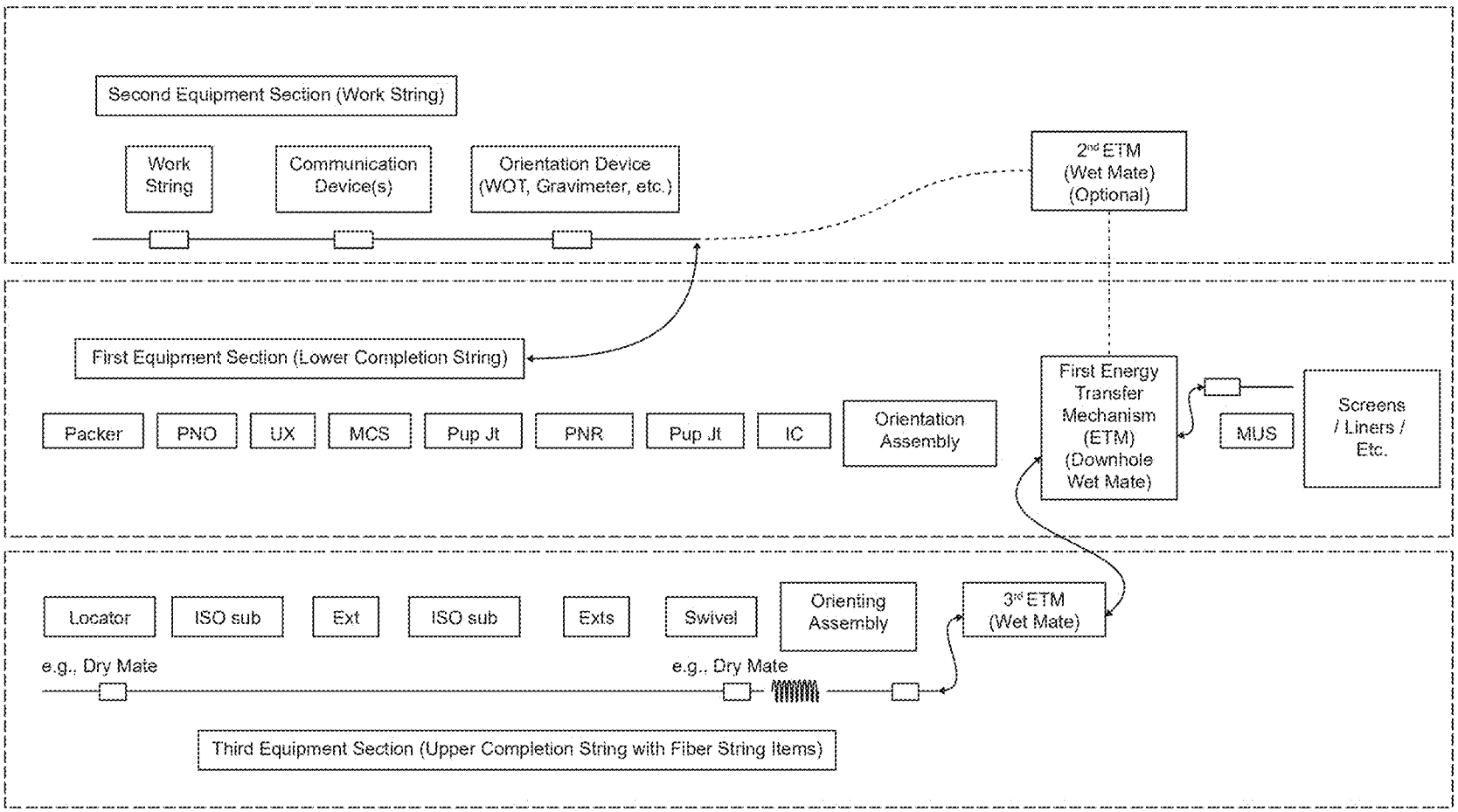

Turning to FIG. 2, illustrated is one embodiment of the disclosure. In at least one embodiment, provided is an apparatus that is usable with a well, and includes a first equipment section that includes an oriented first ETM and a second equipment section. The second equipment section may be adapted to be run downhole into the well releasably attached to the first equipment section. A mechanism (Orientation Device) of the apparatus indicates when the oriented first ETM is substantially oriented opposite to the Earth's gravitational field by at least 90, 60, 45, 30, 20, 15, 10 degrees. In at least one other embodiment, the apparatus comprises a mechanism to relay information from the apparatus to the surface (or other remote location) (reference Communication Devices(s) in FIG. 2. The information comprises at least the orientation of the oriented first ETM or similarly oriented mechanism/component (e.g., WOT's gravimeter or another similar device).

In at least one other embodiment, the apparatus comprises a second ETM, for example coupled to the first ETM. In this embodiment, the second ETM could be coupled with the first ETM when the first and second sections are coupled together, and for example being run-in-hole. Thus, the first ETM and the second ETM could be substantially oriented opposite to the Earth's gravitational field by at least 90, 60, 45, 30, 20, 15, 10 degrees, as discussed above.

In at least one other embodiment, the apparatus may a first equipment section that includes an oriented first ETM and a third equipment section that includes a third ETM. The third equipment section may be adapted to be run downhole into the well after the first equipment section is positioned and oriented downhole, and in one embodiment after the second equipment section and the second ETM has disconnected from the first ETM. A mechanism of the apparatus may urge the third ETM into the same orientation as the oriented first ETM. The oriented first ETM may be substantially oriented opposite to the Earth's gravitational field, as discussed above.

In at least one embodiment, the apparatus includes a mechanism to encourage the rotational alignment of the third ETM with the oriented first ETM. For example, the apparatus may include a mechanism to encourage the axial alignment of the third ETM with the oriented first ETM, or include a mechanism to encourage the releasably locking of the third ETM with the oriented first ETM. In at least one other embodiment, the apparatus may include a mechanism to encourage the gradual engagement (shock/spring device) of the third ETM with the oriented first ETM, or may include a mechanism to exclude debris, wipe mating components before engagement, inject a fluid for cleansing mating components prior to engagement, sliding sleeves (or similar components) to protect one or more surfaces/seals/components. In at least one other embodiment, the apparatus may run fiber to electric submersible pump (ESP) applications.

The ability to detect one or more parameters related to a tool (e.g., orientation of a feature of the tool, temperature, etc.) and/or the operation (pumping fluid, etc.) being performed, then to relay information such as the orientation of a tool to a remote location (e.g., surface) and then adjust a feature of the tool (e.g., orientation) under harsh conditions (dirty environment (solids, contaminated fluids such as drilling muds, or completion fluid), extreme pressures (e.g., >20,000-psi differential), extreme temperatures (e.g., <−20 F to >300 F), makes this disclosure suitable for use in harsh environments such as outer space (e.g., satellites, spacecrafts, etc.), aeronautics (aircrafts), on-ground (swamps, marshes, etc.), below ground (mines, caves, etc.), ocean (on surface and subsea), subterranean (mineral extraction, storage wells (Carbon sequestration, Carbon capture and storage (CCS), etc.), and other energy recovery activities (geothermal, steam, etc.).

Certain commercial competitive advantages of the present disclosure include: 1) reliably connect Fiber Optic Couplers (and/or other Wet Mates) without the risk of debris, sediment, proppant, etc. interfering with the process; 2) providing customers with an assurance of a risk-free gravel-pack completion system; 3) outperforming the competition; 4) application to various deep water projects (e.g., Guyana projects); 5) applications in the Carbon Capture, Utilization and Storage (CCUS) markets.

One proposed solution is an apparatus 300, for example using an orientation device 310 to orient a first ETM 320 to the high side of the wellbore 390, as shown in FIG. 3. The first ETM 320, as illustrated in FIG. 3, may be installed on the first equipment section 330 (e.g., Lower Completion, Sand Control String, etc.) and oriented to the high side of the wellbore 390, as shown. This provides the advantage that debris will fall away from the first ETM 320 during subsequent operations (e.g., frac packing, gravel packing, production, etc.). Likewise, the debris will not interfere with the coupling/de-coupling of the first ETM 320, for example the decoupling of the first ETM with a second ETM, or the subsequent coupling of the first ETM 320 with a third ETM.

In some embodiments, a second ETM 340 that forms a portion of a second equipment section 350 may be coupled to the first ETM 320 while the first equipment section 330 (e.g., Lower Completion, Sand Control String, etc.) is being lowered into the well (see FIG. 3) and while performing other operations (such as frac packing) downhole. As shown in FIG. 3, the orientation of the first ETM 320 is known relative to the orientation of the orientation device 310 (e.g., WOT's Tool Face) prior to running the equipment in the well. The orientation device 360 may transmit its orientation (and/or the orientation of the first ETM 320) to the surface via one or more communication devices. The transmission may occur continuously while running the equipment in the well, intermittently, or only when the equipment is near the bottom of the well or at the desired setting depth.

In at least one embodiment, the orientation device 310 may be two or more devices, for example; 1) a sensor device to sense the orientation; and 2) a communication device 315 to transmit information (e.g., to/from the orientation sensor(s) and/or other sensors/devices). The communication device 315 may comprise one or more components and/or devices to communicate information to/from the surface or other locale.

If it is desirable to monitor the orientation continuously while running the equipment in the wellbore 390, wired pipe or other technology of continuously sending signals to the surface may be employed. If the orientation needs to be known less frequently, other communication devices/protocols may be considered. For example, mud pulse telemetry, acoustic signals, a combination of both may be employed. One or more other methods/systems may be used to transfer "energy" signals from the orientation device 310, the communication device 315, the first ETM 320, the second ETM 340 and/or other devices. It is noted that other signals (power signals, communication signals, sensor readings, data, etc.) may also be transmitted via one or more oriented ETMs 320, 340, etc. Furthermore, one or more sensors 360 may be associated with and/or coupled with the first equipment section, such that the first ETM 320 may be used to assist in transmitting information obtained with the one or more sensors 360 uphole.

Figure 4:
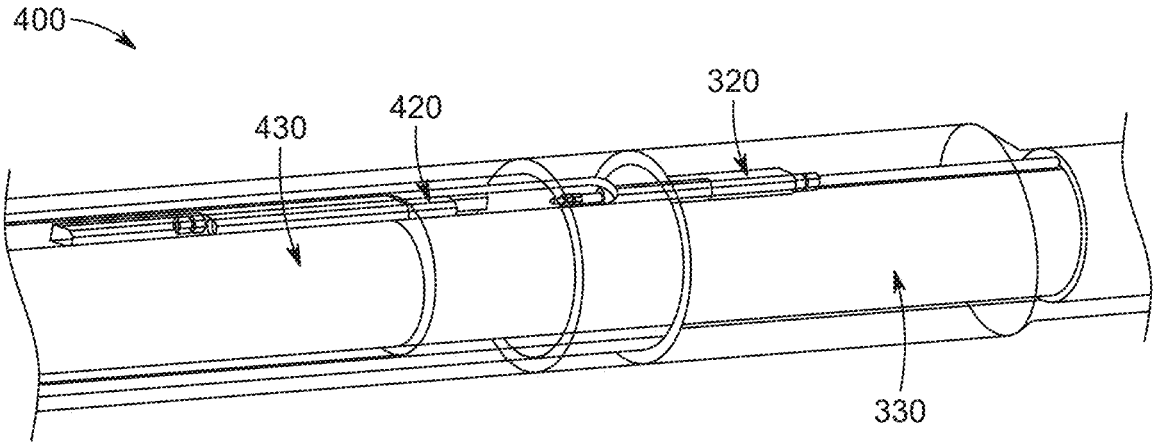

In other embodiments, a third ETM 420 may be coupled to the first ETM 320, as shown in FIG. 4. In some of these embodiments, the third ETM 420 may be run with a third equipment section 430, as shown in FIG. 4. The third ETM 420 may engage with the first ETM 320 before/during/after the third equipment section 430 engages with the first equipment section 330.

Figure 6:
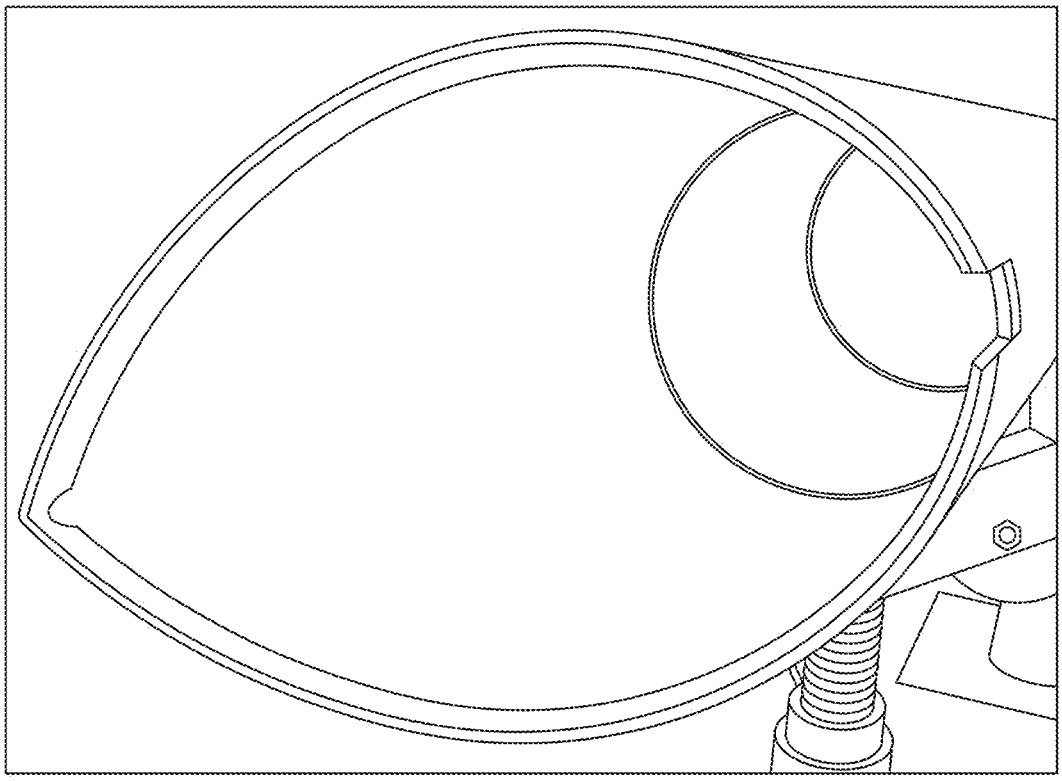
Figure 7:
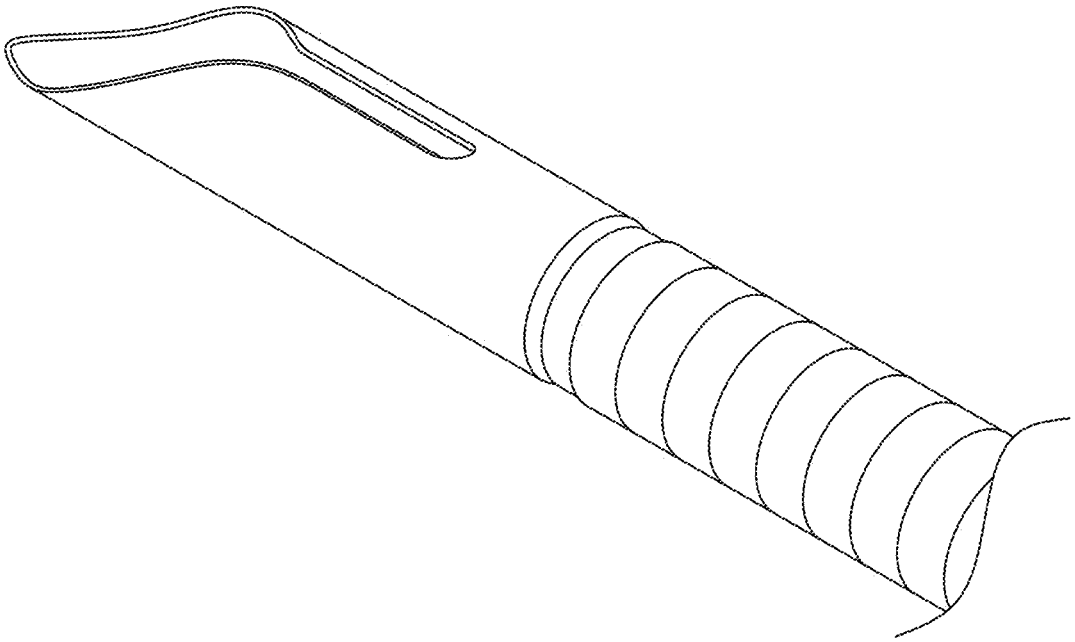
Figure 8:
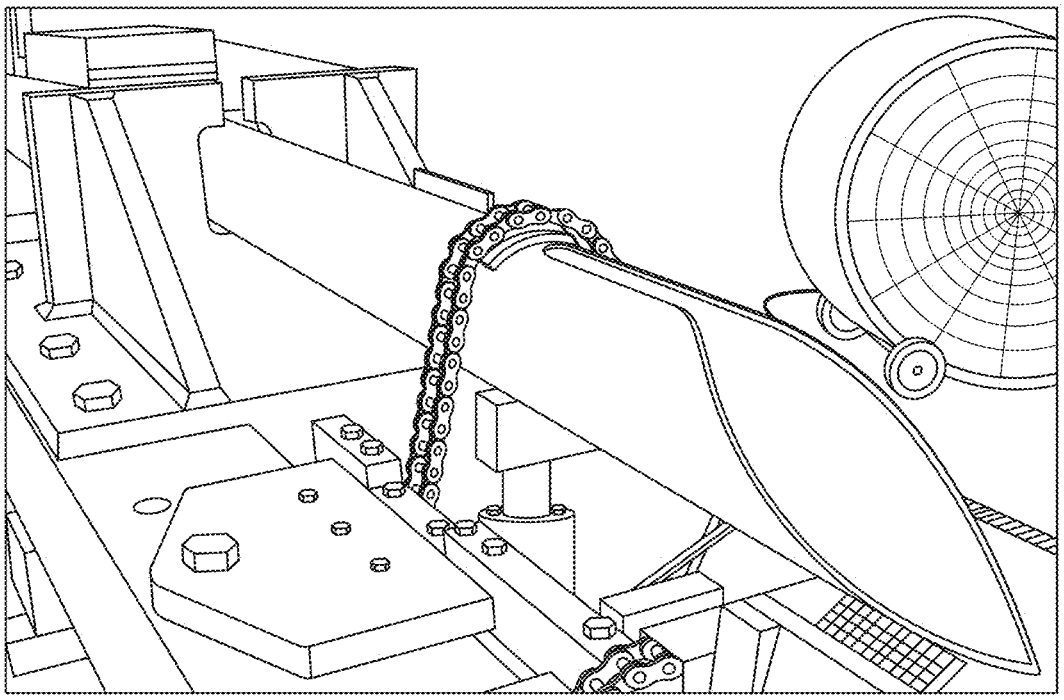
Figure 9:
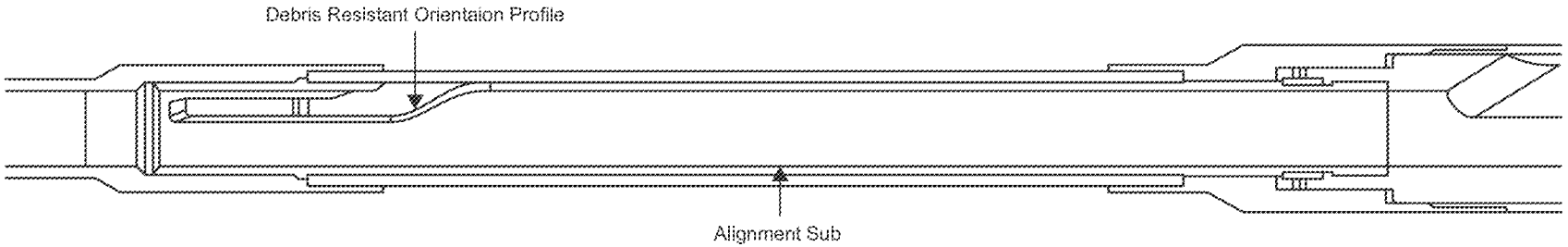

In certain embodiments, the first ETM 320 is held in a high side orientation due to the weight of the first equipment section 330, anchors, packers, materials placed between the exterior surface of the first equipment section 330 and the wellbore (or partial sections thereof) (e.g., proppant, cement, frac pack), etc. In some embodiments, the first equipment section 330 has one or more devices 510 to urge the third ETM 420 into a same orientation as the first ETM 320, as shown in FIG. 5. In the illustrated embodiment of FIG. 5, the third equipment section 430 includes the third ETM 420, the one or more device 510, as well as a communications device 520 (e.g., control line, whether a fiber optic line, an electric line, a hydraulic line, a combination thereof, etc.). Some such devices may be described as a scoop assembly (e.g., FIG. 6), a muleshoe assembly (FIGS. 7 and 8), and orientation slot assembly (FIG. 9), a bishop's hat, a helix, etc.

Figure 10:
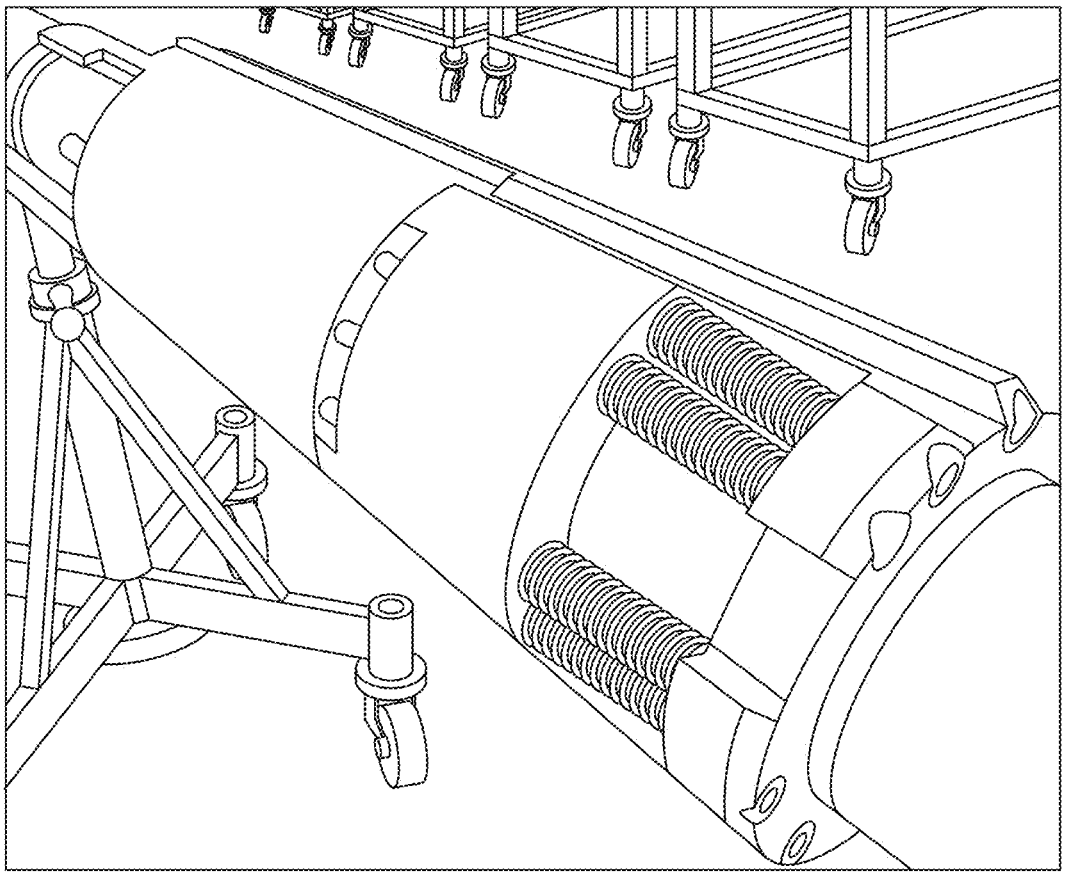
Figure 11:
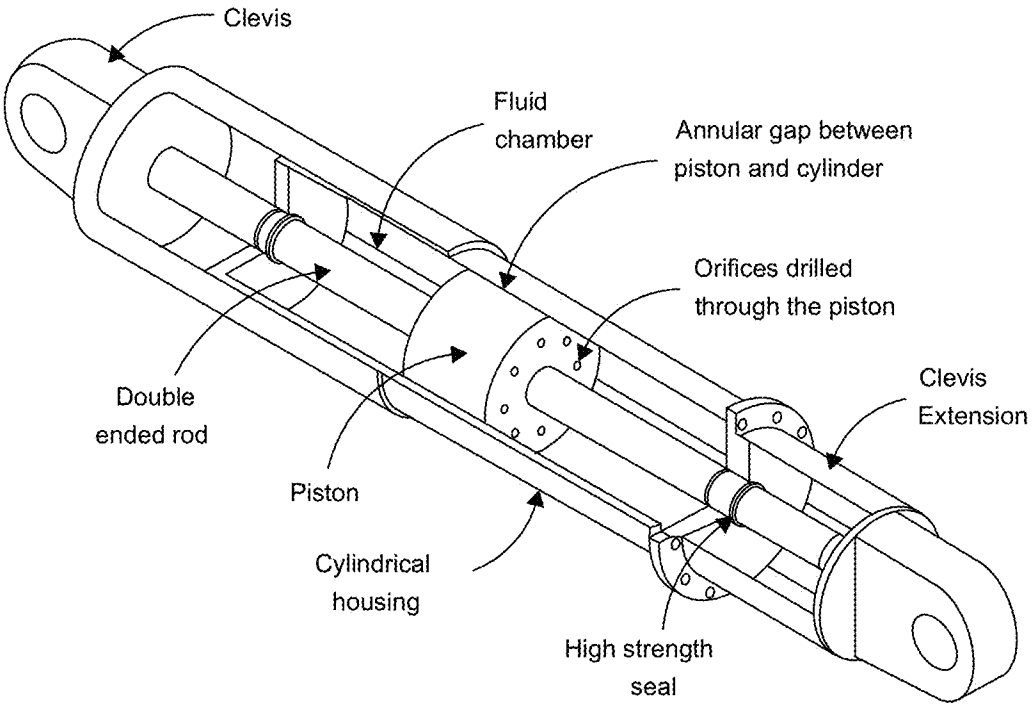

In some embodiments, the first equipment section may have one or more devices to releasably anchor, fixedly anchor, and/or position the second ETM or the third ETM to the first ETM. In some embodiments, the first equipment section, the second equipment section, and/or the third equipment section may comprise one or more devices. In some embodiments, the first equipment section may have one or more devices to cushion or dampen landing and/or engagement of the second ETM and/or the third ETM to the first ETM. Two such examples are shown in FIGS. 10 and 11. Likewise, the second equipment section and/or the third equipment section may have one or more devices to cushion or dampen or improve the engagement, coupling, uncoupling, etc. events.

In some alternate embodiments, a second ETM is installed on the second equipment section and a communication apparatus 315 is employed, as shown in FIG. 3. Accordingly, signals may be transmitted to the surface (and back from surface) while tripping in hole, while orienting, while setting packers, while gravel packing, during the stimulation process, etc. In FIG. 3, the second ETM 340 is coupled to the first ETM 320 while the first equipment section (e.g., lower completion, sand control string, etc.) is being run-in-hole, as well as while other operations (such as frac packing) are being conducted.

Figure 12:
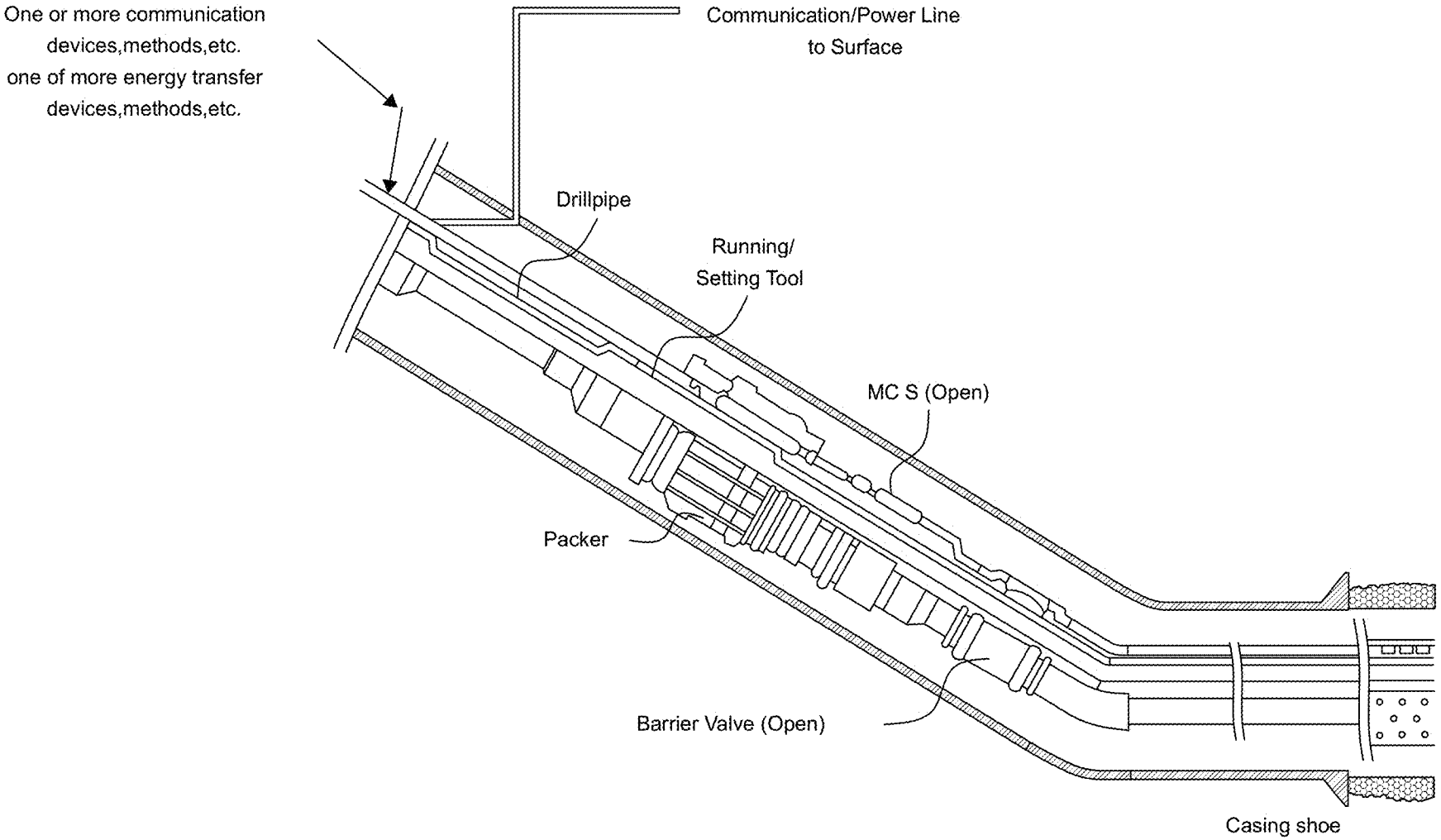

Turning to FIG. 12, illustrated is an embodiment wherein one or more communication devices, methods, etc. and/or ETM devices, methods, etc. for transferring energy (data, signals, power, and/or other things) to or from other locations (e.g., including, but not limited, to the surface, etc.) are shown. In some embodiments, the communication device may be a fiber optic line, a fiber optic line protected in a control line, a fiber optic line attached to a tubular string (drill pipe, tubing string, work string, etc.), etc. In some embodiments, the communication device may be an electrical line. In some embodiments, the communication device may be a combination of energy conduits. Other embodiments may include sound, optics, pressure pulses, other energies or combination thereof, etc. Accordingly, unless otherwise stated, the present disclosure should not be limited to any specific energies.

Figure 13:
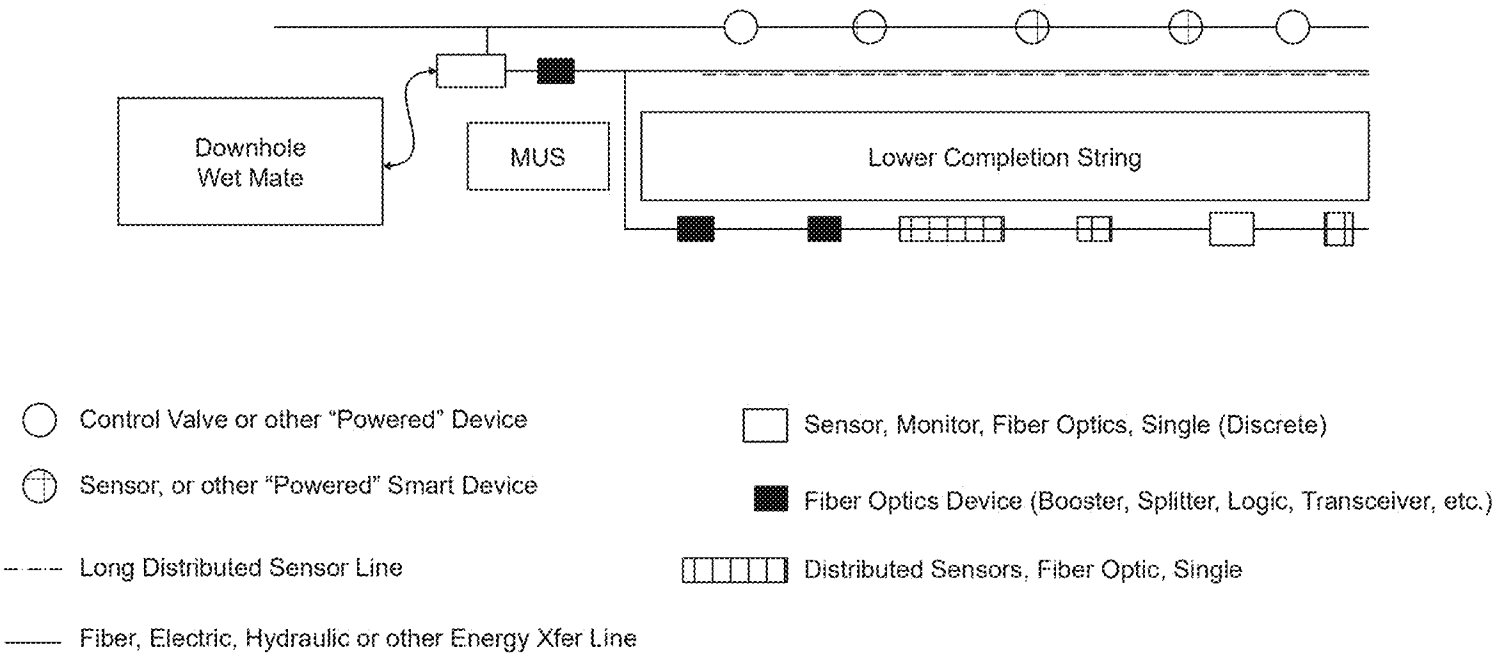
Figure 14:
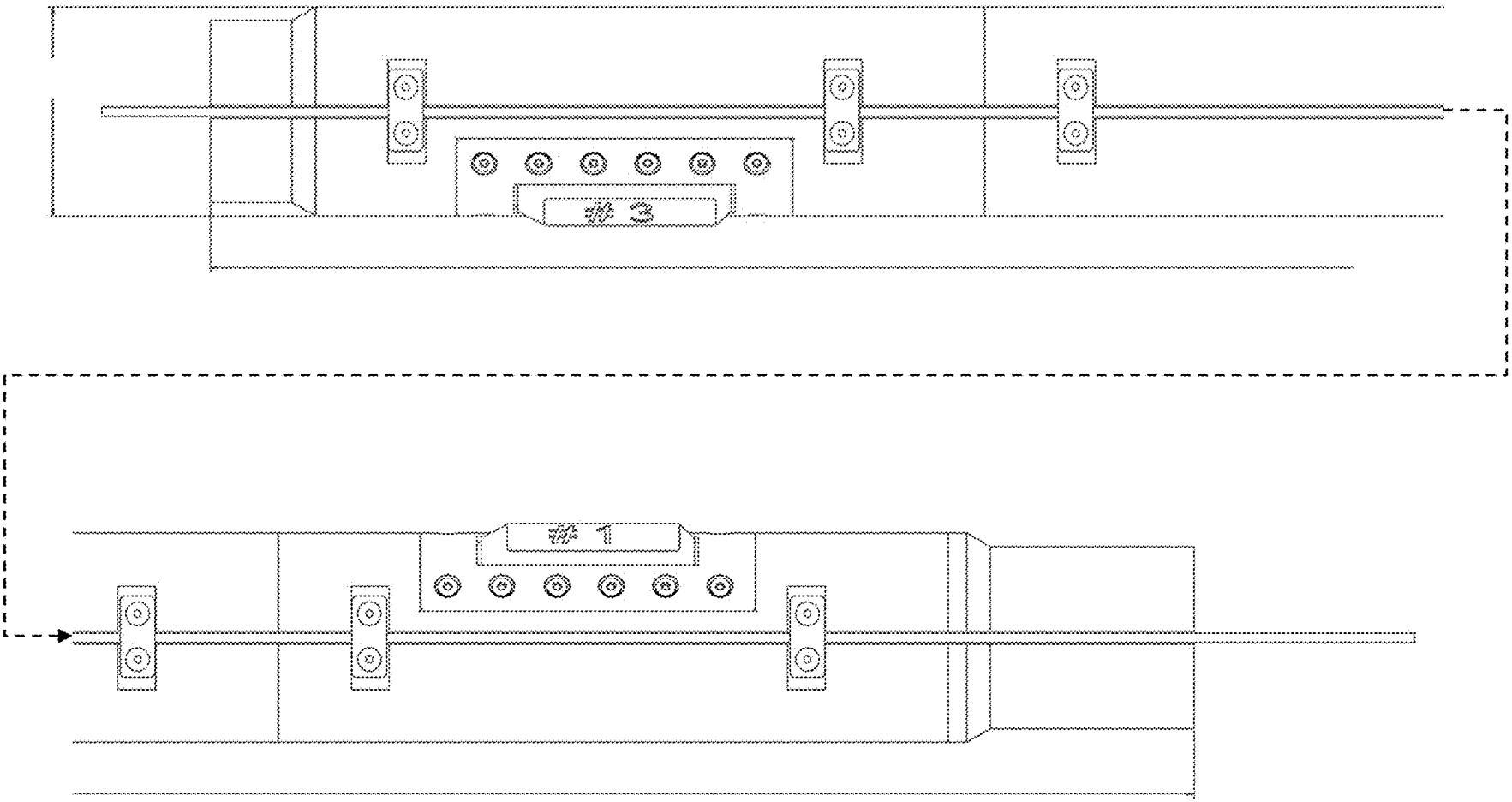
Figure 15:
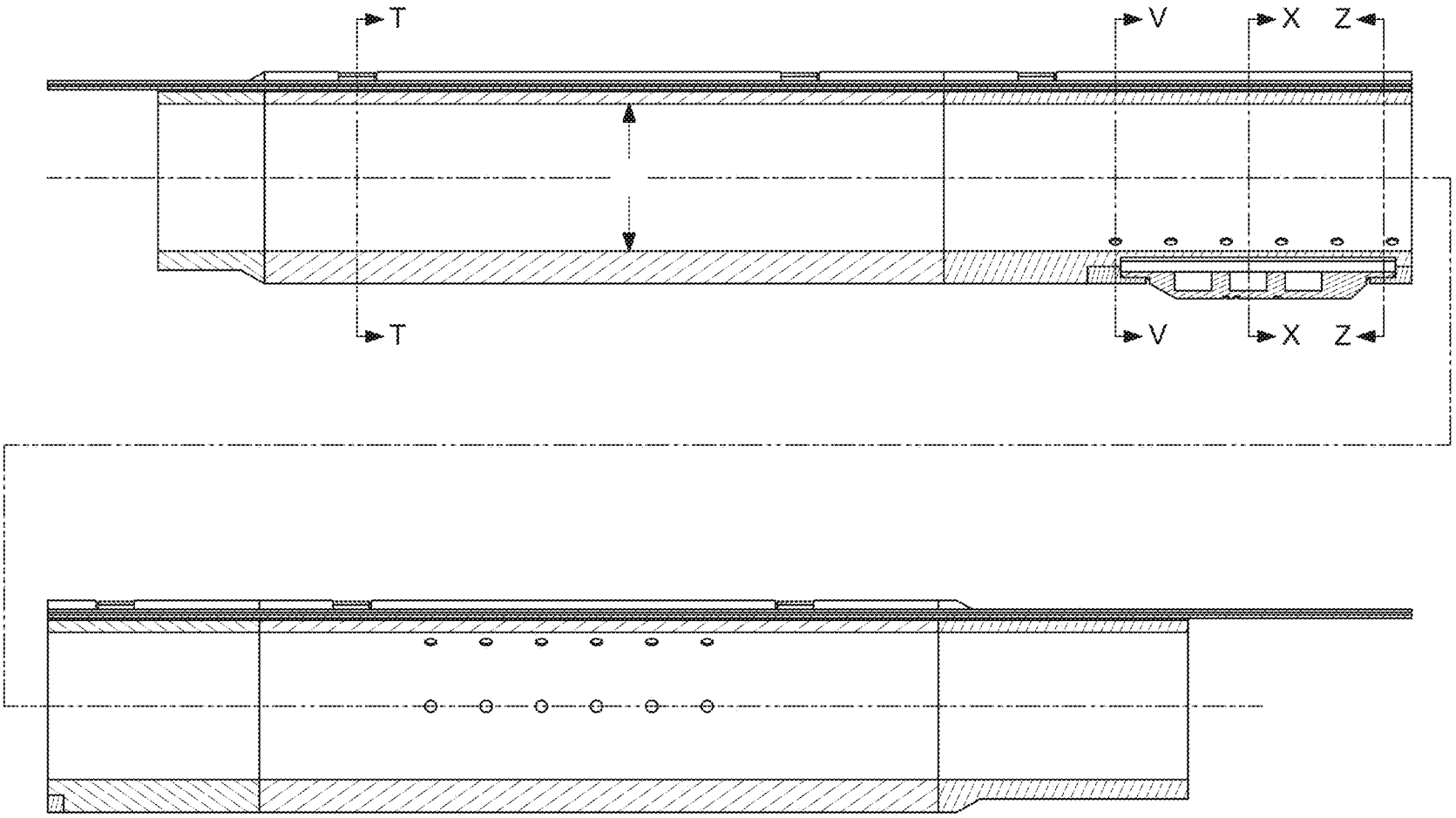
Figure 21:
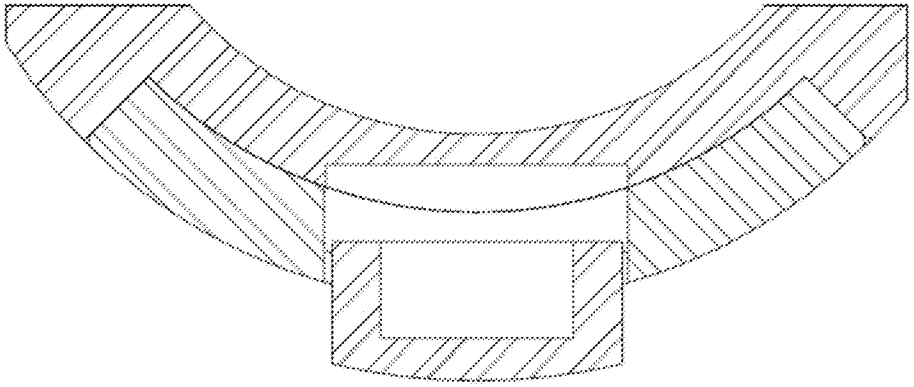
Figure 20:
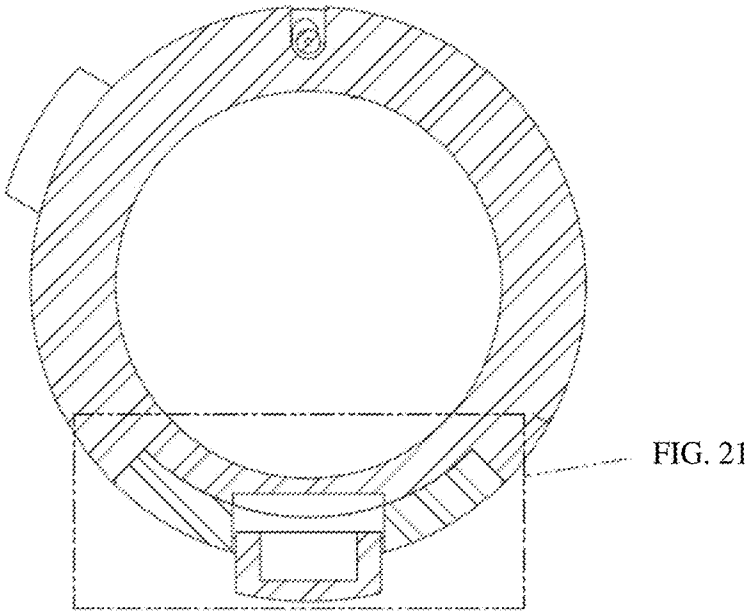
Figure 23:
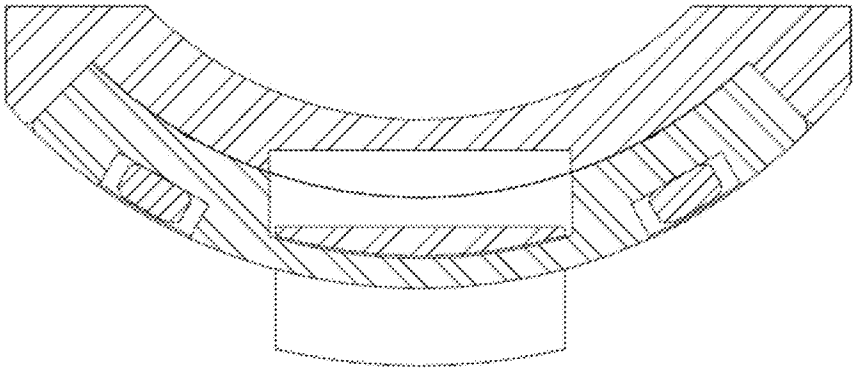
Figure 22:
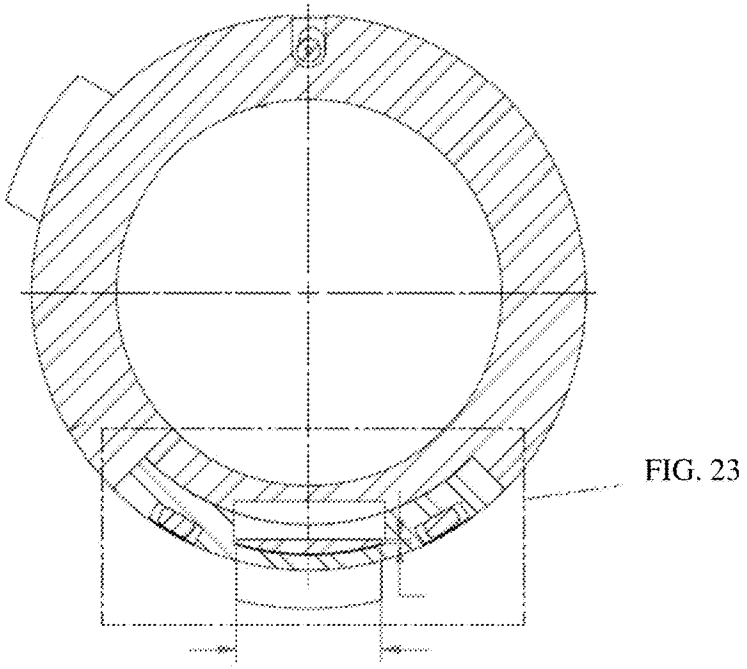

In some alternate embodiments, the first equipment section (e.g., lower completion string) (e.g., examples are shown in FIGS. 3 and 13) may include sand screens, frac pack screens, expandable screens, oriented screens, a base pipe, inflow control valves (e.g., ICVs), inflow control devices (e.g., ICDs), autonomous inflow control devices (e.g., AICDs), electric inflow control devices (eICDs), casing, liner, perforated pipe, etc.). As shown in FIG. 13, the first ETM may be a downhole wet mate that is connected to a control line that includes (e.g., consisting of one or more of the energy transfer lines) a fiber optic cable, an electric line, a hydraulic line and/or another type of energy transfer line.

In some alternate embodiments, the First Energy Transfer Mechanism may be comprised of more than one type of Energy Transfer Mechanism. As an example, the First Energy Transfer Mechanism may comprise a Fiber Optic Wet Mate and an Electrical Wet Mate. The Wet Mates may be aligned serially, parallel or any other configuration that allows both to be connected to other Wet Mates.

In some alternate embodiments, the first equipment section (e.g., lower completion string) and/or the second equipment section (e.g., work string) and/or third equipment section (e.g., upper completion string) may include one or more other apparatuses to enhance or improve the performance and/or reliability of the overall disclosure. For example, sensors, valves, pumps, analyzers, controllers, logic devices, computing devices, memory devices, AI devices, TinyML devices, etc. may be employed. Certain real time operations may occur and/or be performed. For example, in at least one embodiment, a second ETM (e.g., Fiber Optic or other Wet Mate) is installed on the second equipment section (e.g., Work String) and a communication apparatus (e.g., wired pipe, HalSonics, etc.) is employed, as shown in FIGS. 3 and 12. In at least one embodiment, such may be integrated into a digital reservoir management system (e.g., such as Halliburton's Clarity® digital reservoir management system), and thus interconnected to share data seamlessly and deliver real-time solutions from ideation through the reservoir management.

The operators on surface would be able to monitor what is happening downhole in real time.

Some of these embodiments may require fiber optic, electrical, and/or other types of conduits (cables) to pass the signals (and power) to/from the surface. Other means of communication to and from the surface may also be employed such as pressure pulses, acoustic waves, etc.

Turning to FIGS. 14 through 23, illustrated are various different views of a multilateral orientation tool that includes a novel control line design.

The present disclosure acknowledges that there are certain instances, particularly during stimulation and/or fracturing operations, where it may be desirable to employ a slotted orientation apparatus (e.g., also known in the art as a slotted muleshoe) to position a downhole tool within a wellbore. The present disclosure, based upon this acknowledgment, has recognized that debris, such as frac sand in one embodiment, may collect within the slot in the slotted orientation apparatus and present problems with a key of an associated keyed running tool sliding within the slot. With this in mind, the present disclosure has in one embodiment designed a slotted orientation apparatus with the placement of the slot on a high side of the tubular (e.g., such that no portion of the slot is located below 3 o'clock or below 9 o'clock relative to gravity), which greatly reduces this problem. In yet another embodiment, the slot may be replaced with a feature that would traditionally engage with the slot (e.g., a peg), and the slot would be on the second or third equipment section. For example, such an embodiment could employ a slot that radially extends around the tubular 180 degrees or less, and in one embodiment a slot that has its radial center point positioned at 12 o'clock relative to gravity. In accordance with at least one embodiment, an orientation tool could be coupled to the slotted orientation apparatus, the orientation tool configured to orient the slot of the slotted orientation apparatus within the wellbore (e.g., on the high side of the tubular). In yet another embodiment the orientation tool is a measurement while drilling (MWD) tool that uses pressure pulses to orient the slot of the slotted orientation apparatus within the wellbore.

The present disclosure has additionally acknowledged that it can, at times, be difficult to align the keys of the keyed running tool with the slot in the slotted orientation apparatus. The present disclosure has recognized that such can especially be the case when the slot in the slotted orientation apparatus does not extend entirely around the tubular, such as is the case with the aforementioned slotted orientation apparatus with the placement of the slot on the high side of the tubular. With this acknowledgment in mind, the present disclosure designed a keyed running tool having two or more keys movable between a radially retracted state and a radially extended state, wherein adjacent ones of the two or more keys are laterally offset from each other and radially offset from each other by Y degrees, wherein Y is 180 degrees or less. Given this design, ideally at least one of the two keys would engage with the slot when the keyed running tool is being deployed downhole.

Figure 24:
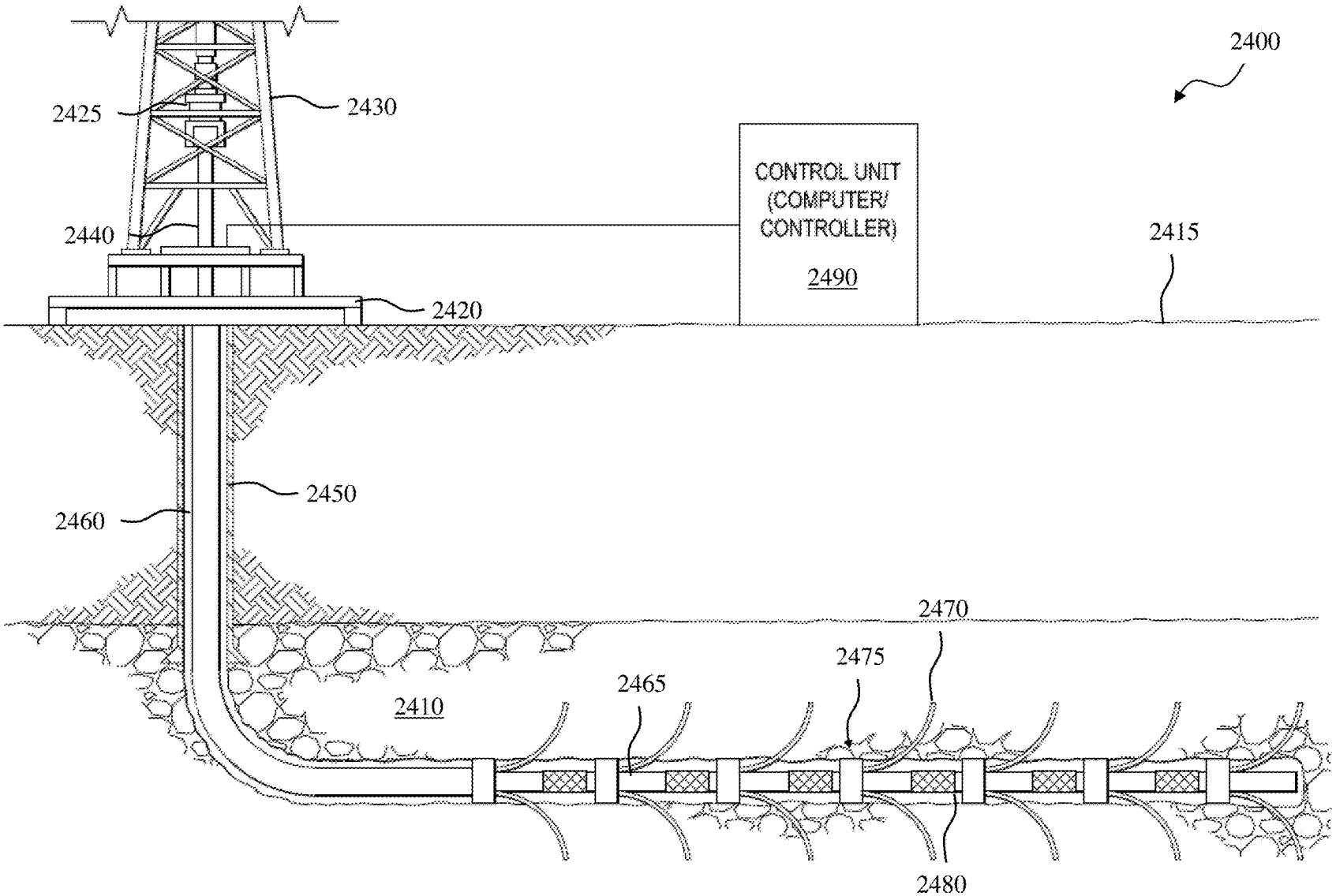
FIG. 24 illustrates a well system designed, manufactured, and operated according to one or more embodiments of the disclosure.

FIG. 24 illustrates a well system 2400 designed, manufactured, and operated according to one or more embodiments of the disclosure. The well system 2400 includes a platform 2420 positioned over a subterranean formation 2410 located below the earth's surface 2415. The platform 2420, in at least one embodiment, has a hoisting apparatus 2425 and a derrick 2430 for raising and lowering a downhole conveyance 2440, such as a drill string, casing string, tubing string, coiled tubing, a running tool, etc. Although a land-based oil and gas platform 2420 is illustrated in FIG. 24, the scope of this disclosure is not thereby limited, and thus could potentially apply to offshore applications. The teachings of this disclosure may also be applied to other land-based multilateral wells different from that illustrated.

The well system 2400, in one or more embodiments, further includes a main wellbore 2450. The main wellbore 2450, in the illustrated embodiment, includes tubing 2460, 2465, which may have differing tubular diameters. Extending from the main wellbore 2450, in one or more embodiments, may be one or more lateral wellbores 2470. Furthermore, a plurality of multilateral junctions 2475 may be positioned at junctions between the main wellbore 2450 and the lateral wellbores 2470. The multilateral junctions 2475 may be designed, manufactured and operated according to one or more embodiments of the disclosure. In accordance with at least one embodiment, the multilateral junction 2475 may include a slotted orientation apparatus and/or keyed running tool according to any of the embodiments, aspects, applications, variations, designs, etc. disclosed in the following paragraphs.

The well system 2400 may additionally include one or more ICVs 2480 positioned at various locations within the main wellbore 2450 and/or one or more of the lateral wellbores 2470. The well system 2400 may additionally include a control unit 2490. The control unit 2490, in this embodiment, is operable to provide control to, or receive signals from, one or more downhole devices.

Figure 25:
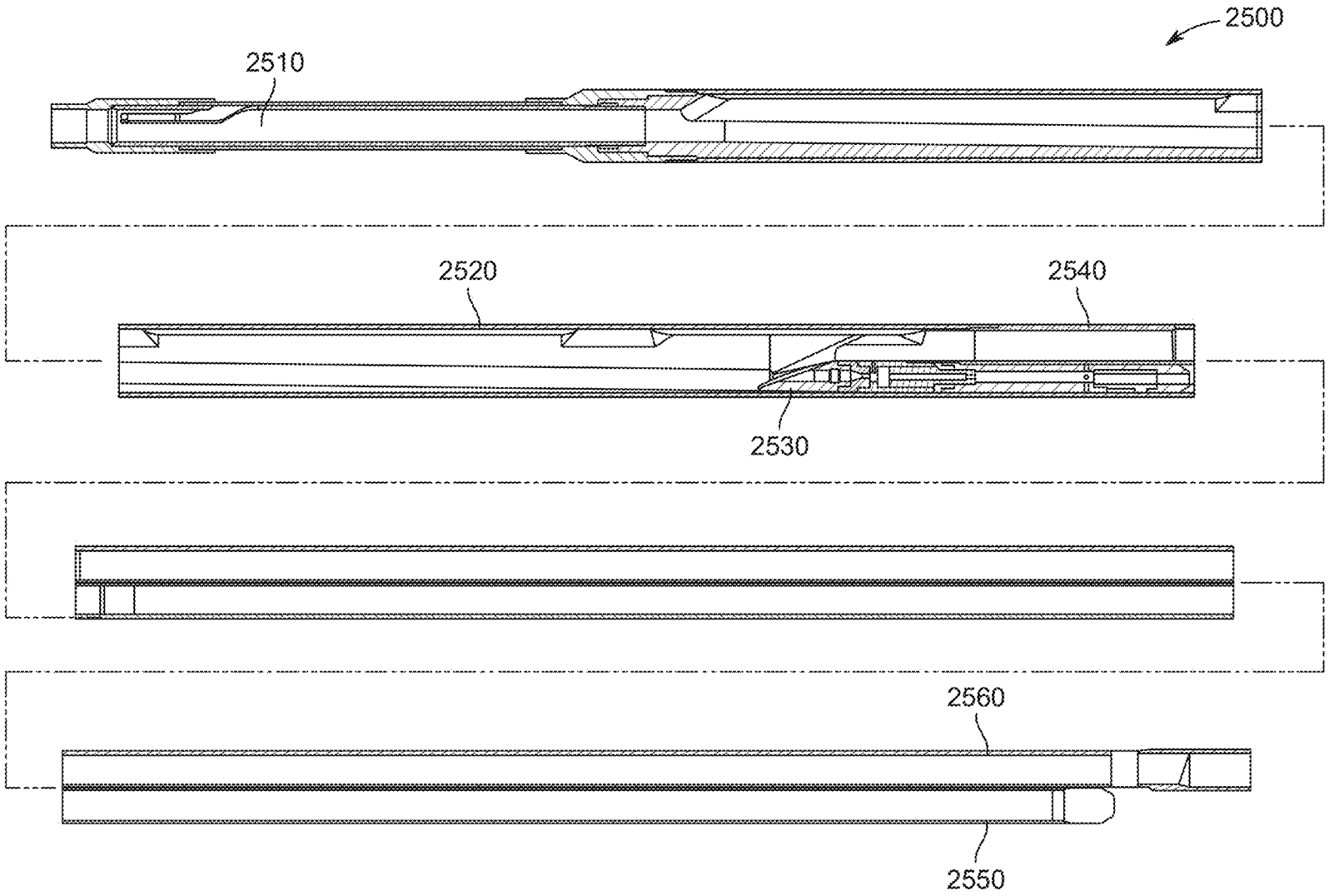
FIG. 25 illustrates one embodiment of a multilateral junction designed, manufactured and/or operated according to one or more embodiments of the disclosure.
Figure 25:
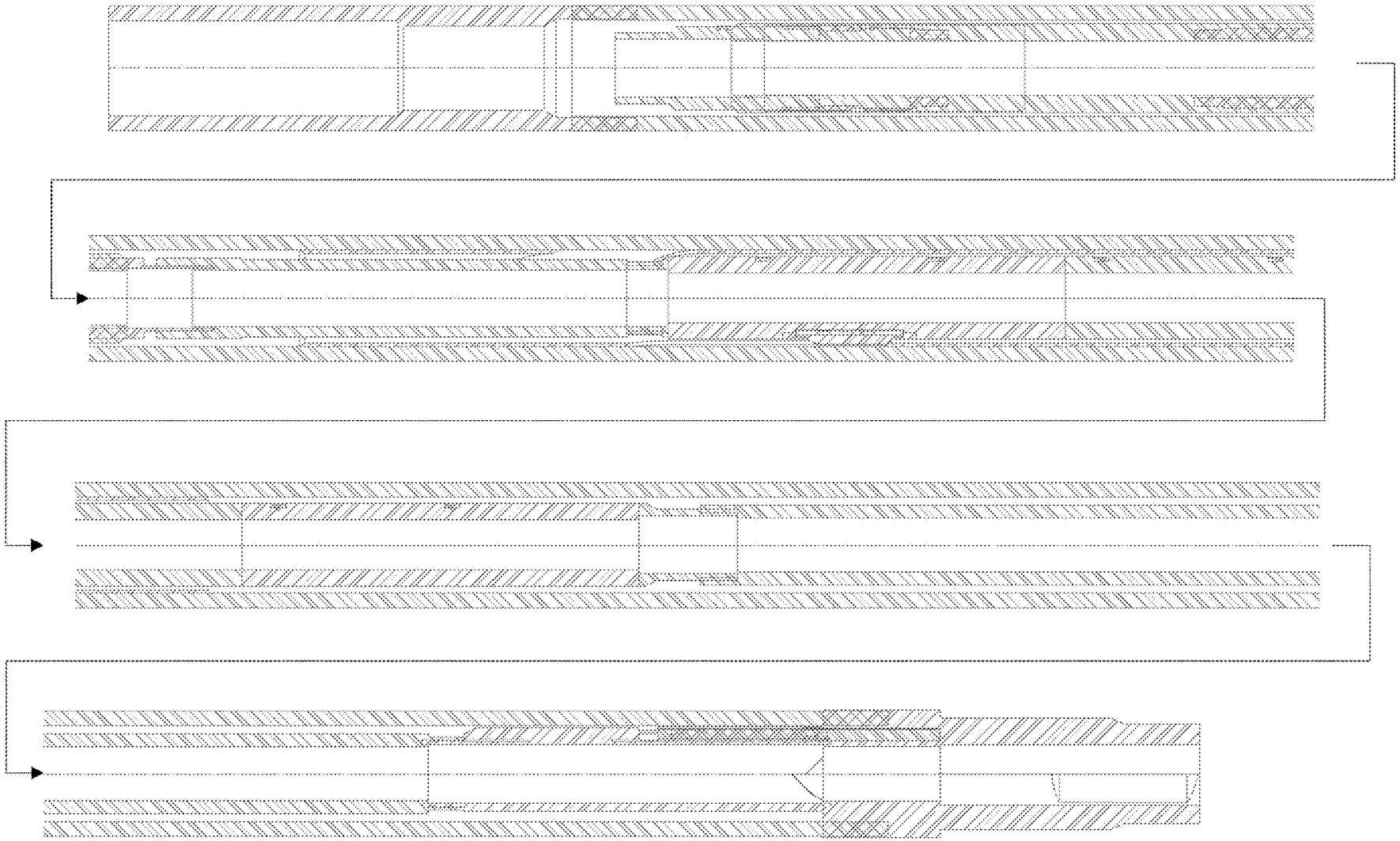

Turning to FIG. 25, illustrated is one embodiment of a multilateral junction 2500 designed, manufactured and/or operated according to one or more embodiments of the disclosure. The multilateral junction 2500, in the illustrated embodiment, includes a slotted orientation apparatus 2510. In at least one embodiment, the slotted orientation apparatus 2510 includes a tubular having a wall thickness (t). The slotted orientation apparatus 2510, in at least one other embodiment, additionally includes a slot extending at least partially through the tubular, the slot having first and second axial portions laterally offset from one another by a distance ($d_s$), and an angled portion connecting the first and second axial portions, wherein the slot radially extends around the tubular X degrees, wherein X is 180 degrees or less. In one or more embodiments, the slot extends entirely through the wall thickness (t) of the slotted orientation apparatus 2510, but in other embodiments the slot only extends into an inner surface of the slotted orientation apparatus 2510 (e.g., only partially through the wall).

The multilateral junction 2500, in the illustrated embodiment, additionally includes a tubular spacer 2520 positioned downhole of the slotted orientation apparatus 2510, a whipstock 2530 positioned downhole of the tubular spacer 2520, and a y-block 2540 positioned downhole of the whipstock 2530. In the embodiment of FIG. 25, the multilateral junction 2500 additionally includes a main bore leg 2550 and a lateral bore leg 2560 coupled to a downhole end of the y-block.

A keyed running tool (not shown) could be used to position (e.g., rotationally position) one or more features within the multilateral junction 2500. For example, the key(s) of the keyed running tool could slide within the slot of the slotted orientation apparatus 2510 to position the one or more features within the multilateral junction 2500. In at least one embodiment, the keyed running tool is configured to position the whipstock 2530 (e.g., a tubing exit whipstock "TEW") at a desired lateral and rotational position within the multilateral junction 2500. Notwithstanding the foregoing, the slotted orientation apparatus 2510 could be used to positioned different features within the multilateral junction 2500, or alternatively could be used to positioned different features not associated with the multilateral junction 2500.

Figure 26A:
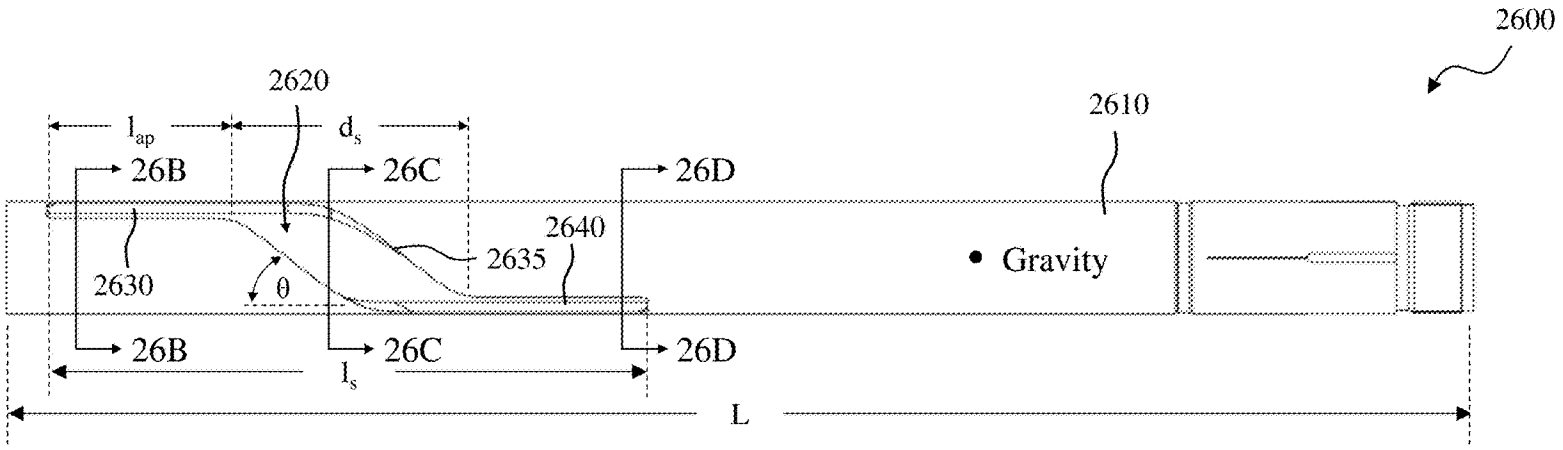
Figure 26B:
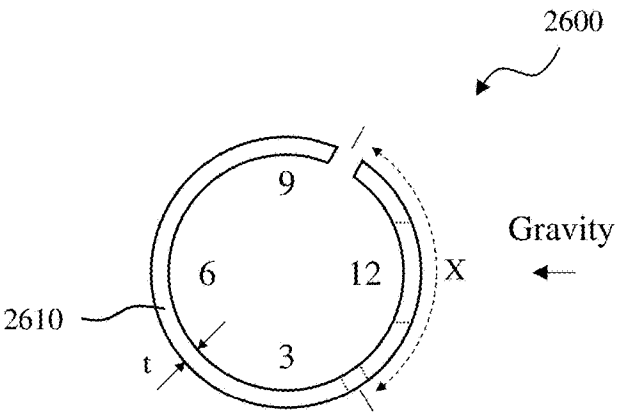
Figure 26C:
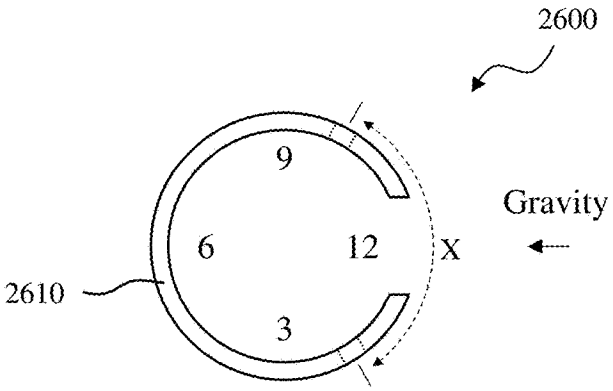
Figure 26D:
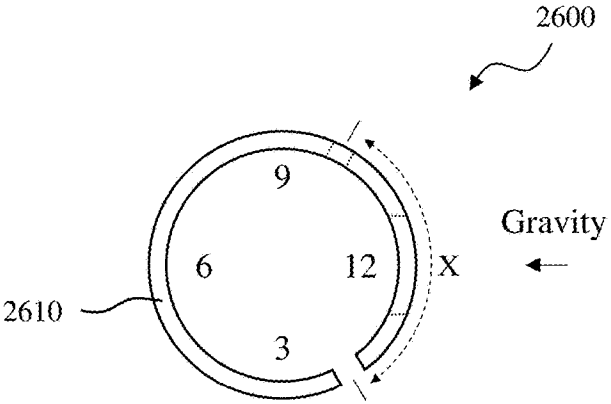
Figure 26E:
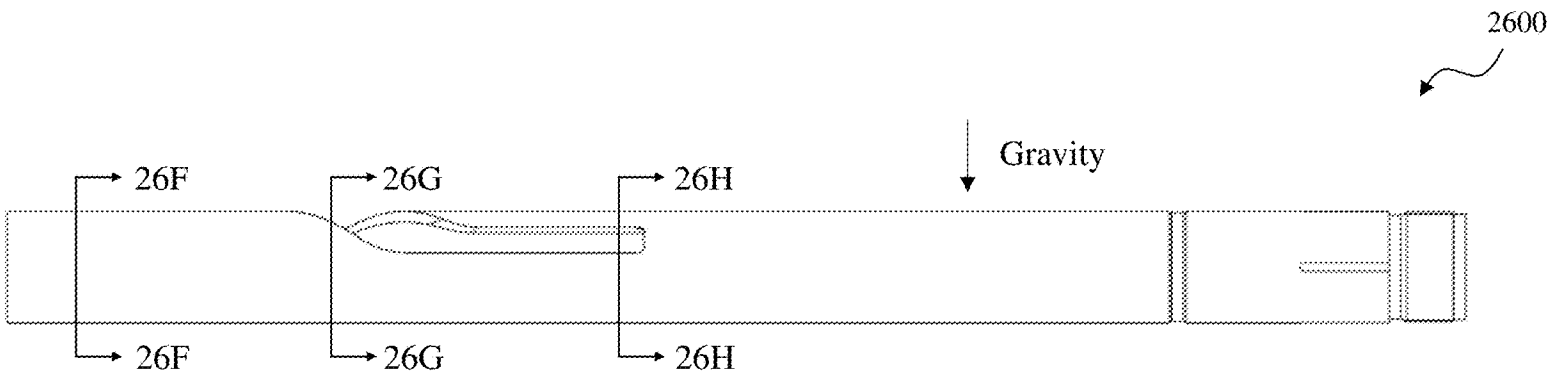
Figure 26F:
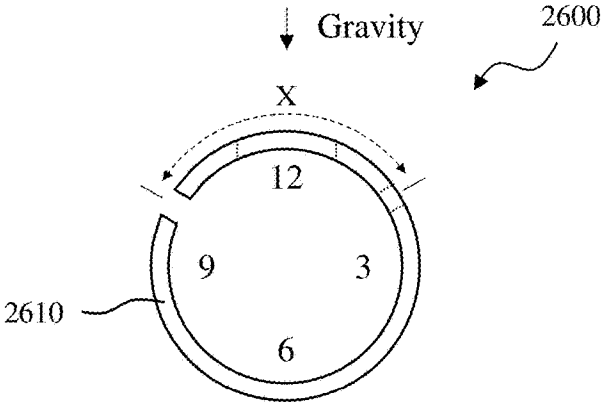
Figure 26G:
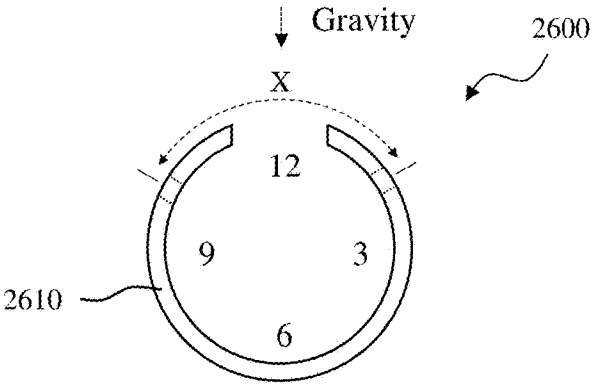
Figure 26H:
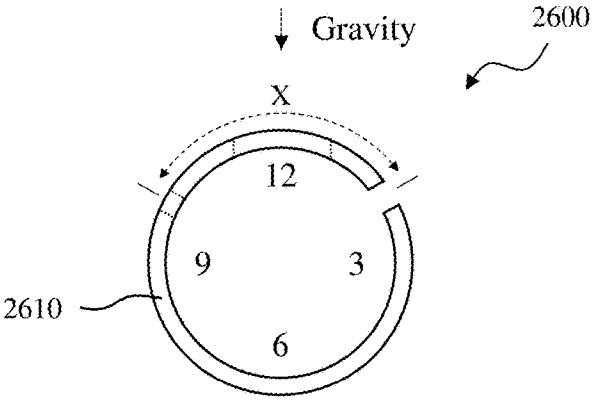
Figure 261:
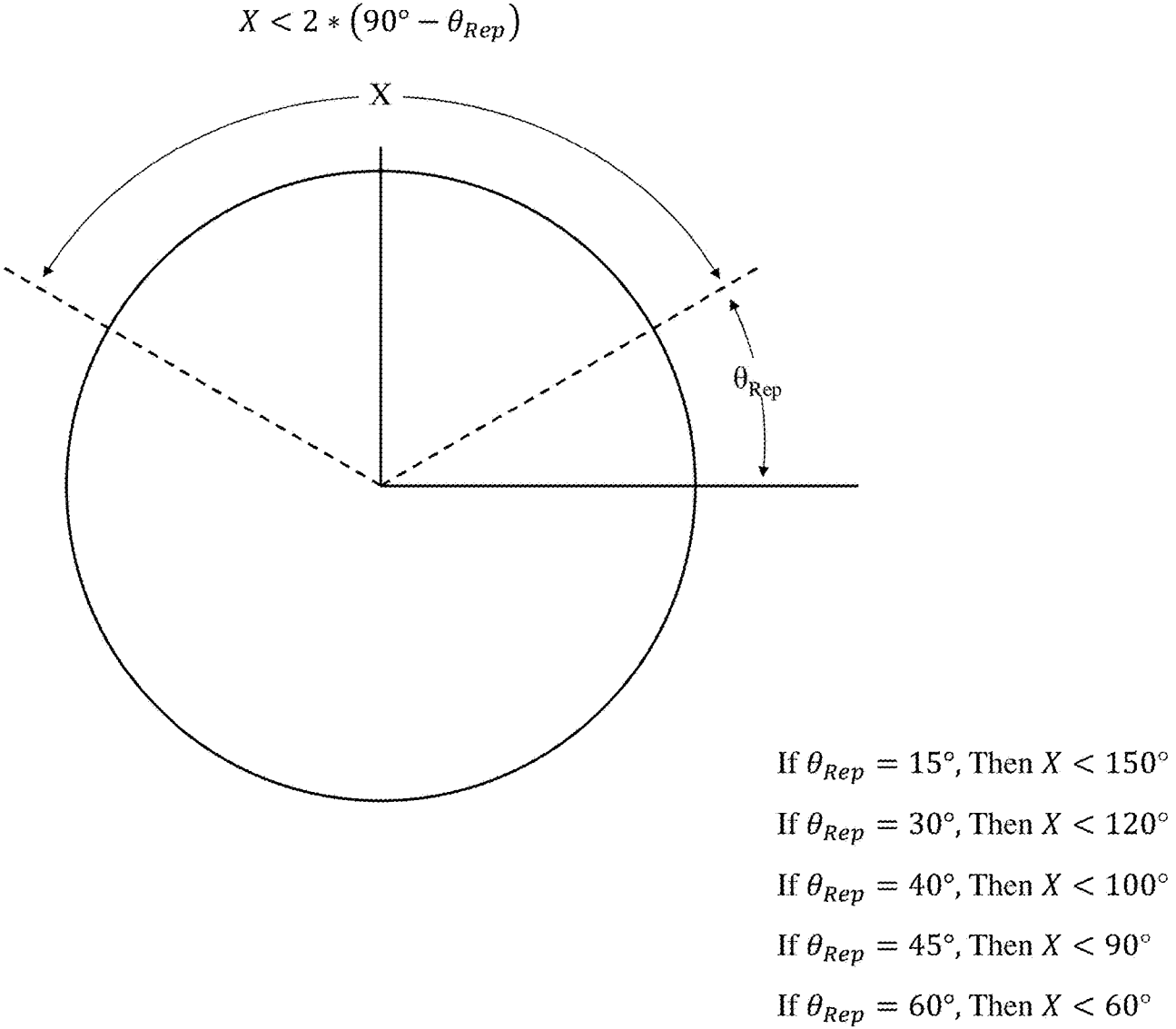

Turning to FIGS. 26A through 26H, illustrated are various different views of a slotted orientation apparatus 2600 designed, manufactured, and operated according to one or more embodiments of the disclosure. FIG. 26A illustrates a top-down view of the slotted orientation apparatus 2600, whereas FIGS. 26B through 26D illustrate various different sectional views of the slotted orientation apparatus 2600 taken through the top-down view of FIG. 26A. In contrast, FIG. 26E illustrates a right-side view of the slotted orientation apparatus 2600, whereas FIGS. 26F through 26H illustrate various different sectional views of the slotted orientation apparatus 2600 taken through the right-side view of FIG. 26E. Each of the views illustrated in FIGS. 26A through 26H additionally illustrate clock settings, as would relate to the illustrated point of gravity. The slotted orientation apparatus 2600, in at least one embodiment, is configured for use with a keyed running tool, such as that discussed below, and may be positioned within another tubular, such as casing.

The slotted orientation apparatus 2600, in the embodiment illustrated in FIGS. 26A through 26H, includes a tubular 2610 having a wall thickness (t). Many different tubular materials, and wall thicknesses (t), may be used for the tubular 2610 and remain within the scope of the disclosure. Nevertheless, in at least one embodiment, the tubular 2610 is a steel tubular, and the wall thickness (t) ranges from 0.07 cm to 5 cm. Furthermore, in at least one embodiment, the tubular could have a length (l) ranging from 5 cm to 18.5 m.

In accordance with at least one other embodiment of the disclosure, the slotted orientation apparatus 2600 includes a slot 2620 extending through the tubular 2610. In one or more embodiments, the slot 2620 has first and second axial portions 2630, 2640 laterally offset from one another by a distance ($d_s$), and an angled portion 2635 connecting the first and second axial portions 2630, 2640. The slot 2620, in at least one embodiment, radially extends around the tubular 2610 by X degrees, wherein X is 180 degrees or less. In at least one other embodiment, X is less than 180 degrees. In yet another embodiment, such as shown in FIGS. 26A through 26H, X is 120 degrees or less, and in one embodiment 120 degrees. In even yet another embodiment, X is 90 degrees or less. As will be discussed in greater detail below, the actual degrees for X may relate to the number of keys employed in the keyed running tool. For example, if three equally spaced keys are used, X would equal 120 degrees. If four equally spaced keys were used, X would equal 90 degrees. If five equally spaced keys were used, X would equal 72 degrees.

The angle X may also be based upon the coefficient of friction between the material within the tubular 2610 (e.g., frac sand, coated frac proppant, formation fines, etc.) and the angled surfaces of the slot 2620, as well as the angle of repose of the material within the tubular 2610. For example, in at least one embodiment, frac sand is being deployed down the tubular 2610. Accordingly, the frac sand might have an angle of repose of Z degrees (e.g., wet sand has an angle of repose of 45 degrees), and the angle X might be chosen based upon the aforementioned coefficient of friction and the angle of repose of Z degrees (e.g., say for example 45 degrees). Thus, the combination of the coefficient of friction between the frac sand and the lower ledge of the slot 2620, along with the angle of repose of Z degrees, would cause the frac sand to not collect on the angled surfaces of the slot 2620.

As an example, the angle X might be less than twice a complementary angle of repose of the material within the tubular 2610 (e.g., X<2*(90°−angle of repose of material, or $\theta_{Rep}$)) when a radial center point of the slot 2620 is positioned at 12 o'clock relative to gravity, as shown in FIG. 26I. In one embodiment, the material might have an angle of repose ($\theta_{Rep}$) of at least 15 degrees (e.g., water filled sand), and the angle X would be less than 150 degrees (e.g., X<2*(90°−15°)). In another embodiment, the material might have an angle of repose ($\theta_{Rep}$) of at least 260 degrees (e.g., water filled sand), and the angle X would be less than 120 degrees (e.g., X<2*(90°−30°)). In yet another embodiment, the material might have an angle of repose ($\theta_{Rep}$) of at least 40 degrees, and the angle X would be less than 100 degrees (e.g., X<2*(90°−40°)). In yet another embodiment, the material might have an angle of repose ($\theta_{Rep}$) of at least 45 degrees, and the angle X would be less than 90 degrees (e.g., X<2*(90°−45°)).

The slot 2620, in certain embodiments, is located on a high side of the tubular 2610 such that no portion of the slot 2620 is located below 3 o'clock or below 9 o'clock relative to gravity. In such embodiments, X would need to be less than 180 degrees to accommodate a width of the first and second axial portions 2630, 2640. For example, depending on the width of the first and second axial portions 2630, 2640, X might need to be 175 degrees or less to accommodate the aforementioned high side. In certain other embodiments, such as that shown in FIGS. 26A through 26H, a radial center point of the slot 2620 is positioned at 12 o'clock relative to gravity.

Further to the embodiment of FIGS. 26A through 26H, the slot 2620 may have a length ($l_s$), and the first and second axial portions may have a length ($l_{ap}$). Thus, in accordance with one or more embodiments, the length ($l_s$) ranges from 2.5 cm to 900 cm and the length ($l_{ap}$) ranges from 1 cm to 600 cm. Similarly, in an embodiment, the distance ($d_s$) ranges from 1 cm to 900 cm, among others. Given certain dimensions of the slot 2620, an angle (θ) of the angled portion 2635 may range from 15 degrees to 60 degrees, and in yet another embodiment from 25 degrees to 50 degrees.

Figure 27A:
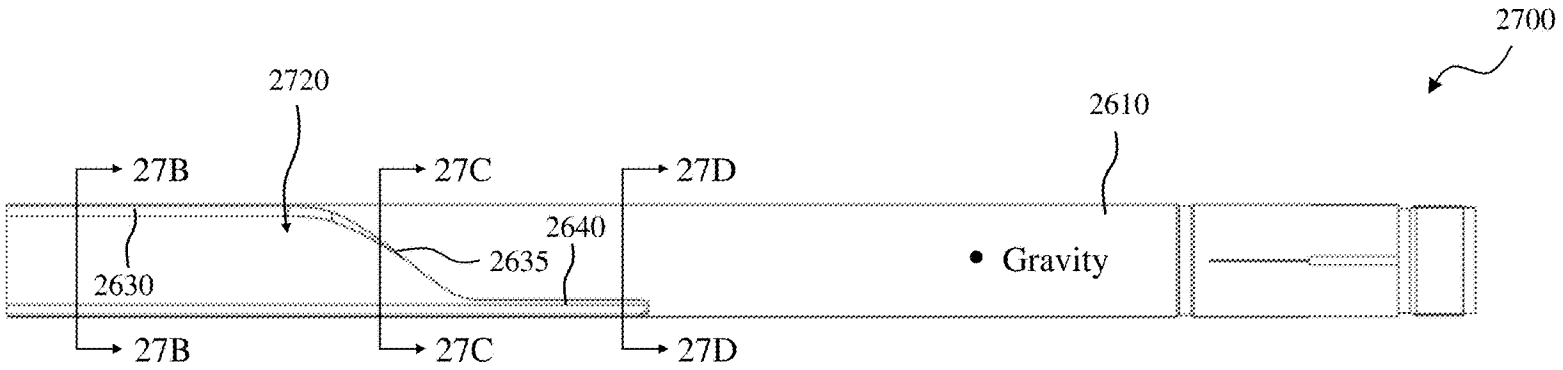
FIGS. 27A through 27D illustrate various different views of a slotted orientation apparatus designed, manufactured, and operated according to one or more alternative embodiments of the disclosure.
Figure 27B:
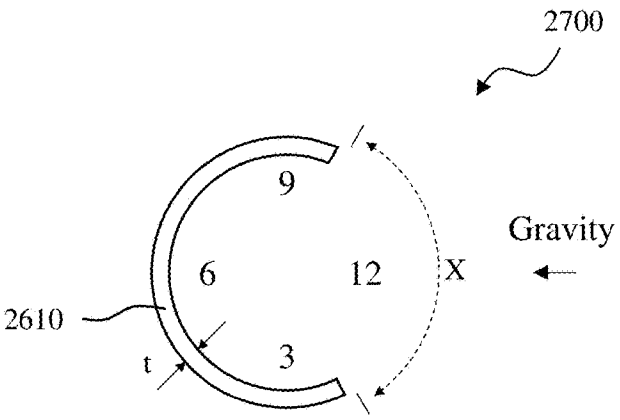
Figure 27C:
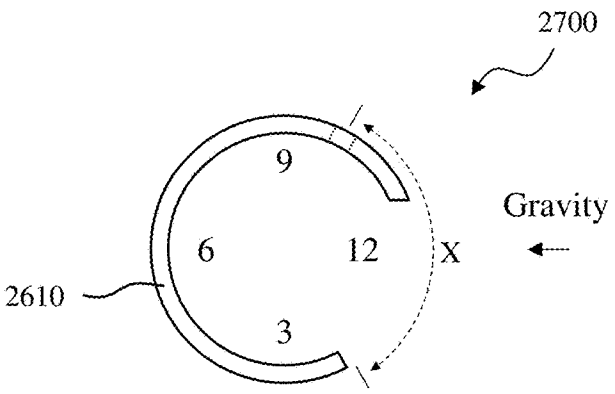
Figure 27D:
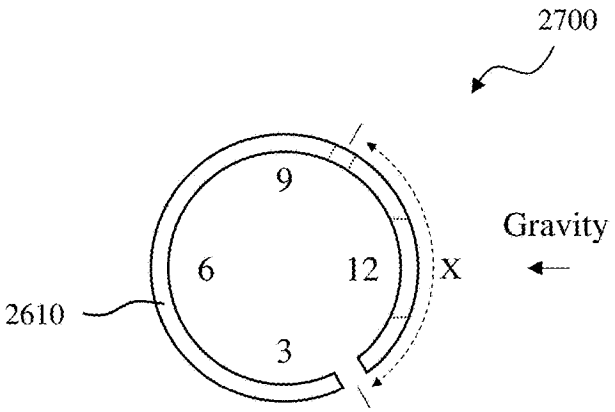

Turning to FIGS. 27A through 27D, illustrated are various different views of a slotted orientation apparatus 2700 designed, manufactured, and operated according to one or more alternative embodiments of the disclosure. FIG. 27A illustrates a top-down view of the slotted orientation apparatus 2700, whereas FIGS. 27B through 27D illustrate various different sectional views of the slotted orientation apparatus 2700 taken through the top-down view of FIG. 27A. The slotted orientation apparatus 2700 is similar in many respects to the slotted orientation apparatus 2600. Accordingly, like reference numbers have been used to indicate similar, if not identical, features. For example, the slotted orientation apparatus 2700 includes the first axial portion 2630, the angled portion 2635, and the second axial portion 2640. Nevertheless, the slotted orientation apparatus 2700 employs an open-type slot 2720, as opposed to the more closed-type slot 2620 of the slotted orientation apparatus 2600.

Figure 28A:
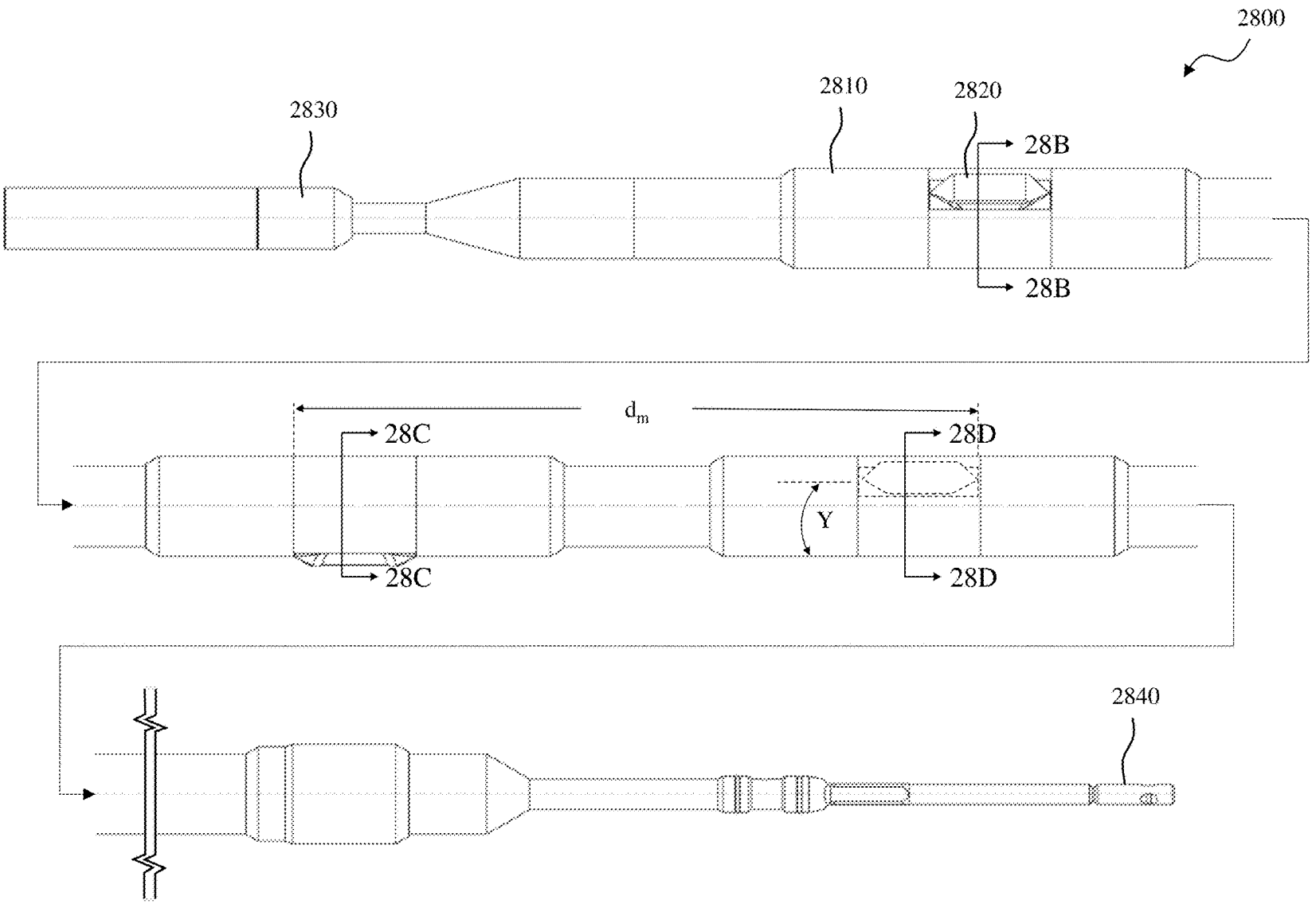
FIGS. 28A through 28D illustrate different views of a keyed running tool designed, manufactured and operated according to one or more embodiments of the disclosure.
Figure 28A:
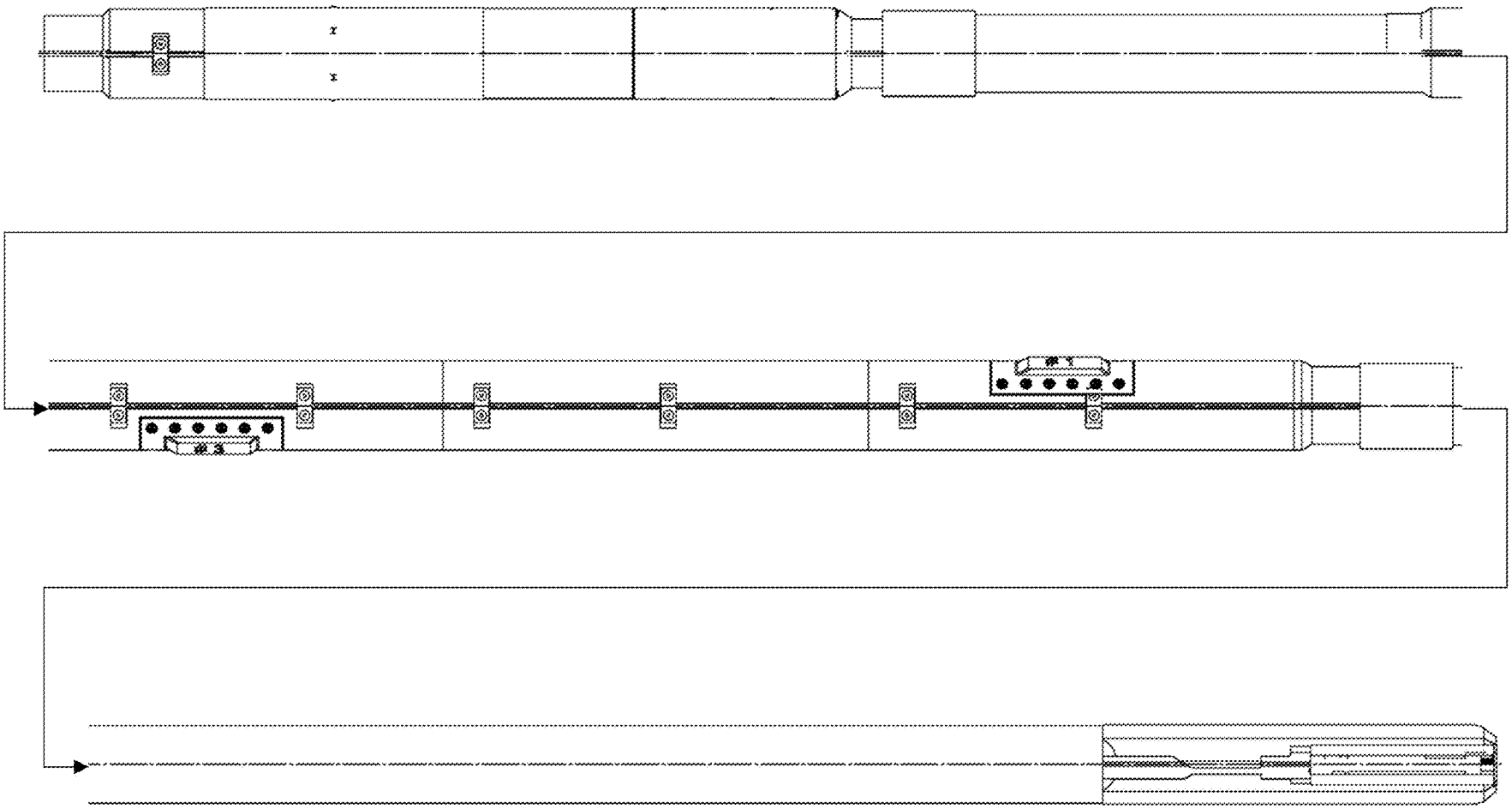
Figure 28B:
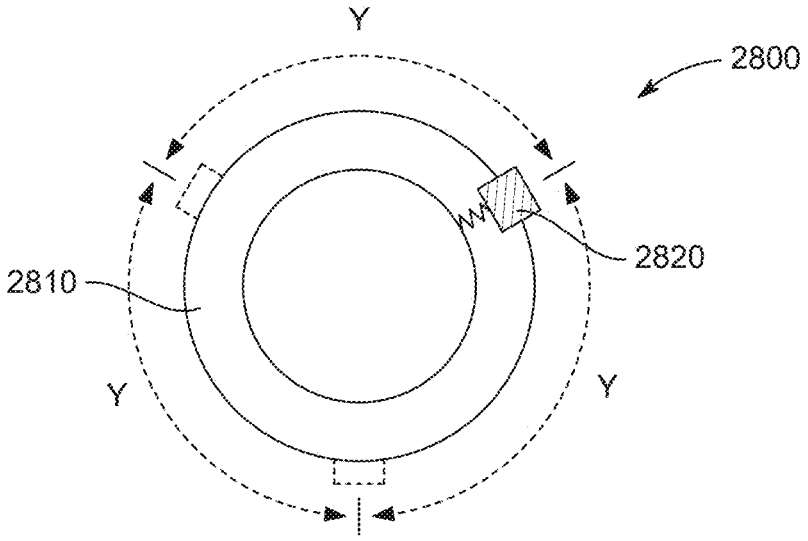
Figure 28C:
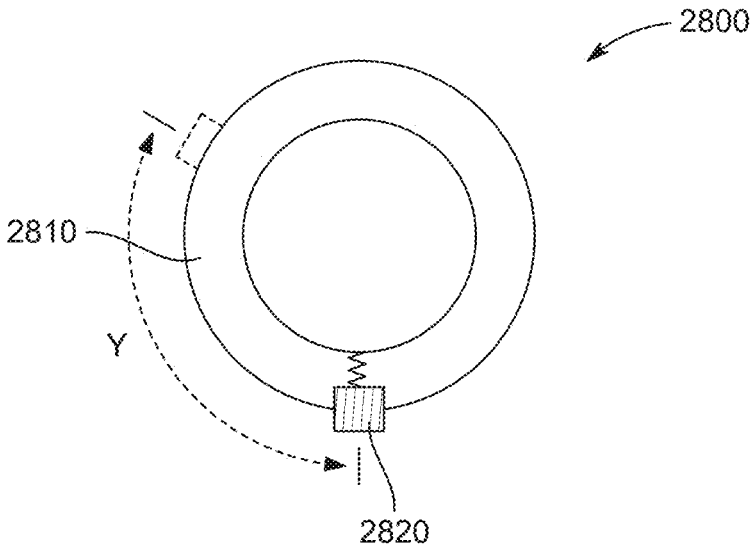
Figure 28D:
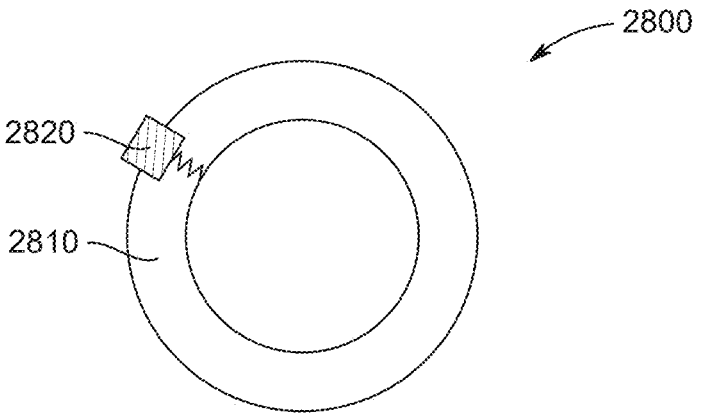

Turning to FIGS. 28A through 28D, illustrated are different views of a keyed running tool 2800 designed, manufactured and operated according to one or more embodiments of the disclosure. FIG. 28A illustrates an isometric view of the keyed running tool 2800, whereas FIGS. 28B through 28D illustrated cross-sectional views taken at various different locations of the keyed running tool 2800. The keyed running tool 2800, in at least one embodiment, is configured for use with a slotted orientation apparatus, such as the slotted orientation apparatus 2600 illustrated above with regard to FIGS. 26A through 27D.

The keyed running tool 2800 illustrated in FIGS. 28A through 28D, in one or more embodiments, includes a housing 2810. The housing 2810 may comprise many different shapes, lengths and/or materials while remaining within the scope of the disclosure. In at least one embodiment, however, the housing 2810 comprises steel. Housing 2810 may comprise more than one component in order to perform its function (securing the more than one key, alignment of the keys, attaching the main housing to tools at one or both ends.

The keyed running tool 2800, in accordance with one embodiment of the disclosure, includes two or more keys 2820 extending from the housing 2810. The two or more keys 2820, in certain embodiments, are movable between a radially retracted state (e.g., where they may be flush with an outside diameter of the housing 2810) and a radially extended state (e.g., such as shown, where they extend beyond the outside diameter of the housing 2810). For example, the two or more keys 2820 may be two or more spring loaded keys 2820, and remain within the scope of the disclosure. In the embodiment of FIGS. 28A through 28D, the keyed running tool 2800 includes three keys 2820.

In accordance with one embodiment of the disclosure, adjacent ones of the two or more keys 2820 are radially offset from each other by Y degrees, wherein Y is 180 degrees or less. For example, depending on the number of keys 2820, Y may vary. For example, if three equally spaced keys are used, Y would equal 120 degrees. If four equally spaced keys were used, Y would equal 90 degrees. If five equally spaced keys were used, Y would equal 72 degrees. In certain instances, it may be advantageous to have an odd number of equally spaced keys, such that no two keys are radially offset from one another by 180 degrees. In certain instances, it may be advantageous to have the three-or-more keys spaced at different angles from one another. For example, if the assembly that needs to be urged into a certain orientation, but its center of mass is not positioned along the centerline, then having two keys engaged at a particular orientation can distribute the stresses over a larger area to reduce the stresses upon the keys (and slots). Likewise, the keys may be made wider to increase the load-bearing area of the keys to reduce the stresses upon the keys and orientation slot.

In accordance with one embodiment of the disclosure, adjacent ones of the two or more keys 2820 are laterally offset from each other. For example, adjacent ones of the two or more keys are laterally offset from each other by a maximum distance ($d_m$). In at least one embodiment, the maximum distance ($d_m$) ranges from 2.5 cm to 900 cm. Nevertheless, other values for the maximum distance ($d_m$) are within the scope of the disclosure.

In certain embodiments, the value for the Y (e.g., the radial offset of the keys 2820) and the value for X (e.g., how far the slot of the slotted orientation apparatus radially extends around the tubular) relate to one another. For example, certain embodiments exist wherein the value for Y is substantially equal to the value for X. The term "substantially equal," as used herein with respect to the associated values for Y and X, means that the values are within 10 percent of one another, for example to accommodate a width of the key 2820. In other embodiments, the value for Y is ideally equal to the value for X. The term "ideally equal," as used herein with respect to the associated values for Y and X, means that the values are within 5 percent of one another, for example to accommodate a width of the key 2820. In yet other embodiments, the value for Y is exactly equal to the value for X. The term "exactly equal," as used herein with respect to the associated values for Y and X, means that the values are within 1 percent of one another.

Similarly, in certain embodiments, the maximum distance ($d_m$) (e.g., the maximum lateral offset of adjacent key 2820) and the length ($l_s$) of the slot of the slotted orientation apparatus relate to one another. For example, in certain embodiments it is beneficial for two or more of the keys 2820 to reside within the slot at the same time. Accordingly, in at least one embodiment, the maximum distance ($d_m$) is less than the length ($l_s$). However, in certain other embodiments it is beneficial for the two or more keys 2820 to reside within the first and second axial portions of the slot, respectively, thus the maximum distance ($d_m$) is greater than the distance ($d_s$) (e.g., the lateral distance between the first and second axial portions).

The keyed running tool 2800, in one or more embodiments, may additionally include a swivel 2830 coupled to an uphole end of the housing 2810. In at least one embodiment, the swivel 2830 is configured to allow the housing 2810 and the two or more keys 2820 to rotate when following a slot in a slotted orientation apparatus. The keyed running tool 2800 may additionally include an engagement member 2840 coupled to a downhole end of the housing 2810. The engagement member 2840, in at least one embodiment, is configured to engage with a downhole tool and rotationally position the downhole tool within a wellbore within which it is located. For example, the engagement member 2840 could engage with a whipstock, such as the whipstock 230 illustrated in FIG. 25, in which case the keyed running tool 2800 would be used to rotationally position the whipstock 2530 within the multilateral junction 200. The keyed running tool 2800 may be used in other processes or phases of constructing and producing hydrocarbons such as, but not limited to: during production, completion, stimulation, workover, re-drilling, and/or fracturing operations, etc. In one or more embodiments, engagement member 2840 may comprise an Energy Transfer Mechanism (ETM), an Orientation Device, Communication Device, a Wet Mate, Dry Mate, a Fiber Optic Coupler (Wet Mate) like the ones mentioned in this application. In some embodiments, engagement member 2840 may comprise ETM, Orientation or Communication Device, Wet Mate, Dry Mate, Fiber Optic Coupler different than the ones mentioned in this application. Engagement member 2840 may comprise a mechanical device (such as a collet, spring, a dashpot, a shoulder, debris excluder, barrier, pressure barrier, a reservoir, an accumulator, a profile, etc.), an electrical device (a resistor, capacitor, battery, sensor, switch, etc.), a fluidic device (reservoir, accumulator, a choke, a poppet, a line, a burst disc, a vent, logic device, amplifiers, triodes, amplifier, oscillator, etc.), an electronic device (a computer, a chip, a sensor, an energy convertor, memory storage, logic chip/device, MEMS, etc.), a power supply line (i.e. electrical, hydraulic, fiber, heat, etc.), a power transfer line (i.e. electrical, hydraulic, fiber, heat, etc.), etc.

Turning now to FIGS. 29A through 29F, illustrated is one embodiment for aligning a downhole tool in accordance with the disclosure. For example, the embodiment for aligning a downhole tool could include employing a slotted orientation apparatus 2900 and a keyed running tool 2950 for aligning a downhole tool. In at least one embodiment, the slotted orientation apparatus 2900 and the keyed running tool 2950 are similar to the slotted orientation apparatus 2600 and the keyed running tool 2800 discussed above. Thus, in at least one embodiment, the slotted orientation apparatus 2900 could include a tubular 2910, as well as a slot 2920 extending through the tubular, the slot having first and second axial portions 2930, 2940 laterally offset from one another by a distance ($d_s$), and an angled portion 2935 connecting the first and second axial portions 2930, 2940. In accordance with at least one embodiment, the slot 2920 radially extends around the tubular 2910 X degrees, wherein X is 180 degrees or less. Similarly, in at least one embodiment, the keyed running tool 2950 could include a housing

2960, as well as two or more keys 2970 extending from the housing 2960, the two or more keys 2970 movable between a radially retracted state and a radially extended state. In accordance with at least one embodiment, adjacent ones of the two or more keys 2970 are laterally offset from each other and radially offset from each other by Y degrees, wherein Y is 180 degrees or less. The slotted orientation apparatus 2900 may comprise one or more slots or features to enhance functional requirements and reliability of the apparatus and system. In some embodiments, one or more sets of axial and helical slots. For example, 2900 may comprise 3 sets of axial slots (2930 and/or 2940) and/or (angled/helical) slots (2920, 2935, etc.). One benefit of having 3 sets of slots is that if there are 3 keys (e.g., 2970*a, b, c*), more than one key may engage more than one slot. This in turn can reduce the amount of stress placed on one key and slot during the orienting/alignment process. In addition, the torque generated by more than one key would be less and distributed around the axis of tool 2950 and components/assemblies attached to it. As a one example, referring to FIG. 29D, another slot or slots may be positioned so that Key 2970*a* could engage at least one of the slots in unison with key 2970*b* engaging slot(s) 2930, 2920, 2940, etc. In some embodiments, when key 2970*c* is engaging a slot (e.g., as shown in FIG. 29E), keys 2970*a* and/or 2970*b* may be engaging one or more other slots.

In the embodiment of FIGS. 29A through 29F, the slot 2920 of the slotted orientation apparatus 2900 radially extends around the tubular 2910 by 120 degrees. Similarly, the keyed running tool 2950 includes three keys, including a downhole key 2970*a*, a middle key 2970*b*, and an uphole key 2970*c*. Further to the embodiment of FIGS. 29A through 29F, the downhole key 2970*a*, middle key 2970*b*, and uphole key 2970*c* are radially offset from each other by 120 degrees. While a three key 2970 and 120 degree design is being illustrated and described with regard to FIGS. 29A through 29F, other number of keys 2970 and radial spacing are within the scope of the disclosure.

Figure 29A:
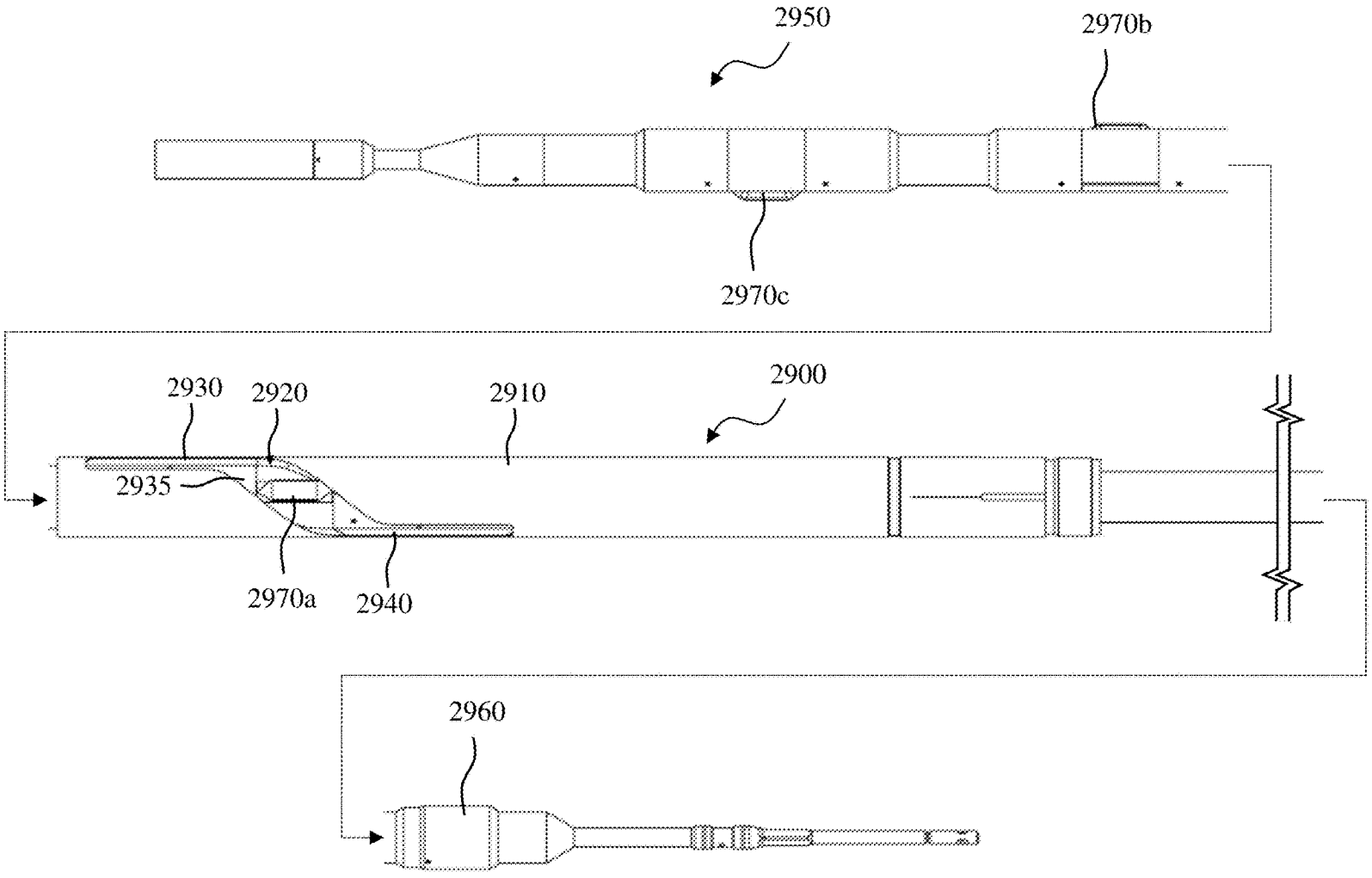
FIGS. 29A through 29F illustrate one embodiment for aligning a downhole tool in accordance with the disclosure.
Figure 29A:
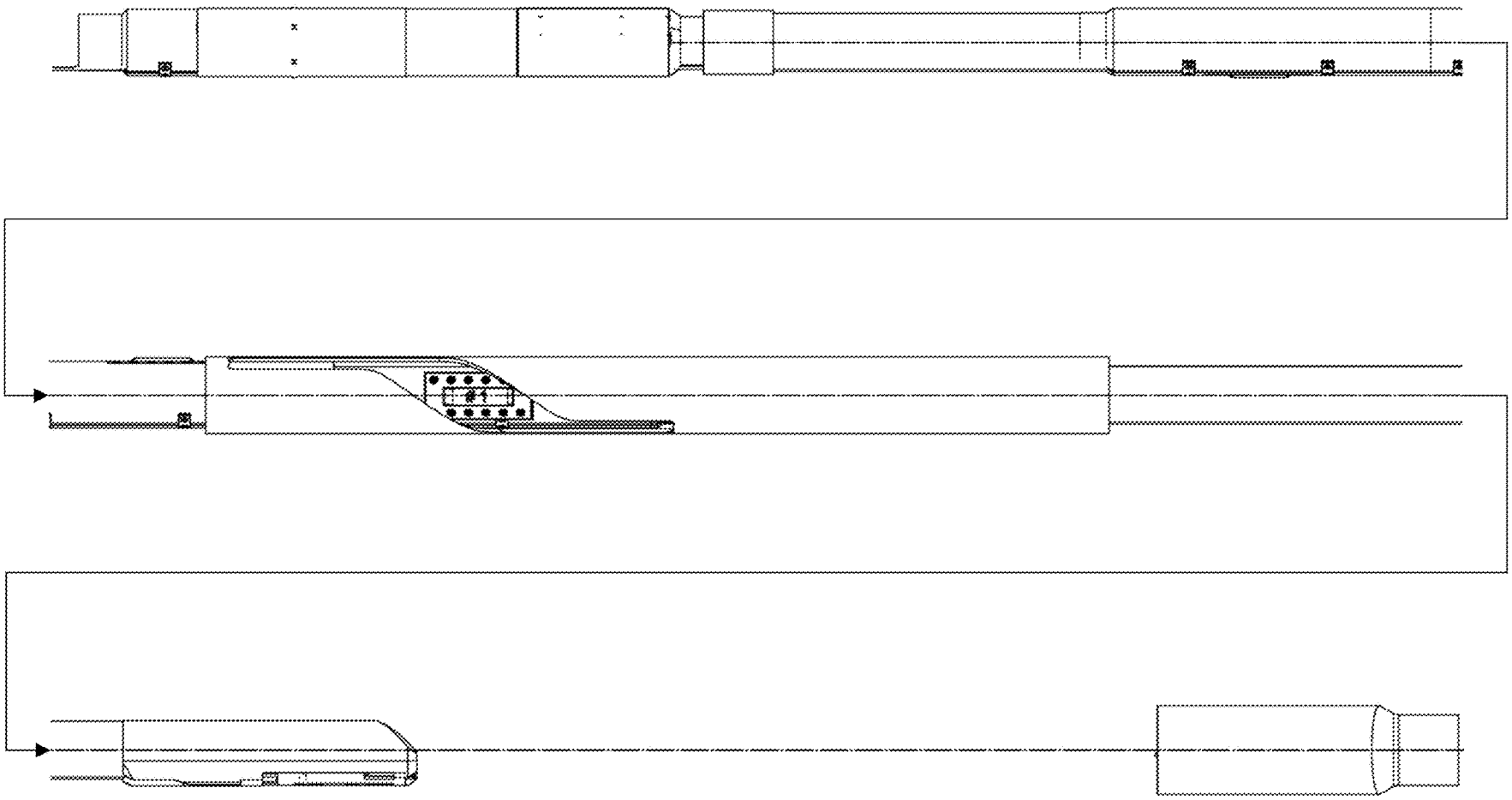

With reference to FIG. 29A, the keyed running tool 2950 is initially at least partially engaged with the slotted orientation apparatus 2900. For example, in the embodiment of FIG. 29A, the downhole key 2970*a* is laterally aligned with the slot 2920 when the keyed running tool 2950 is being pushed downhole. Thus, in the embodiment of FIG. 29A, the downhole key 2970*a* may engage with the slot 2920, as is shown. While FIG. 29A illustrates the downhole key 2970*a* positioned in the angled portion 2935 of the slot 2920, depending on the initial radial alignment between the downhole key 2970*a* and the slot 2920, the downhole key 2970*a* might alternatively initially engage the first axial portion 2930 or initially engage the second axial portion 2940. Additionally, as the keys 2970 are movable between radially retracted states and radially extended states, a location at which the keys 2970 engage with the slot 2920 has no effect on the keys 2970.

Figure 29B:
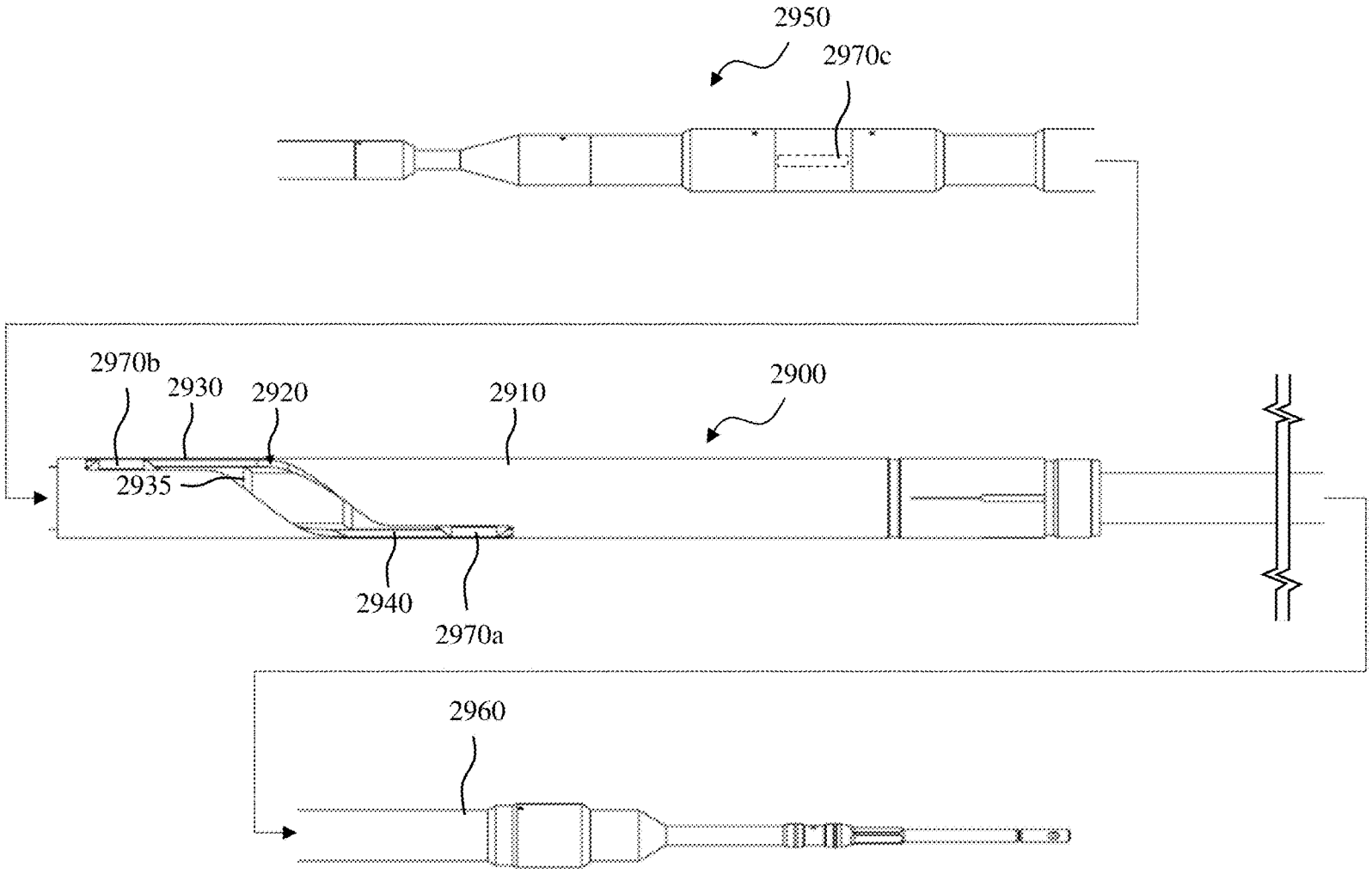
Figure 29B:
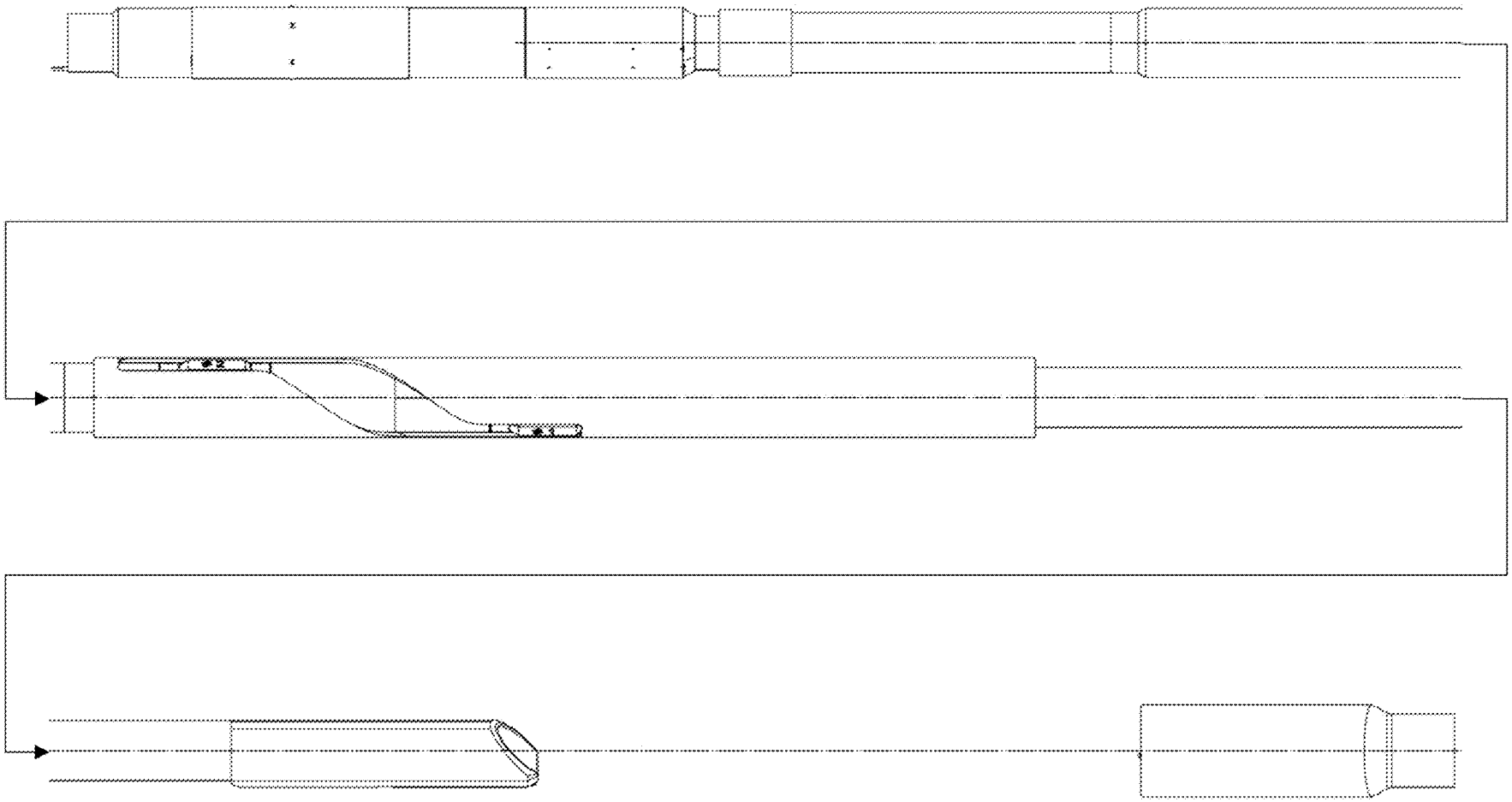

With reference to FIG. 29B, illustrated is the keyed running tool 2950 of FIG. 29A after continuing to push the keyed running tool 2950 downhole causing the downhole key 2970*a* to rotate within the slot 2920 until the downhole key 2970*a* is positioned within the second axial portion 2940 of the slot 2920 and the middle key 2970*b* is positioned within the first axial portion 2930 of the slot 2920. As the maximum distance ($d_m$) between the downhole key 2970*a* and the middle key 2970*b* is less than the length ($l_s$) of the slot 2920, both of the downhole key 2970*a* and the middle key 2970*b* may be simultaneously located within the slot 2920. Moreover, in certain embodiments, the relationship between the maximum distance ($d_m$) and the length ($l_s$) dictates that no more than two keys 2970 may be engaged with the slot 2920 at any one given moment in time. Furthermore, as the radial value for X is substantially similar to the radial value for Y, the downhole key 2970*a* and the middle key 2970*b* may be simultaneously located within second axial portion 2940 and the first axial portion 2930, respectively.

Figure 29C:
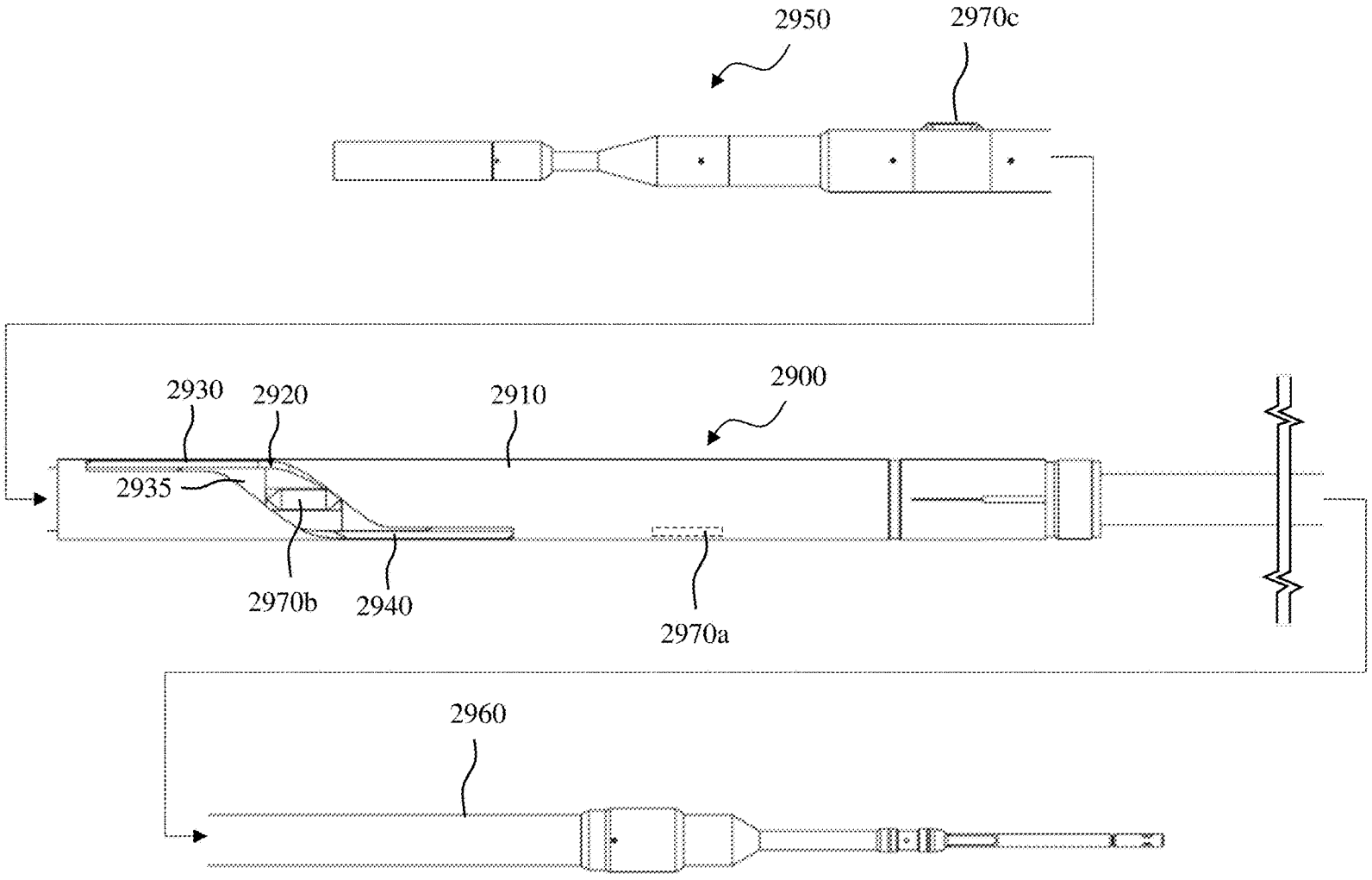
Figure 29C:
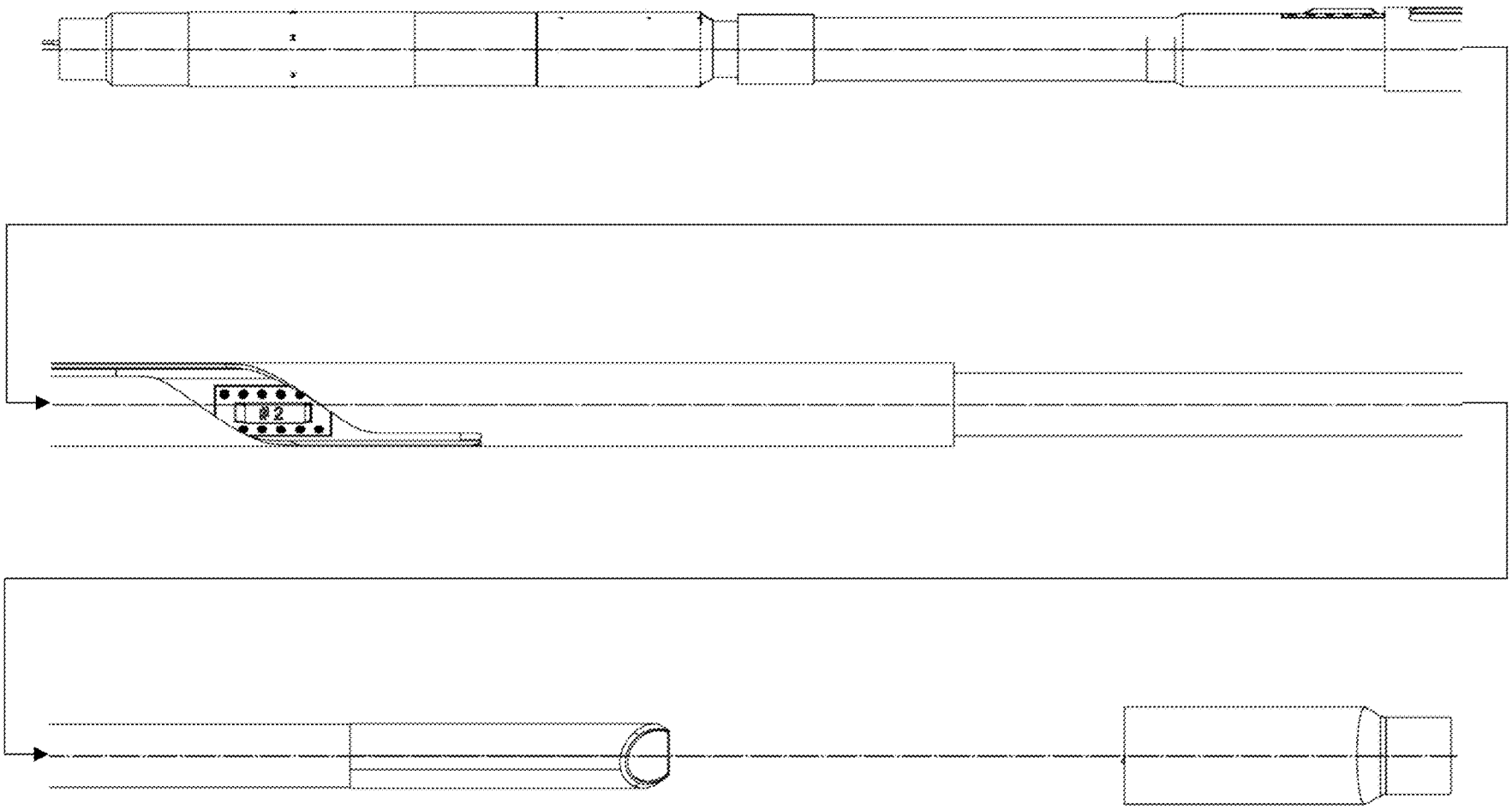

With reference to FIG. 29C, illustrated is the keyed running tool 2950 of FIG. 29B after continuing to push the keyed running tool 2950 downhole causing the downhole key 2970*a* to move to its radially retracted state (e.g., within the tubular 2910) and the middle key 2970*b* to rotate to the angled portion 2935 of the slot 2920. Given the spacing between adjacent keys 2970, in one or more embodiments, if one key (e.g., the middle key 2970*b*) is located within the angled portion 2935 of the slot 2920, an adjacent key 2970 (e.g., the downhole key 2970*a* or the uphole key 2970*c*) cannot also be located within the slot 2920.

Figure 29D:
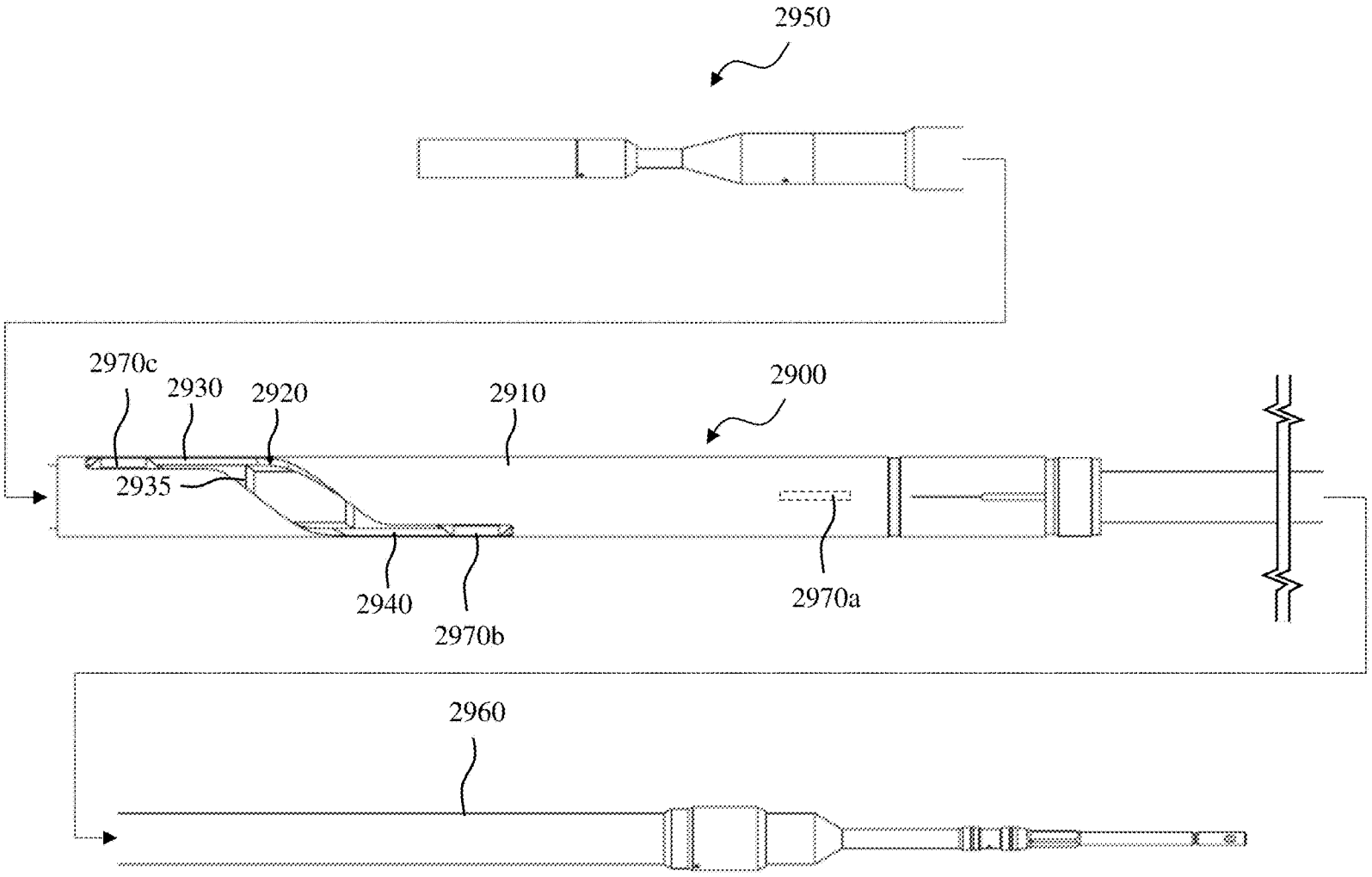
Figure 29D:
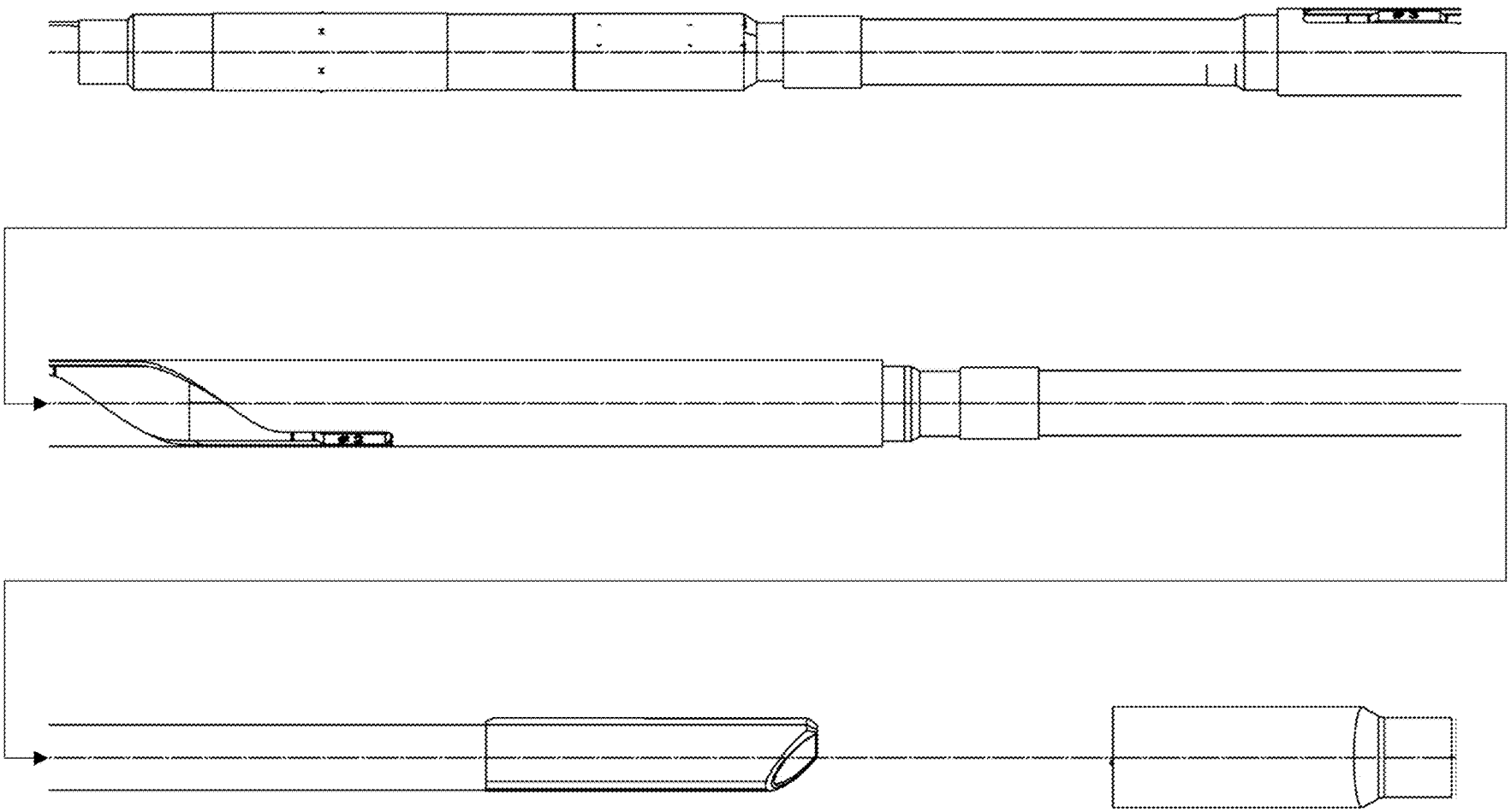
Figure 29E:
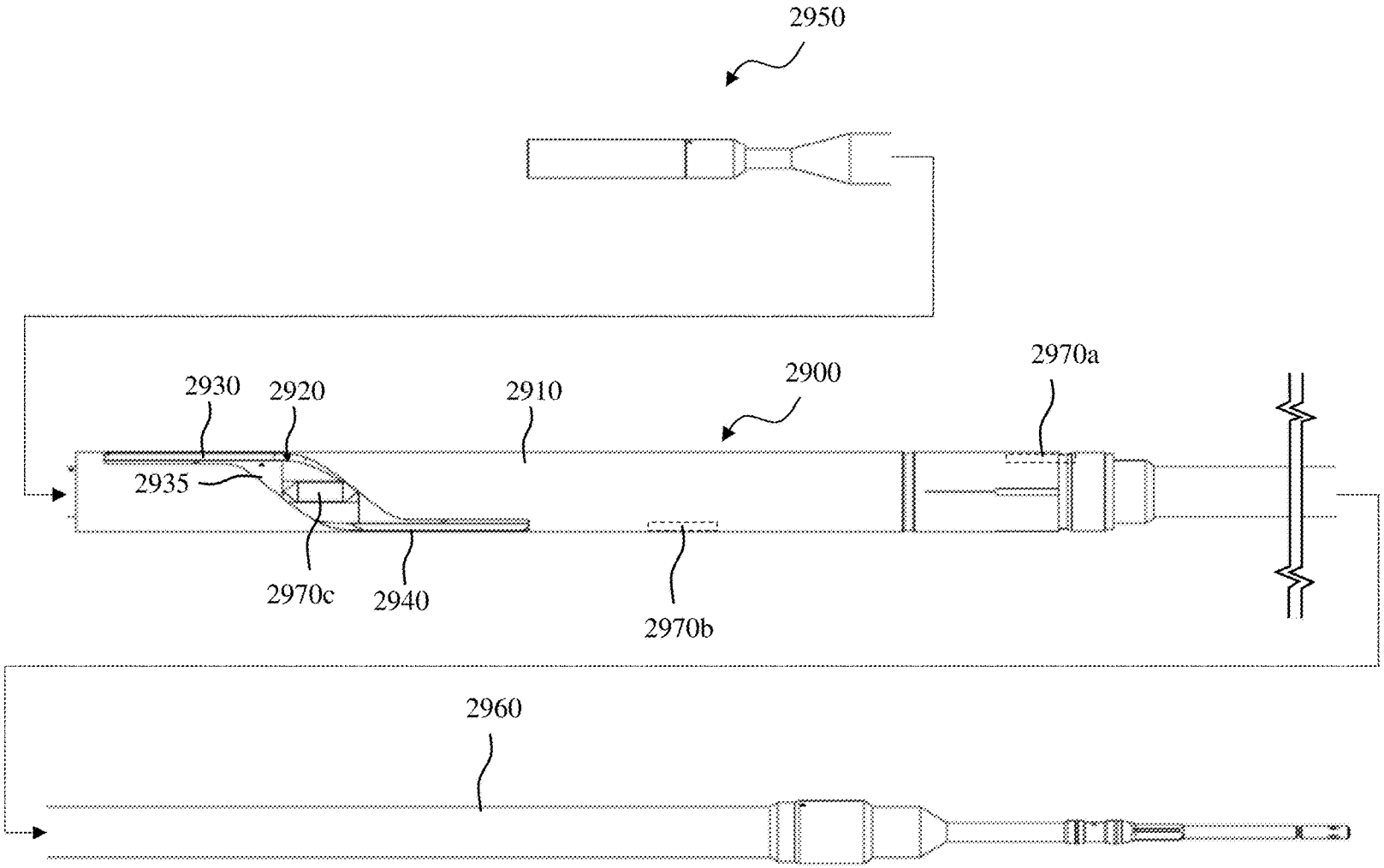
Figure 29E:
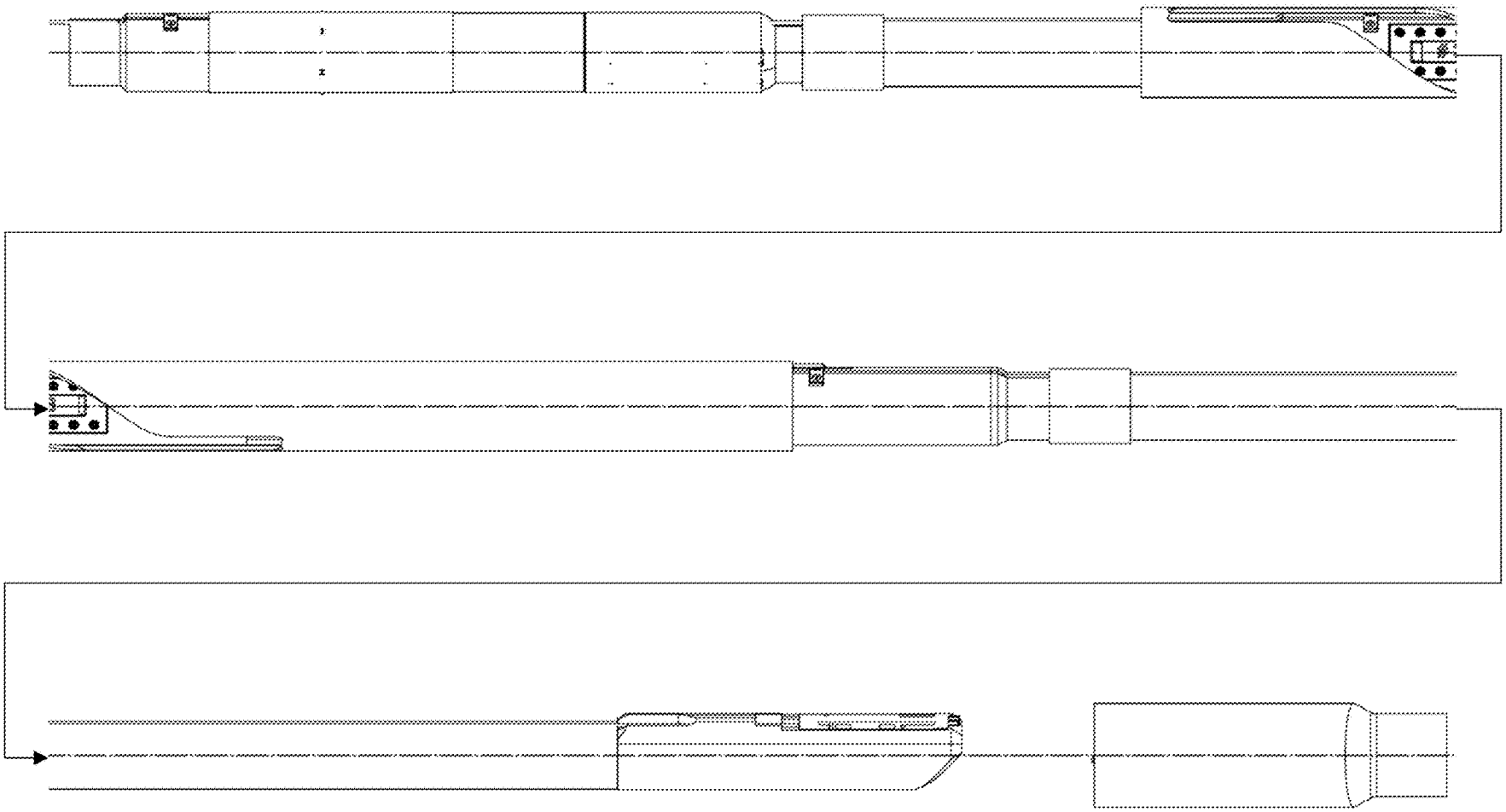

With reference to FIG. 29D, illustrated is the keyed running tool 2950 of FIG. 29C after continuing to push the keyed running tool 2950 downhole causing the middle key 2970*b* to rotate within the slot 2920 until the middle key 2970*b* is positioned within the second axial portion 2940 of the slot 2920 and the uphole key 2970*c* is positioned within the first axial portion 2930 of the slot 2920. As the maximum distance ($d_m$) between the middle key 2970*b* and the uphole key 2970*c* is less than the length ($l_s$) of the slot 2920, both of the middle key 2970*b* and the uphole key 2970*c* may be simultaneously located within the slot 2920. Furthermore, as the radial value for X is substantially similar to the radial value for Y, the middle key 2970*b* and the uphole key 2970*c* may be simultaneously located within second axial portion 2940 and the first axial portion 2930, respectively.

With reference to FIG. 29E, illustrated is the keyed running tool 2950 of FIG. 29D after continuing to push the keyed running tool 2950 downhole causing the middle key 2970*b* to also move to its radially retracted state (e.g., within the tubular 2910) and the uphole key 2970*c* to rotate to the angled portion 2935 of the slot 2920. Given the spacing between adjacent keys 2970, in one or more embodiments, if one key (e.g., the uphole key 2970*c*) is located within the angled portion 2935 of the slot 2920, adjacent key 2970 (e.g., the downhole key 2970*a* or the middle key 2970*b*) cannot also be located within the slot 2920.

Figure 29F:
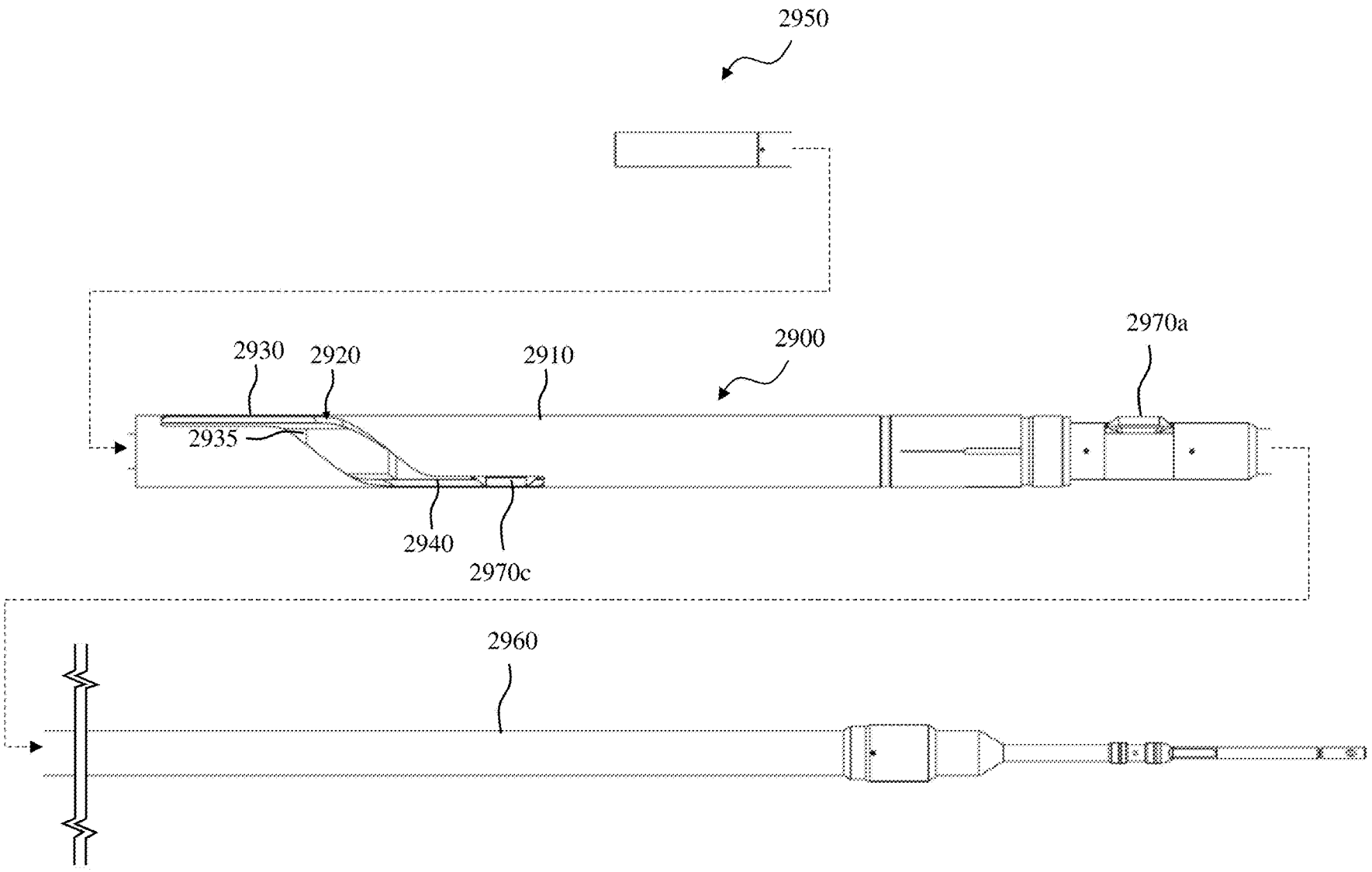
Figure 29F:
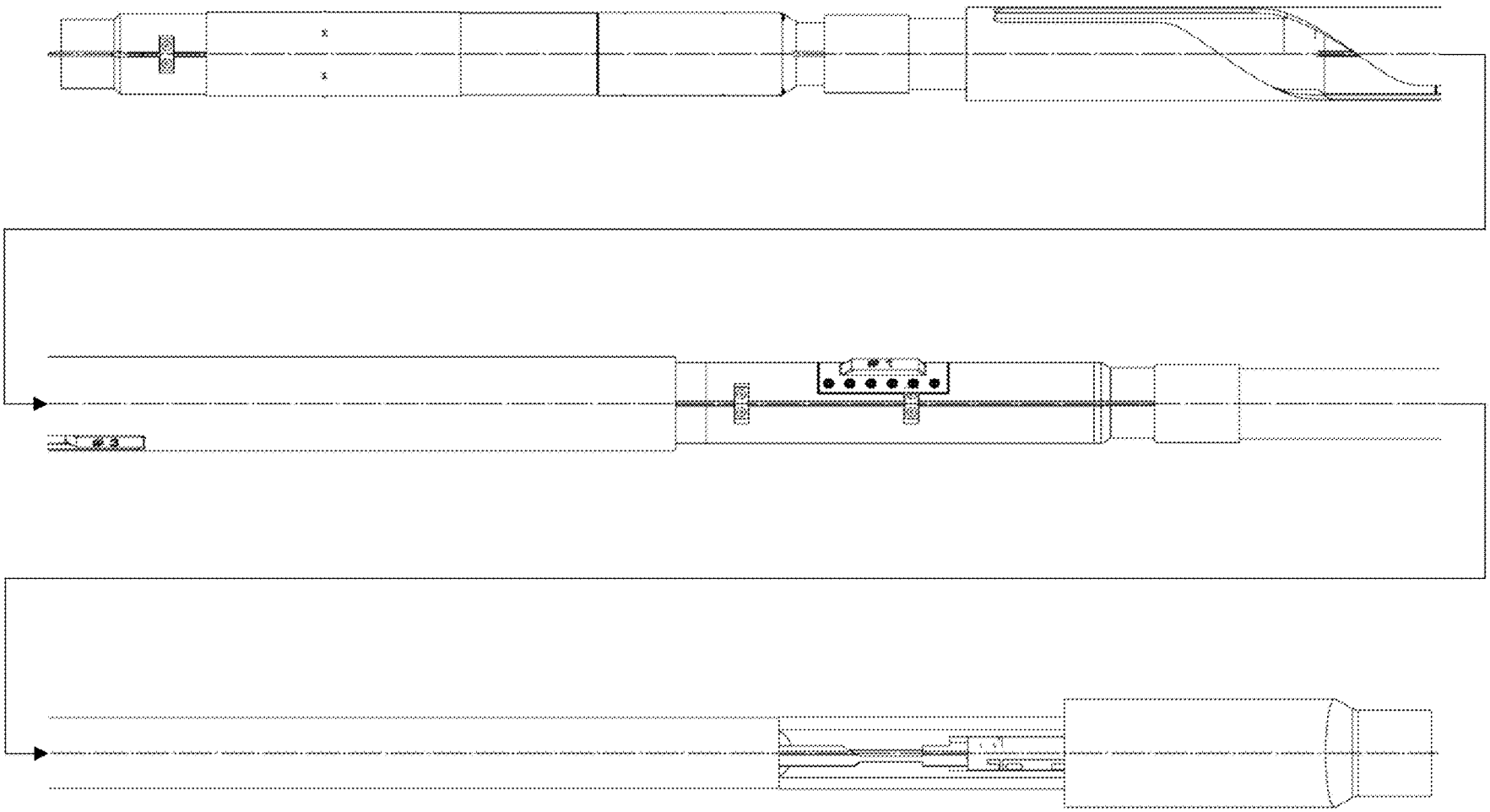

With reference to FIG. 29F, illustrated is the keyed running tool 2950 of FIG. 29E after continuing to push the keyed running tool 2950 downhole causing the uphole key 2970*c* to rotate within the slot 2920 until the uphole key 2970*c* is positioned within the second axial portion 2940 of the slot 2920. At this stage, at least in the embodiment of FIGS. 29A through 29F, the keyed running tool 2950 bottoms out, and thus cannot move any further downhole. Moreover, in certain embodiments, any downhole tool coupled to the keyed running tool 2950 is rotationally, and laterally, placed at a desired position within the wellbore.

The embodiment of FIGS. 29A through 29F assume that the downhole key 2970*a* is initially radially aligned with the slot 2920 such that as the keyed running tool 2950 is pushed downhole the downhole key 2970*a* would engage with at least one of the first axial portion 2930, the angled portion 2935, or the second axial portion 2940. Nevertheless, in certain instances the downhole key 2970*a* would be radially misaligned with the slot 2920 such that as the keyed running tool 2950 is pushed downhole the downhole key 2970*a* would not engage with the slot 2920. In such an instance, either one of the middle key 2970*b* or the uphole key 2970*c* might initially radially align with the slot 2920.

In the instance where the downhole key 2970*a* is radially misaligned with the slot 2920 but the middle key 2970*b* is at least partially radially aligned with the slot 2920, the keyed running tool 2950 would be pushed downhole causing the downhole key 2970*a* to miss the slot 2920 and the middle key 2970*b* to initially engage with and rotate within the slot 2920 until the middle key 2970*b* is positioned within the second axial portion 2940 of the slot 2920 and the uphole key 2970*c* is positioned within the first axial portion 2930 of the slot 2920, very similar to that shown in FIGS. 29C and 29D. Thereafter, the process would proceed by continuing to push the keyed running tool 2950 downhole causing the uphole key 2970*c* to rotate within the slot 2920 until the uphole key 2970*c* is positioned within the second axial portion 2940, at which time the downhole tool is rotationally positioned within the wellbore, similar to that shown in FIGS. 29E and 29F.

In the instance where the downhole key 2970*a* and the middle key 2970*b* are both radially misaligned with the slot 2920 but the uphole key 2970*c* is at least partially radially aligned with the slot 2920, the keyed running tool 2950 would be pushed downhole causing the downhole key 2970*a* and middle key 2970*b* to miss the slot 2920 and the uphole key 2970*c* to initially engage with and rotate within the slot 2920 until the uphole key 2970*c* is positioned within the second axial portion 2940, at which time the downhole tool is rotationally positioned within the wellbore, very similar to that shown in FIGS. 29E and 29F.

Unique to at least one embodiment of the design, no matter the radial alignment between the keyed running tool 2950 and the slotted orientation apparatus 2900, at least one of the downhole key 2970*a*, the middle key 2970*b*, or the uphole key 2970*c* will at least partially align with the slot 2920. Accordingly, regardless of the radial alignment, in at least one embodiment the uphole key 2970*c* will ultimately always end up in the second axial portion 2940, resulting in the downhole tool that is coupled to a downhole end of the keyed running tool 2950 being both laterally and rotationally positioned as a desired located within the wellbore.

It should be apparent to one skilled in the art that the keyed running tool 2950 may also align with respect to the slotted orientation apparatus 2900 when traveling from below the slotted orientation apparatus 2900 in an upward motion (e.g., provided the keys 2970*a*, 2970*b* and 2970*c* have the proper profile to engage the slot 2920 in the slotted orientation apparatus 2900. For example, the keys 2970*a*, 2970*b* and 2970*c* could engage with the slot 2920 in the opposite manner as was described above with respect to FIGS. 29A through 29F.

It should also be noted that the slotted orientation apparatus 2900 may have an upward no-go to hold the keyed running tool 2950 in an axial position until a desired amount of upward force is exerted to cause the no-go mechanism (not shown) to allow further upwardly movement. In some embodiments, one or more of the keys (e.g., uphole key 2970*c*) may provide the desired resistance to temporarily halt the upward movement of the keyed running tool 2950 (e.g., until additional force is applied).

It should also be noted that the slotted orientation apparatus 2900 may be designed to slide/fit inside a standard API-type casing, or a specially designed tubular with an OD similar (or different) than a standard API casing, tubing, or other tubular.

It should be noted that the lengths of the first and second axial portions 2930, 2940 do not have to be the same. In some examples it may be desirable for the keyed running tool 2950 to be held at a certain orientation by one or more of the keys 2970 until an additional distance has been traveled—or a certain event has occurred (e.g., mating up with another assembly pre-installed in the well). In one or more embodiments, the additional distance may be used to slow the rate of decent of 2950 by including one or more devices such as a dashpot, a spring, a cushion, a damper, or combination thereof to resist the motion of 2950 and the components attached to it. One or more components of such a device may be positioned between the distal end of 2900. In some embodiments, one or more devices may be used to releasably lock 2950 and/or associated components/assemblies (e.g., swivel, ETM, etc.) in place. In one or more embodiments, it may be beneficial to allow the 2950 and/or associated components (e.g., ETM, Fiber Optic Wet Mate, Production Tubing, etc.) to move after engagement. For instance, after an ETM (e.g., fiber optic Wet Mate, Electrical Wet Mate, a combination of ETMs) coupling is coupled together, the production string (e.g., tubing) may expand or contract due to changes in pressures (e.g., ballooning, etc.) or thermal changes (e.g., due to pumping a cold fluid down a warm/hot production tubing string, etc.) or for other reasons. In such cases, it would be pertinent to allow the ETM (and/or related parts) to move at least axially so that the loads generated by ballooning, heating/cooling, etc. will not load against the ETM couplings and try to force them apart. A device that allows the control line to expand/contract without generating forces on the ETM would be preferred. The device may comprise a coiled or folded control line which can allow (axial) movement without inducting high-stresses or loads on the control line and/or related components (such as the ETM). The space between the distal end of 2900 and the First Equipment (e.g., Lower Completion's Wet Mate, the Lower Completion's Sand Control String, etc.) would be a preferred location for devices mentioned above (e.g. mechanical device (such as a collet, spring, a dashpot, etc.), an electrical device (a sensor, switch, etc.), a fluidic device (reservoir, accumulator, a poppet valve, a check valve, etc.), an electronic device (a sensor, a MEMS device, etc.), etc. Other devices, technologies, etc. may also be employed in this area. In some or most cases the lower components of the third equipment section (aka Upper Completion String) may have complimentary features, devices, assemblies that may function together with the above-mentioned items (e.g., items located on the distal end of 2900). The above is not meant to limit the use of the area above 2900; similar or different features, devices, assemblies may be used above 2900 to aid in the efficient, reliable installation and use of the items disclosed within. The above items, features, devices, assemblies mentioned herein are applicable for use with a second equipment section (e.g., Work String) or other Equipment Sections such as another Equipment Section similar to the second equipment section (e.g., Work String) which may be used before Third Equipment String is used and/or after Third Equipment String is used.

It should be apparent that the slotted orientation apparatus (e.g., slotted orientation apparatus 2600, 2900) and the keyed running tool (e.g., keyed running tool 2800, 2950) disclosed herein may be used to perform other actions whether or not debris may be an issue. For example, the slotted orientation apparatus may be used to orient tools for formation evaluation, production evaluation, evaluating the condition of tools/equipment, etc. In at least one embodiment, the slotted orientation apparatus could orient a feeler gauge (e.g., multi-finger device) to measure erosion at various orientations.

A keyed running tool according to the disclosure may be a sleeve-type device, wherein after it orients a tool it remains located in the slotted orientation apparatus while the oriented tool (and coiled tubing) continues to move downward. For example, the sleeve-type keyed running tool might orient the tool so it enters the mainbore leg of a multilateral junction. After the oriented tool is aligned, the sleeve-type keyed running tool might release itself from the tubing (e.g., coiled tubing), so the oriented tool can continue to be lowered into the mainbore via the tubing. In at least one other embodiment, the sleeve-type keyed running tool could have a jay-profile, so that when the other tool is pulled back above a y-block, the sleeve-type keyed running will index 90-degrees and the other tool will enter the lateral bore of the multilateral junction and/or y-block.

Turning to FIG. 25', as well as FIGS. 29A' through 29F', illustrated is a hydraulic stimulation device designed, manufactured and/or operated according to one or more embodiments of the disclosure. The hydraulic stimulation device is similar in many respects to the multilateral junction 2500 and slotted orienting apparatus 2900 disclosed above, and thus may share many of the same features.

In one embodiment, this disclosure seeks to capture completion (e.g., stimulation) data and/or long-term production data by employing a fiber optic wet mate. One purpose is to implement a downhole fiber optic wet-connect to monitor downhole parameters, etc. employing gauges, sensors (including distributed, quasi-distributed fiber optic sensors, and the fiber itself (such as measuring the change in light in the fiber optic cable such as "backscattering" of light occurring in an optical fiber when the fiber encounters vibration, strain or temperature change)), etc. In at least one embodiment, this occurs after the production string is installed. In one or more embodiments, the new product/service/method of this disclosure provides a low-cost solution to record completion-type operations (gravel-packing, etc.) via the same downhole wet connect (e.g., wet mate), or in an alternative embodiment using a different wet connect (e.g., wet mate). The different wet connect could be one that the production string could plug into. In at least one embodiment, this may keep the downhole wet mate of the production string protected (e.g., covered and protected from debris, etc.).

In one embodiment, a downhole data recorder, sometimes referred to in the disclosure or drawings as a black box, comprising a light source, light receiver (or transceiver) and a data logger would be "plugged into" the downhole fiber optic wet-connect at the surface before running the first equipment section downhole. The term "black box," as used herein, is a system which can be viewed in terms of its inputs and outputs without knowledge of its internal workings. The term can be used to refer to many inner workings, such as the ones of a transistor, an engine, an algorithm, an optical-to-electrical transceiver, such as a small form-factor pluggable (SFP) that converts the electrical signals to optical signals and vice versa, or alternatively a TinyML device.

In some embodiments, the black box may comprise more than one black box. In some embodiments, one black box may contain some components and another black box may include similar or different components. In some embodiments the second box may be a "backup" to the first black box. In some embodiments, one black box may include the "sending" components (light source, power source, controller, etc.) and another black box may include the "receiving" components (light receiver, energy converter (e.g., light-to-electric, battery, etc.), data storage, etc.). Each black box may have its own ETM (e.g., wet mate/dry mate/other type of mate). The black boxes may be connected serially, in parallel, or not connected at all. FIG. 50A illustrates a block diagram of an example of a data recorder.

In at least one embodiment, data would be logged during the gravel pack operation and then the black box would be retrieved with the second equipment section (e.g., the work string or service string). When the third equipment section (e.g., Production String (including the "Fiber String Items" shown in below and/or other devices) is installed, then the upper wet-mate would be "plugged into" the downhole fiber optic wet-connect.

Figure 30:
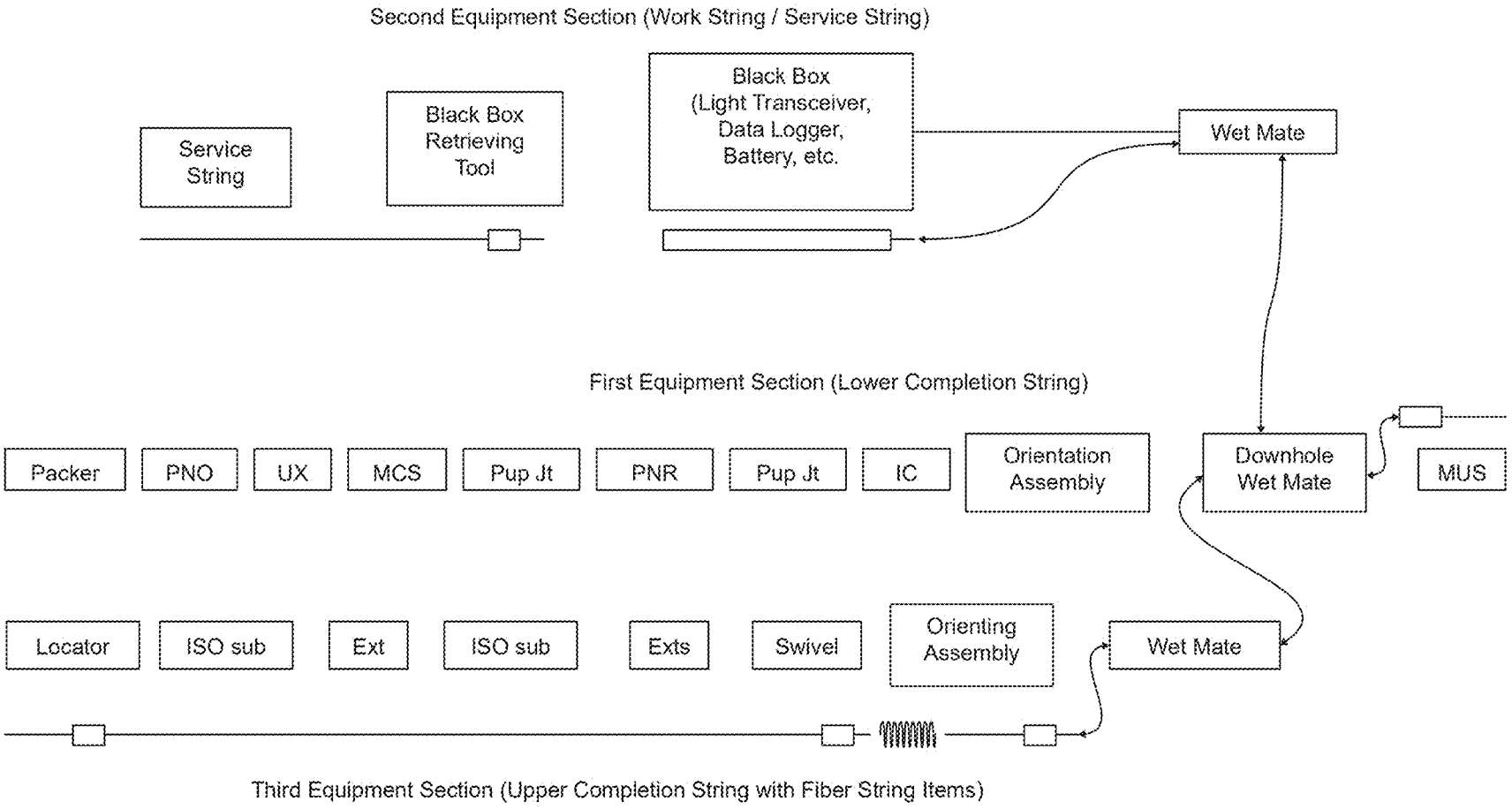
FIG. 30 illustrates one embodiment of monitoring gravel pack via the second equipment section (e.g., work string/service string), and in certain embodiments the production via the same first ETM.

Turning to FIG. 30, illustrated is one embodiment of monitoring gravel pack via the second equipment section (e.g., work string/service string), and in certain embodiments the production via the same first ETM.

In one or more embodiments, the black box would be "plugged into" the first ETM of the first equipment section (e.g., downhole fiber optic wet-connect) at the surface before running the first equipment section downhole. It should be understood that by plugging (connecting) the black box and its connector at the surface, it is not necessarily a wet mate connection. Nevertheless, if one were to break that connection downhole, and desire to make another connection downhole, it would be desirable for the connector to be a wet mate connection. Since the connector is being connected on the surface, it may be defined as a dry mate connection. In fact, the connector for the black box may not need to be a wet mate since it is typically connected at the surface (in most embodiments). However, since it is typically disconnected when downhole, it is desirable for it to be waterproof so that the black box components will not be exposed to fluids during the disconnection process and while tripping out of the well.

The following is one way to look at wet mate and dry mate connectors: There are fundamentally two different types of connectors available in the underwater arena for physical connections. These are basically wet mateable connectors, and dry mateable connectors (normally called wet mate connectors, or WMC's, and dry mate connectors, or DMC's). Wet mateable connectors are of a type that can be connected while underwater (or downhole). Dry mateable, or dry mate connectors, on the other hand, need be connected (mated) above the waterline, and then the connector and cable assembly, and its related equipment, are taken into the ocean environment. In some embodiments, a dry mate connector could be used downhole if means are provided to keep the connectors components dry during the mating process, etc.

The connection of the black box to the first equipment section may have different methods, positions, features, processes, etc. In fact, there may be more than one black box with similar or different connections, connection methods, positions, features, functions, uses, power source(s), energy types, etc. The black box may also be attached to the second equipment section in one or more methods, positions, etc. Accordingly, various different coupling mechanisms can be used to connect the black box to the second equipment section. For example, in some embodiments, the black box may be attached to the second equipment section via a protractible mechanism (e.g., telescoping, latching, etc.) so that the second equipment section may be actuated/moved/etc. to different positions without the black box moving or becoming disconnected from the second equipment section.

As one example, a telescoping mechanism may allow the second equipment section to perform all operational gravel pack steps (including but not limited to run-in-hole, packer test, circulate, reverse, etc.) with the black box remaining stationary and connected to the fiber optic connector. In another example, the second equipment section may engage the black box during one or more manipulations. As an example, the wash pipe located below the location of the black box may comprise a profile that a retrieval mechanism associated with the black box can engage the profile when it passes by the black box. For example, the black box may comprise a collet-type device as a retrieval mechanism that will catch on the wash pipe profile as the service string is pulled out of the well (or during another operation). In another embodiment, if a wash down is required, then there may need to be a means of establishing a circulating point above the float shoe. In this instance (or others), the wash pipe may need to be manipulated, therefore a "catch/release/catch" (aka snap-latch) mechanism, simply referred to as a releasable mechanism, may be useful for "catching" the black box, then releasing it, and then catching it again. Different devices can be used for releasing and catching the black box and the same releasable mechanism can be used with the different devices. The above examples and embodiments are provided as some examples of how the black box may be attached, run, used, retrieved, etc. In at least one embodiment, data would be logged during the gravel pack operation and then the black box would be retrieved with the service string. The examples and embodiments are not intended to limit the scope of the Disclosure, but only examples.

Also provided is the ability to monitor downhole completion-type operations, and in certain embodiments production-related operations via the same downhole ETM (e.g., wet mate connection). Monitoring of the completion-type operations or production-related operations via this downhole ETM can be via the ETM 5020 of the data recorder 5000 in FIG. 50A. For example, the present disclosure provides a means to improve completions operations and goals (e.g., oil productive index (PI)) by combining the data from one or more completion activities with other data such as production data, seismic data, etc. For example, as shown in FIG. 31 gravel pack data can be analyzed and combined with production data to improve and reduce well costs.

In at least one embodiment, the present disclosure provides the following commercial advantages, among others: Increase the oil productive & revenue efficiencies by gathering; 1) completion-type data (e.g., frack placement (pack factor per foot), pack factor, etc.); 2) production-type data (e.g., production per zone, production per meter/foot (distributed sensing); 3) geological/reservoir data (porosity, permeability, oil %, etc.); 4) 4D geological/reservoir data/production data; 5) analyzing the above data; and 6) using the above analysis to plan next well's completion, and employing a continuous feedback loop, including gathering data, analyzing multiple streams of data, making intelligent decisions for the next well's completion.

Figure 31:
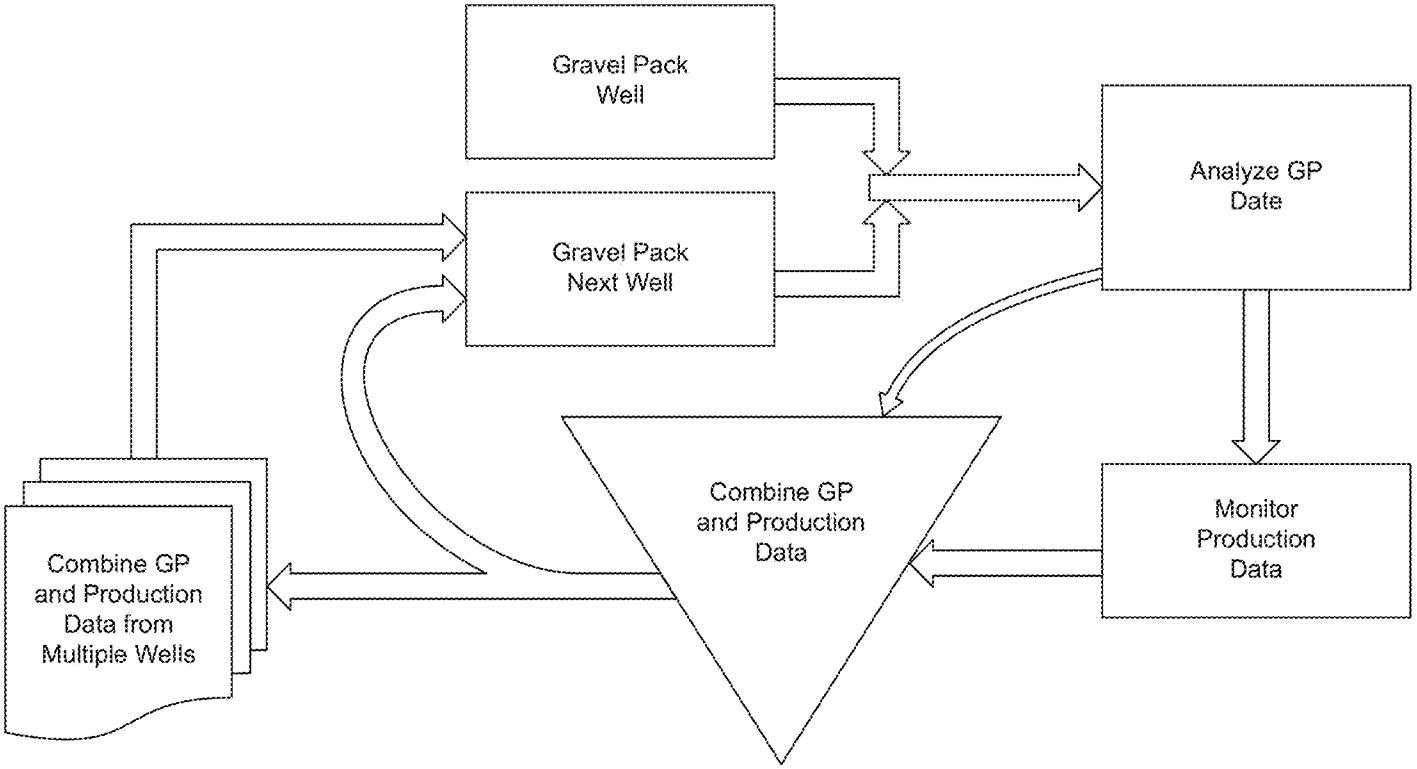
FIG. 31 illustrates that machine learning and deep learning can be used to improve and reduce well costs.
Figure 32:
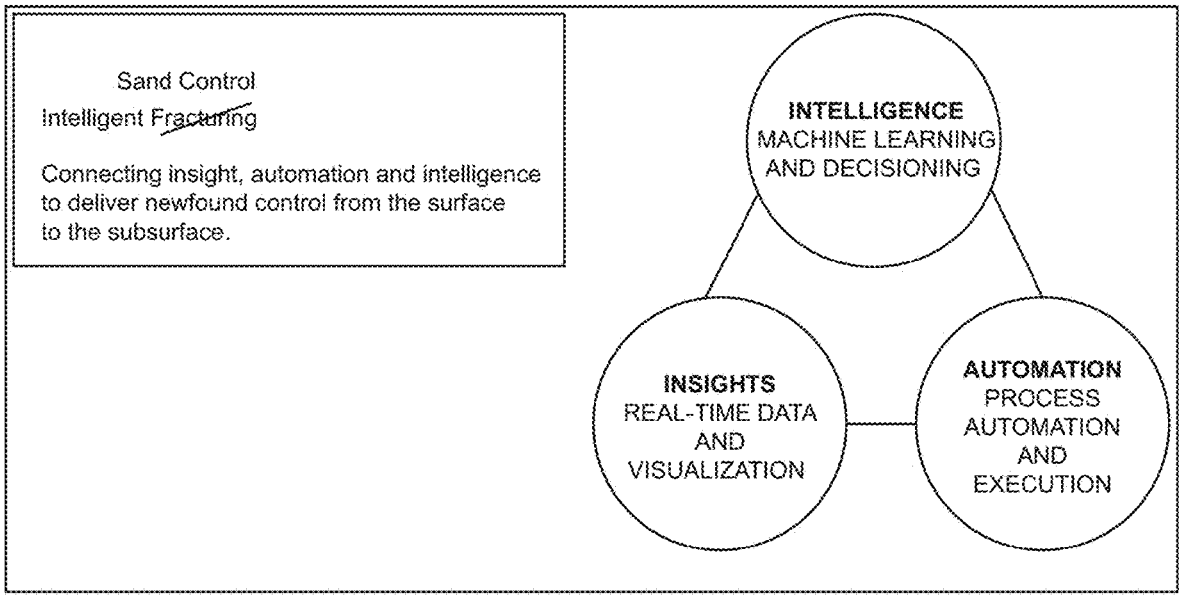
FIG. 32 illustrates that data from multiple sources may be used to increase production and make intelligent decisions.

As shown in FIG. 31, data from multiple sources may be used to increase production and make intelligent decisions. For example, as shown in FIG. 32, the present disclosure allows for intelligent sand control (e.g., using data, intelligence and automation for sand control).

Figure 33A:
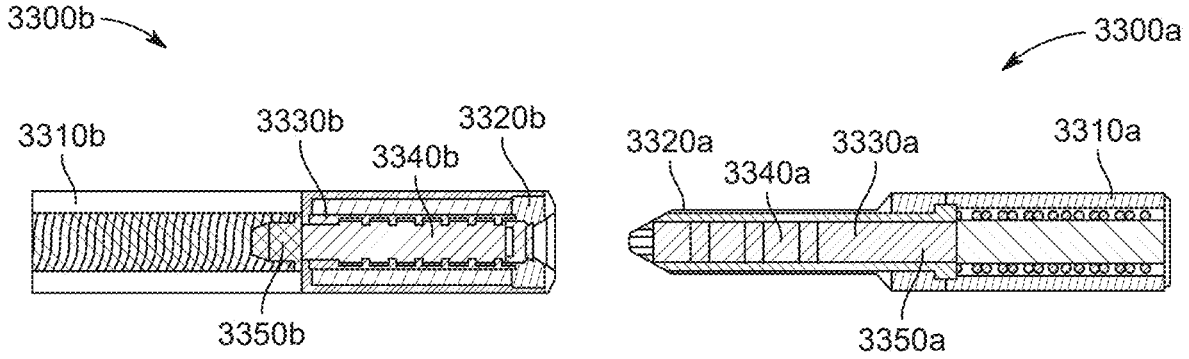
FIG. 33A illustrates an embodiment of a pair of wet mates designed, manufactured and/or operated according to one or more embodiments of the disclosure.

Turning to FIG. 33A, illustrated is an embodiment of a pair of wet mates 3300*a*, 3300*b* designed, manufactured and/or operated according to one or more embodiments of the disclosure. The wet mate 3300*a*, in one or more embodiments, includes a wet mate housing 3310*a*, the wet mate housing 3310*a* having a male wet mate connector portion or a female wet mate connector portion. In the illustrated embodiment, the wet mate housing 3310*a* includes the male wet mate connector portion 3320*a*. The wet mate 3300*a*, in accordance with this one embodiment, further includes a fluid reservoir 3330*a* located within the wet mate housing 3310*a*. In one or more embodiments, the wet mate 3300*a* further includes a volume of optical coupling fluid 3340*a* located within the fluid reservoir 3330*a*, the volume of optical coupling fluid 3340*a* sufficient to allow the wet mate housing 3310*a* to undergo at least three decoupling/coupling sequences before running out. In at least one embodiment, the volume of the optical coupling fluid 3340*a* is sufficient to allow the wet mate housing 3310*a* to undergo at least six decoupling/coupling sequences before running out, if not at least ten before running out, if not at least 20 before running out. Notwithstanding the foregoing, it is unlikely that the wet mate housing 3310*a* could undergo any more than 1000 decoupling/coupling sequences before running out.

The wet mate 3300*a*, in one or more embodiments, is capable of undergoing at least three decoupling/coupling sequences before running out while the wet mate housing is in a substantially horizontal location. The term substantially horizontal location, as used herein, means that the wet mate housing is within −60 degrees and +30 degrees from perfectly horizontal. The wet mate 3300*a*, in one or more alternative embodiments, is capable of undergoing at least three decoupling/coupling sequences before running out while the wet mate housing is in a clearly horizontal location, if not ideally horizontal location, if not an exactly horizontal location. The term clearly horizontal location, as used herein, means that the wet mate housing is within −30 degrees and +20 degrees from perfectly horizontal, the term ideally horizontal location, as used herein, means that the wet mate housing is within −15 degrees and +15 degrees from perfectly horizontal, and the term exactly horizontal location, as used herein, means that the wet mate housing is within −5 degrees and +5 degrees from perfectly horizontal.

The term coupling fluid, including optical coupling fluid, as used herein, includes fluids (e.g., viscous fluids) that are capable of flushing debris, wellbore fluid, or any material (e.g., solid, liquid, fluid, gas) that may interfere/impede the connection and/or successful transmission of signal (e.g., light, electricity, etc.) etc., out of a wet mate housing, such as the wet mate housing 3310*a*. In at least one embodiment, a refractive index of the optical coupling fluid closely matches the refractive index of the transmitter of the signal. For example, a silica fiber transmitter might have a refractive index of 1.46, and thus the refractive index of the optical coupling fluid would closely match (e.g., ±10 percent) 1.46. In yet another embodiment, the refractive index of the optical coupling fluid would substantially match (e.g., ±5 percent) the refractive index of the transmitter of the signal, if not clearly match (e.g., ±2 percent), if not ideally match (e.g., ±1 percent), if not exactly match (e.g., ±0.1 percent).

Optical coupling fluids, in one or more embodiments, may include index matching fluids, including: 1) fluids with a refractive index similar to that of other optical materials, typically used for suppressing light reflections; and 2) liquid substances which are selected or optimized such that their refractive index approximately matches that of some other optical materials. Some index matching fluids have a substantially higher viscosity, which can be convenient for applications downhole. High-viscosity fluids are often called index matching gels. An important practical advantage of using optical gels instead of low-viscosity fluids is that they stay at their place without special measures for encapsulation. Silicone-based fluids are often used with visible and near-ultraviolet light because they are chemically quite inert, can be made with high purity and can be used in wider temperature ranges. Additionally, their refractive index and viscosity can be controlled to some degree via the chemical composition.

In at least one embodiment, the optical coupling fluid includes one or more primary performance aspects, including; 1) there should not be any substantial absorption or scattering of light in the relevant wavelength region; 2) such fluids should ideally not exhibit any significant rate of evaporation at the intended operation temperatures, and they should be chemically stable over long times, and would ideally also not react with metallic parts (e.g., causing corrosion) with which they may get into contact; 3) include some degree of viscosity for certain applications, and thus if such a fluid exhibits good adhesion to optical surfaces (if they are sufficiently clean), it is easier to avoid any air bubbles; 4) for temporary applications, it is often desirable that an index matching fluid can be completely removed from optical surfaces after use, restoring the full optical quality without cumbersome cleaning procedures; and 5) not flammable and non-toxic, thus completely safe to use.

In one or more embodiments, the wet mate 3300*a* includes a biasing device 3350*a* coupled with the volume of optical coupling fluid 3340*a*, the biasing device 3350*a* configured to discharge an amount of the optical coupling fluid outside of the wet mate housing 3310*a* between each decoupling/coupling sequence. In at least one embodiment, the biasing device 3350*a* is configured to discharge the amount of the optical coupling fluid outside of the wet mate housing 3310*a* as the wet mate housing 3310*a* and the second opposing wet mate housing 3310*b* are approaching one another, for example to clear any wellbore debris from the wet mate housing 3310*a* prior to the wet mate housing 3310*a* and the second opposing wet mate housing 3310*b* fully mating together. In at least one embodiment, the biasing device 3350*a* is configured to discharge a substantially consistent amount of the optical coupling fluid outside of the wet mate housing 3310*a* between each decoupling/coupling sequence. The term substantially consistent, as used herein, means that each discharge is within 75 percent of the discharge before it and/or after it. In at least one other embodiment, the biasing device 3350*a* is configured to discharge a very consistent amount of the optical coupling fluid outside of the wet mate housing 3310*a* between each decoupling/coupling sequence, the term very consistent meaning that each discharge is within 90 percent of the discharge before it and/or after it. In at least one other embodiment, the biasing device 3350*a* is configured to discharge an extremely consistent amount of the optical coupling fluid outside of the wet mate housing 3310*a* between each decoupling/coupling sequence, the term extremely consistent meaning that each discharge is within 95 percent of the discharge before it and/or after it.

It should be understood that the term optical coupling fluid and the term coupling fluid, unless otherwise required may be used interchangeably through the application, and the definitions—both as defined in this document as used within industry—can be used without limiting the scope of this disclosure. Likewise, the ETMs, the wet mates, the components of the ETMs and/or Wet Mates, unless otherwise required, may be exchanged and still remain within the scope of this document. For example, a fluid reservoir 3330*b* may contain a volume of optical coupling fluid 3340*b*, or a volume of dielectric coupling fluid, or a volume of other fluid(s) that may be used to improve the connection of the wet mate (e.g., by debris removal, optical clarity, improved electrical transmission, improved fluid/hydraulic seal, or combinations thereof).

The wet mate 3300*b* is similar in many respects to the wet mate 3300*a*, but for the wet mate 3300*b* including the female wet mate connector portion 3320*b*. Accordingly, the wet mate 3300*b* may additionally include a wet mate housing 3310*b*, a fluid reservoir 3330*b* located within the wet mate housing 3310*b*, a volume of optical coupling fluid 3340*b* located within the fluid reservoir 3330*b*, the volume of optical coupling fluid 3340*b* sufficient to allow the wet mate housing 3310*b* to undergo at least three decoupling/coupling sequences (e.g., at least six decoupling/coupling sequences, at least ten decoupling/coupling sequences, at least 20 decoupling/coupling sequences) before running out. In at least one embodiment, the wet mate 3300*b* may additionally include a biasing device 3350*b*.

In the illustrated embodiment, the wet mate 3300*a* could be associated with a lower completion string, and the wet mate 3300*b* could be associated with another tubular string (e.g., service string and/or upper completion string). In yet another embodiment, the wet mate 3300*b* could be associated with the lower completion string and the wet mate 3300*b* could be associated with the other tubular string (e.g., service string and/or upper completion string).

Figure 33B:
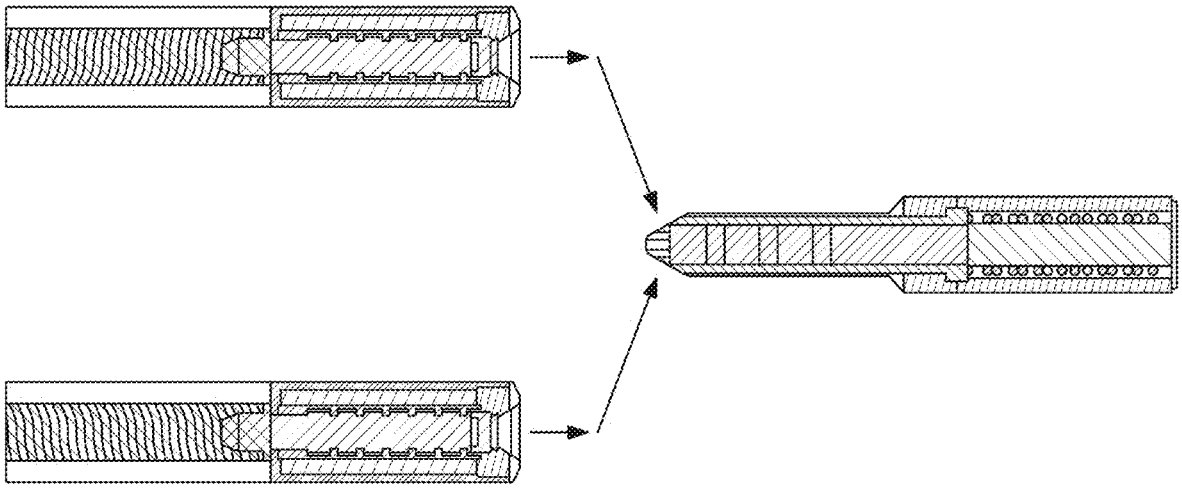
FIG. 33B illustrates an embodiment wherein a permanent downhole half wet mate connector (e.g., first ETM) is coupleable to a first removable/retrievable half wet mate connector (e.g., second ETM) and a second removable/retrievable half wet mate connector (e.g., third ETM)

Turning to FIG. 33B, illustrated is an embodiment wherein a permanent downhole half wet mate connector (e.g., first ETM) is coupleable to a first removable/retrievable half wet mate connector (e.g., second ETM) and a second removable/retrievable half wet mate connector (e.g., third ETM).

One example embodiment of this product/service/method is the use of one permanent downhole half wet mate connector (shown on the right of FIGS. 33 and 34) that is installed with the first equipment section. The permanently downhole half wet mate connector is then engageable by two or more non-permanent (removable/retrievable) half wet mate connectors as shown in FIG. 33B.

Turning to FIGS. 34A through 34F, illustrated are various different embodiments of a male wet mate 3400 and a female wet mate 3450 engaging one another in accordance with one or more embodiments of the disclosure. In the illustrated embodiments of FIGS. 34A through 34F, the male wet mate 3400 includes a male wet mate end 3402 and the female wet mate 3450 includes a female wet mate end 3452. The male wet mate end 3402 and the female wet mate end 3452 may comprise many different wet mate ends and remain within the scope of the present disclosure. Accordingly, rather simple shapes are used to depict their function.

The male wet mate 3400, in one or more embodiments, may include an opening 3404 extending through a substantial center point thereof, the opening 3404 configured to engage with an ETM, such as a fiber source, electric source, inductive source, hydraulic source, combinations thereof, etc. Similarly, the female wet mate 3450, in one or more embodiments, may include an opening 3454 extending through a substantial center point thereof, the opening 3454 configured to house a related ETM, such as a fiber source, electric source, inductive source, hydraulic source, combinations thereof, etc. In at least one embodiment, the male wet mate 3400 and the female wet mate 3450 are configured to engage with one another such that the opening 3404 and the opening 3454 are substantially aligned with one another.

The male wet mate 3400, in one or more embodiments, includes a first prong 3406. In at least one embodiment, the first prong 3406 includes a catch profile 3408, the purpose of which will be discussed in greater detail below. The male wet mate 3400, in one or more embodiments, may further include a second prong 3410. In at least one embodiment, the second prong 3410 includes a fluid passageway 3412 therein, the fluid passageway 3412 in fluid contact with a male wet mate fluid reservoir chamber 3414.

The female wet mate 3450, in one or more embodiments, includes a first prong slot 3456, for example configured to couple with the first prong 3406. In at least one embodiment, the first prong slot 3456 includes a piston 3458 positioned therein. In at least one other embodiment, the piston 3458 includes a related catch profile 3460. As will be further understood below, the related catch profile 3460 of the female wet mate 3450 is configured to engage with the catch profile 3408 of the first prong 3406 of the male wet mate 3400, as the male wet mate 3400 and the female wet mate 3450 are brought together. The female wet mate 3450, in one or more other embodiments, further includes a second prong slot 3462, for example configured to couple with the second prong 3410.

In at least one embodiment, the first prong slot 3456 and a first side (e.g., left side) of piston 3458 create a first fluid chamber 3464, which in at least one embodiment is coupled to a female wet mate fluid reservoir chamber 3466. For example, in at least one embodiment, a first check valve 3468 couples the female wet mate fluid reservoir chamber 3466 to the first fluid chamber 3464. In yet another embodiment, a second side of the piston 3460 creates a second fluid chamber 3470, the second fluid chamber 3470 also coupled with the female wet mate fluid reservoir chamber 3466 via a second check valve 3472.

As shown, as the male wet mate 3400 and the female wet mate 3450 move together (e.g., the male wet mate 3400 moving to the left in the illustrated embodiments), the first prong 3406 and the second prong 3410 engage with the first prong slot 3456 and the second prong slog 3462, respectively. In at least one embodiment, the catch profile 3408 of the first prong 3406 engages with the related catch profile 3460 of the piston 3458. As the two are brought closer together, the piston 3458 is forced to the left. As the piston 3458 is forced to the left, fluid 3467 that has made its way from the female wet mate fluid reservoir chamber 3466 into the first fluid chamber 3464 is pushed past a third check valve 3474 (e.g., as the first check valve 3468 prevents the fluid from moving back toward the female wet mate fluid reservoir chamber 3466) and into a space 3476 between the male wet mate 3400 and the female wet mate 3450.

As further shown, as the male wet mate 3400 and the female wet mate 3450 move together (e.g., the male wet mate 3400 moving to the left in the illustrated embodiments), the second prong 3410 couples with the second prong slot 3462. Accordingly, a second fluid chamber 3478 is formed. The second fluid chamber 3478, is thus now coupled with the fluid 3415 of the male wet mate fluid reservoir chamber 3414 via the fluid passageway 3412. In at least one embodiment, the male wet mate fluid reservoir chamber 3414 has a bias spring 3416 and one or more check valves associated therewith, which may cause the fluid 3415 from within the male wet mate fluid reservoir chamber 3414 to be injected into the second fluid chamber 3478, and thus ultimately into the space 3476 (e.g., through a fourth check valve 3480).

Figure 34A:
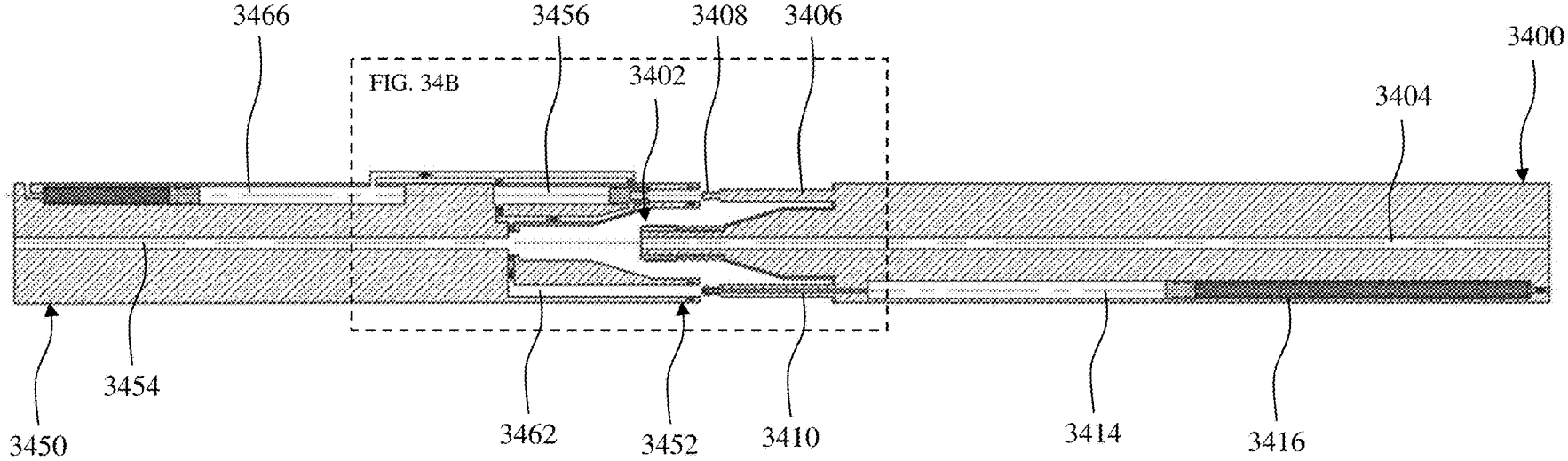
Figure 34B:
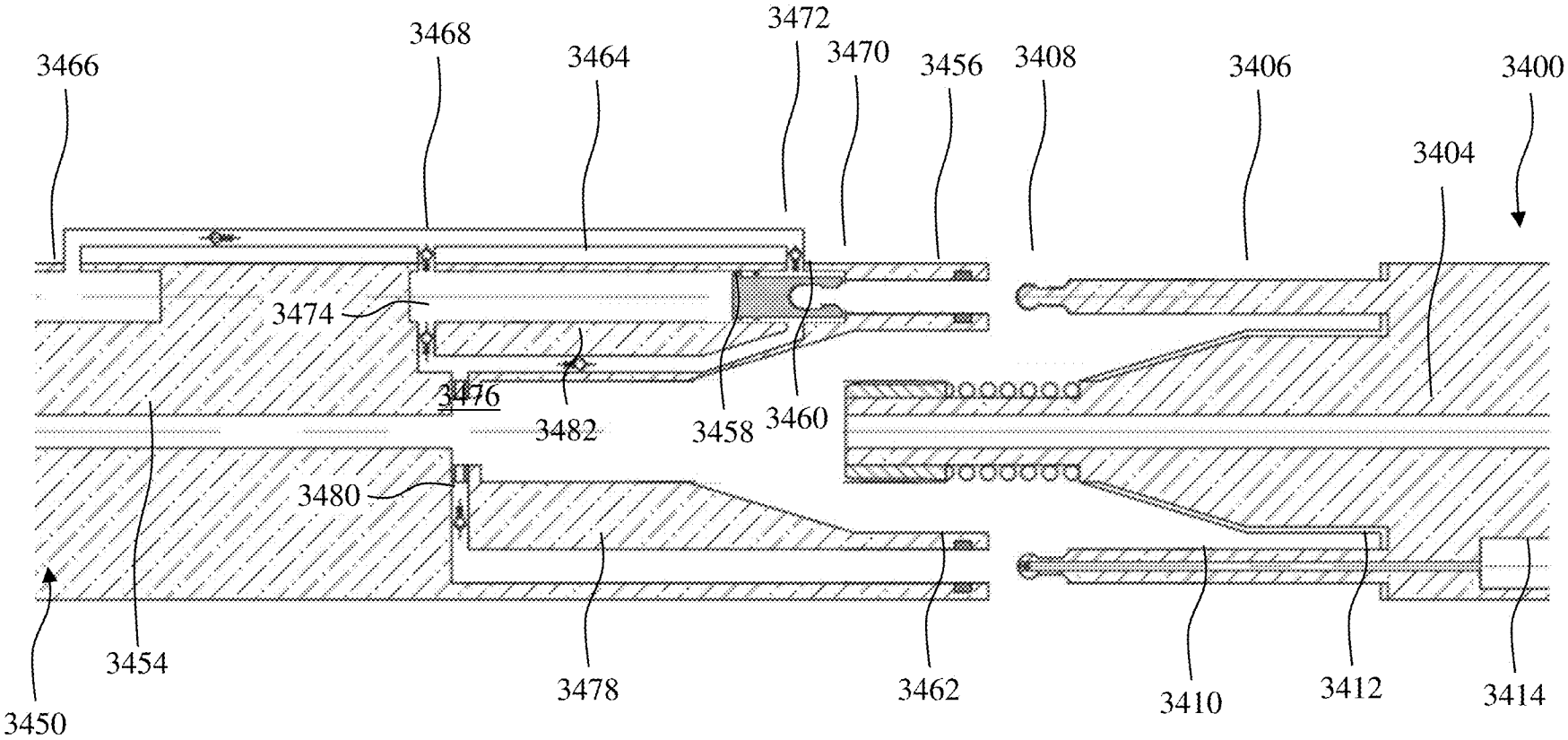
Figure 34C:
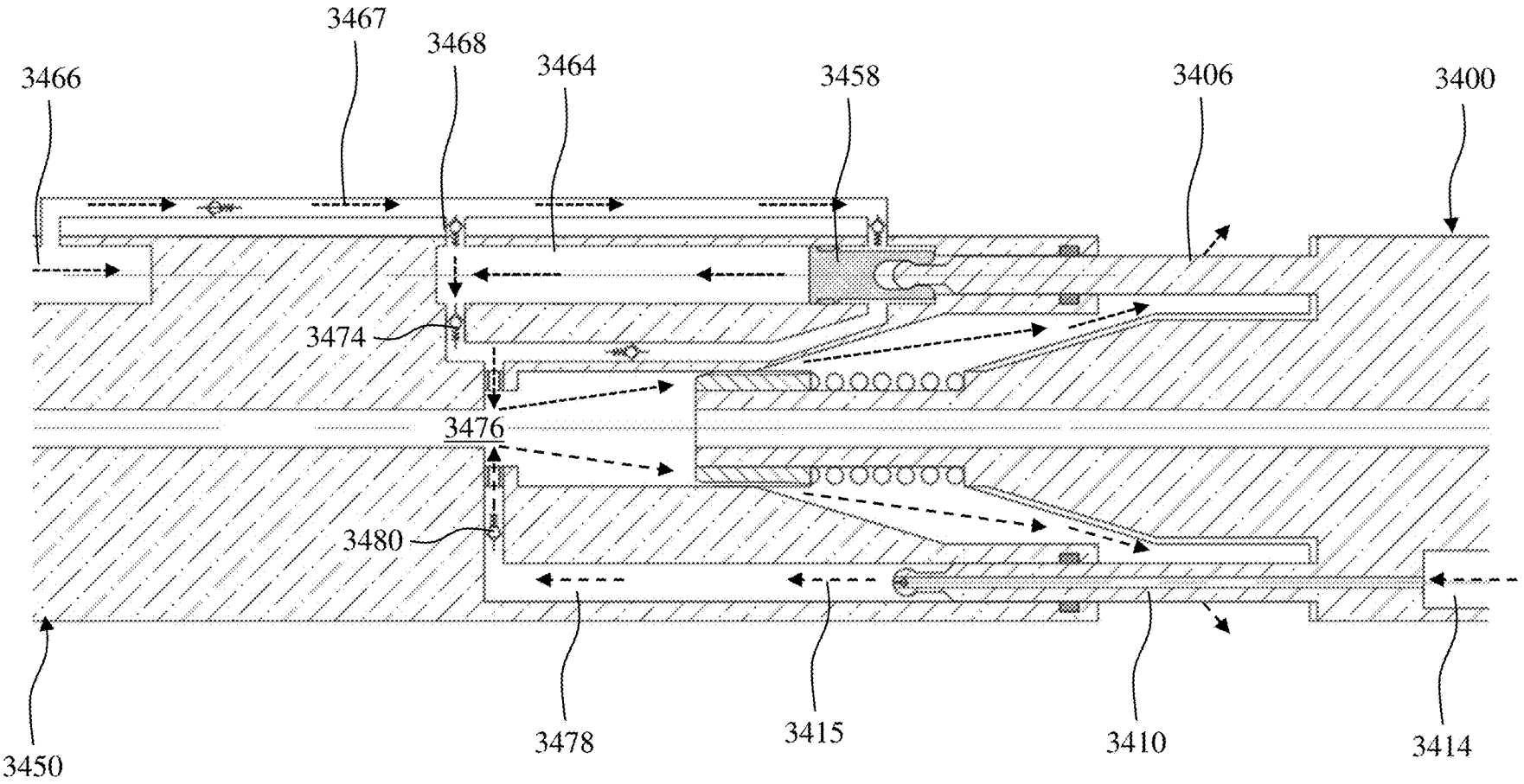

As the fluid 3467 from the first fluid chamber 3464 and the fluid 3415 from the second fluid chamber 3478 move into the space 3476, any undesirable fluid that was previously located in the space 3476 will be displaced through narrow gaps between the male wet mate 3400 and the female wet mate 3450 and ultimately outside of the two, as shown in FIG. 34C.

Figure 34D:
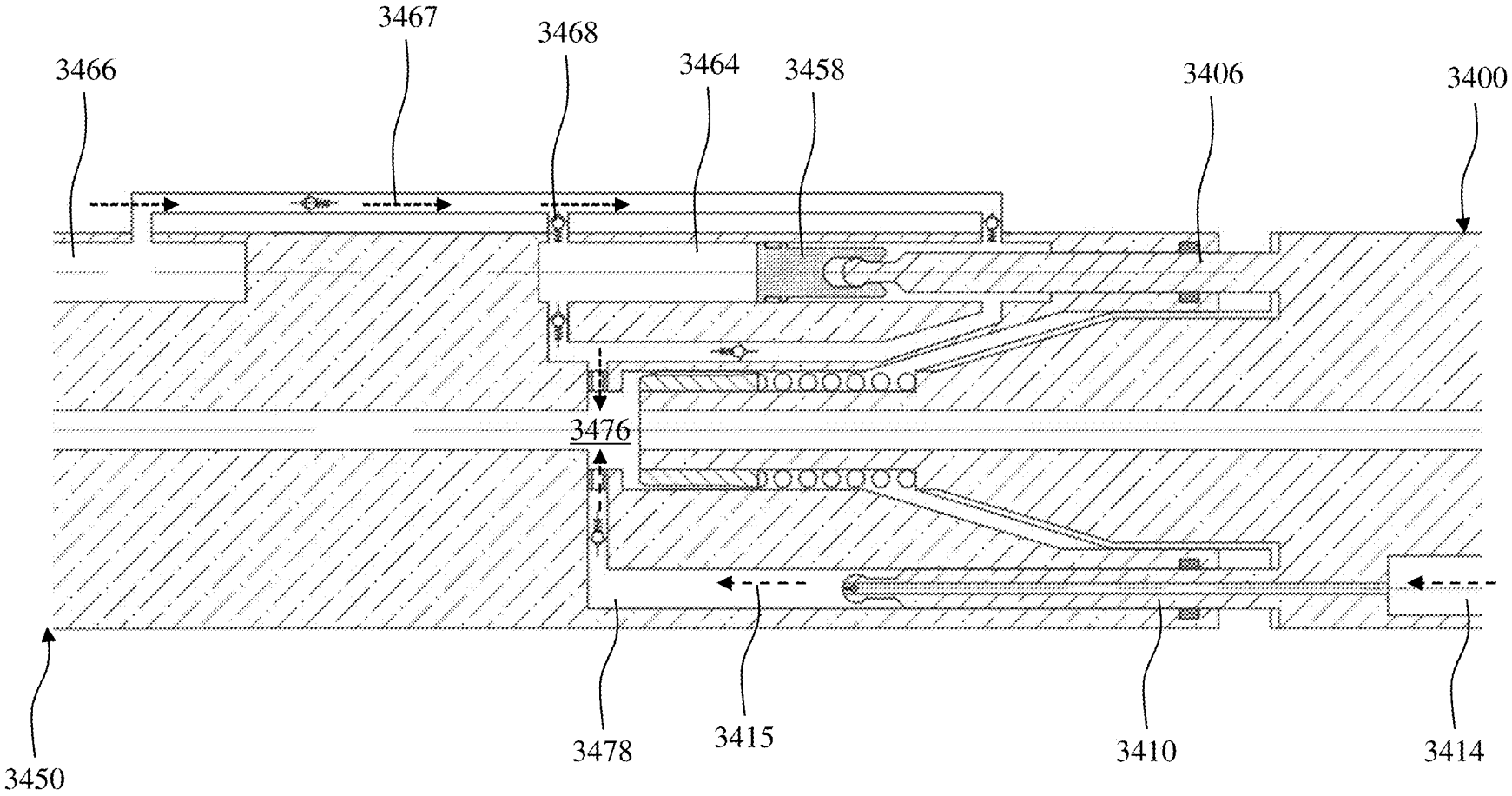
Figure 34E:
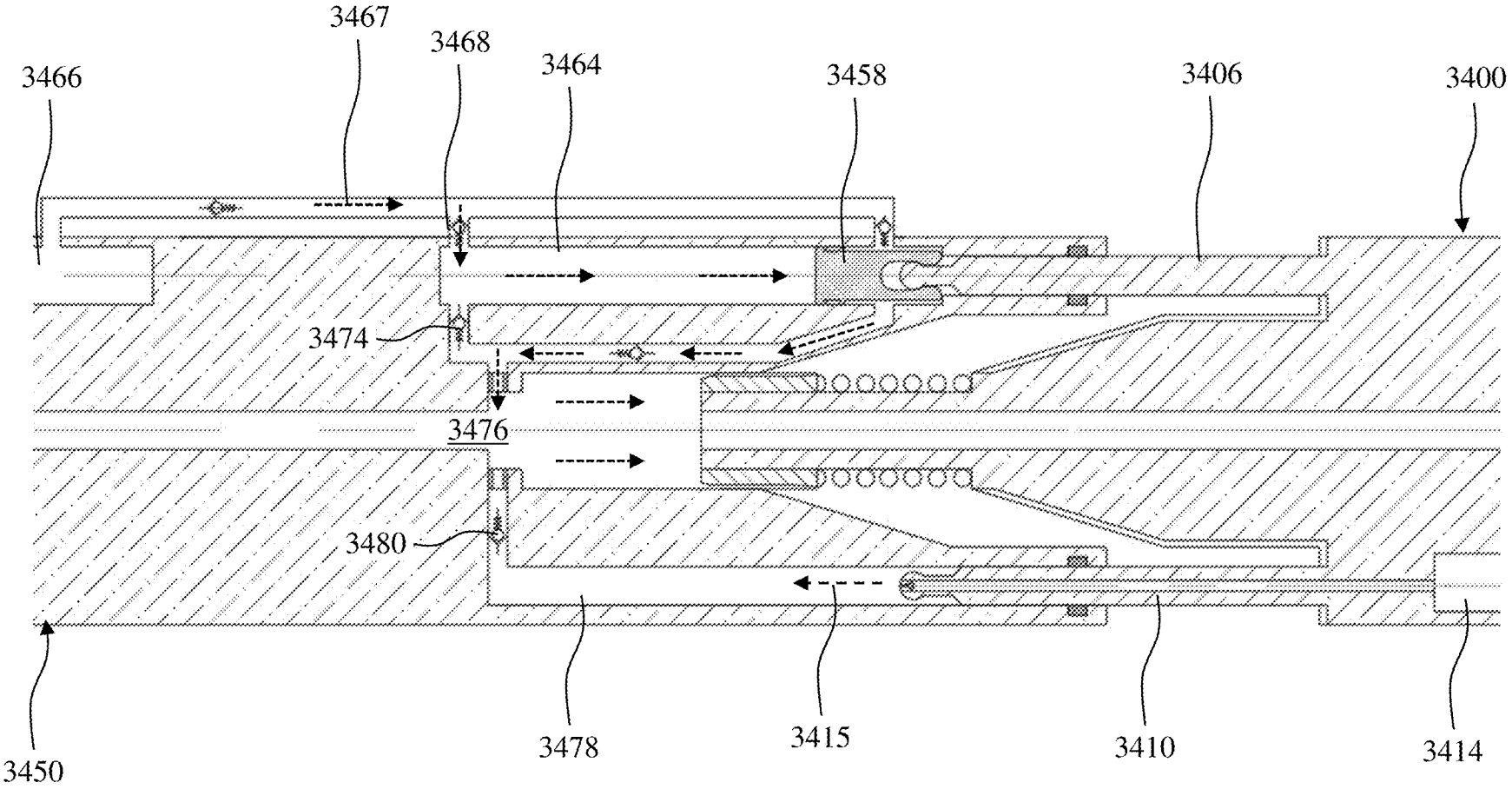

Similarly, the fluid 3467, fluid 3415, or a combination of the two fluids, may now completely fill the space 3476, as shown in FIG. 34D.

It should be noted that, in one or more embodiments, as the piston 3458 moves to the left, the fluid 3467 from the female wet mate fluid reservoir chamber 3466 fills into the second fluid chamber 3470, for example via the second check valve 3472. Thus, the piston 3472, at this stage, may have clean fluid on both sides thereof.

With the male wet mate 3400 and the female wet mate 3450 properly coupled, and thus there being no undesirable fluid within the space 3476, the device is free to operate.

However, at a time when it is desirable to remove the male wet mate 3400 from the female wet mate 3450, the two may be pulled away from each other. In the illustrated embodiment of FIG. 34E, the male wet mate 3400 would be pulled to the right. In this instance, the first prong 3406 pulls the piston 3458 to the right. In this example, the piston 3458 forces fluid from the second fluid chamber 3470 (e.g., fluid 3467 from the female wet mate reservoir chamber 3466) past a fourth check valve 3482. As a result of the location and orientation of the third check valve 3474 and, the fluid is forced into the space 3476 as the male wet mate 3400 and the female wet mate 3450 separate from one another. Furthermore, as the piston 3458 continues to move to the right, the fluid 3467 from the female wet mate reservoir chamber 3466 refills the first chamber 3464.

Figure 34F:
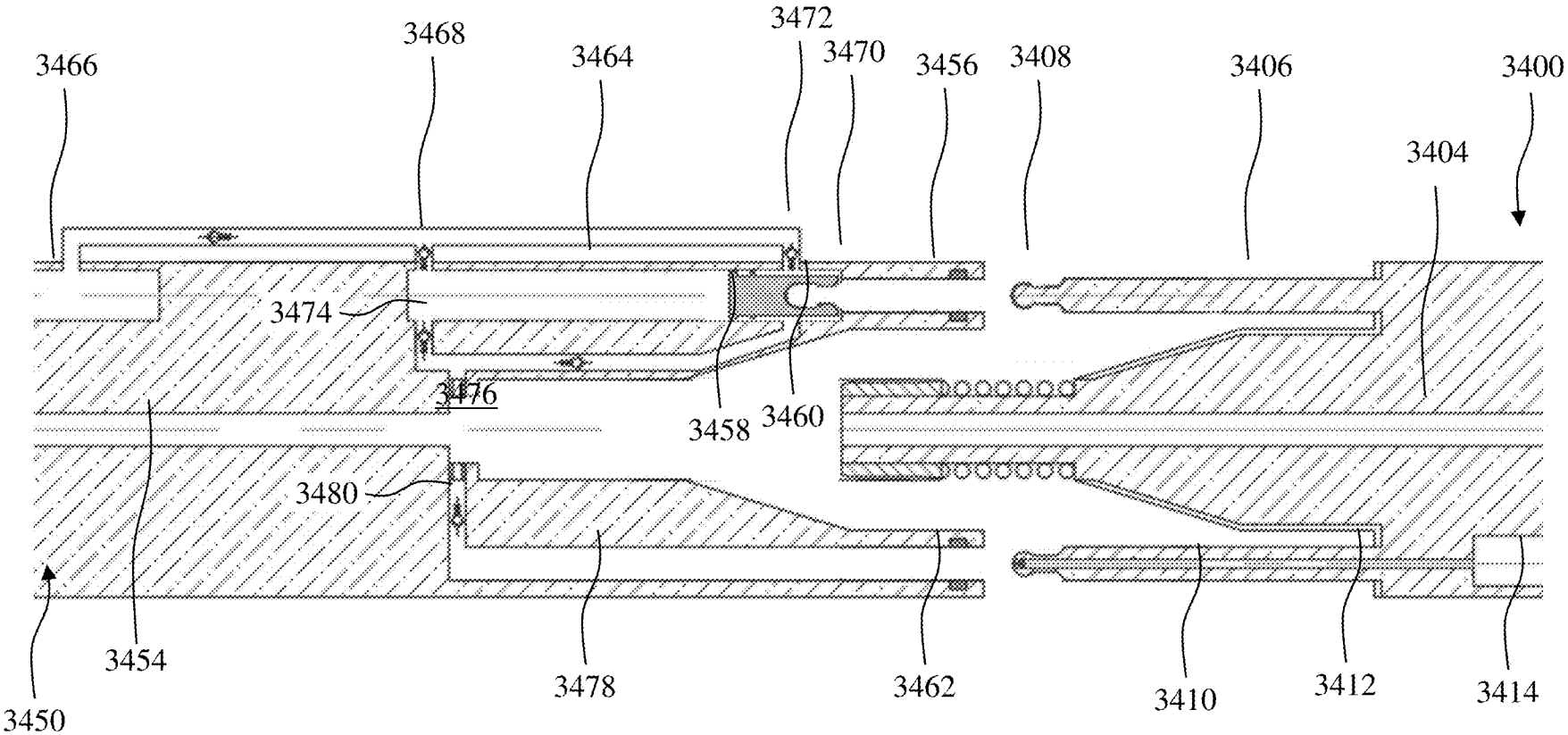

Thus, at the point when the male wet mate 3400 and the female wet mate 3450 are fully separated, the devices of FIG. 34F will be substantially identical to the devices of FIG. 34B, and ready for another coupling/decoupling sequence.

In at least one embodiment, one or more of the surfaces within the male wet mate 3400 or female wet mate 3450 may include serrations, elastic materials, etc. to aid in the flushing of the debris/displacement of fluids/mating of the wet mates/etc.

Figure 34G:
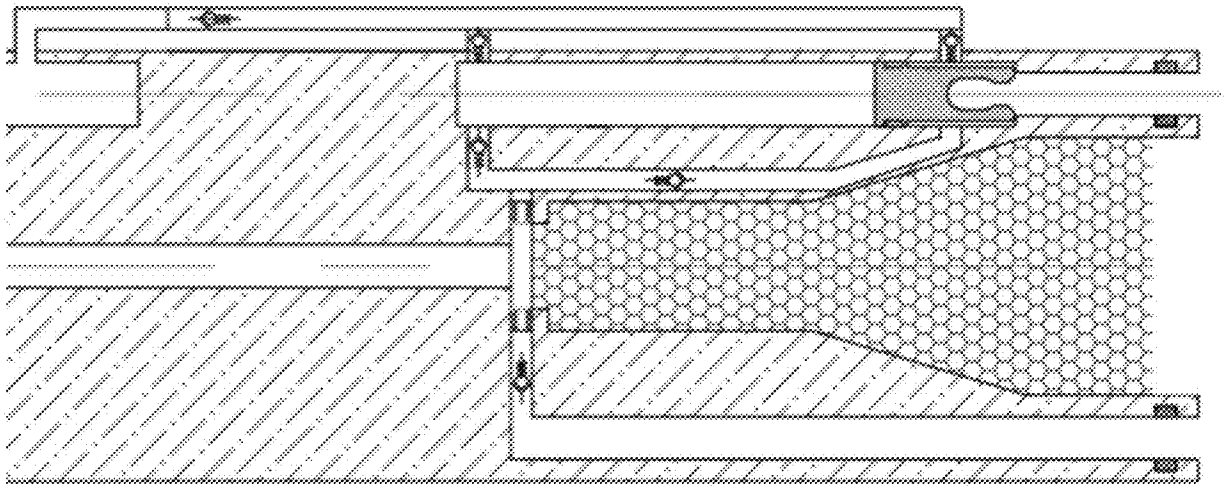
Figure 34H:
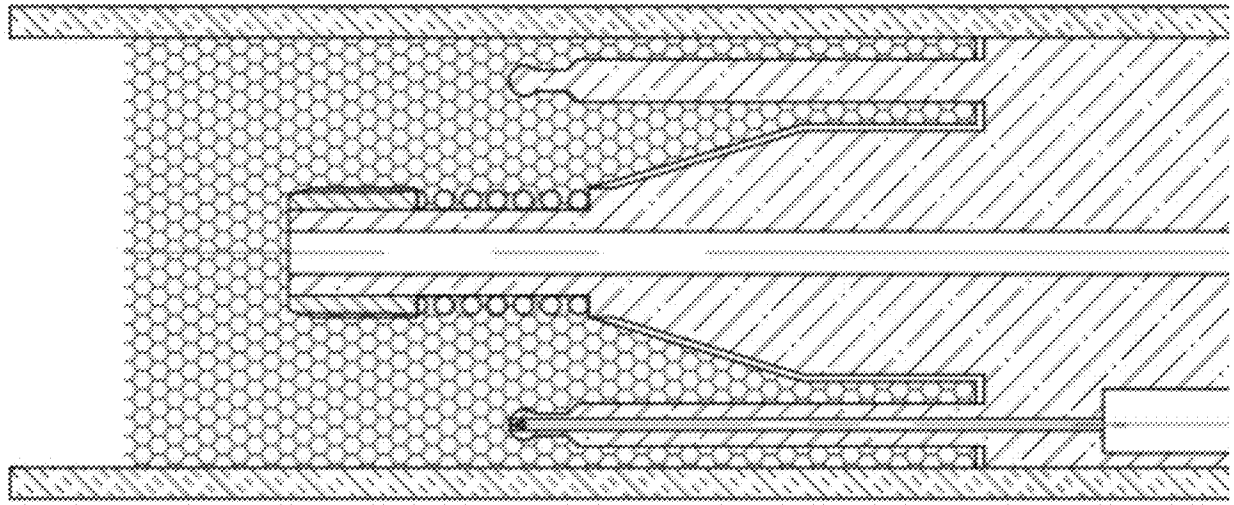
Figure 34I:
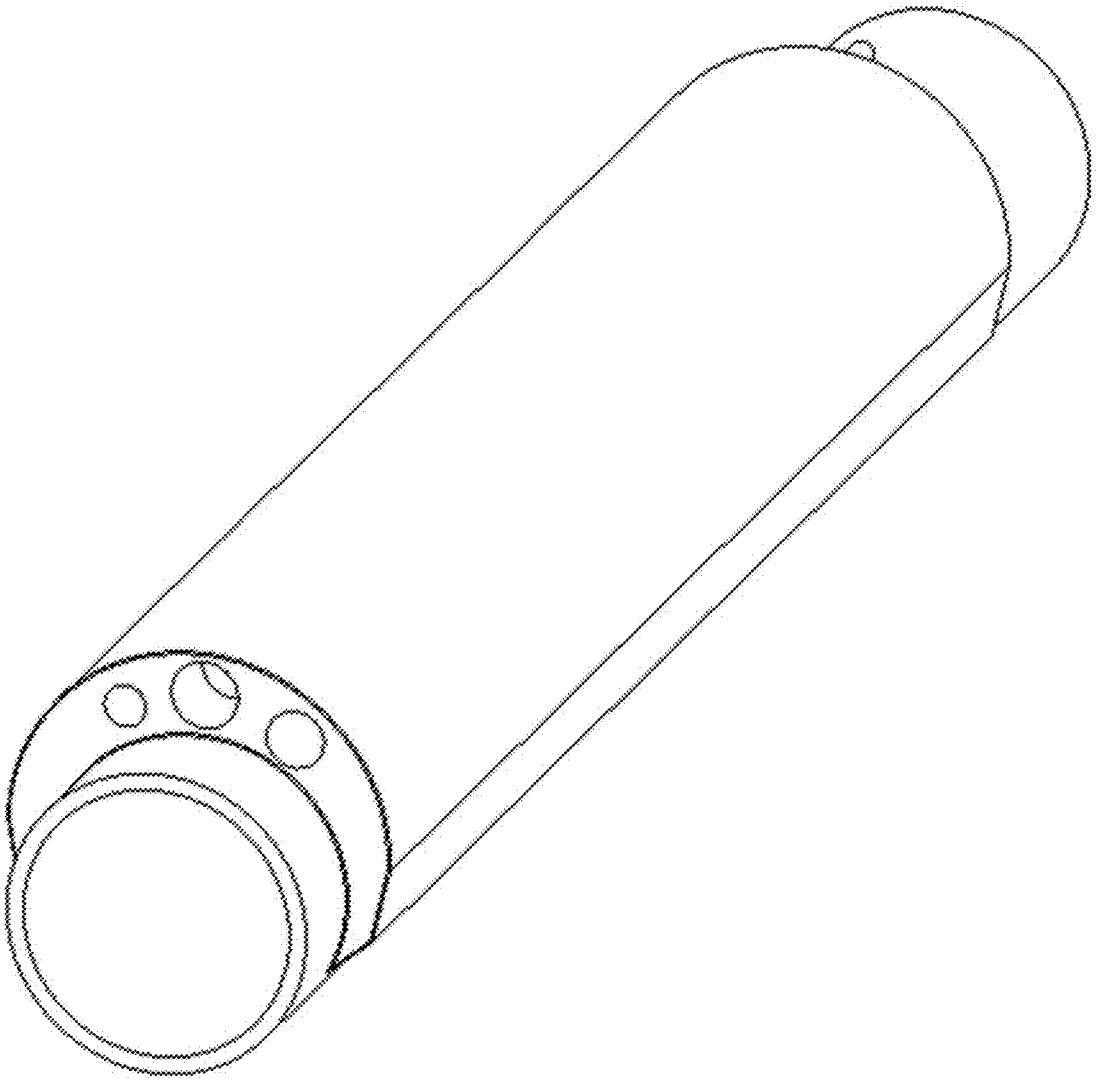
Figure 34J:
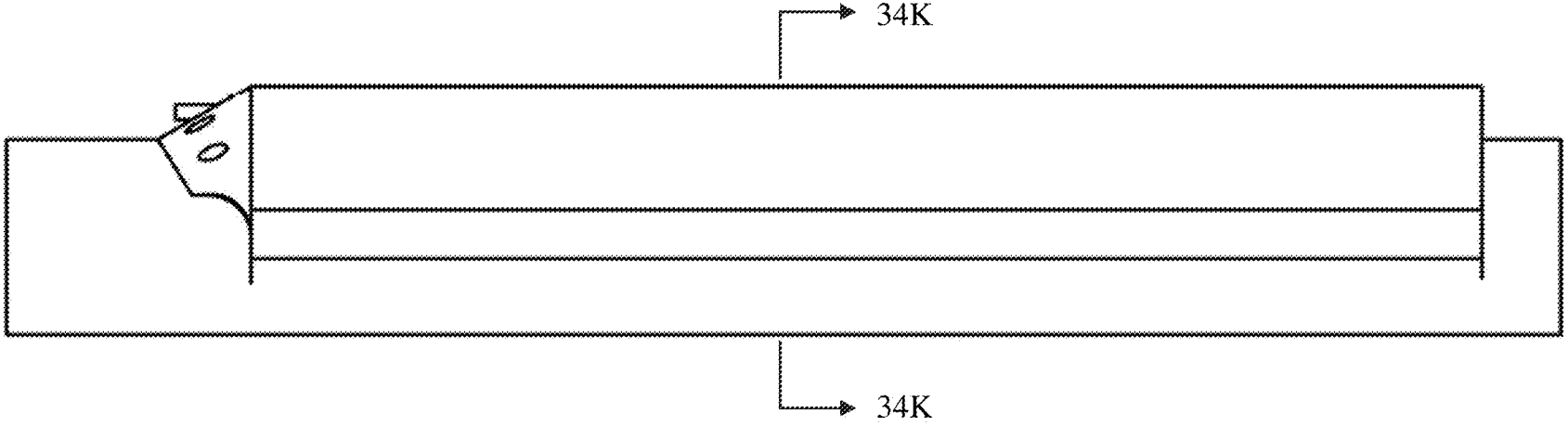
Figure 34K:
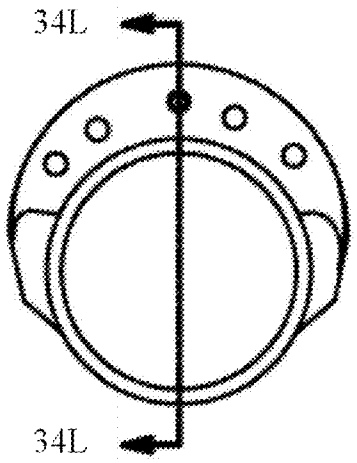

Turning now to FIGS. 34G and 34H, illustrated is another embodiment wherein cavities of one or more of the male wet mate 3400 or female wet mate 3450 remain filled with a fluid/gel/solid/composite (multiple-material mixture)/gel-making/clear fluid/dielectric fluid/anti-corrosion material, or a combination of one or more thereof, etc. so that well bore fluids and/or debris cannot enter the cavity/cavities when the wet mates are not connected.

Figure 34L:
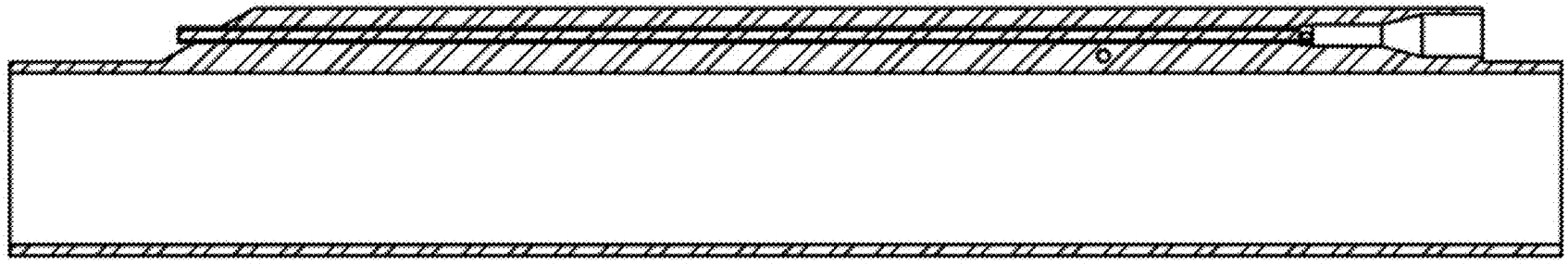

Turning to FIGS. 341 through 34L, illustrated are various different views of one or more embodiments or a wet mate connection, for example including one or more fluid reservoirs, designed, manufactured and/or operated according to one or more embodiments of the disclosure.

In at least one embodiment, the operational steps may be as follows. The first equipment string is made up on surface. The first equipment section (e.g., lower completion string) may include sand screens, frac pack screens, expandable screens, oriented screens, base pipe, ICVs, ICDs, AICDs, electric inflow control devices (eICDs), casing, liners, perforated pipe), as shown in FIG. 35. A listing of sensors (e.g., completion task sensors capable of obtaining completion task sensor information), flow control devices, tinyML, edge computing devices, fog computing devices, machine-to-machine (M2M) communications devices, software, IoT devices adapted/adopted, etc. are illustrated herein.

One feature in the above FIG. 35 is the downhole wet mate also denoted above as a permanent downhole half wet mate connector in FIGS. 33 and 34. The downhole wet mate may include of any type of energy transfer devices that can be connected downhole in a harsh environment. The wet mate connector may comprise more than one type of energy transfer device (e.g., electrical+light (fiber optic), electrical+light+hydraulic, 2-electrical+3 light, etc.). There may be multiple wet connect devices in series or parallel or other combinations.

After the downhole wet mate is connected and all sensors, devices, lines are checked to ensure they are working properly, the gravel pack tools may be attached to the first equipment section. As shown below, the gravel pack tools may comprise one or more tools depending on the type of gravel pack operation, etc. As shown in FIGS. 36 and 37, a line may extend from the downhole wet mate (or related part) upwards to connect to one or more distributed sensors on the service tool string for monitoring, sensing, controlling, one or more devices/tools associated with the gravel pack tool-string, and for example transferring the completion task sensor information uphole as the service string is coupled with the lower completion string. The devices may be known tools, known tools with additions (e.g., add sensors or controllers), or new/unique tools not commonly associated with gravel packing/gravel pack tool-strings. As illustrated in FIG. 37, a data recorder (e.g., a black box) can be connected to the downhole wet mate for the monitoring, sensing, controlling, and transferring. Depending on the type of downhole wet mate, the black box can include either one of the wet mates 3300*a* or 3300*b* for connecting to the downhole permanent half wet mate connector. FIG. 50A illustrates an example of data recorder 5000 that can be used.

Certain advantages may be achieved by adding sensors to the service string. For example, axial stress/strain/load sensors may be used. When running in the well with a lower completion system ledges or other obstacles may be encountered which may resist or prevent the continued lowering of the completion into the well. By having multiple load sensors in the lower completion and in the service string, the operator will know if the resistance is from one particular point (e.g., a ledge) or if the resistance is due to a distributed resistance (e.g., such as a large part of the completion laying on the low side of the wellbore). In addition, if the resistance is due to a ledge, or other local effect, the operator may be able to ascertain if the localized loading may cause a failure in the tools in the localized area. If the tools are strong and not near a failure rating, additional weight may be added to the string to force the string to bottom.

However, if a tool in that particular area is for example a tool with a low axial rating, then the operator will know that he/she cannot get aggressive with the string and add more weight or pull excessively high loads.

Similarly, torque sensors may be used. In some completion strings (e.g. certain types of screens), it is not recommended to apply torque (or rotation) to the screens. However, in some circumstances, applying rotation or torque to a string is required. For example, if a string (e.g. lower completion, service string, a liner, etc.) becomes stuck, applying torque or some rotation may be employed to free the stuck string. By having a torque sensor in the service string near the bottom of the service string (or above the lower completion), the amount of applied torque at the surface that is getting down to the sensor can be confirmed by the sensor. For example, assume we have a highly deviated well with a lower completion that has a torque rating of 10,000 ft-lbs (e.g., meaning it will fail if more torque is applied to it). The service string may have a torque rating of 30,000 ft-lbs or more. Then assume due the deviation of the well, the bottom of the service string is sensing a torque value of 12,000 ft-lbs and rising quickly but the lower completion torque sensor is maintaining a constant torque reading of, for instance, 5,000 ft-lbs. In this embodiment, this is an indication that the item causing the increased torque is between the surface and the service string's torque sensor (since the lower completion is not seeing an increase in torque). As a result, the operator knows additional torque can be applied at the surface without compromising the lower completion string.

Additionally, sensors internal to the service string can be used to detect the change in the fluid composition inside the service string. As a non-limiting example, a sand detector of one kind or another (densiometer, sonar, audio, radioactive tag, RFID tags, etc.) may detect a change in fluid properties inside a service string. In one example, when the service string is connected to a formation fluid tester (e.g., drill stem test), as the formation fluids flow from the formation fluid tester (e.g., completion string) to the service string, a change in the fluid composition can be detected and relayed to surface. Any time a formation fluid is allowed to enter a conduit to the surface, whether it is a service string, work string, tubing string, etc., a safety concern arises that requires additional precautions, such as early detection about when and how much formation fluid has entered the string. This disclosure provides the extra bit of precaution by the use of one or more sensors in the service string.

Moreover, sensors external to the service string can be used to detect the change in the fluid composition outside the service string. As one example, cement is pumped through the service string to the lower completion (e.g. a liner) and back up the annulus of the lower completion. By having sensors mounted to sense the fluid composition on the outside of the completion string and/or the service string, the height of the cement fluid on the outside of the strings can be monitored. The one or more sensors on the outside of the completion string and/or the service string can inform the operator how high up the annulus the cement has progressed.

In the same light as cement, other fluids may be pumped into a wellbore to enhance operations/oil production/etc. For example, Reservoir Drill-in Fluids (RDF) are specially designed fluids displaced into a well before drilling into a reservoir. The RDFs have special properties to prevent or reduce the damage to a reservoir that may be caused by conventional drilling muds. By being able to sense the location, concentration, properties, etc. of the RDF in the well, added protection for the reservoir is ensured. Thus, sensors inside and/or outside the lower completion/bottom hole assembly and/or sensors inside and/or outside the service string (e.g., drill string), can be used to detect and evaluate the properties of the fluids inside the service string/bottom hole assembly and also the properties of the fluids in the wellbore and annulus of the service string and/or bottom hole assembly.

Similar to RDFs, filter cake removal treatments may be pumped into a reservoir wellbore to remove the filter cake left by a drilling fluid. Sensors mounted in and outside of the service string and/or completion string may aid in optimizing the placement and effectiveness of the filter cake removal fluids/treatments.

Distributed Sensors may also be used on the inside and/or outside of the service string, for example to aid in temperature, strain, acoustical and other sensing and analysis studies. For example, 4D seismic geological studies (including 4D formation compression studies), 2D, 3D and 4D reservoir and formation studies will benefit from sensors mounted on a service string.

Discrete Sensors, separately or in conjunction with distributed sensors, may be used inside and/or outside the service string for all the reasons mentioned above and other reasons. Again, the above examples are only given for references; those with knowledge of the art will naturally think of other uses after reading this disclosure.

The service strings sensors, transceivers, data transmission, data storage, data analysis, (all features that were included in the description of the "black box") may be employed alone or with sensors, transceivers, black-block type features employed in the completion string, casing string, surface devices, etc. For example, the service string and its devices may interface with casing mounted devices and transmission devices such as Halliburton's LinX System or other casing-conveyed permanent downhole monitoring systems.

The service string sensors, in one or more embodiments, may add value during sand control stimulation treatments, including gravel packing and frac packing. For example, in one or more embodiments, the amount of weight placed down on the service tool to lower completion interface is an unknown value, that with the sensors of the present disclosure could be advantageously calculated. Additionally, the location of the service string relative to the lower completion would provide useful information (e.g., assurances) that the aforementioned weight being placed down on the service tool was being provided in the correct location (e.g., commonly referred to as weight down circulate). The position sensors could also communicate that the service tool had properly reached the reverse position, for example to reduce the risk of sticking the service tool while cleaning up the well (e.g., post sand control stimulation treatment).

Thus, according to the embodiment of FIG. 35, the well system may include a wellbore extending through one or more subterranean formations, as well as a lower completion string located within the wellbore, the lower completion string having a downhole half wet mate connector (e.g., permanent downhole half wet mate connector) coupled to one or more sensors positioned along the lower completion string. In at least this embodiment, the well system may further include a service string coupled with the lower completion string, the service string having an uphole half wet mate connector (e.g., retrievable uphole half wet mate connector) coupled with the downhole half wet mate connector of the lower completion string, the downhole half wet mate connector and the uphole half wet mate connector configured to transfer sensor information obtained by the one or more sensors uphole as the service string is coupled with the lower completion string.

In one or more embodiments, the one or more sensors are one or more completion task sensors, the downhole half wet mate connector and the uphole half wet mate connector configured to transfer completion task sensor information obtained by the one or more sensors uphole as the service string is coupled with the lower completion string. For example, as discussed herein, the one or more sensors are one or more gravel pack sensors, are one or more frac pack sensors, or another sensor that might be used in the lower completion string.

In yet another embodiment, the one or more sensors are a plurality of discrete sensors distributed along at least a portion of the lower completion string. For example, in at least one embodiment, the plurality of discrete sensors are a plurality of discrete sensors distributed less than 500 m apart along at least a portion of the lower completion string. In yet another embodiment, the plurality of discrete sensors are a plurality of discrete sensors distributed less than 50 m apart (if not less than 10 m, if not less than 3 m, if not less than 0.25 m, if not less than 1 mm apart) along at least a portion of the lower completion string, such as employed in the continuous fiber of FIG. 43. In even yet another embodiment, the one or more sensors are one or more distributed fibers positioned along at least a portion of the lower completion string. In one or more embodiments, a distributed fiber is fiber sensing technology that is capable of measuring continuously throughout a length of the fiber, as known in the art.

While not illustrated in FIG. 35, in at least one embodiment the service string may be decoupled from the lower completion string at some point in time. In this embodiment, the service string and retrievable uphole half wet mate connector may be disconnected from the lower completion string and permanent downhole half wet mate connector. Thereafter, in at least on embodiment, an upper completion having a second uphole half wet mate connector may be coupled with the lower completion string and permanent downhole half wet mate connector. Accordingly, one or more of the one or more sensors could be production task sensors. Thus, production task sensor information could be obtained from the production task sensors as the upper completion string is coupled with the lower completion string, and the production task sensor information could be transferred uphole as the upper completion string is still coupled with the lower completion string. In at least one embodiment, a production task sensor is a sensor that could measure production task sensor information, such as Geological Information—rock movement, subsidence, fault movement, etc.", "Reservoir Information—changes in permeability, changes in porosity, Oil cut—% of oil at different places along the wellbore, % water at different places along the wellbore, how those parameters change with respect to time (e.g., 4D analysis), etc.

FIGS. 36 and 37 illustrate that the use of the wireless devices (e.g., sensors, transceivers, etc.) may be used: 1) to/from formation to transceivers mounted on the outer side of gravel pack tools; 2) to/from formation to transceivers mounted on the inner side of gravel pack tools; 3) to/from transceivers mounted on the outer side of gravel pack tools to/from transceivers mounted on the inner side of gravel pack tools; 4) to/from sensors, etc., mounted on the outer side of gravel pack tools to/from transceivers mounted on the inner side of gravel pack tools; 5) to/from transceivers mounted on the outer side of production string to/from transceivers mounted on the inner side of gravel pack tools; 6) etc.

Turning to FIG. 38, it is shown that: 1) sensors may be located on the inside of the first equipment section (e.g., lower completion equipment); 2) sensors may be located on the outside of the first equipment section (e.g., lower completion equipment); 3) sensors may be located in the wall of the first equipment section (e.g., lower completion equipment); 4) flow sensors, controllers, etc. may exist for flow from outside to the inside of the first equipment section (e.g., lower completion equipment (and vice versa); 5) a feed thru may be used; 6) sensors may be deployed/released from the outer surface and allowed to move out into the annulus; 7) wireless sensors, etc. may be used; 8) sensors may be used in the annulus—e.g., may be pumped during stimulation; 9) sensor may be in the formation—e.g., can be flowed back and capture during production; 10) etc.

Turning to FIG. 39, illustrated is one embodiment of the gravel pack tools installed.

In some embodiments, once the gravel pack tools are assembled and installed onto first equipment section (e.g., the lower completion string), the black box and its associated wet mate connector (e.g., first retrievable half wet mate connector shown in FIG. 36) may be installed. The black box will be described in more detail down below. After being installed, the black box may be turned on and it, as well as any connected sensors, devices, etc., may be functioned/tested. In some embodiments, the steps listed here may be re-arranged, some steps may be added, others deleted, but all remain within scope of this disclosure. For example, the black box may be installed and tested before installing the gravel pack tools. Or the gravel pack tools and black box may be made-up in the shop, tested, and sent out to the rig as a single unit. Once made-up to the first equipment section (e.g., lower completion string), the black box and related devices may be re-tested.

Turning to FIG. 40, illustrated is one embodiment of the installation of the black box and its wet mate.

Next, the service string may be installed, as shown in FIG. 41. In the embodiment shown here, the black box is shown to be not connected to the second equipment section (e.g., service string). The intent is to allow the second equipment section (e.g., service string) to be manipulated (e.g., moved up and down hole, etc.) before it is used to retrieve the black box and pulled out of the well. As noted above, the black box can include a coupling mechanism that interacts with the black box retrieving tool of the second equipment section.

Once the second equipment section (e.g., service string) is out of the hole, the third equipment section (e.g., the upper completion string, for example with the second retrievable half wet mate connector (e.g., FIG. 33B) and related equipment) is run-in-hole, as shown in FIG. 42. The second retrievable half wet mate connector may be aligned and mated with the permanent downhole half wet mate connector.

It should be noted that the names, such as first and second retrievable half wet mate connector, lower completion, upper completion, etc. are used as general descriptors. For example, the upper completion may not always need to be the upper-most completion string. For example, it may comprise the middle completion where a third uppermost completion string is run afterwards. In the same fashion, first and second retrievable half wet mate connectors, may be identical, or may differ from one another, or may not be retrievable, or may comprise more than a half of a wet mate, or may include of more than one type of wet mate, or may include two or more wet mates. The wet mates may be axially aligned (one on top of the other), parallelly aligned (e.g., may engaged corresponding mates at the same time) or not, etc.

The black box and its ability to be deployed (e.g., run-in-hole), turn on a downhole light source, send signals to one or more sensors downhole (e.g., via a wet mate), read the data, store the data (e.g., frac data) and then be retrieved by a service string is new and novel.

The concept can be a method/service/system for increased oil productive & revenue efficiencies by gathering one or more of the following steps: 1) gather completion-type data (e.g., frack placement (pack factor per foot), pack factor, etc.); 2) production-type data (e.g., production per zone, production per meter/foot (distributed sensing); 3) geological/reservoir data (porosity, permeability, oil %, etc.); 4) 4D geological/reservoir data/production data; 5) drilling data; 6) analyzing the above data; 7) using the above analysis to plan the next well's completion.

The concept can also be a method/service/system for improved stimulation, including: a) measure and record frack placement using semi-distributed and distributed sensing by sensing temperature, vibration, pressure, sound, acoustics and/or other parameters; 2) measure frack pressures, etc. on a per-meter (or per foot) basis; 3) measure fluid leak-off on a per-meter (or per foot) basis by using semi-distributed and distributed sensing via sensing temperature, vibration, pressure, and/or other parameters; 4) monitor and record other stimulation phenomenon such as: a) slurry roping, b) changes in proppant concentration (spatially and in time), proppant density (spatially and in time), c) carrier fluid density, d) carrier fluid leak off, e) bridging, f) sand suspension capability of the fluid, g) pack progression, including alpha wave development and progression (spatially and in time), and beta wave development and progression (spatially and in time); 5) better understanding of gravel packs, frac packs, etc.

The present disclosure has recognized that 83% of the open hole gravel packs are pumped with periods of no positive surface pressure ranging from 3 to 116 minutes in duration with an average of 37 minutes. Similarly, 38% of the open hole gravel packs that were pumped with periods of no positive surface pressure experienced shunting while there was no positive surface pressure on the work string. In such situations, these jobs were pumped through the shunt tubes with no positive surface pressure, for durations ranging from 3 to 48 minutes, before positive surface pressure was restored. The present disclosure has recognized that the inclusion of the black box would tell you where the gravel pack was going.

The present disclosure has further recognized that in fracturing a wellbore, far less proppant flows out of the first clusters passed in a stage than the last ones. The flow travels upwards of 45 miles an hour, if not upwards of 75 miles an hour, and the sand particles have to turn in approximately three-eighths of an inch. Again, the inclusion of the black box would tell you where the gravel pack was going and other pertinent information.

The present disclosure, in one or more embodiments, employs distributed sensing/sensors, semi-distributed sensing/sensor, and one or more discrete sensors, and combinations thereof. Example of a semi-distributed sensing—a spool of continuous digital fiber with 100 embedded devices, as shown in FIG. 43. On the left, a photograph of a spool containing a continuous digital fiber with 100*s* of embedded devices. On the right, magnified optical image of the fiber array showing that the digital devices are all rotated to the critical angle with connections to wire electrodes. On bottom, a photograph showing size comparison between the fiber and a coin (penny).

Turning to FIG. 44, illustrated is a tree that shows the basic black box and how it could be used with fiber optic, electric, a combination of such, etc. An energy transmitter is shown as another alternate component because some sensors may provide their own power and/or method of transmitting energy to the black box. However, one embodiment may have a laser or LED transceiver to send and receive light to and from sensors.

As shown in FIG. 45, one of the labeled cells receives one or more types of energy signals. The circle at the end of certain labels indicates other information is to be added. The added information is found in FIG. 46.

Any of the fiber optic sensors found at https://en.wikipedia.org/wiki/Fiber-optic_sensor, which is incorporated herein by reference, may be employed in this disclosure. Other sensors, optical and non-optical, are considered within the scope of this disclosure, such as a particle size analyzer.

In one or more alternate embodiments, the downhole black box may also transmit signals (data) to the surface (see FIG. 47) for a real time operation—the operators on surface would be able to monitor what is happening downhole in real time. Some of these embodiments may require fiber optic, electrical, and/or other types of conduits (cables) to pass the signals (and power) to/from the surface. Other means of communication to and from the surface may also be employed, such as pressure pulses, acoustic waves, etc., via a communications interface, such as communications interface 5060 of FIG. 50A Edge (AI) Computing Embodiment(s): In some alternate embodiments, the black box may also provide control signals and/or power to one or more other downhole "things" (see FIG. 48). The things may be electric valves (e-Completions, all-electric completions), regulators, or other controlled devices, sensors, etc. An engine may be also be considered one of the downhole "things" employing the broad definition of an engine or motor as a machine designed to convert one or more forms of energy into mechanical energy. The edge, or edge computing, can be defined as a device with software that provides communication and processing power in a remote location. Edge computing is a distributed computing paradigm that brings computation and data storage closer to the sources of data. This is expected to improve response times and save bandwidth. It is an architecture rather than a specific technology. It is a topology- and location-sensitive form of distributed computing.

The circle in FIG. 47 after AND providing a Control/Power Signal to another downhole "thing" relates to FIG. 48 and the items shown there. As a reminder, these items may be located in the first equipment section (e.g., lower completion as shown in FIG. 39). Other locations of these "things" is also considered within the scope of this disclosure (e.g., see paragraphs discussing FIG. 40).

Distributed Computing Embodiment(s): In one or more embodiments, one or more functions of the black box may be performed by other remote devices. This disclosure includes the concept of a distributed (computing/data sharing/control sharing) system which is a system whose components are located on different networked computers, which communicate and coordinate their actions by passing messages to one another from any system. The wet mate connection(s) may be a key factor within some embodiments including distributed computing and edge computing embodiments.

TinyML Embodiment(s): In some alternate embodiments, the black box may also provide TinyML. TinyML takes edge AI one step further, making it possible to run deep learning models on microcontrollers (MCU). Microcontrollers are cheap, with average sales prices reaching under $0.50, and they are everywhere, embedded in consumer and industrial devices. At the same time, they do not have the resources found in generic computing devices. Most of them do not have an operating system. They have a small CPU, are limited to a few hundred kilobytes of low-power memory (SRAM) and a few megabytes of storage, and do not have any networking gear. They mostly do not have a main electricity source and must run on cell and coin batteries for years. Therefore, fitting deep learning models on MCUs can open the way for many applications. Your iPhone now runs facial recognition and speech recognition on the device. Your Android phone can run on-device translation. Your Apple Watch uses machine learning to detect movements and ECG patterns. TinyML can send control signals and/or power to one or more other downhole "things" while reading and analyzing sensors to provide "true" real-time analysis and control.

Other Types of Stimulation Embodiment(s): In one or more alternate embodiments, the disclosure may be used in other completions-type operations including other stimulation-type treatments such as the ones listed below in FIG. 49. In addition, the Disclosure may be used in other activities other than pumping, such as while being run-in-hole. The disclosure may comprise other features such as software, sensors, timers, etc. The disclosure may be used with more than one type of sensor and sensors located in more than one type of component (packer, service string component, upper completion string component, valves, pumps, analyzers, logic devices, computing devices, memory devices, AI devices, TinyML devices, etc.).

FIG. 50A illustrates a block diagram of an example of a data recorder 5000 that might be used in accordance with the features of FIGS. 44 to 49. As such, the data recorder 5000 is configured to monitor downhole conditions and operations of a wellbore by collecting and storing data from sensors and/or other downhole devices. The data recorder 5000 can also provide power to the devices and sensors and control signals. The data recorder 5000 can use one or more of the different types of means of communication noted in FIGS. 44 to 47. The data recorder 5000 includes a data logger 5010, an ETM 5020, a controller 5030, a power source 5040, a light source 5050, a communications interface 5060, and a coupling mechanism 5070. Each of these components of the data recorder 5000 can be integrated in a single device. In some embodiments, the functionality of the data recorder 5000 can be distributed into multiple devices that are at least communicatively coupled together. An additional ETM or ETM 5020 can be used as a connector with another black box.

Data logger 5010 is configured to store downhole data. The downhole data includes sensor data that is generated from sensed signals received from various downhole devices. The devices can be sensors or can include one or more sensors. The downhole sensors and devices include those noted in the disclosure. A non-limiting list of sensors and devices noted herein include completion task sensors and stimulation task sensors (collectively referred to as completion task sensors), production type sensors, distributed sensors, flow control devices, tinyML, edge computing devices, fog computing devices, machine-to-machine (M2M) communications devices, and IoT devices.

The sensed signals can be received in response to control signals that are sent to the downhole sensors. The control signals can be generated by the controller 5030 and sent to the various downhole sensors. The ETM 5020 can be used to send the control signals and receive the sensed signals. The ETM 5020 can be configured to connect to an ETM that will be located downhole, such as the ETM of a first equipment section of a wellbore. FIGS. 33A and 33B provide examples of a downhole ETM to which ETM 5020 can be coupled. For example, ETM 5020 can be a retrievable half wet mate connector, such as 3300*b*, and can connect to a permanent half wet mate connector, such as 3300*a*, of a first equipment section of a wellbore. The control signals and sensed signals can be optical signals and the downhole ETM can be a fiber optic wet connect. In addition to the sensor data, the sensed signals can also be part of the downhole data that is stored in the data logger 5010.

In addition to generating control signals and sensor data from the sensed signals, the controller 5030 can also send power signals to one or more of the devices or sensors via the ETM 5020. For example, the controller 5030 can send power or control signals to downhole "things" as denoted in FIG. 48. The controller 5030 is also configured to direct operation of the data recorder 5000. The operations can include turning on the power source 5040, turning on the light source 5050, and sending downhole data to the surface in real time via the communications interface 5060. The downhole data can include processed data that is generated from the sensed signals, the sensor data, or from both. The processed data can be the sensor data or the sensed signals that is analyzed to allow, for example, observations of trends, identify problems, etc. Thus, processing can be performed downhole that is typically done at the surface and then sent to the surface in real time or delivered when the data recorder 5000 is retrieved. The controller 5030 can use a machine learning algorithm, such as one denoted in the disclosure, for generating the processed data. As noted in FIG. 50B, the controller 5030 can include one or more processors to perform the various operations.

The power source 5040 can be a conventional power source that is used in the industry to provide power downhole. The light source 5050 can also be a conventional apparatus used in the industry to provide light for optical communication. The ETM 5020, and also the communications interface 5060, can be used as light communicators for the data recorder 5000.

The communications interface 5060 is configured to communicate with the surface using one or more means of communication used in the industry. Optical communication is one example that can be used. Electrical or a combination of signals can also be used. For optical communications, the controller 5030 can cooperate with the light source 5050 to send the downhole data uphole, such as to the surface. Instead of sending light from the surface, the controller 5030 can also cooperate with the light source to send light, such as a laser, through the ETM 5020 (and connected ETM of the first equipment string) and receive backscatter light. The back scatter light can be stored in the data logger 5010. The backscatter light can be used, for example, for Distributed Fiber Optic Sensing, Distributed Acoustic Sensing (DAS), Distributed Temperature Sensing (DTS), or Distributed Temperature Strain Sensing (DTSS).

FIG. 50B illustrates a block diagram of the controller 5030 of FIG. 50A. Controller 5030 can be implemented on a single computing device or on more than one computing device. Accordingly, the functionality or operations performed by the controller 5030 can be distributed to different computing devices. In one embodiment, one of the computing devices can be located at the surface.

Controller 5030 is configured to perform the various functions or operations disclosed in, for example, FIGS. 44 to 49, including processing sensed signals, sending control signals, generating sensor data, sending or initiate sending power, generating processed data, sending downhole data uphole, and controlling the operation of the data recorder 5000. Controller 5030 has multiple components including one or more data interfaces represented by data interface 5032, one or more memories represented by memory 5034, and one or more processors represented by processor 5036. The various components of the controller 5030 can communicate via wireless or wired conventional connections.

Data interface 5032 is configured to transmit and receive data. For example, data interface 5032 can receive the sensed signals, operating instructions, and machine learning models. Data interface 5032 can also transmit generated data, such as the sensor data and the processed data. Data interface 5032 can communicate via communication systems used in the industry. For example, wireless or wired protocols can be used.

Memory 5034 can be configured to store a series of operating instructions that direct the operation of processor 5034 when initiated thereby. The operating instructions include code corresponding to one or more algorithms for performing the functions of the controller 5000. Memory 5034 is a non-transitory computer readable medium. Multiple types of memory can be used for data storage and the memory 5034 can be distributed across multiple memories.

Processor 5036 is configured to perform the operations of controller 5030 according to the operating instructions. Processor 5036 includes the logic to communicate with data interface 5032 and memory 5034, and perform the functions described herein, such as interacting with downhole sensors and devices, and processing sensed signals therefrom for monitoring downhole operations and conditions. The processing includes generating sensor data from the sensed signals. For example, the sensed signal can be raw data, such as voltages, amplitudes, etc., and the processor 5036 can convert the sensed signal to meaningful measurements, such as a pressure measurement, a flow rate, a temperature, etc, In some embodiments, generating of the sensor data can be performed at a sensor and sent to the controller 5030. The processor 5036 can be configured according to one or more ANN and can use various trained models. For example, the processor 5036 can use a trained model for filtering data, such as the sensed signals.

FIG. 50C illustrates a block diagram of a data recording system 5080 for monitoring and recording data from a downhole network including sensors. The data recording system 5080 includes at least one data recorder represented by data recorder 5082, a wet connect 5084, and a network 5086 of downhole devices.

The data recorder 5082 sends data uphole from the network 5086 and receives data sent downhole, such as from the surface. Accordingly, the data recorder 5082 at least includes an ETM that connects to the wet connect 5084. The data recorder 5082 can also collect, monitor, and process data from the network 5086. The data recorder 5082 can be, for example, data recorder 5000. The data recorder 5082 interacts with the network 5086 through wet connect 5084. Examples of the wet connect 5084 are permanent half wet mate connectors, such as illustrated in FIGS. 33A to 42.

Devices of the network 5084 can be sensors, such as one or more of completion task sensors, one or more of production task sensors, or other types of sensors that might be used in equipment strings of a wellbore. The sensors can be a plurality of discrete sensors or distributed sensors as disclosed herein. One or more of the sensors can also be intelligent sensors and/or edge sensors. FIGS. 35 to 38 provide examples of sensors that can be or be included in the network 5084. The devices can be, for example, flow control devices, tinyML computing devices, edge computing devices, fog computing devices, M2M communications devices, and IoT devices.

FIG. 50D illustrates a flow diagram of an example method 5090 of obtaining downhole data from a wellbore carried out according to the principles of the disclosure. The method 5090 can be performed using a data recording system including a data recorder, such as the data recording system 5080 and the data recorder 5030. The method begins in step 5091.

In step 5092, a data recorder is run into the wellbore and connected to a wet connect of an equipment string located in the wellbore. The wet connect can be a permanent half wet mate connector. The data recorder includes at least one ETM that is connected to the wet connect. The wet connect can be a fiber optic wet connect or another type of ETM. The equipment string can be, for example, a first equipment string located in the wellbore.

Sensed signals from a downhole network of devices are received at the data recorder in step 5093. The sensed signals are received by the ETM of the data recorder via the wet connect. The sensed signals can be filtered signals that are filtered by one or more computing devices of the network of devices. Alternatively, or in addition to, the sensed signals can also be filtered by a controller of the data recorder. Regardless of the location, a machine learning algorithm can be used for the filtering.

In step 5094, sensor data is generated from the sensed signals. The sensed signals used for the generating can be filtered sensed signals. The controller of the data recorder can generate the sensor data.

In step 5095, the sensor data is stored in a data logger of the data recorder. The sensed signals can also be stored in the data logger.

In step 5096, processed data is generated using one or more of the sensor data and the sensed signals. The controller of the data recorder can generate the processed data. The processed data can also be stored in the data logger.

The downhole data is delivered to the surface of the wellbore in step 5097. The downhole data includes the sensor data and can also include the processed data and the sensed signals. The downhole data can be delivered in real time to the surface via a communications interface of the data recorder. The downhole data can also be delivered when the data recorder is retrieved, such as via a second equipment string. The surface includes a computing device located proximate the wellbore. Additionally, the downhole data can be delivered to other remote computing devices or systems not located proximate the wellbore. For example, cloud computing systems, a data center, an operation center that can use real time data, etc.

After the retrieval of the data recorder, a well operation in step 5098 is performed or completed using the downhole data. The well operation can be a stimulation process. Based on the downhole data, an operating parameter of the well operation can be altered.

The method 5090 ends in step 5099. The real time delivery of the downhole data can continue until the data recorder is retrieved. The data recorder can be used to deliver downhole data from stimulation tasks sensors. Once retrieved, another data recorder can be run downhole and connected to the wet connect. The other data recorder can then deliver data from other sensors, such as production tasks sensors.

Artificial Intelligence (AI), Machine Learning, Deep Learning Embodiment(s): In one or more alternate embodiments, the disclosure (components, devices, methods, systems, configurations, processes, etc.) maybe used in the realm of big data, artificial intelligence, and data science. FIGS. 51A through 54 provide information on big data, artificial intelligence, and data science, as might be used herein.

Figure 55:
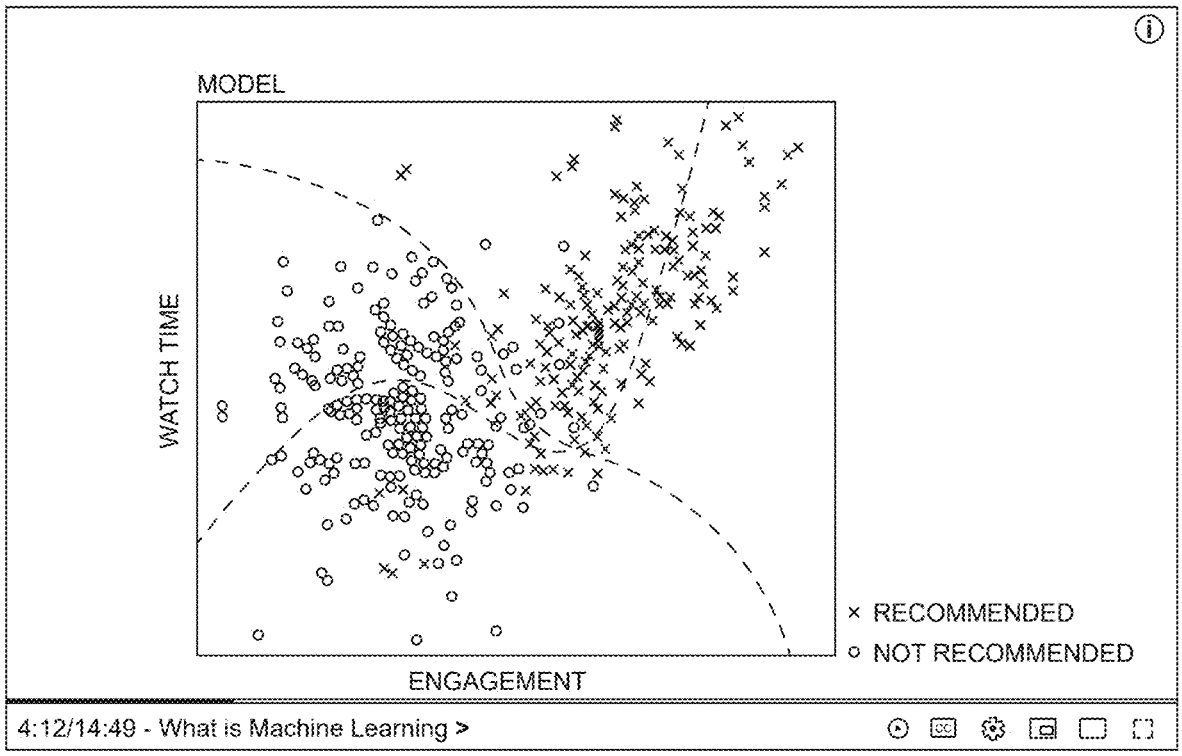

One objective of both types of learning is to develop a machine learning model. They both use a variety of techniques, approaches, and algorithms to form the division boundaries over a data set's decision space. This divided up division space is referred to as the machine learning model, as shown in FIG. 55.

Figure 56:
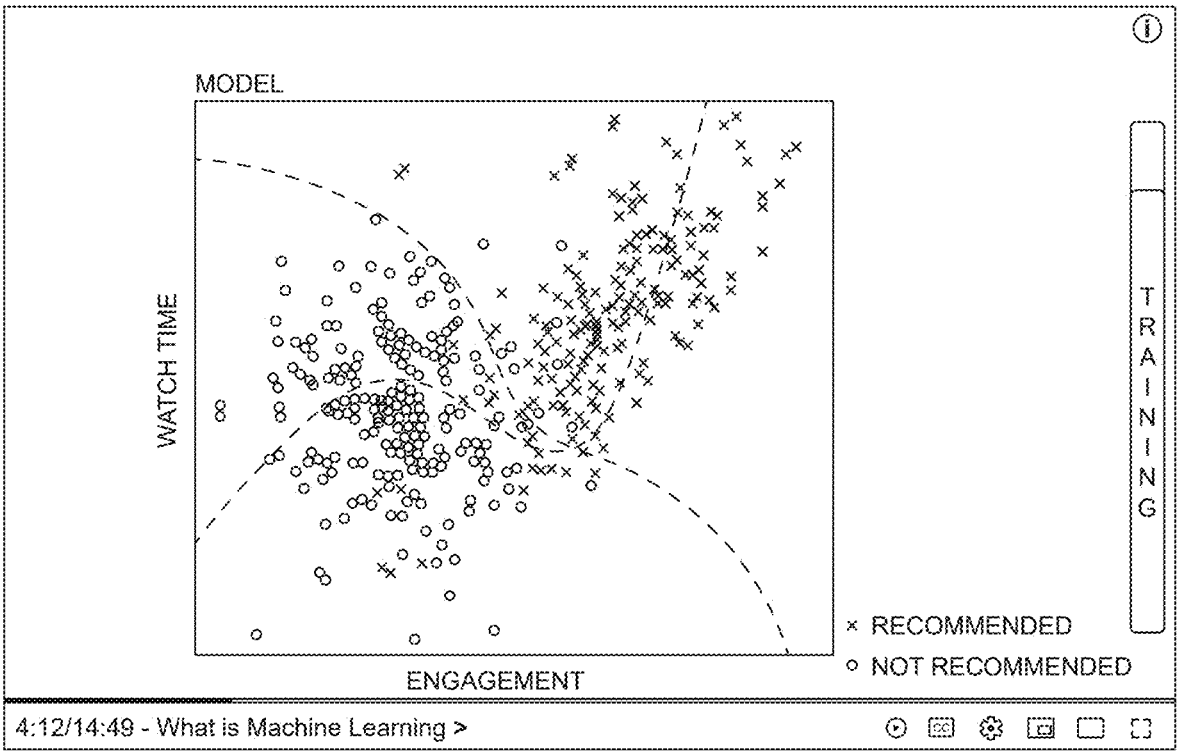
Figure 57:
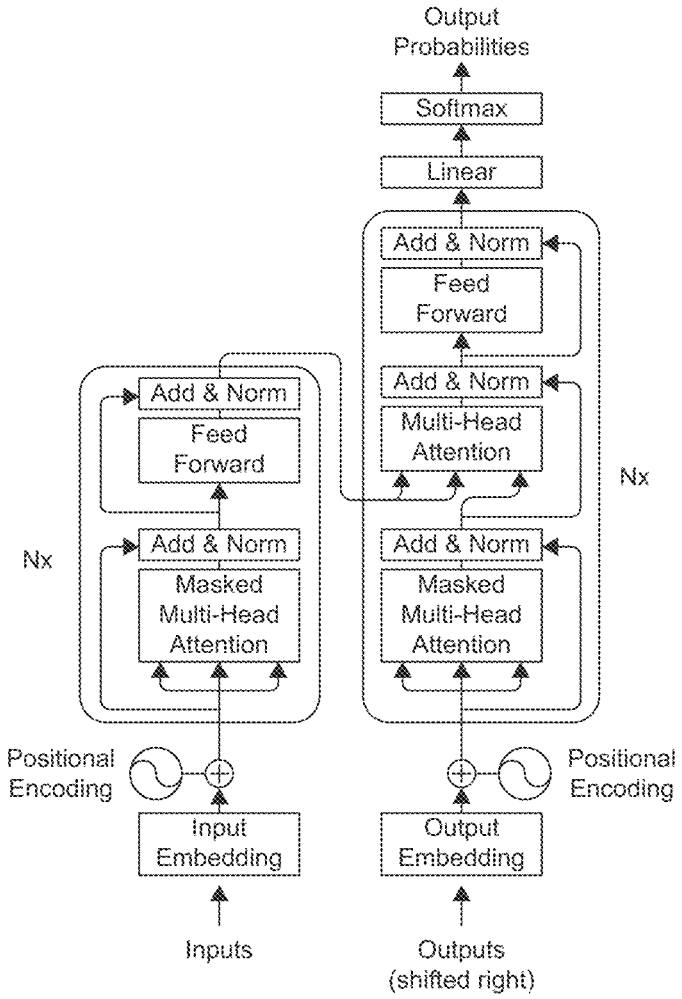
Figure 58:
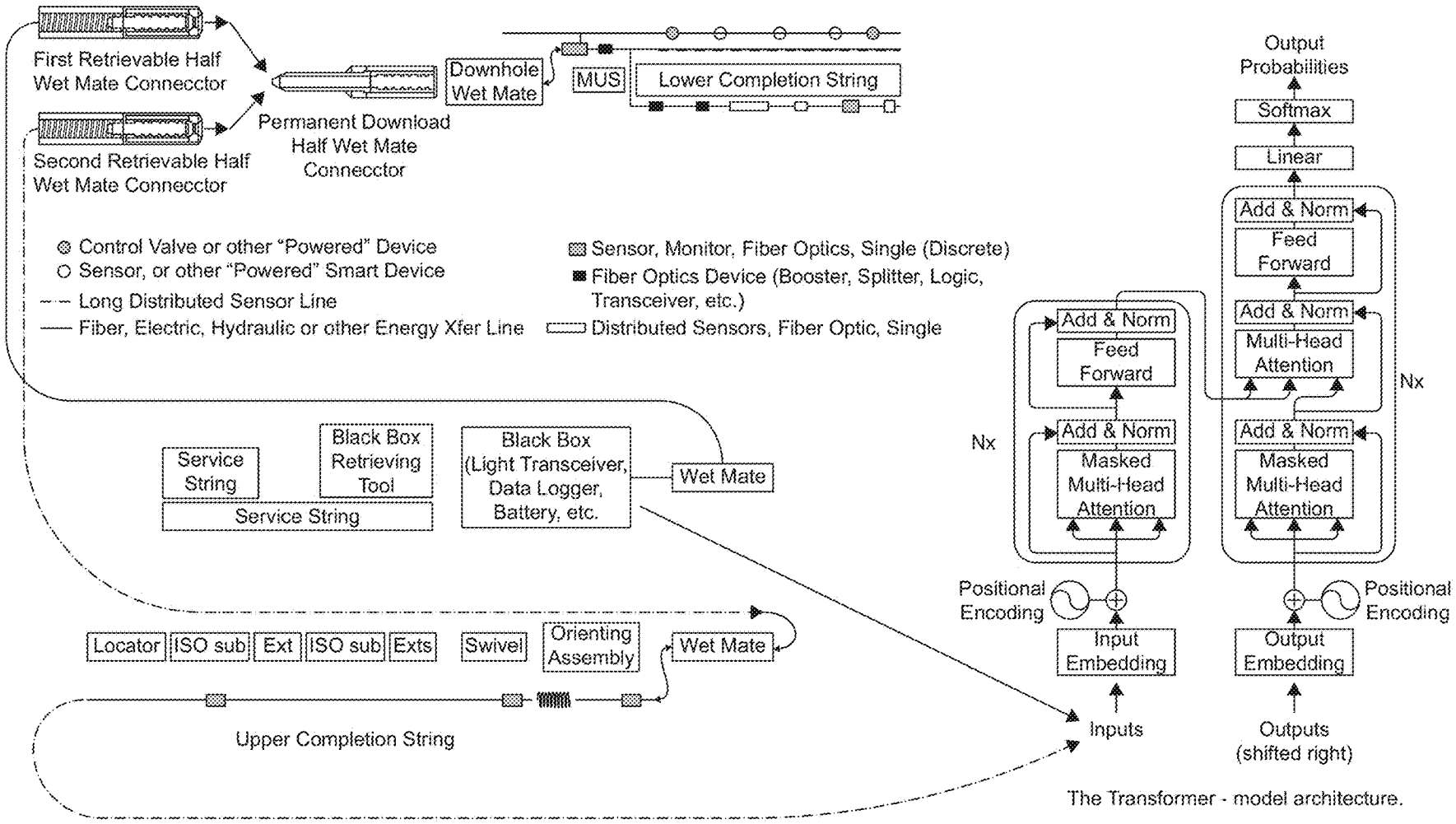

The process of forming the machine learning model—defining the decision boundaries and the data set—is referred to as training, as shown in FIG. 56.

Preprocessing of Training Data Embodiment(s) In one or more alternate embodiments, the disclosure may be employed for preprocessing of training data by adding discrete and distributed features for use in training/use of a ML models. The discrete and distributed features may come from the completions/stimulation data set, the production data set derived in part, or fully, or from other areas of this disclosure. The data used for the preprocessing of training data may also come from other sources (laboratory data, offset well data, engineering calculations, engineering formulas, expert observations and analysis—human and artificial, etc.)

- Preprocessing of Training Data, based on this Disclosure, for use in training/use of a Stimulation ML model
  - Adding new features to Train a Frac Model
    - Adding distributed and/or discrete measurements from data gathered by using the concepts taught in this Disclosure including (but not limited to)
      - Pressure measurements
      - Pack Density
      - Pack Efficiency
      - Production Index
      - Pack Profile/Size Distribution
      - Formation Permeability
      - Formation Porosity
      - Formation Oil/Water/Gas ratio
  - Modifying existing features based on this Disclosure to Train a Frac Model or Re-Train an existing Frac Model or other Stimulation Model
    - Existing ML/Deep Learning models can be re-trained by providing data acquired by this Disclosure
- Preprocessing of Training Data based on this Disclosure for use in training/use of a specific Stimulation ML models (See, FIG. 49)
  - Adding new features based on this Disclosure to Train a Stimulation Model
    - Adding distributed and/or discrete measurements from data gathered by using the concepts taught in this Disclosure including (but not limited to)
  - gravel packing—all types
  - Fracking—Gravel-pack Frac, Unconventional Fracs, Slick-water Fracks, etc.
  - Acidizing—bull heading, squeeze, hesitation, different types of acid, different formations, etc.
  - Surfactants—bull heading, squeeze, injection, circulation, heated, via chemical injection line, etc.
  - Cementing—squeeze, hesitation, wellbore deviation, type of formation, formation characteristics, etc.
- Preprocessing of Training Data based on this Disclosure for use in training/use in a Production ML model
  - Oil production
  - Gas production
  - Water production
  - Water, or other fluid, injection
  - Production Optimization ML Model Machine Learning (ML) Model Training Process Embodiment(s): In one or more alternate embodiments, the disclosure may be used employed for training one or more ML Models. Training the stimulation model as mentioned above and then using the output of that model as input for the production model. Using both discrete and distributed features for use in training/use of a ML models. Using time-based data in the models and their training(s)/re-trainings.

Deep Learning Algorithm Embodiment(s): One benefit/improvement of gathering large quantities of data over a period of time is that deep learning algorithms using time-series modeling may provide faster analysis and may be run using graphics processing units. By employing transient data (such as frac pressures at a given point over time), deep learning algorithms using time-series modeling may learn the complex transient dependencies between a target parameter (e.g., successful screen out) to one-or more measured parameters of a well during a stimulation process. Likewise, production data can be used with well stimulation data and/or other data such as other production data, drilling data, logging data, mud logger data, etc. to forecast production rates, decline curves, offset well fracking, stimulation, drilling, production data.

Transformer Deep Learning Algorithm Embodiment (e.g., FIGS. 57 and 58): The self-attention mechanism of the transformer model can learn the complex transient dependencies in field data between the target parameter (for example, bottomhole pressure) and input features, which are the measured parameters of a well (for example, flow rates, bottomhole temperature, and choke opening size) improving the accuracy of predictions of the target parameter as compared to the RNNs. Moreover, the transformer can process the entire input sequences of various lengths; in contrast, the number of cells in recurrent networks is often limited.

Feature Extraction Embodiment(s): One benefit/improvement of gathering large quantities of data and data from distributed sensors is the resolution of the data. Now instead of getting the pressure of a well bore, this disclosure gathers innovative data such as:

1. "Pressure per foot" of well bore,
2. "Pressure per change in frac pack per proppant size," or
3. "Oil Production per meter as a function of porosity, wellbore inclination and liquid leak-off rate, or more alternate embodiments"

The combination of variables and discretizing the information on a per foot or per hour basis is nearly unfathomable. However, by using innovative technologies like deep learning, machine learning, edge computing, the optimization of completion processes, stimulation processes, and oil & gas production are within our grasp.

Figure 59:
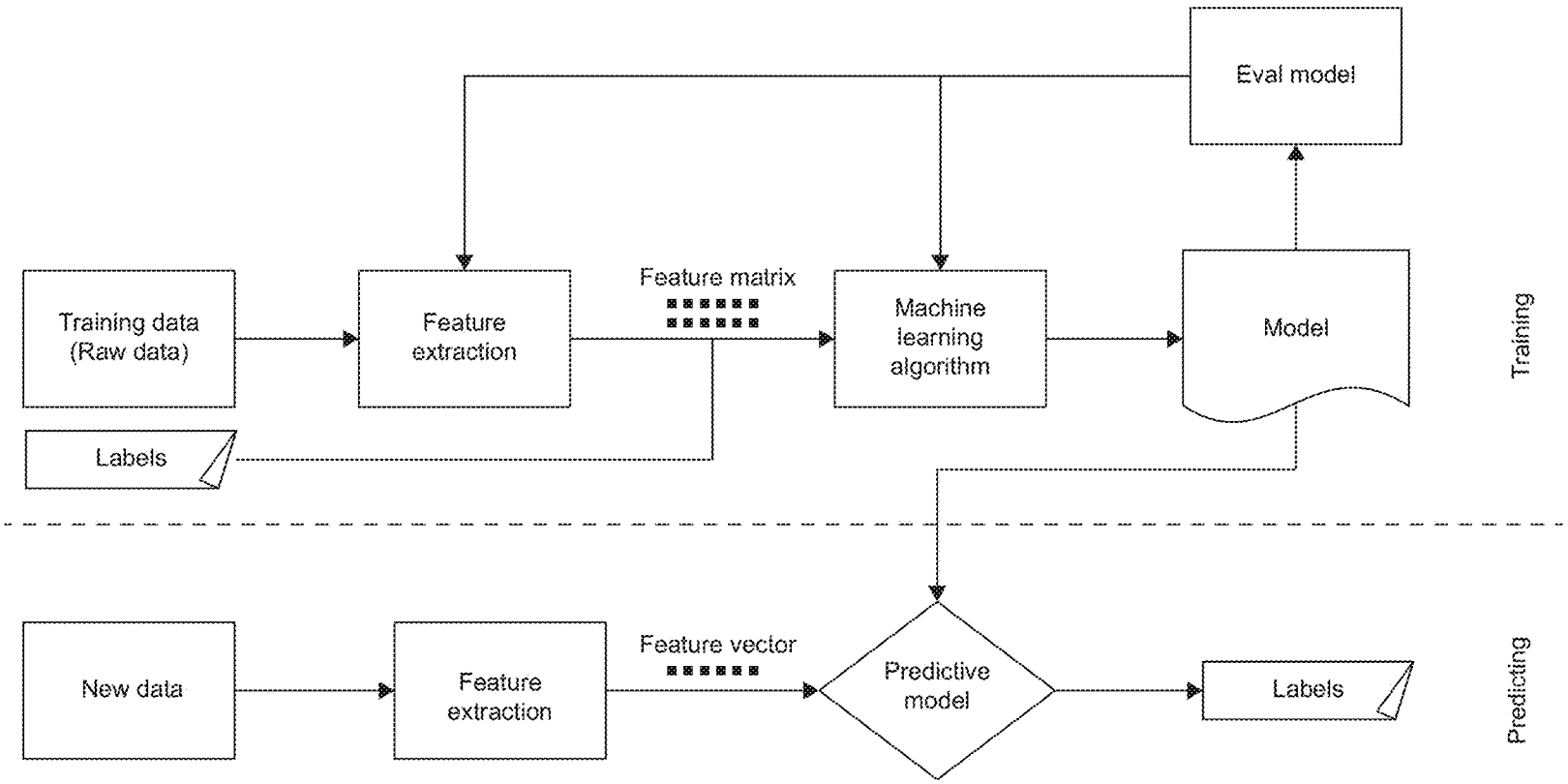

FIG. 59 illustrates how feature extraction can be employed in machine learning, supervised learning, unsupervised learning, deep learning, inference, artificial neural networks (ANN), hybrid artificial intelligence, convolutional neural networks (CNN), system 2 deep learning, recurrent neural networks (RNN, tiny machine learning, or TinyML).

Filtering sensor data and detection of outliers Embodiment(s): Embodiments of this disclosure comprise the use of methods, devices, systems and/or artificial intelligence to filter one or more streams of data (or data sets, etc.). Some sensors may generate spurious data (false data caused by power fluctuations, pressure surges, temperature fluctuations, electrical shorts (short term and long term), software errors, mechanical failure, electrical components overheating, debris plugging causing pressure spikes, etc.). An example spurious data may include pressure spike(s) both positive and/or negative creating what may be termed as outliers—bits of data that lie outside the normal range of expected data values (pressure readings). Instead of spending precious computing time to process that data, it is more efficient and faster to cull that data before it gets to the processor(s), transmitters, ML Models, etc. The sooner or faster the spurious data can be detected and culled, the better.

Spurious data filters/rejectors:

1. Detect and reject at the sensor
   a. Intelligent Sensors
      i. Built-in AI/ML/Deep Learning to detect spurious data
      ii. Teachable/Learning Sensors that can learn to be detect/sort spurious data
      iii. Supervised Sensors—as the sensors teach/learn by themselves, their learnings are sent to a "teacher" or "grader" to have their revised models "graded." If their revised models receive a passing grade, they are sent a command to go ahead and use their revised models.
   b. Edge Sensors
      i. Built-in AI/ML/Deep Learning to detect spurious data
      ii. Reject spurious data before transmission
      iii. Flag suspect spurious data before transmission
2. Detect and reject at the "Near Edge" (aka Cutting Edge)
   a. The Near Edge—somewhere near the sensor but not at the surface
   b. The Near Edge—where space and power are in limited supply. Environment may not be desirable. Where external protection (hardened case, water-resistant or vibration-resistant enclosure is needed).
   c. Below the first ETM
3. Detect and reject at the "Far Edge"
   a. The Far Edge—somewhere "far" from the sensor but not at the surface
   b. The Far Edge—where the environment is better than at the Near Edge—less, or no, corrosive gas, lower temperature (<200-F), less vibration, less dust, moderate temperature extremes, etc.
   c. Above the first ETM
   d. An area that more than one sensor's data can be monitored and checked for spurious data
   e. "Far Edge"—an area where power, resources, space, climate, environment, and/or other factors may limit the size of the computer/device/system/TinyML/etc. used for detecting spurious data.
4. Detect and reject at the "Near Cloud"
   a. The Near Cloud—somewhere "far-far" from the sensor (e.g., at the surface)
   b. At a distance further from the sensor than the "Far Edge"
   c. "Near Cloud"—an area where power (electrical generator or public power is readily available, resources (humans present to monitoring and repair), space, climate, environment (climate-controlled), and/or other "nice" factors are readily available.

Methods/Systems/AI Concepts for detecting and isolating spurious data—the use of methods, devices, systems and/or artificial intelligence to filter one or more streams of data (or data sets, etc.). The data may, and will, change over time as more stimulation fluid is pumped, formation/reservoir rock changes as the stimulation commences—fractures occur, proppant enters the fractures, proppant restricts the flow of fluid into the fracture(s), formations break down and take more fluid, pressures drop. Production rates decline, temperatures increase/decrease as gas and water encroach from gas caps or water drives, from water injection, etc. Time and the exchange of fluids are two variables that can affect sensors and their readings. Therefore, it is critical to know the sensor data is accurate and trustable. Certain circuits known as band-pass filters may be used, however most are set to certain values and cannot be changed. Therefore, it is ideal to have a system or method to monitor the data and determine if changes in data are spurious or are "for real." AI is an ideal candidate for such monitoring and classify of data. Supervised and unsupervised learning can both be employed individually to classify data; or they may be used together to create a Machine Learning (ML) Model to identify spurious and non-spurious data. One option is to use existing data sets to train the ML Model. And then as conditions change with time and/or events, the ML Model can be re-trained or a different ML Model can be implemented, or both can be employed (new training and new ML Models).

By using the methods/components/system described in this disclosure, the use of AI methods to detect and isolate spurious data will improve the efficiency of the disclosure by rejecting spurious data as close to its source (e.g., the sensor) as possible.

This Disclosure claims the use of intelligent sensors, edge sensors, near edge components/systems/methods/AI, far edge components/systems/methods/AI, near cloud components/systems/methods/AI for use in the system/methodologies/processes/etc. described in this disclosure—and in all processes/systems/methodologies/concepts/components/ etc. used in the exploration, completion, stimulation, drilling, production, secondary recovery operations (e.g., water injection), tertiary operations (chemical flood, WAG injection, etc.) of oil, gas, hydrocarbons and other forms of energy recovery and production (e.g., geothermal wells).

Methods/Systems/AI Concepts for creating a ML Model for improving hydrocarbon production by using a multi-step ML process (using 2 or more ML Models) Embodiments:—the use of methods, devices, systems and/or artificial intelligence/machine learning/deep learning to improve well production, predict best location of next well, and improve completions (stimulating techniques, etc.), improve production, improve seismic analysis and interpretation by lowering costs and processing time, improve drilling ROP (speed) and reduce drilling risks, improve logging analysis and interpretation while lowering costs, etc.

Figure 60:
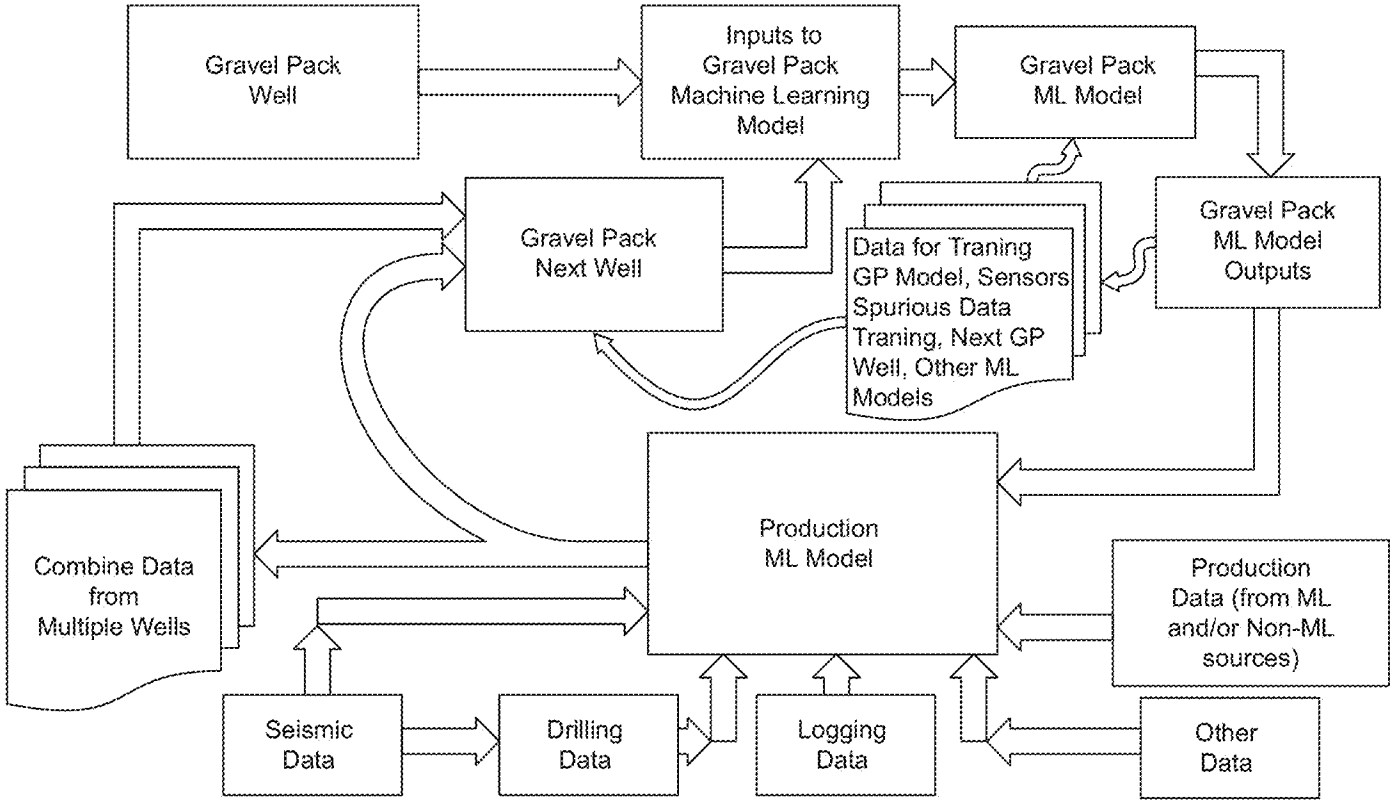

As shown in FIG. 60, the basis of using the output of the gravel pack ML Model is expanded upon. In this embodiment, Machine Learning (ML) Models are used in association with the gravel pack data and the production data. Both sets of data are used to optimize the gravel pack for the next well and future wells. As shown, data from other sources (seismic, drilling, logging, and other sources may also be used to feed into the production ML Model). It should be noted that the production ML model may be used to optimize production, planning the gravel pack for future well(s), or a variety of other uses.

Figure 61:
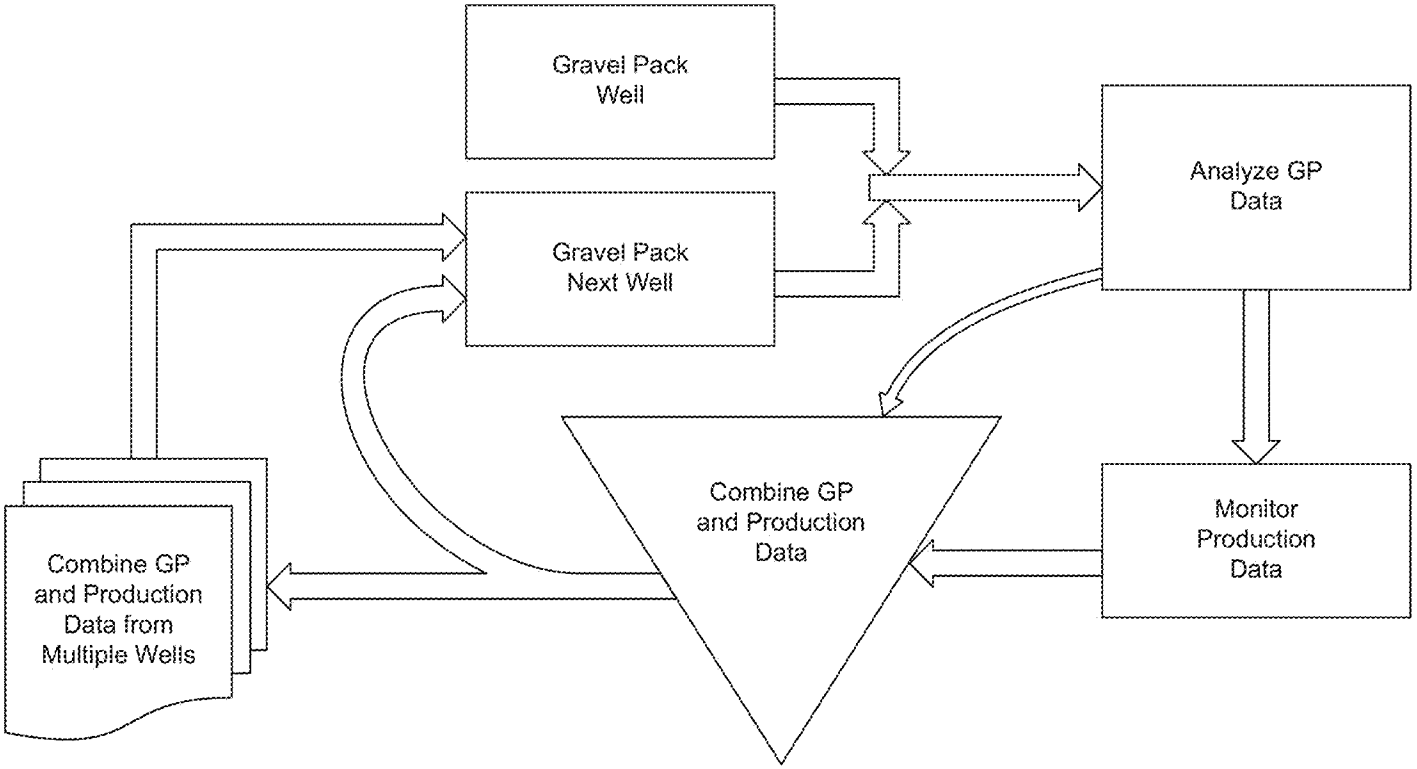

As shown in FIG. 61, data from multiple sources may be used to increase production and make intelligent decisions.

Figure 62:
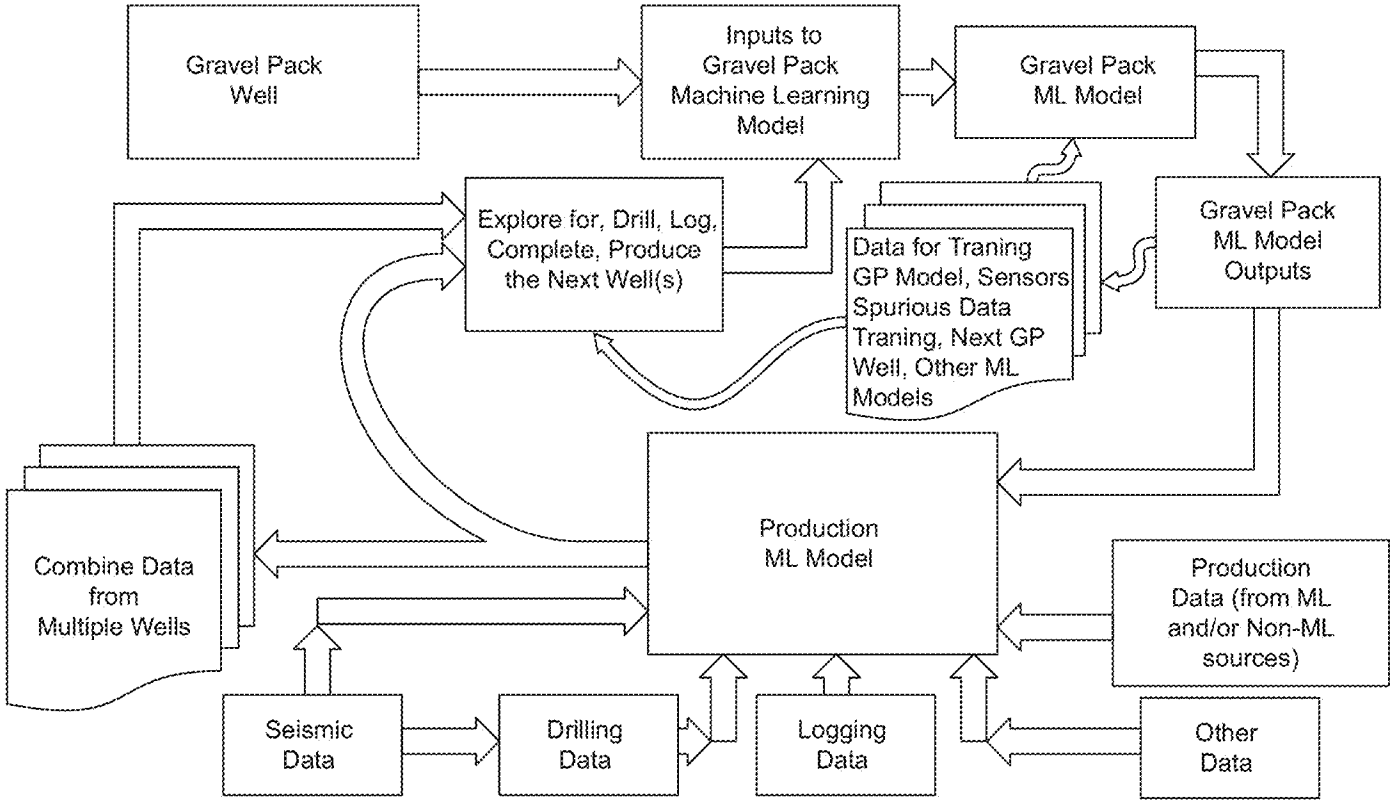

As shown in FIG. 62, the production ML model is used not only for completing the next well, but for other activities such as exploring for hydrocarbons, drilling a well (s), logging, and producing the next well(s).

Figure 63:
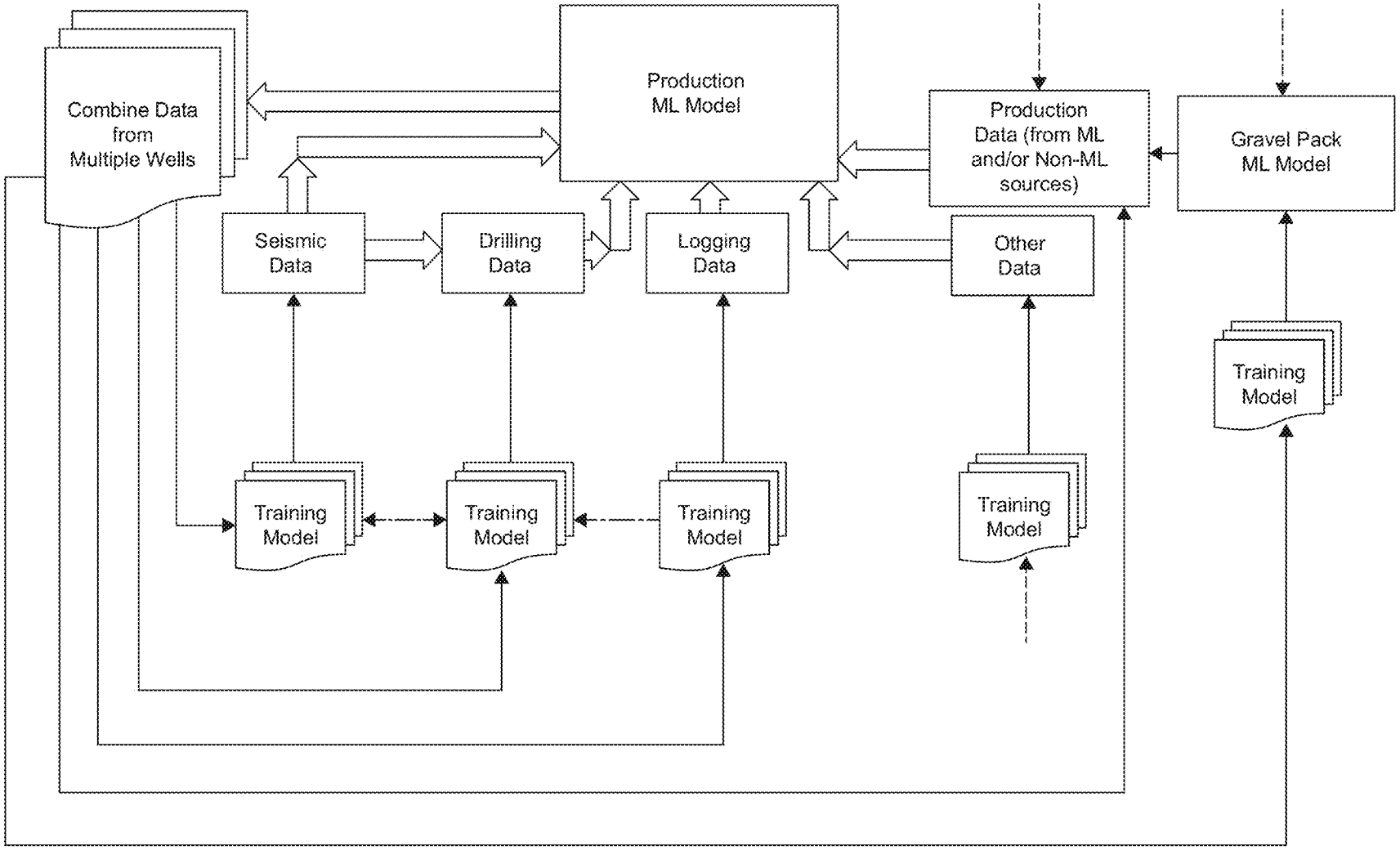

As shown in FIG. 63, the data produced from the production ML model (with input from the other sets of data) is collected and analyzed—perhaps by a different ML model. The output from the combined data may then be fed back into training models for one or more of the sets of data.

Sharing ML data to more than one training model for improving hydrocarbon production and operations associated with such embodiments: The use of methods, devices, systems and/or Artificial Intelligence/Machine Learning/Deep Learning to improve well production, predict best location of next well, and improve Completions (stimulating techniques, etc.), improve production, improve seismic analysis and interpretation by lowering costs and processing time, improve drilling ROP (speed) and reduce drilling risks, improve logging analysis and interpretation while lowering costs, etc.

Figure 64:
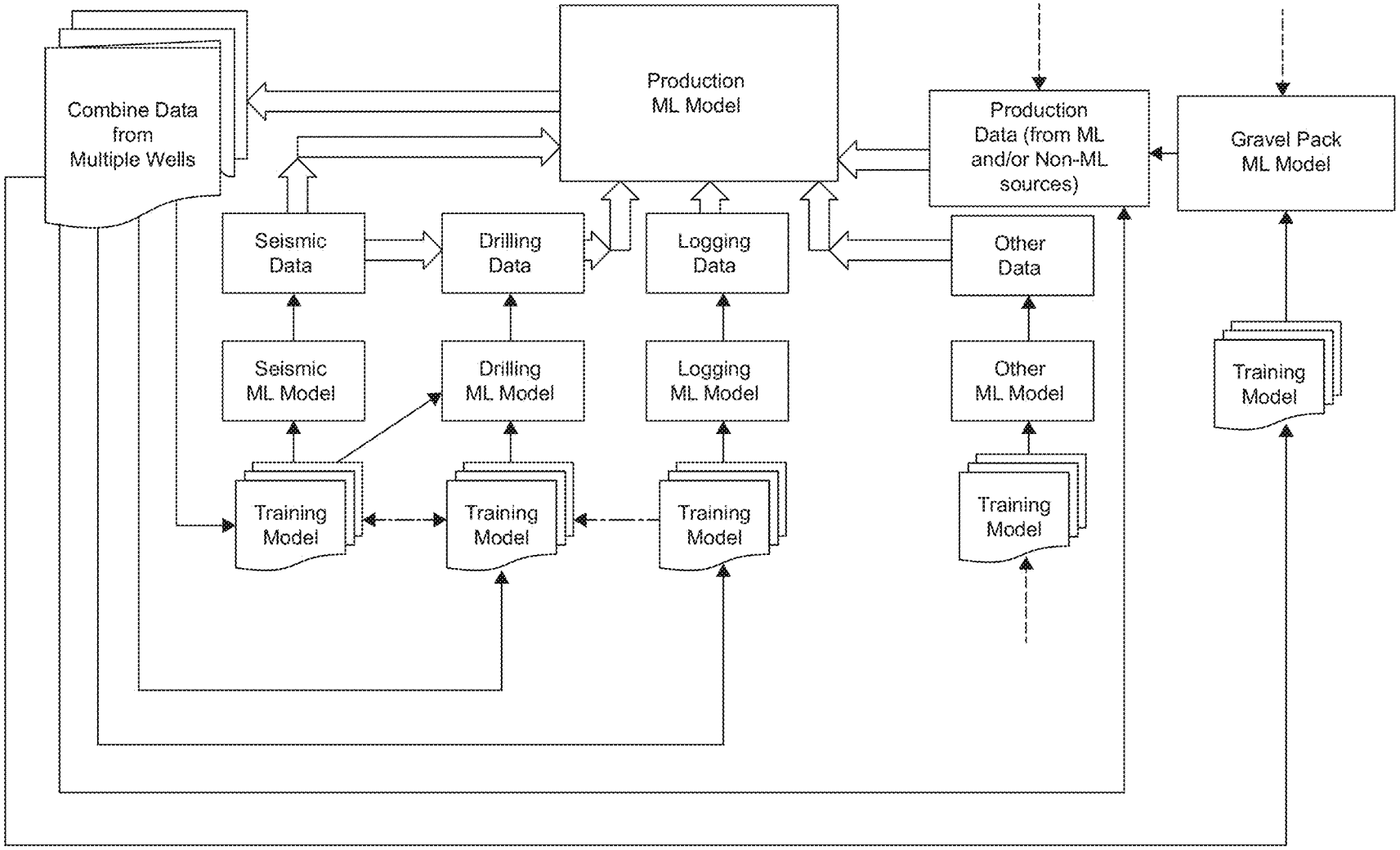

As shown in FIG. 64, the output from the combined data ML (and/or other type of model/database) is fed back into training models for one or more of the ML models.

Figure 65:
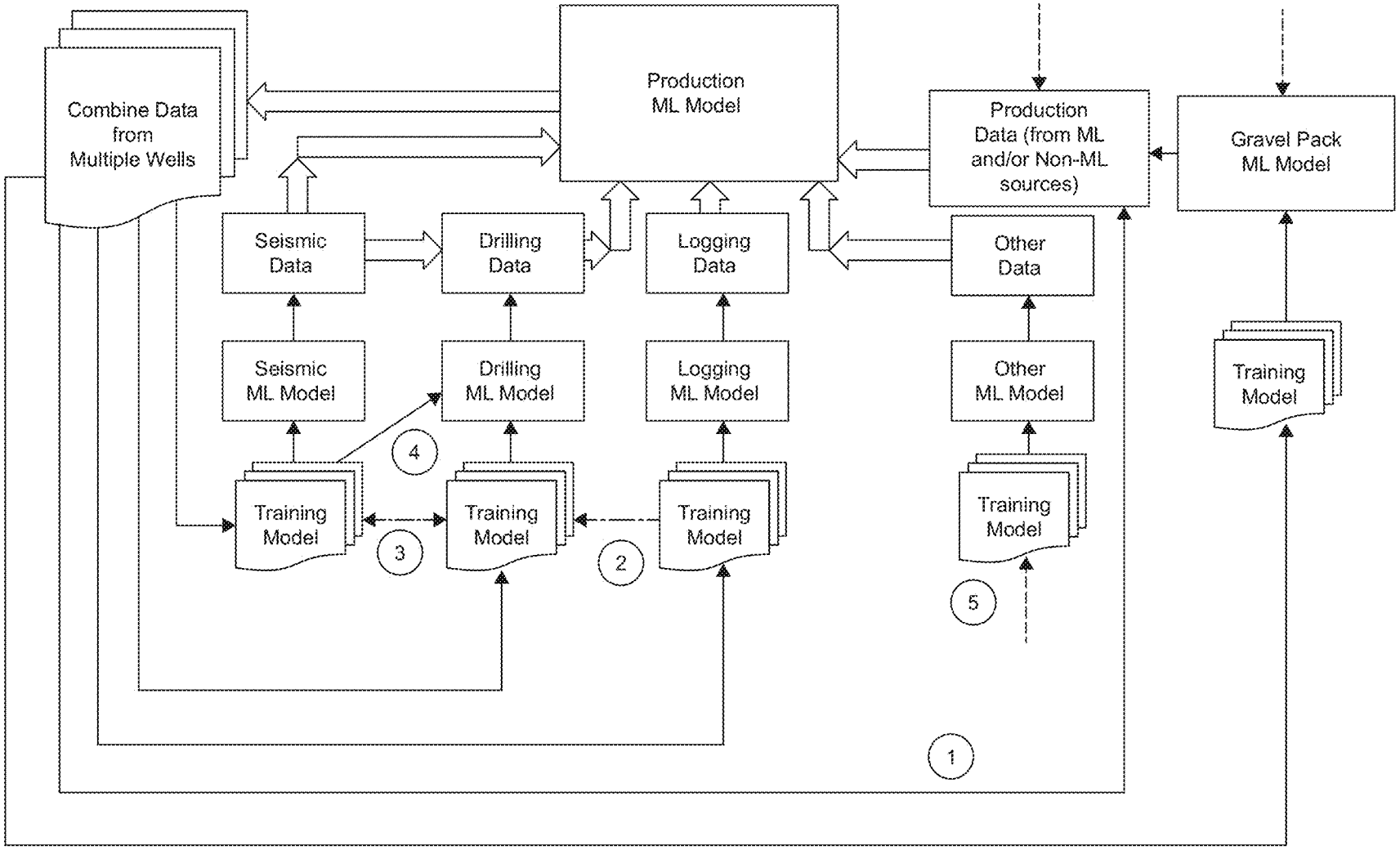

As shown in FIG. 65, the sharing of Output data from the "Combined Data" source is shown. Various sharing methodologies are claimed that are within the scope of this Disclosure.

1. Data from "Combined Data" source is shared with one or more training models. Each set of data may be identical or completely different. In most cases the data sets would be different. The data may be suited (presorted and configured) for each individual training model, or not.
2. Training data from one training model may be shared with another training model. For example, sharing training data about wellbore size due to washout conditions, deviated wellbores, key seats, porous zones, etc. may be valuable information for the drilling model to know/use. In one embodiment, the data is shared one-way.
3. Bi-directional sharing of Training Data. For example, the training data for the drilling training model may be useful for the seismic. As an example, the sudden change of a rate of penetration "ROP" while drilling may indicate the top of a harder formation. This information would help the seismic ML model to know where/why certain seismic wave reflections are stronger (or weaker). A sudden increase in ROP may be an indication of a porous zone; another good data to pass to the seismic ML model.
4. Sharing of Training Data directly with an ML Model. In some situations, it may lead to improved efficiencies and faster analysis if one training model shares its data directly with the ML model. For example, if the seismic training model has information regarding faults, fractures, rubble zones, swelling shales, etc. that may be valuable for the drilling model to know/use directly.
5. Other sets of data from other sources may be valuable and decrease the cost and time of drilling and/or completing a well. For example, if a new type of completion fluid becomes available on the market, that information may be input into the Training Model of the "Other ML Model" to assist in analyzing the cost-benefit ratio of using the new completion fluid.
6. The above are only some methods/ways to use and share ML Data.

Methods/Systems/AI Concepts for use of an Autoencoder in the Disclosure:—the amount of data that is made available by the embodiments of the disclosure is extremely large. Especially in the previous example where there may be multiple ML models, multiple training models, and a combination ML model compiling and deciphering data from all the other ML models. In one or more embodiments, dimensionality reduction is a system/means/device transform data from a high-dimensional space into a low-dimensional space so that the representation retains some meaningful properties of the original data. Working in high-dimensional spaces can be undesirable for many reasons; raw data are often sparse as a consequence of the curse of dimensionality, and analyzing the data is usually computationally intractable (hard to control or deal with). Dimensionality reduction is common in fields that deal with large numbers of observations and/or large numbers of variables, such as signal processing, speech recognition, neuroinformatic, and bioinformatics. Methods are commonly divided into linear and nonlinear approaches. Approaches can also be divided into feature selection and feature extraction.

Dimensionality reduction can be used for noise reduction, data visualization, cluster analysis, or as an intermediate step to facilitate other analyses.

Figure 66:
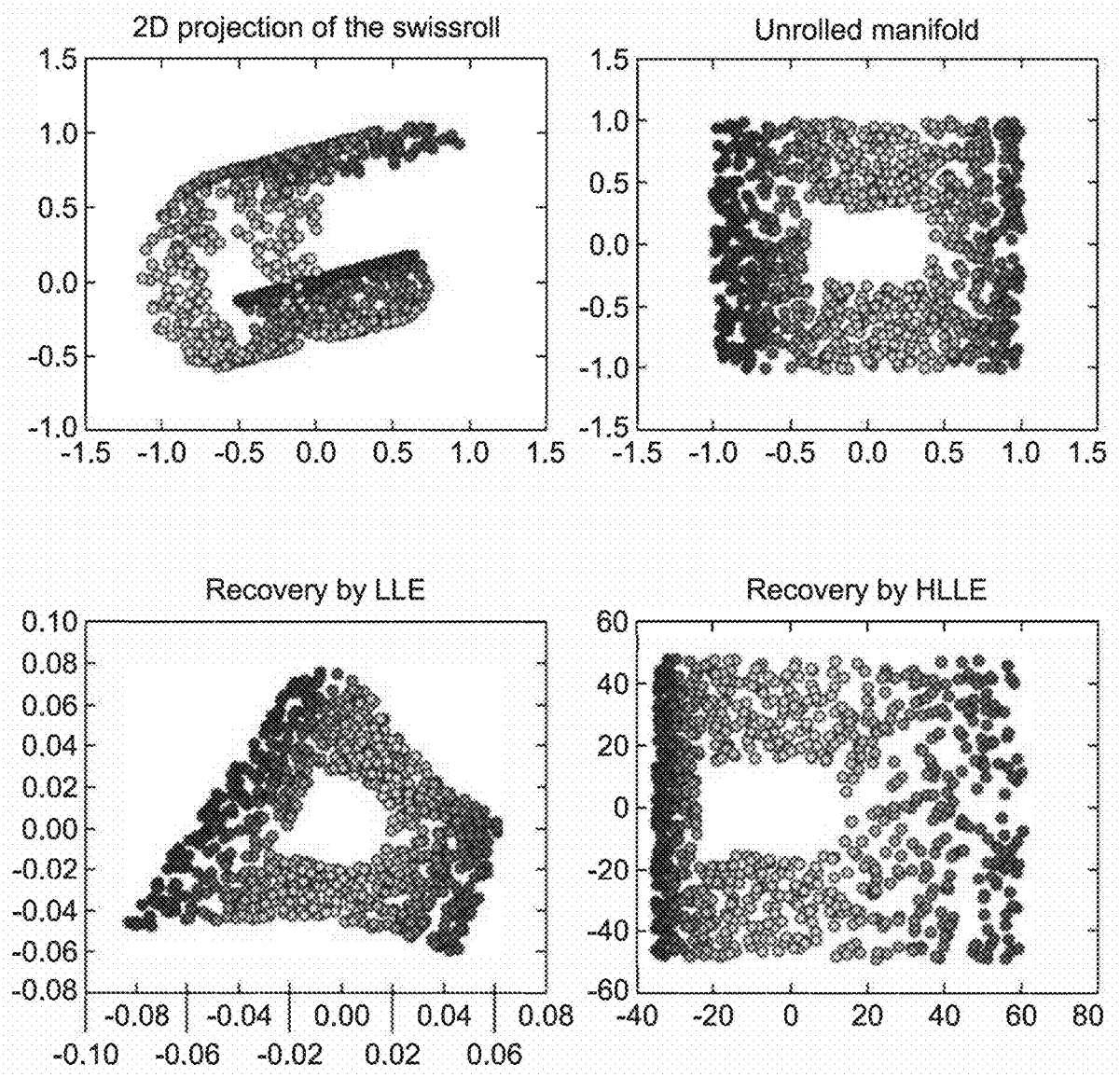

A visual example of a nonlinear dimensionality reduction is shown in FIG. 66. Each image contains 1000 data points. The data points of the same color are related—or belong in the same "cluster." In the left upper view, it is difficult to see a correlation of the different data clusters. However, by employing certain algorithms, the data can be turned/rotated to align the same-colored data points into common clusters.

An autoencoder is a type of artificial neural network used to learn efficient coding of unlabeled data (unsupervised learning). The encoding is validated and refined by attempting to regenerate the input from the encoding. The autoencoder learns a representation (encoding) for a set of data, typically for dimensionality reduction, by training the network to ignore insignificant data ("noise").

Variants exist, aiming to force the learned representations to assume useful properties. Examples are regularized autoencoders (Sparse, Denoising and Contractive), which are effective in learning representations for subsequent classification tasks, and variational autoencoders, with applications as generative models. Autoencoders are applied to many problems, including facial recognition, feature detection, anomaly detection and acquiring the meaning of words. Autoencoders are also generative models which can randomly generate new data that is similar to the input data (training data).

As mentioned earlier under "Deep Learning Algorithm Embodiment(s)" time-series modeling may provide faster analysis. One deep learning algorithm called transformer can learn the complex transient dependencies in field data between the target parameter (for example, bottomhole pressure) and input features, which are the measured parameters of a well (for example, flow rates, bottomhole temperature, and choke opening size)

Transforming autoencoders differ from CNNs in that they are designed to explicitly capture the exact position of each feature, so it can learn the overall transformation matrix. The feature detectors are now no longer simple binary activation neurons, but are complex structures which are capable of representing the precise POS (Position, Orientation, and Scale) of each feature. This complex structure is what Hinton calls a 'capsule'. It allows the autoencoder to maintain translational invariance without throwing away important positional information.

The ability to produce, detect, and record one or more parameters related to a tool (e.g., orientation of a feature of the tool, temperature, etc.) and/or the operation (e.g., pumping fluid, etc.) being performed, then to relay information such as the orientation of the tool to a remote location (e.g., surface) and then adjust a feature of the tool (e.g., orientation) under harsh conditions (e.g., a dirty environment, solids, contaminated fluids such as drilling muds, or completion fluid), extreme pressures (e.g., >20,000-psi differential), extreme temperatures (e.g., <−20 F to >300 F)), makes this disclosure suitable for use in harsh environments such as outer space (e.g., satellites, spacecrafts, etc.), aeronautics (e.g., aircrafts), on-ground (e.g., swamps, marshes, etc.), below ground (e.g., mines, caves, etc.), ocean (e.g., on surface and subsea), subterranean (e.g., mineral extraction, storage wells (Carbon sequestration, Carbon capture and storage (CCS), etc.), and other energy recovery activities (e.g., geothermal, steam, etc.).

In addition, the ability to produce, detect, record, relay one or more parameters related to a tool and/or operation and then adjust a feature of the tool via one device, system and method and then connect another (e.g., long-term) system via a wet mate connection to perform similar and/or different functions under the adverse conditions, pressures, and/or temperatures mentioned above can reduce risks and improve reliability and functionality.

Likewise, the other embodiments described herein (e.g., Edge (AI) Computing, Distributed Computing, TinyML Embodiment(s), etc.) may be employed to improve data analysis, computations, transfer, etc. reliability and functionality in harsh environments such as those mentioned above.

FIG. 67 illustrates a flow diagram of an example of a method 6700 of training a stimulation model carried out according to the principles of the disclosure. The stimulation model can be for various stimulation processes, such as gravel packing, proppant control, fracking, acidizing, pumping, etc. The method 6700 begins in step 6701.

In step 6710, a set of sensed signals are collected from downhole sensors. The set of sensed signals can include transient data and the downhole sensors can be distributed sensors, discrete sensors, or a combination of both. The downhole sensors can include sensors for, at least, sensing one or more of temperatures, vibrations, pressures, or sound. The downhole sensors can be stimulation task sensors. The downhole sensors can be from, for example, an upper completion string or a lower completion string. FIGS. 36 and 38 provide examples of the type of sensors and the location of the sensors within a wellbore that can be used. Other examples of possible sensor type and location are provided in FIGS. 35, 37, 42, and 43. The sensed signals can be received via a wet connect. The wet connect can be a permanent half wet mate connector, such as illustrated in FIGS. 33A and 33B. An ETM of a data recorder can receive the sensed signals from the wet connect.

A training data set is generated in step 6720 by processing the collected set of sensed signals. The sensed signals can be raw data and the processing can include determining sensor data from the raw data and extracting stimulation features from the sensor data. For example, the sensed signals can be raw data, such as a voltage or an amplitude, and sensor data that correlates to the raw data is determined, such as measurements for pressure, temperature, sound level, etc. Desired stimulation features that correspond to the sensor data measurements can be extracted. Additional data can be used when generating the training data set and extracting the stimulation features. For example, the additional data can include one or more of: laboratory data, offset well data, engineering calculations, engineering formulas, or expert observations and analysis. The expert observations and analysis can be from human intelligence, artificial intelligence, or both. Examples of stimulation features include pressure measurements per foot or meter of a completion section of the wellbore and pressure measurements per change in frac pack per proppant size. Regardless the features, generating the training data set can include combining different types of stimulation features, discretizing the combined features per a particular distance or amount of time, and using the discretized features for the training data set.

The processing can also include filtering the set of sensed signals by removing anomalies. One or more machine learning algorithms can be used for the filtering. For example, a supervised or unsupervised algorithm can be used. A deep learning algorithm, such as a transformer may also be used. The filtering can be performed by one or more of an intelligent sensor, an edge computing device, or a data recorder, such as data recorder 5000.

In step 6730, a stimulation model is trained using one or more machine learning algorithms by learning relationships between the training data set and targeted parameters of a stimulation process. Additional data can also be used when learning the relationships. As noted above, the additional data can include one or more of: laboratory data, offset well data, engineering calculations, engineering formulas, or expert observations and analysis. The additional data can be related to stimulation processes.

The method 6700 continues to step 6740 and ends with a trained stimulation model. Once trained, the trained production model can be used to improve a stimulation process. A trained stimulation model can be retrained using real time sensed signals. As such, the method 6700 of training also includes retraining of a previously trained stimulation model.

FIG. 68 illustrates a flow diagram of an example of a method 6800 of training a production model carried out according to the principles of the disclosure. The production model can be for various production processes as disclosed herein, such as retrieving hydrocarbons from a wellbore. The method 6800 begins in step 6801.

In step 6810, a set of sensed signals are collected from downhole sensors. The set of sensed signals can include transient data and the downhole sensors can be distributed sensors, discrete sensors, or a combination of both. The downhole sensors can include sensors for sensing one or more of temperatures, vibrations, pressures, sound, oil cut, water cut, gas cut, solids content, pH level, noise, strain, or other sensors known in the art and future sensor/devices not known today, etc. The downhole sensors can be production task sensors. The downhole sensors can be from, for example, a production string. The sensed signals can be received via a wet connect. The wet connect can be a permanent half wet mate connector, such as illustrated in FIGS. 33A and 33B. An ETM of a data recorder can receive the sensed signals from the wet connect.

A training data set is generated in step 6820 by processing the collected set of sensed signals. The sensed signals can be raw data and the processing can include determining sensor data from the raw data and extracting production features from the sensor data. For example, the sensed signals can be raw data, such as a voltage or an amplitude, and sensor data that correlates to the raw data is determined, such as measurements for pressure, temperature, sound level, etc. Desired production features that correspond to the sensor data measurements can be extracted. Additional data can be used when generating the training data set and extracting the production features. For example, the additional data can include one or more of: laboratory data, offset well data, engineering calculations, engineering formulas, or expert observations and analysis. Examples of features include oil or gas production per foot/meter as a function of porosity, wellbore inclination, and liquid leak-off rate. Regardless the production features, generating the training data set can include combining different types of production features, discretizing the combined features per a particular distance or amount of time, and using the discretized features for the training data set.

The processing can also include filtering the set of sensed signals by removing anomalies. One or more machine learning algorithms can be used for the filtering. For example, a supervised or unsupervised algorithm can be used. A deep learning algorithm, such as a transformer may also be used. The filtering can be performed by one or more of an intelligent sensor, an edge computing device, or a data recorder, such as data recorder 5000.

In step 6830, a production model is trained using one or more machine learning algorithms by learning relationships between the training data set and targeted parameters of a production process. Additional data can also be used when learning the relationships. For example, the additional data can include one or more of: laboratory data, offset well data, engineering calculations, engineering formulas, or expert observations and analysis. The additional data can be related to production processes.

In step 6840, the production model is further trained using other data than the data based on the sensed signals. The other data can be well data generated by machine learning algorithms for well operations that are different than production operations. The non-well data can include, for example, seismic data, drilling data, logging data or a combination thereof. The well operations can include corresponding seismic operations, drilling operations, logging operations, or a combination thereof. The well data can be from a combination of wells.

Each of the machine learning algorithms can be directed to a specific well operation and at least one the machine learning algorithms can use well data from another well operation that is different than the specific well operation. For example, a machine learning algorithm directed to drilling can use seismic data.

Additional production data from a source different than the downhole sensors can also be used for the training. The additional production data can be from artificial or human intelligence. The artificial intelligence based production data can be based on a trained stimulation model, such as one trained by method 6700. FIGS. 58 and 60 to 65 provide examples of the different type of data and machine learning models that can be used for developing a production model according to method 6800.

The method 6800 continues to step 6850 and ends with a trained production model. Once trained, the trained production model can be used to improve a production process. A trained production model can be retrained using real time sensed signals from the production process. As such, the method 6800 of training also includes retraining of a previously trained production model.

FIG. 69 illustrates a flow diagram of an example of a method 6900 of performing a well operation for a wellbore using a trained model according to the principles of the disclosure. The well operation can be, for example, a stimulation process or a production process. Accordingly, the trained model can be a stimulation model or a production model. Methods 6700 and 6800 can be used to generate the respective stimulation or production models. The method 6900 begins in step 6901.

In step 6910 sensed signals are collected from sensors located in the wellbore during the well operation. The sensed signals can be collected via a data recorder connected to a wet connect. The wet connect can be a permanent half wet mate connector. The sensors can be, for example, stimulation task sensors or production task sensors. The sensors can include distributed sensors, discrete sensors, or both The well operation is evaluated in a step 6920. A computing system, such as computing system 7000 of FIG. 70, can perform the evaluation. The evaluation is based on the sensed signals and a trained model. The trained model has been previously trained to detect relationships between a training data set based on a set of sensed signals and targeted parameters of a well operation. The set of sensed signals were collected from downhole sensors that included at least one of distributed sensors or discrete sensors. The set of sensed signals may have been collected via a data recorder and a wet connect. The wet connect can be a permanent half wet mate connector. The data recorder and wet connect used in step 6920 can be different than the data recorder and wet connect possibly used in step 6910. The trained model can be a stimulation model trained via sensed signals from stimulation task sensors. Alternatively, the trained model can be a production model trained via sensed signals from production task sensors.

In step 6930 the well operation is performed based on the evaluating. One or more operating parameters can be changed when performing the well operation based on the evaluating. The evaluating can provide commercial advantages, such as increasing the efficiency of stimulation processes and increasing the oil production and revenue efficiencies by gathering and analyzing the stimulation and production data.

Regarding a stimulation process, the evaluating using the trained model provides knowledge that can be used to change stimulation parameters including the following examples. At least some of the changes can be performed automatically.

Concentration of Proppant:

The proppant concentration at the surface may be changed. For example, at time 12:12 pm the stimulation fluid may be being mixed which will end up at an interval between 2,515-m and 2,520-m. The evaluating, or analysis, has indicated there is a large fracture in the interval which will "steal" the proppant that should go in another interval. The evaluating determines it is best to increase the size and concentration of the proppant headed for interval 2,515-m and 2,520-m to plug/pack off the fracture so the following stimulation fluid (and related proppant) is diverted to other intervals. Accordingly, one or more valve can be operated for the diversion.

Concentration/Addition/Deletion of Some Chemicals:

The chemical concentration at the surface may be changed. For example, at time 12:12 pm the stimulation fluid may be being mixed which will end up at an interval between 2,515-m and 2,520-m. A higher concentration of fluid loss chemicals may be added to prevent the fluid portion of the stimulation fluid from being "lost" (absorbed/leaked) into the interval between 2,515-m and 2,520-m. As such, an automatic dispenser or an operator can be instructed to increase the concentration of fluid loss chemicals.

Pump Rate/Pumping Pressure:

Using the same interval as an example, the pumping parameters may be changed as a particular stimulation fluid "mix" is passing across the interval between 2,515-m and 2,520-m to prevent excessively exceeding the formation fracture pressure of that particular interval. Accordingly, the evaluating can lead to changing the operating parameters of one or more pumps to alter the pumping parameters of the stimulation fluid mix.

Flow Back Procedure and Rate:

The analysis using the trained model may provide information regarding the flow back procedure and flow back rate(s). Based on the output from the trained model, an automatic choke or an operator can be instructed to maintain a flow back rate to 6 barrels per hour during the recovery of the first 100 barrels of fluid, then increase the flow back rate at a given rate (e.g. 2 barrels of fluid increase every 10 minutes, but not exceed a flow back rate of 18 barrel per hour). The flow back rate, pressure drop across the choke, temperature of the fluid, oil cut of the fluid, proppant recovered in the flow back fluid, etc. may be recorded and used in one or more AI/ML models such as stimulation model used in method 6700 discussed above.

Regarding a production process, as indicated above oil production and revenue efficiencies can be increased by: 1) completion-type data (e.g., frack placement (pack factor per foot), pack factor, etc.); 2) production-type data (e.g., production per zone, production per meter/foot (distributed sensing); 3) geological/reservoir data (porosity, permeability, oil %, etc.); 4) 4D geological/reservoir data/production data; 5) analyzing the above data; and 6) using the above analysis to plan next well's completion, and employing a continuous feedback loop, including gathering data, analyzing multiple streams of data, making intelligent decisions for the next well's completion.

The evaluating using the trained model provides knowledge that can be used to change production parameters to, for example, achieve production improvements. At least some of the changes can be performed automatically. The examples include the following:

Placement of Downhole Equipment:

Continuing with the use of interval between 2,515-m and 2,520-m with the large fracture as an example. The trained production model can help assess the production from that interval/fracture. If the evaluating by the trained production model determines the interval/fracture will produce mainly water, isolation devices may be installed in the current well (or future wells) across the fracture to prevent influx of water.

If the AI/ML model determines the interval/fracture will produce mainly oil, packers and flow control devices may be installed in the current well (or future wells) across the fracture or interval to ensure optimum production of hydrocarbons from that interval/fracture.

Refine a Reservoir Model:

The AI/ML model or models can be used to assess the parameters of the interval/fracture to quantize the interval/fracture/well/field/reservoir/multiple reservoirs/reservoir type. For example: The production of an interval with a given porosity may be determined to be a function directly proportional: $y=mx+c$. Or the production of an interval (oil production per meter/foot; OilPrdpMtr) in a reservoir is determined to be a function of porosity (Por) in a given interval, width of fracture (Frw), height of fracture (Frh), height of formation (Fmh), position of the wellbore within the formation (WbH), etc., wherein $OilPrdpMtr=5*Pro+3*Frw^2+Frh^{-1/3}-\ln(140*Fmh)+0.001*WbHc^3+\ldots$.

The result of analysis may be to fine tune or refine a reservoir model used in another reservoir and geological simulation.

Improve Inputs:

A trained model or models can be used to assess the parameters of the interval/fracture to quantize the interval/fracture/well/field/reservoir/multiple reservoirs/reservoir types. In other words, the trained model output can be used to improve the Input Data for other programs such as reservoir, geological, seismic, stress, strain, compaction, flow, water flood, steam injection, injection, stimulation, etc.

The output of the trained model or models can be used to control the input variables of systems used to control the production/injection of fluids from/to an interval, from a geological feature (e.g. a fracture, a low-permeability zone, a low-porosity zone, a high oil-cut interval, a high water-cut interval, an interval with a viscous oil (e.g. heavy oil). The variables may be for a system to control an interval, a fracture, a well, a field, a reservoir, multiple reservoirs, etc.

In other words, the model output can be used to improve the Input Data for systems utilized in controlling and gathering data from a variety of places including reservoir (e.g.

huff and puff systems, CCUS Injection, etc.), geological (seismic acquisition, core drilling, etc.), etc.

The output of the trained model or models can be used to control the input variables of logging systems and other data-gathering systems (e.g. systems used to gather and evaluate well data acquired by "logs" sent downhole to gather information (aka electric log, wireline logs, sonic logs, coiled tubing logging, Drill Stem Tests, Production Logging Tool (PLT), Pressure Build Up logs, Logging While Drilling (LWD), etc.)

The trained output can also be used as input to the above. For example, the trained model output can be used to control the speed, decent, locations of the tools. The speed of the tools may be slowed if the output indicates a special zone of interest needs to be logged slowly to gather data with a higher resolution. The output may dictate that a certain zone should be evaluated for a longer amount of time. The trained model output may provide indications of where specialized tools may be placed or used during a logging trip or a PLT trip. Instead of those specialized tools being running continuously during the logging trip, they may be turned on and off to conserve energy, time and/or money due to the information provided by the ML.

The AI/ML model or models can be used to optimize/improve the inputs used in transient analysis. For example, the trained models output can be used for 4D geological/reservoir data/production data analysis to determine how oil production, water production, gas injection, production rates, etc. are affected over a time span. The time span may be a span of milliseconds, microseconds, seconds, minutes, hours, days, weeks, months, years, etc.

The AI/ML model or models can be used to optimize/improve the inputs used in transient analysis (e.g. 4D transient analysis). For example: the oil production per meter data (OilPrdpMtr) mentioned earlier from a particular well or wellbore can be used to improve the resolution of the oil phase movement in a reservoir modeling software; especially useful in a 4D reservoir modeling software.

The AI/ML results can be used separately or in conjunction with the reservoir modeling software to provide inputs for a water injection system, a production rate controlling system, etc. In some embodiments, the trained model or models can include reservoir modeling software or parts thereof. In some embodiments, the trained model or models can include AI/ML driven reservoir modeling software or parts thereof.

The method 6900 continues to step 6940 and ends. The method 6900 can continue until the particular well operation is complete. As such, the method 6900 can end at the completion of a stimulation process or a production process.

FIG. 70 illustrates a block diagram of an example of a computing system 7000 configured to train well operation models using one or more machine learning algorithms according to the principles of the disclosure. For example, the computing system 7000 can perform the methods 6700 or 6800. The computing system 7000 can also be used to evaluate well operations, such as according to the method 6900. The computing system 7000 can be located proximate a wellbore or remote from a wellbore, such as in a data center or corporate office. The computing system can be a cloud computing system. The functionality of the computing system 7000 can be distributed across various computing device. In one embodiment, at least a portion of the functionality can be located downhole, such as in a data recorder disclosed herein. The computing system 7000 includes one or more data interfaces represented by data interface 7010, one or more memories represented by memory 7020, and one or more processor 7030 represented by processor 7030.

Data interface 7010 is configured to transmit and receive data. For example, data interface 7010 can receive the sensed signals and operating instructions. The operating instructions can correspond to machine learning algorithms, such as supervised or unsupervised learning algorithms. Data interface 7010 can also be used output a trained model. Data interface 7010 can communicate via communication systems used in the industry. For example, wireless or wired protocols can be used.

Memory 7020 can be configured to store a series of operating instructions that direct the operation of processor 7030 when initiated thereby. The operating instructions include code corresponding to one or more algorithms for performing the functions of the computing system 7000 that include training models. Memory 7020 is a non-transitory computer readable medium. Multiple types of memory can be used for data storage and the memory 7020 can be distributed across multiple memories.

Processor 7030 includes the logic to train a model using one or more machine learning algorithms. The processor 7030 can be configured according to one or more ANN for the training. The processor 7030 can be a parallel processor, a serial processor, or a combination of both.

Aspects disclosed herein include:

A. A well system, the well system including: 1) a wellbore extending through one or more subterranean formations; 2) a lower completion string located within the wellbore, the lower completion string having a downhole half energy transfer mechanism coupled to one or more sensors positioned along the lower completion string; and 3) a service string coupled with the lower completion string, the service string having an uphole energy transfer mechanism coupled with the downhole energy transfer mechanism of the lower completion string, the downhole energy transfer mechanism and the uphole energy transfer mechanism configured to transfer sensor information obtained by the one or more sensors as the service string is coupled with the lower completion string.

B. A method, the method including: 1) forming a wellbore through one or more subterranean formations; and 2) positioning a lower completion string within the wellbore along with a service string, the lower completion string having a downhole energy transfer mechanism coupled to one or more sensors positioned along the lower completion string, and the service string having an uphole energy transfer mechanism coupled with the downhole energy transfer mechanism of the lower completion string, the downhole energy transfer mechanism and the uphole energy transfer mechanism configured to transfer sensor information obtained by the one or more sensors as the service string is coupled with the lower completion string.

C. An energy transfer mechanism, the energy transfer mechanism including: 1) an energy transfer mechanism housing, the energy transfer mechanism housing having a male energy transfer mechanism connector portion or a female energy transfer mechanism connector portion; 2) a fluid reservoir located within the energy transfer mechanism housing; and 3) a volume of coupling fluid located within the fluid reservoir, the volume of coupling fluid sufficient to allow the energy transfer mechanism housing to undergo at least three decoupling/coupling sequences before running out while the energy transfer mechanism housing is in a substantially horizontal location.

D. A well system, the well system including: 1) a wellbore extending through one or more subterranean formations; and 2) an energy transfer mechanism located in the wellbore, the energy transfer mechanism including: a) an energy transfer mechanism housing, the energy transfer mechanism housing having a male energy transfer mechanism connector portion or a female energy transfer mechanism connector portion; b) a fluid reservoir located within the energy transfer mechanism housing; and c) a volume of coupling fluid located within the fluid reservoir, the volume of coupling fluid sufficient to allow the energy transfer mechanism housing to undergo at least three decoupling/coupling sequences before running out while the energy transfer mechanism housing is in a substantially horizontal location.

E. A method, the method including: 1) forming a wellbore through one or more subterranean formations; and 2) placing an energy transfer mechanism within the wellbore, the energy transfer mechanism including: a) energy transfer mechanism housing, the energy transfer mechanism housing having a male energy transfer mechanism connector portion or a female energy transfer mechanism connector portion; b) a fluid reservoir located within the energy transfer mechanism housing; and c) a volume of coupling fluid located within the fluid reservoir, the volume of coupling fluid sufficient to allow the energy transfer mechanism housing to undergo at least three decoupling/coupling sequences before running out.

F. A well system, the well system including: 1) a wellbore extending through one or more subterranean formations; and 2) a lower completion string located within the wellbore, the lower completion string having a plurality of sensors distributed along at least a portion thereof.

G. A method, the method including: 1) forming a wellbore through one or more subterranean formations; and 2) positioning a lower completion string within the wellbore using a service string, the lower completion string having a plurality of sensors distributed along at least a portion thereof.

H. A well system, the well system including: 1) a wellbore extending through one or more subterranean formations; 2) a lower completion string located within the wellbore; and 3) a service string coupled with the lower completion string, the service string having one or more completion task sensors positioned along its length.

I. A method, the method including: 1) forming a wellbore through one or more subterranean formations; and 2) positioning a lower completion string within the wellbore along with a service string coupled thereto, the service string having one or more completion task sensors positioned along its length.

J. A data recorder for a wellbore, the data recorder including: 1) an energy transfer mechanism configured to receive sensed signals from one or more downhole sensors; 2) a data logger; 3) a controller having one or more processors to perform operations including: a) converting the sensed signals received from the one or more downhole sensors into sensor data; and b) storing the sensor data in a data logger; and 4) a coupling mechanism configured to connect the data recorder to an equipment section.

K. A downhole data recording system for a wellbore, the downhole data recording system including: 1) a network of devices, wherein the network includes sensors; 2) a data recorder including: a) an energy transfer mechanism configured to receive sensed signals from the sensors of the network; b) a data logger; and c) a controller having one or more processors to perform operations including: i) converting the sensed signals received from the network into sensor data; and ii) storing the sensor data in a data logger; and 3) a wet connect coupled to the data recorder, wherein the sensed signals are received by the energy transfer mechanism via the wet connect.

L. A method of obtaining downhole data from a wellbore, the method including: 1) receiving, at a data recorder, sensed signals from a network of devices, wherein the data recorder includes an energy transfer mechanism and the data recorder and the network of device are located downhole; and 2) delivering downhole data to the surface via the data recorder, wherein the data recorder includes an energy transfer mechanism connected to a permanent half wet mate connector of a first equipment string of the wellbore and the sensed signals are received by the energy transfer mechanism via the permanent half wet mate connector, wherein the downhole data is based on the sensed signals.

M. A method of training a stimulation model for a wellbore, the method including: 1) collecting a set of sensed signals from downhole sensors, wherein the downhole sensors include at least one of distributed sensors or discrete sensors, and 2) training, using one or more machine learning algorithms, a stimulation model by learning relationships between a training data set based on the set of sensed signals and targeted parameters of a stimulation process.

N. A method of performing a stimulation process for a wellbore, including: 1) collecting sensed signals from sensors located in the wellbore during the stimulation process, 2) evaluating the stimulation process based on the sensed signals and using a stimulation model trained to detect relationships between a training data set based on a set of sensed signals and targeted parameters of stimulation processes, wherein the set of sensed signals were collected from downhole sensors that included at least one of distributed sensors or discrete sensors, and 3) altering one or more operating parameter of the stimulation process based on the evaluating.

O. A computing system, including: 1) an interface for receiving a set of sensed signals from downhole sensors, wherein the downhole sensors include at least one of distributed sensors or discrete sensors, and 2) one or more processors to perform operations including training, using one or more machine learning algorithms, a stimulation model by learning relationships between a training data set based on the set of sensed signals and targeted parameters of a stimulation process.

P. A method of training a production model for a wellbore, including: 1) collecting a set of sensed signals from downhole sensors, wherein the downhole sensors include at least one of distributed sensors or discrete sensors, and 2) training, using one or more machine learning algorithms, a production model by learning relationships between a training data set based on the set of sensed signals and targeted parameters of a production process.

Q. A method of performing a production process for a wellbore, including: 1) collecting sensed signals from downhole sensors located in the wellbore during a production process, 2) evaluating the production process based on the sensed signals and using a production model trained to detect relationships between a training data set based on a set of sensed signals and targeted parameters of production processes, wherein the set of sensed signals were collected from downhole sensors that included at least one of distributed sensors or discrete sensors, and 3) altering one or more operation of the production process based on the evaluating.

R. A computing system, including: 1) an interface for receiving a set of sensed signals from downhole sensors, wherein the downhole sensors include at least one of distributed sensors or discrete sensors, and 2) one or more processors to perform operations including training, using one or more machine learning algorithms, a production model by learning relationships between a training data set based on the set of sensed signals and targeted parameters of a production process.

Aspects A through R may have one or more of the following additional elements either alone or in combination: Element 1: wherein the one or more sensors are one or more completion task sensors, the downhole energy transfer mechanism and the uphole energy transfer mechanism configured to transfer completion task sensor information obtained by the one or more sensors as the service string is coupled with the lower completion string. Element 2: wherein the one or more sensors are one or more gravel pack sensors. Element 3: wherein the one or more sensors are one or more frac pack sensors. Element 4: wherein the one or more sensors are a plurality of discrete sensors distributed along at least a portion of the lower completion string. Element 5: wherein the plurality of discrete sensors are a plurality of discrete sensors distributed less than 500 m apart along at least a portion of the lower completion string. Element 6: wherein the plurality of discrete sensors are a plurality of discrete sensors distributed less than 50 m apart along at least a portion of the lower completion string. Element 7: wherein the plurality of discrete sensors are a plurality of discrete sensors distributed less than 3 m apart along at least a portion of the lower completion string. Element 8: wherein the plurality of discrete sensors are a plurality of discrete sensors distributed less than 0.25 m apart along at least a portion of the lower completion string. Element 9: wherein the plurality of discrete sensors are a plurality of discrete sensors distributed less than 1 mm apart along at least a portion of the lower completion string. Element 10: wherein the one or more sensors are one or more distributed fibers positioned along at least a portion of the lower completion string. Element 11: wherein the downhole energy transfer mechanism is a permanent downhole half wet mate connector. Element 12: wherein the uphole energy transfer mechanism is a retrievable uphole half wet mate connector. Element 13: further including sending power down the service string to the lower completion string via the uphole energy transfer mechanism and the downhole energy transfer mechanism. Element 14: further including sending data or commands down the service string to the lower completion string via the uphole energy transfer mechanism and the downhole energy transfer mechanism. Element 15: wherein the one or more sensors are a plurality of discrete sensors distributed along at least a portion of the lower completion string and one or more distributed fibers positioned along at least a portion of the lower completion string. Element 16: wherein the plurality of discrete sensors and the one or more distributed fibers pass through the uphole energy transfer mechanism and the downhole energy transfer mechanism. Element 17: wherein the one or more sensors are one or more completion task sensors, and further including obtaining completion task sensor information from the completion task sensors as the service string is coupled with the lower completion string. Element 18: further including transferring the completion task sensor information as the service string is coupled with the lower completion string. Element 19: wherein the one or more sensors are one or more gravel pack sensors. Element 20: wherein the one or more sensors are one or more frac pack sensors. Element 21: wherein the one or more sensors are a plurality of discrete sensors distributed along at least a portion of the lower completion string. Element 22: wherein the plurality of discrete sensors are a plurality of discrete sensors distributed less than 500 m apart along at least a portion of the lower completion string. Element 23: wherein the plurality of discrete sensors are a plurality of discrete sensors distributed less than 50 m apart along at least a portion of the lower completion string. Element 24: wherein the plurality of discrete sensors are a plurality of discrete sensors distributed less than 3 m apart along at least a portion of the lower completion string. Element 25: wherein the plurality of discrete sensors are a plurality of discrete sensors distributed less than 0.25 m apart along at least a portion of the lower completion string. Element 26: wherein the plurality of discrete sensors are a plurality of discrete sensors distributed less than 1 mm apart along at least a portion of the lower completion string. Element 27: wherein the one or more sensors are one or more distributed fibers positioned along at least a portion of the lower completion string. Element 28: wherein the downhole energy transfer mechanism is a permanent downhole half wet mate connector. Element 29: wherein the uphole energy transfer mechanism is a retrievable uphole half wet mate connector. Element 30: further including disconnecting the service string and retrievable uphole half wet mate connector from the lower completion string and permanent downhole half wet mate connector. Element 31: further including connecting an upper completion string having a second uphole half wet mate connector with the lower completion string and permanent downhole half wet mate connector. Element 32: wherein the one or more sensors are one or more production task sensors, and further including obtaining production task sensor information from the production task sensors as the upper completion string is coupled with the lower completion string. Element 33: further including transferring the production task sensor information uphole as the upper completion string is coupled with the lower completion string. Element 34: further including sending power down the service string to the lower completion string via the uphole energy transfer mechanism and the downhole energy transfer mechanism. Element 35: further including sending data or commands down the service string to the lower completion string via the uphole energy transfer mechanism and the downhole energy transfer mechanism. Element 36: wherein the one or more sensors are a plurality of discrete sensors distributed along at least a portion of the lower completion string and one or more distributed fibers positioned along at least a portion of the lower completion string. Element 37: wherein the plurality of discrete sensors and the one or more distributed fibers pass through the uphole energy transfer mechanism and the downhole energy transfer mechanism. Element 38: wherein the volume of coupling fluid is sufficient to allow the energy transfer mechanism housing to undergo at least six decoupling/coupling sequences before running out. Element 39: wherein the volume of coupling fluid is sufficient to allow the energy transfer mechanism housing to undergo at least ten decoupling/coupling sequences before running out. Element 40: wherein the volume of coupling fluid is sufficient to allow the energy transfer mechanism housing to undergo at least twenty decoupling/coupling sequences before running out. Element 41: further including a biasing device coupled with the volume of coupling fluid, the biasing device configured to discharge an amount of the coupling fluid outside of the energy transfer mechanism housing between each decoupling/coupling sequence. Element 42: wherein the biasing device is configured to discharge the amount of the coupling fluid outside of the energy transfer mechanism housing as the energy transfer mechanism housing and the second opposing energy transfer mechanism housing are approaching one another to clear any wellbore debris from the energy transfer mechanism housing prior to the energy transfer mechanism housing and the second opposing energy transfer mechanism housing fully mating together. Element 43: wherein the biasing device is configured to discharge a substantially consistent amount of the coupling fluid outside of the energy transfer mechanism housing between each decoupling/coupling sequence. Element 44: wherein the energy transfer mechanism housing includes the male energy transfer mechanism connector portion, and further wherein the fluid reservoir is located in the male energy transfer mechanism connector portion. Element 45: wherein the energy transfer mechanism housing includes the female energy transfer mechanism connector portion, and further wherein the fluid reservoir is located in the female energy transfer mechanism connector portion. Element 46: wherein the energy transfer mechanism housing is a lower completion string energy transfer mechanism housing. Element 47: wherein the volume of coupling fluid is a volume of optical coupling fluid. Element 48: wherein the volume of coupling fluid is a volume of dielectric coupling fluid. Element 49: wherein the volume of coupling fluid is sufficient to allow the energy transfer mechanism housing to undergo at least six decoupling/coupling sequences before running out. Element 50: wherein the volume of coupling fluid is sufficient to allow the energy transfer mechanism housing to undergo at least ten decoupling/coupling sequences before running out. Element 51: wherein the volume of coupling fluid is sufficient to allow the energy transfer mechanism housing to undergo at least twenty decoupling/coupling sequences before running out. Element 52: further including a biasing device coupled with the volume of coupling fluid, the biasing device configured to discharge an amount of the coupling fluid outside of the energy transfer mechanism housing between each decoupling/coupling sequence. Element 53: wherein the biasing device is configured to discharge the amount of the coupling fluid outside of the energy transfer mechanism housing as the energy transfer mechanism housing and the second opposing energy transfer mechanism housing are approaching one another to clear any wellbore debris from the energy transfer mechanism housing prior to the energy transfer mechanism housing and the second opposing energy transfer mechanism housing fully mating together. Element 54: wherein the biasing device is configured to discharge a substantially consistent amount of the coupling fluid outside of the energy transfer mechanism housing between each decoupling/coupling sequence. Element 55: wherein the biasing device is configured to discharge a substantially consistent amount of the coupling fluid at an interface of the energy transfer mechanism during each decoupling/coupling sequence. Element 56: wherein the energy transfer mechanism housing includes the male energy transfer mechanism connector portion, and further wherein the fluid reservoir is located in the male energy transfer mechanism connector portion. Element 57: wherein the energy transfer mechanism housing includes the female energy transfer mechanism connector portion, and further wherein the fluid reservoir is located in the female energy transfer mechanism connector portion. Element 58: wherein the energy transfer mechanism housing is a downhole lower completion string half energy transfer mechanism housing. Element 59: further including a tubing string coupled with the lower completion string, the tubing string having a second energy transfer mechanism including an uphole tubing string half energy transfer mechanism connector housing coupled with the downhole lower completion string half energy transfer mechanism housing. Element 60: wherein the tubing string is a service string. Element 61: wherein the tubing string is an upper completion string. Element 62: wherein the second energy transfer mechanism includes: a second energy transfer mechanism housing, the second energy transfer mechanism housing having a second male energy transfer mechanism connector portion or a second female energy transfer mechanism connector portion; a second fluid reservoir located within the second energy transfer mechanism housing; and a second volume of coupling fluid located within the second fluid reservoir, the second volume of coupling fluid sufficient to allow the second energy transfer mechanism housing to undergo at least three decoupling/coupling sequences before running out while the energy transfer mechanism housing is in a substantially horizontal location. Element 62: wherein the volume of coupling fluid is a volume of optical coupling fluid. Element 63: wherein the volume of coupling fluid is a volume of dielectric coupling fluid. Element 64: wherein the plurality of sensors are a plurality of discrete sensors distributed along at least a portion of the lower completion string. Element 65: wherein the plurality of discrete sensors are a plurality of discrete sensors distributed less than 500 m apart along at least a portion of the lower completion string. Element 66: wherein the plurality of discrete sensors are a plurality of discrete sensors distributed less than 10 m apart along at least a portion of the lower completion string. Element 67: wherein the plurality of discrete sensors are a plurality of discrete sensors distributed less than 3 m apart along at least a portion of the lower completion string. Element 68: wherein the plurality of discrete sensors are a plurality of discrete sensors distributed less than 0.25 m apart along at least a portion of the lower completion string. Element 69: wherein the plurality of discrete sensors are a plurality of discrete sensors distributed less than 1 mm apart along at least a portion of the lower completion string. Element 70: wherein the plurality of sensors is a distributed fiber positioned along at least a portion of the lower completion string. Element 71: wherein the plurality of sensors are positioned inside the lower completion string. Element 72: wherein the plurality of sensors are positioned outside of the lower completion string. Element 73: wherein the plurality of sensors are positioned within a sidewall of the lower completion string. Element 74: further including a downhole half energy transfer mechanism coupled with the plurality of sensors. Element 75: further including a tubing string coupled with the lower completion string, the tubing string having an uphole half energy transfer mechanism connector coupled with the downhole half energy transfer mechanism of the lower completion string. Element 76: wherein the tubing string is a service string. Element 77: wherein the tubing string is an upper completion string. Element 78: wherein the lower completion string further includes one or more adjustable devices, the one or more adjustable devices configured to be adjusted based upon sensor information obtained by the plurality of sensors. Element 79: wherein the one or more adjustable devices are one or more control valves. Element 80: wherein the one or more adjustable devices are configured to receive power from a remote location. Element 81: wherein the one or more adjustable devices are configured to receive power from a surface of the wellbore. Element 82: wherein the one or more adjustable devices are configured to receive power through an energy transfer mechanism. Element 83: wherein the plurality of sensors are a plurality of discrete sensors distributed along at least a portion of the lower completion string. Element 84: wherein the plurality of discrete sensors are a plurality of discrete sensors distributed less than 500 m apart along at least a portion of the lower completion string. Element 85: wherein the plurality of discrete sensors are a plurality of discrete sensors distributed less than 10 m apart along at least a portion of the lower completion string. Element 86: wherein the plurality of discrete sensors are a plurality of discrete sensors distributed less than 3 m apart along at least a portion of the lower completion string. Element 87: wherein the plurality of discrete sensors are a plurality of discrete sensors distributed less than 0.25 m apart along at least a portion of the lower completion string. Element 88: wherein the plurality of discrete sensors are a plurality of discrete sensors distributed less than 1 mm apart along at least a portion of the lower completion string. Element 89: wherein the plurality of sensors is a distributed fiber positioned along at least a portion of the lower completion string. Element 90: wherein the plurality of sensors are positioned inside the lower completion string. Element 91: wherein the plurality of sensors are positioned outside of the lower completion string. Element 92: wherein the plurality of sensors are positioned within a sidewall of the lower completion string. Element 93: further including a downhole half wet mate connector coupled with the plurality of sensors. Element 94: further including a tubing string coupled with the lower completion string, the tubing string having an uphole energy transfer mechanism coupled with the downhole half energy transfer mechanism of the lower completion string. Element 95: wherein the tubing string is a service string. Element 96: wherein the tubing string is an upper completion string. Element 97: wherein the lower completion string further includes one or more adjustable devices, the one or more adjustable devices configured to be adjusted based upon sensor information obtained by the plurality of sensors. Element 98: wherein the one or more adjustable devices are one or more control valves. Element 99: wherein the one or more adjustable devices are configured to receive power from a remote location. Element 100: wherein the one or more adjustable devices are configured to receive power from a surface of the wellbore. Element 101: wherein the one or more adjustable devices are configured to receive power through an energy transfer mechanism. Element 102: wherein the lower completion string has a downhole energy transfer mechanism, and the service string has an uphole energy transfer mechanism coupled with the downhole energy transfer mechanism of the lower completion string. Element 103: wherein the downhole energy transfer mechanism is a permanent downhole half wet mate connector. Element 104: wherein the uphole energy transfer mechanism is a retrievable uphole half wet mate connector. Element 105: wherein the one or more sensors are one or more gravel pack sensors. Element 106: wherein the one or more sensors are one or more frac pack sensors. Element 107: wherein the one or more sensors are one or more cement sensors. Element 108: wherein the one or more sensors are a plurality of discrete sensors distributed along at least a portion of the lower completion string. Element 109: wherein the plurality of discrete sensors are a plurality of discrete sensors distributed less than 500 m apart along at least a portion of the lower completion string. Element 110: wherein the plurality of discrete sensors are a plurality of discrete sensors distributed less than 50 m apart along at least a portion of the lower completion string. Element 111: wherein the plurality of discrete sensors are a plurality of discrete sensors distributed less than 3 m apart along at least a portion of the lower completion string. Element 112: wherein the plurality of discrete sensors are a plurality of discrete sensors distributed less than 0.25 m apart along at least a portion of the lower completion string. Element 113: wherein the plurality of discrete sensors are a plurality of discrete sensors distributed less than 1 mm apart along at least a portion of the lower completion string. Element 114: wherein the one or more sensors are one or more distributed fibers positioned along at least a portion of the service string. Element 115: further including one or more production task sensors positioned along the lower completion string, and further including obtaining production task sensor information from the production task sensors as the service string is coupled with the lower completion string. Element 116: further including obtaining completion task sensor information from the completion task sensors as the service string is coupled with the lower completion string. Element 117: further including transferring the completion task sensor information uphole as the service string is coupled with the lower completion string. Element 118: wherein the lower completion string has a downhole energy transfer mechanism, and the service string has an uphole energy transfer mechanism coupled with the downhole energy transfer mechanism of the lower completion string. Element 119: wherein the downhole energy transfer mechanism is a permanent downhole half wet mate connector. Element 120: wherein the uphole energy transfer mechanism is a retrievable uphole half wet mate connector. Element 121: wherein the one or more sensors are one or more gravel pack sensors. Element 122: wherein the one or more sensors are one or more frac pack sensors. Element 123: wherein the one or more sensors are one or more cement sensors. Element 124: wherein the one or more sensors are a plurality of discrete sensors distributed along at least a portion of the lower completion string. Element 125: wherein the plurality of discrete sensors are a plurality of discrete sensors distributed less than 500 m apart along at least a portion of the lower completion string. Element 126: wherein the plurality of discrete sensors are a plurality of discrete sensors distributed less than 50 m apart along at least a portion of the lower completion string. Element 127: wherein the plurality of discrete sensors are a plurality of discrete sensors distributed less than 3 m apart along at least a portion of the lower completion string. Element 128: wherein the plurality of discrete sensors are a plurality of discrete sensors distributed less than 0.25 m apart along at least a portion of the lower completion string. Element 129: wherein the plurality of discrete sensors are a plurality of discrete sensors distributed less than 1 mm apart along at least a portion of the lower completion string. Element 130: wherein the one or more sensors are one or more distributed fibers positioned along at least a portion of the service string. Element 131: further including disconnecting the service string having a retrievable uphole half wet mate connector from the lower completion string having a permanent downhole half wet mate connector. Element 132: further including connecting an upper completion string having a second uphole half wet mate connector with the lower completion string having the permanent downhole half wet mate connector. Element 133: further including one or more production task sensors positioned along the lower completion string, and further including obtaining production task sensor information from the production task sensors as the upper completion string is coupled with the lower completion string. Element 134: further including transferring the production task sensor information uphole as the upper completion string is coupled with the lower completion string. Element 135: wherein the energy transfer mechanism is couplable to an energy transfer mechanism of a first equipment section of the wellbore and receives the sensed signals via the energy transfer mechanism of the first equipment section. Element 136: wherein the energy transfer mechanism of the first equipment section is a permanent downhole half wet mate connector. Element 137: wherein the operations further include sending control signals to the one or more sensors, wherein the sensed signals are received in response to the control signals. Element 138: wherein the control signals and the sensed signals are optical signals. Element 139: further comprising a light source, wherein the operations further include activating the light source and using the light source to send the control signals. Element 140: further comprising a communications interface that is configured to transmit downhole data uphole in real time, wherein the downhole data at least includes the sensor data. Element 141: wherein the one or more operations further include generating processed data from the sensed signals, the sensor data, or from both. Element 142: wherein a machine learning algorithm is used for the generating the processed data. Element 143: wherein the data logger additionally stores at least one of the sensed signals and the processed data. Element 144: wherein the sensors are embedded in a second equipment section and the sensed signals are stimulation data. Element 145: wherein the coupling mechanism is a retrieval mechanism that is a collet-type device or a releasable mechanism. Element 146: further comprising a power source. Element 147: wherein the downhole sensors are completion task sensors. Element 148: wherein the downhole sensors are production task sensors. Element 149: wherein the wet connect is a permanent downhole half wet mate connector of a first equipment section of the wellbore. Element 150: wherein the wet connect is a fiber optic wet connect. Element 151: wherein the operations further include sending control signals to the network via the wet connect, wherein the sensed signals are received in response to the control signals. Element 152: wherein the control signals and the sensed signals are optical signals. Element 153: wherein the operations further include sending power signals to one or more of the devices of the network via the wet connect. Element 154: wherein the devices includes computing devices and one or more of the operations of controller are distributed to one or more of the computing devices. Element 155: wherein the operations further include sending downhole data uphole in real time, wherein the downhole data includes the sensor data. Element 156: wherein the operations further include filtering the sensed signals before generating the sensor data. Element 157: wherein the one or more processor use a machine learning algorithm for the filtering. Element 158: wherein the devices includes computing devices and the filtering is performed by one or more of the computing devices. Element 159: wherein the data recorder further includes a coupling mechanism configured to connect the data recorder to a second equipment section. Element 160: wherein the downhole sensors are completion task sensors. Element 161: wherein the downhole sensors are production task sensors. Element 162: further comprising generating sensor data by processing the sensed signals and storing the sensor data in a data logger of the data recorder, wherein the downhole data includes the sensor data. Element 163: wherein the sensed signals are filtered before the processing. Element 164: wherein the sensed signals are filtered using a machine learning algorithm. Element 165: wherein the sensed signals are filtered by a computing device of the network of devices. Element 166: further comprising generating processed data using one or more of the sensor data and the sensed signals, wherein the downhole data further includes the processed data. Element 167: wherein the delivering includes sending the downhole data to the surface in real-time. Element 168: wherein the delivering includes retrieving the data recorder after the storing. Element 169: wherein the sensor data is from completion task sensors and the method further comprises running a different data recorder into the wellbore, connecting an energy transfer mechanism of the different data recorder to the permanent half wet mate connector, and obtaining sensor data from production task sensors via the permanent half wet mate connector. Element 170: wherein the downhole sensors include sensors for sensing one or more of temperatures, vibrations, pressures, or sound. Element 171: wherein the downhole sensors are stimulation task sensors. Element 172: wherein the set of sensed signals includes transient data. Element 173: further comprising generating the training data set by processing the collected set of sensed signals before the training, wherein the processing includes extracting stimulation features from the sensed signals. Element 174: wherein the features include pressure measurements per foot or meter of a completion section of the wellbore and pressure measurements per change in frac pack per proppant size. Element 175: wherein generating the training data set further includes combining different types of stimulation features, discretizing the combined features per a particular distance or amount of time, and using the discretized features for the training data set. Element 176: wherein the processing further includes filtering the set of sensed signals by removing anomalies. Element 177: wherein filtering includes using one or more machine learning algorithms. Element 178: wherein the filtering is performed by one or more of an intelligent sensor, an edge computing device, or a data recorder. Element 179: wherein the one or more machine learning algorithms include a deep learning algorithm. Element 180: wherein the deep learning algorithm is a transformer. Element 181: wherein generating the training data set further includes using additional data that includes one or more of: laboratory data, offset well data, engineering calculations, engineering formulas, or expert observations and analysis. Element 182: wherein the expert observations and analysis is from artificial intelligence. Element 183: wherein the stimulation process is gravel packing. Element 184: wherein the set of sensed signals includes transient data. Element 185: wherein the collecting includes receiving the set of sensed signals via a permanent half wet mate connector. Element 186: wherein the stimulation process includes one or more of cementing, packing, acidizing, pumping, or fracking. Element 187: wherein the one or more operating parameter relates to proppant used for the fracking. Element 188: wherein the one or more operating parameter relates to surfactants of the stimulation process. Element 189: wherein the set of sensed signals include transient data. Element 190: wherein the set of sensed signals were collected via a permanent half wet mate connector. Element 191: wherein the one or more operations further include generating the training data set by processing the collected set of sensed signals before the training and extracting stimulation features based on the sensed signals. Element 192: wherein the extracted features include at least one of pressure measurements per foot or meter of a completion section of the wellbore and pressure measurements per change in frac pack per proppant size. Element 193: wherein generating the training data set includes combining different types of features, discretizing the combined features per a particular distance or amount of time, and using the discretized features for the training data set. Element 194: wherein the processing further includes filtering the set of sensed signals by removing anomalies. Element 195: wherein filtering includes using one or more machine learning algorithms and the filtering is performed by one or more of an intelligent sensor, an edge computing device, or a data recorder. Element 196: wherein the one or more machine learning algorithms include at least one of a supervised learning algorithm, an unsupervised learning algorithm, and a deep learning algorithm. Element 197: wherein the stimulation process is fracking. Element 198: wherein the set of sensed signals include transient data. Element 199: wherein the set of sensed signals were collected via a permanent half wet mate connector. Element 200: wherein the downhole sensors are production task sensors. Element 201: further comprising generating the training data set by processing the collected set of sensed signals before the training, wherein the processing includes extracting production features from the sensed signals and using the extracted features for training. Element 202: wherein the features include oil or gas production per foot/meter as a function of porosity, wellbore inclination, and liquid leak-off rate. Element 203: wherein generating the training data set further includes combining different types of production features, discretizing the combined features per a particular distance or amount of time, and using the discretized features for the training. Element 204: wherein the processing further includes filtering the set of sensed signals by removing anomalies. Element 205: wherein the filtering includes using one or more machine learning algorithms. Element 206: wherein the filtering is performed before the collecting. Element 207: wherein the one or more machine learning algorithms includes at least one of a supervised learning algorithm, an unsupervised learning algorithm, and a deep learning algorithm. Element 208: wherein the deep learning algorithm is a transformer. Element 209: wherein generating the training data set further includes using one or more of: laboratory data, offset well data, engineering calculations, engineering formulas, or expert observations and analysis. Element 210: wherein the training further includes using additional data that is well data generated by machine learning algorithms for well operations that are different than production operations. Element 211: wherein the well data includes at least one of seismic data, drilling data, and logging data and the well operations include at least a corresponding one of seismic operations, drilling operations, and logging operations. Element 212: wherein the well data is based on a combination of wells. Element 213: wherein each of the machine learning algorithms are directed to a specific well operation and at least one the machine learning algorithms use well data from another well operation that is different than the specific well operation. Element 214: wherein the training further includes using additional production data from a source different than the downhole sensors. Element 215: wherein the additional production data is based on a trained stimulation model. Element 216: wherein the production model is for oil production or gas production. Element 217: wherein the set of sensed signals includes transient data. Element 218: wherein the collecting includes receiving the set of sensed signals via a permanent half wet mate connector. Element 219: wherein the production process includes one or more of retrieving oil or retrieving gas. Element 220: wherein the altering includes installing an isolating device, installing packers, or installing flow control devices. Element 221: wherein the one or more operations further include generating the training data set by processing the collected set of sensed signals before the training, and extracting features based on the extracted features. Element 222: wherein the features include at least one of oil or gas production per foot/meter as a function of porosity, wellbore inclination, and liquid leak-off rate. Element 223: wherein the processing further includes filtering the set of sensed signals by removing anomalies. Element 224: wherein the filtering includes using one or more machine learning algorithms and the filtering is performed by one or more of an intelligent sensor, an edge computing device, or a data recorder. Element 225: wherein the one or more machine learning algorithms includes at least one of a supervised learning algorithm, an unsupervised learning algorithm, and a deep learning algorithm. Element 226: wherein generating the training data set further includes using additional data that is well data generated by machine learning algorithms for well operations that are different than production operations. Element 227: wherein the well data is based on a combination of wells and includes at least one of seismic data, drilling data, and logging data and the well operations include at least a corresponding one of seismic operations, drilling operations, and logging operations. Element 228: wherein each of the machine learning algorithms are directed to a specific well operation and at least one the machine learning algorithms use well data from another well operation that is different than the specific well operation. Element 229: wherein the training further includes using additional production data from a source different than the downhole sensors, wherein the additional production data is based on a trained stimulation model. Element 230: wherein the set of sensed signals includes transient data. Element 231: wherein the collecting includes receiving the set of sensed signals via a permanent half wet mate connector Those skilled in the art to which this application relates will appreciate that other and further additions, deletions, substitutions and modifications may be made to the described embodiments.

What is claimed is:

1. An energy transfer mechanism, comprising:

an energy transfer mechanism housing, the energy transfer mechanism housing having a male energy transfer mechanism connector portion or a female energy transfer mechanism connector portion;

a fluid reservoir located within the energy transfer mechanism housing;

a volume of coupling fluid located within the fluid reservoir, the volume of coupling fluid sufficient to allow the energy transfer mechanism housing to undergo at least three decoupling/coupling sequences before running out while the energy transfer mechanism housing is in a substantially horizontal location; and a biasing device coupled with the volume of coupling fluid, the biasing device configured to discharge an amount of the coupling fluid outside of the energy transfer mechanism housing between each decoupling/coupling sequence.

2. The energy transfer mechanism as recited in claim 1, wherein the volume of coupling fluid is sufficient to allow the energy transfer mechanism housing to undergo at least six decoupling/coupling sequences before running out.

3. The energy transfer mechanism as recited in claim 1, wherein the volume of coupling fluid is sufficient to allow the energy transfer mechanism housing to undergo at least ten decoupling/coupling sequences before running out.

4. The energy transfer mechanism as recited in claim 1, wherein the volume of coupling fluid is sufficient to allow the energy transfer mechanism housing to undergo at least twenty decoupling/coupling sequences before running out.

5. The energy transfer mechanism as recited in claim 1 wherein the biasing device is configured to discharge the amount of the coupling fluid outside of the energy transfer mechanism housing as the energy transfer mechanism housing and the second opposing energy transfer mechanism housing are approaching one another to clear any wellbore debris from the energy transfer mechanism housing prior to the energy transfer mechanism housing and the second opposing energy transfer mechanism housing fully mating together.

6. The energy transfer mechanism as recited in claim 1, wherein the biasing device is configured to discharge a substantially consistent amount of the coupling fluid outside of the energy transfer mechanism housing between each decoupling/coupling sequence.

7. The energy transfer mechanism as recited in claim 1, wherein the energy transfer mechanism housing includes the male energy transfer mechanism connector portion, and further wherein the fluid reservoir is located in the male energy transfer mechanism connector portion.

8. The energy transfer mechanism as recited in claim 1, wherein the energy transfer mechanism housing includes the female energy transfer mechanism connector portion, and further wherein the fluid reservoir is located in the female energy transfer mechanism connector portion.

9. The energy transfer mechanism as recited in claim 1, wherein the energy transfer mechanism housing is a lower completion string energy transfer mechanism housing.

10. The energy transfer mechanism as recited in claim 1, wherein the volume of coupling fluid is a volume of optical coupling fluid.

11. The energy transfer mechanism as recited in claim 1, wherein the volume of coupling fluid is a volume of dielectric coupling fluid.

12. A well system, comprising:

a wellbore extending through one or more subterranean formations; and an energy transfer mechanism located in the wellbore, the energy transfer mechanism including:

an energy transfer mechanism housing, the energy transfer mechanism housing having a male energy transfer mechanism connector portion or a female energy transfer mechanism connector portion;

a fluid reservoir located within the energy transfer mechanism housing; and a volume of coupling fluid located within the fluid reservoir, the volume of coupling fluid sufficient to allow the energy transfer mechanism housing to undergo at least three decoupling/coupling sequences before running out while the energy transfer mechanism housing is in a substantially horizontal location; and a biasing device coupled with the volume of coupling fluid, the biasing device configured to discharge an amount of the coupling fluid outside of the energy transfer mechanism housing between each decoupling/coupling sequence.

13. The well system as recited in claim 12, wherein the volume of coupling fluid is sufficient to allow the energy transfer mechanism housing to undergo at least six decoupling/coupling sequences before running out.

14. The well system as recited in claim 12, wherein the volume of coupling fluid is sufficient to allow the energy transfer mechanism housing to undergo at least ten decoupling/coupling sequences before running out.

15. The well system as recited in claim 12, wherein the volume of coupling fluid is sufficient to allow the energy transfer mechanism housing to undergo at least twenty decoupling/coupling sequences before running out.

16. The well system as recited in claim 12, wherein the biasing device is configured to discharge the amount of the coupling fluid outside of the energy transfer mechanism housing as the energy transfer mechanism housing and the second opposing energy transfer mechanism housing are approaching one another to clear any wellbore debris from the energy transfer mechanism housing prior to the energy transfer mechanism housing and the second opposing energy transfer mechanism housing fully mating together.

17. The well system as recited in claim 12, wherein the biasing device is configured to discharge a substantially consistent amount of the coupling fluid outside of the energy transfer mechanism housing between each decoupling/coupling sequence.

18. The well system as recited in claim 12, wherein the biasing device is configured to discharge a substantially consistent amount of the coupling fluid at an interface of the energy transfer mechanism during each decoupling/coupling sequence.

19. The well system as recited in claim 12, wherein the energy transfer mechanism housing includes the male energy transfer mechanism connector portion, and further wherein the fluid reservoir is located in the male energy transfer mechanism connector portion.

20. The well system as recited in claim 12, wherein the energy transfer mechanism housing includes the female energy transfer mechanism connector portion, and further wherein the fluid reservoir is located in the female energy transfer mechanism connector portion.

21. The well system as recited in claim 12, wherein the energy transfer mechanism housing is a downhole lower completion string half energy transfer mechanism housing.

22. The well system as recited in claim 21, further including a tubing string coupled with the lower completion string, the tubing string having a second energy transfer mechanism including an uphole tubing string half energy transfer mechanism connector housing coupled with the downhole lower completion string half energy transfer mechanism housing.

23. The well system as recited in claim 22, wherein the tubing string is a service string.

24. The well system as recited in claim 22, wherein the tubing string is an upper completion string.

25. The well system as recited in claim 22, wherein the second energy transfer mechanism includes:

a second energy transfer mechanism housing, the second energy transfer mechanism housing having a second male energy transfer mechanism connector portion or a second female energy transfer mechanism connector portion;

a second fluid reservoir located within the second energy transfer mechanism housing; and a second volume of coupling fluid located within the second fluid reservoir, the second volume of coupling fluid sufficient to allow the second energy transfer mechanism housing to undergo at least three decoupling/coupling sequences before running out while the energy transfer mechanism housing is in a substantially horizontal location.

26. The well system as recited in claim 12, wherein the volume of coupling fluid is a volume of optical coupling fluid.

27. The well system as recited in claim 12, wherein the volume of coupling fluid is a volume of dielectric coupling fluid.

28. A method, comprising:

forming a wellbore through one or more subterranean formations; and placing an energy transfer mechanism within the wellbore, the energy transfer mechanism including:

energy transfer mechanism housing, the energy transfer mechanism housing having a male energy transfer mechanism connector portion or a female energy transfer mechanism connector portion;

a fluid reservoir located within the energy transfer mechanism housing; and a volume of coupling fluid located within the fluid reservoir, the volume of coupling fluid sufficient to allow the energy transfer mechanism housing to undergo at least three decoupling/coupling sequences before running out; and a biasing device coupled with the volume of coupling fluid, the biasing device configured to discharge an amount of the coupling fluid outside of the energy transfer mechanism housing between each decoupling/coupling sequence.

* * * * *